US009257778B2

(12) United States Patent
Buck et al.

(10) Patent No.: US 9,257,778 B2
(45) Date of Patent: Feb. 9, 2016

(54) HIGH SPEED ELECTRICAL CONNECTOR

(71) Applicants: Jonathan E. Buck, Hershey, PA (US); Stuart C. Stoner, Lewisberry, PA (US); Steven E. Minich, Mechanicsburg, PA (US); Douglas M. Johnescu, York, PA (US); Stephen B. Smith, Mechanicsburg, PA (US); Arkady Y. Zerebilov, Lancaster, PA (US); Deborah A. Ingram, Etters, PA (US); Hung-Wei Lord, Harrisburg, PA (US); Robert Douglas Fulton, Mount Wolf, PA (US)

(72) Inventors: Jonathan E. Buck, Hershey, PA (US); Stuart C. Stoner, Lewisberry, PA (US); Steven E. Minich, Mechanicsburg, PA (US); Douglas M. Johnescu, York, PA (US); Stephen B. Smith, Mechanicsburg, PA (US); Arkady Y. Zerebilov, Lancaster, PA (US); Deborah A. Ingram, Etters, PA (US); Hung-Wei Lord, Harrisburg, PA (US); Robert Douglas Fulton, Mount Wolf, PA (US)

(73) Assignee: FCI AMERICAS TECHNOLOGY, Carson City, NV (US)

( * ) Notice: Subject to any disclaimer, the term of this patent is extended or adjusted under 35 U.S.C. 154(b) by 204 days.

(21) Appl. No.: 13/836,610

(22) Filed: Mar. 15, 2013

(65) Prior Publication Data

US 2013/0273781 A1 Oct. 17, 2013

Related U.S. Application Data

(60) Provisional application No. 61/624,247, filed on Apr. 13, 2012, provisional application No. 61/624,238, filed on Apr. 13, 2012.

(51) Int. Cl.
*H01R 13/648* (2006.01)
*H01R 13/516* (2006.01)

(Continued)

(52) U.S. Cl.
CPC ..... *H01R 13/516* (2013.01); *H01R 13/6471* (2013.01); *H01R 13/6587* (2013.01); *H01R 12/737* (2013.01)

(58) Field of Classification Search
CPC .. H01R 9/096; H01R 23/688; H01R 23/7073; H05K 7/1069
USPC ..... 439/65, 68, 79, 108, 607.01, 607.06, 439/607.07, 607.08, 607.09, 607.1, 660
See application file for complete search history.

(56) References Cited

U.S. PATENT DOCUMENTS 318,186 A 5/1885 Hertzog
741,052 A 10/1903 Mahon (Continued)

FOREIGN PATENT DOCUMENTS

DE 1665181 4/1974
DE 3529218 2/1986

(Continued)

OTHER PUBLICATIONS

Research Disclosure, Kenneth Mason Publications Ltd., England, Aug. 1990, No. 316, 1 page.

(Continued)

*Primary Examiner* — Thanh Tam Le
(74) *Attorney, Agent, or Firm* — Baker & Hostetler LLP

(57) ABSTRACT

Electrical connector assemblies are provided that include electrical connectors having electrical contacts that have receptacle mating ends are provided. The connector housings of the provided electrical connectors include alignment members that are capable of performing staged alignment of components of the electrical connector assemblies. The provided electrical connector assemblies and the electrical connectors provided therein are capable of operating at a data transfer rate of forty gigabits per second with worst case multi-active cross talk that does not exceed a range of about two percent to about four percent.

57 Claims, 57 Drawing Sheets

(51) Int. Cl.

| | |
|---|---|
| ***H01R 13/6471*** | (2011.01) |
| ***H01R 13/6587*** | (2011.01) |
| *H01R 12/73* | (2011.01) |

(56) References Cited

U.S. PATENT DOCUMENTS

| | | | |
|---|---|---|---|
| 1,477,527 | A | 12/1923 | Raettig |
| D86,515 | S | 3/1932 | Cox |
| 2,231,347 | A | 2/1941 | Reutter |
| 2,248,675 | A | 7/1941 | Huppert |
| 2,430,011 | A | 11/1947 | Gillentine |
| 2,664,552 | A | 12/1953 | Ericsson et al. |
| 2,759,163 | A | 8/1956 | Ustin et al. |
| 2,762,022 | A | 9/1956 | Benander et al. |
| 2,849,700 | A | 4/1958 | Perkin |
| 2,844,644 | A | 7/1958 | Soule, Jr. |
| 2,858,372 | A | 10/1958 | Kaufman |
| 3,011,143 | A | 11/1961 | Dean |
| 3,115,379 | A | 12/1963 | McKee |
| 3,178,669 | A | 4/1965 | Roberts |
| 3,179,738 | A | 4/1965 | De Lyon |
| 3,208,030 | A | 9/1965 | Evans et al. |
| 3,286,220 | A | 11/1966 | Marley et al. |
| 3,320,658 | A | 5/1967 | Bolda et al. |
| 3,337,838 | A | 8/1967 | Damiano et al. |
| 3,343,120 | A | 9/1967 | Whiting |
| 3,366,729 | A | 1/1968 | Pauza |
| 3,411,127 | A | 11/1968 | Adams |
| 3,420,087 | A | 1/1969 | Hatfield et al. |
| D213,697 | S | 4/1969 | Oxley |
| 3,482,201 | A | 12/1969 | Schneck |
| 3,514,740 | A | 5/1970 | Filson et al. |
| 3,538,486 | A | 11/1970 | Shlesinger, Jr. |
| 3,560,908 | A | 2/1971 | Dell et al. |
| 3,591,834 | A | 7/1971 | Kolias |
| 3,634,811 | A | 1/1972 | Teagno |
| 3,641,475 | A | 2/1972 | Irish et al. |
| 3,663,925 | A | 5/1972 | Proctor |
| 3,669,054 | A | 6/1972 | Desso et al. |
| 3,692,994 | A | 9/1972 | Hirschman et al. |
| 3,701,076 | A | 10/1972 | Irish |
| 3,719,981 | A | 3/1973 | Steitz |
| 3,732,697 | A | 5/1973 | Dickson |
| 3,748,633 | A | 7/1973 | Lundergan |
| 3,827,005 | A | 7/1974 | Friend |
| 3,845,451 | A | 10/1974 | Neidecker |
| 3,864,004 | A | 2/1975 | Friend |
| 3,865,462 | A | 2/1975 | Cobaugh et al. |
| 3,867,008 | A | 2/1975 | Gartland, Jr. |
| 3,871,015 | A | 3/1975 | Lin et al. |
| 3,889,364 | A | 6/1975 | Krueger |
| 3,942,856 | A | 3/1976 | Mindheim et al. |
| 3,972,580 | A | 8/1976 | Pemberton et al. |
| 4,030,792 | A | 6/1977 | Fuerst |
| 4,056,302 | A | 11/1977 | Braun et al. |
| 4,070,088 | A | 1/1978 | Vaden |
| 4,076,362 | A | 2/1978 | Ichimura |
| 4,082,407 | A | 4/1978 | Smorzaniuk et al. |
| 4,097,266 | A | 6/1978 | Takahashi et al. |
| 4,136,919 | A | 1/1979 | Howard et al. |
| 4,140,361 | A | 2/1979 | Sochor |
| 4,159,861 | A | 7/1979 | Anhalt |
| 4,217,024 | A | 8/1980 | Aldridge et al. |
| 4,232,924 | A | 11/1980 | Kline et al. |
| 4,260,212 | A | 4/1981 | Ritchie et al. |
| 4,274,700 | A | 6/1981 | Keglewitsch et al. |
| 4,288,139 | A | 9/1981 | Cobaugh et al. |
| 4,371,912 | A | 2/1983 | Guzik |
| 4,380,518 | A | 4/1983 | Wydro, Sr. |
| 4,383,724 | A | 5/1983 | Verhoeven |
| 4,395,086 | A | 7/1983 | Marsh |
| 4,396,140 | A | 8/1983 | Jaffe et al. |
| 4,402,563 | A | 9/1983 | Sinclair |
| 4,403,821 | A | 9/1983 | Zimmerman et al. |
| 4,448,467 | A | 5/1984 | Weidler |
| 4,462,534 | A | 7/1984 | Bitaillou et al. |
| 4,464,003 | A | 8/1984 | Goodman et al. |
| 4,473,113 | A | 9/1984 | Whitfield et al. |
| 4,473,477 | A | 9/1984 | Beall |
| D275,849 | S | 10/1984 | Sakurai |
| 4,482,937 | A | 11/1984 | Berg |
| 4,505,529 | A | 3/1985 | Barkus |
| 4,523,296 | A | 6/1985 | Healy, Jr. |
| 4,533,187 | A | 8/1985 | Kirkman |
| 4,536,955 | A | 8/1985 | Gudgeon |
| 4,545,610 | A | 10/1985 | Lakritz et al. |
| 4,552,425 | A | 11/1985 | Billman |
| 4,560,222 | A | 12/1985 | Dambach |
| 4,564,259 | A | 1/1986 | Vandame |
| 4,592,846 | A | 6/1986 | Metzger et al. |
| 4,596,428 | A | 6/1986 | Tengler |
| 4,596,433 | A | 6/1986 | Oesterheld et al. |
| 4,624,604 | A | 11/1986 | Wagner et al. |
| 4,632,476 | A | 12/1986 | Schell |
| 4,641,426 | A | 2/1987 | Hartman et al. |
| 4,655,515 | A | 4/1987 | Hamsher, Jr. et al. |
| 4,664,309 | A | 5/1987 | Allen et al. |
| 4,664,456 | A | 5/1987 | Blair et al. |
| 4,664,458 | A | 5/1987 | Worth |
| 4,678,250 | A | 7/1987 | Romine et al. |
| 4,685,886 | A | 8/1987 | Denlinger et al. |
| 4,705,205 | A | 11/1987 | Allen et al. |
| 4,705,332 | A | 11/1987 | Sadigh-Behzadi |
| 4,717,360 | A | 1/1988 | Czaja |
| 4,722,470 | A | 2/1988 | Johary |
| 4,734,060 | A | 3/1988 | Kawawada et al. |
| 4,762,500 | A | 8/1988 | Dola et al. |
| 4,767,344 | A | 8/1988 | Noschese |
| 4,776,803 | A | 10/1988 | Pretchel et al. |
| 4,782,893 | A | 11/1988 | Thomas |
| 4,790,763 | A | 12/1988 | Weber et al. |
| 4,806,107 | A | 2/1989 | Arnold et al. |
| 4,815,987 | A | 3/1989 | Kawano et al. |
| 4,818,237 | A | 4/1989 | Weber |
| 4,820,169 | A | 4/1989 | Weber et al. |
| 4,820,182 | A | 4/1989 | Harwath et al. |
| 4,824,383 | A | 4/1989 | Lemke |
| 4,830,264 | A | 5/1989 | Bitaillou et al. |
| 4,836,791 | A | 6/1989 | Grabbe et al. |
| 4,844,813 | A | 7/1989 | Helfgott et al. |
| 4,846,727 | A | 7/1989 | Glover et al. |
| 4,850,887 | A | 7/1989 | Sugawara |
| 4,854,899 | A | 8/1989 | Matthews |
| 4,867,713 | A | 9/1989 | Ozu et al. |
| 4,871,110 | A | 10/1989 | Fukasawa et al. |
| 4,878,611 | A | 11/1989 | LoVasco et al. |
| 4,881,905 | A | 11/1989 | Demler et al. |
| 4,882,554 | A | 11/1989 | Akaba et al. |
| 4,884,335 | A | 12/1989 | McCoy et al. |
| 4,898,539 | A | 2/1990 | Glover et al. |
| 4,900,271 | A | 2/1990 | Colleran et al. |
| 4,904,212 | A | 2/1990 | Durbin et al. |
| 4,907,990 | A | 3/1990 | Bertho et al. |
| 4,908,129 | A | 3/1990 | Finsterwalder et al. |
| 4,913,664 | A | 4/1990 | Dixon et al. |
| 4,915,641 | A | 4/1990 | Miskin et al. |
| 4,917,616 | A | 4/1990 | Demler, Jr. et al. |
| 4,952,172 | A | 8/1990 | Barkus et al. |
| 4,963,102 | A | 10/1990 | Gettig et al. |
| 4,965,699 | A | 10/1990 | Jorden et al. |
| 4,973,257 | A | 11/1990 | Lhotak |
| 4,973,271 | A | 11/1990 | Ishizuka et al. |
| 4,974,119 | A | 11/1990 | Martin |
| 4,975,069 | A | 12/1990 | Fedder et al. |
| 4,975,084 | A | 12/1990 | Fedder et al. |
| 4,979,074 | A | 12/1990 | Morley et al. |
| 4,997,390 | A | 3/1991 | Scholz et al. |
| 5,004,426 | A | 4/1991 | Barnett |
| 5,016,968 | A | 5/1991 | Hammond et al. |
| 5,024,372 | A | 6/1991 | Altman et al. |
| 5,024,610 | A | 6/1991 | French et al. |
| 5,035,631 | A | 7/1991 | Piorunneck et al. |
| 5,035,639 | A | 7/1991 | Kilpatrick et al. |
| 5,046,960 | A | 9/1991 | Fedder et al. |

(56) References Cited

U.S. PATENT DOCUMENTS 5,052,953 A 10/1991 Weber
5,055,054 A 10/1991 Doutrich
5,060,844 A 10/1991 Behun et al.
5,065,282 A 11/1991 Polonio
5,066,236 A 11/1991 Broeksteeg
5,077,893 A 1/1992 Mosquera et al.
5,082,459 A 1/1992 Billman et al.
5,083,238 A 1/1992 Bousman
5,093,986 A 3/1992 Mandai et al.
5,094,623 A 3/1992 Scharf et al.
5,094,634 A 3/1992 Dixon et al.
5,098,311 A 3/1992 Roath et al.
5,104,332 A 4/1992 McCoy
5,104,341 A 4/1992 Gilissen et al.
5,111,991 A 5/1992 Clawson et al.
5,117,331 A 5/1992 Gebara
5,118,027 A 6/1992 Braun et al.
5,120,237 A 6/1992 Fussell
5,127,839 A 7/1992 Korsunsky et al.
5,131,871 A 7/1992 Banakis et al.
5,137,959 A 8/1992 Block et al.
5,139,426 A 8/1992 Barkus et al.
5,145,104 A 9/1992 Apap et al.
5,151,056 A 9/1992 McClune
5,152,700 A 10/1992 Bogursky et al.
5,161,987 A 11/1992 Sinisi
5,163,337 A 11/1992 Herron et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,194,480 A 3/1993 Block et al.
5,199,885 A 4/1993 Korsunsky et al.
5,203,075 A 4/1993 Angulas et al.
5,207,372 A 5/1993 Funari et al.
5,213,868 A 5/1993 Liberty et al.
5,214,308 A 5/1993 Nishiguchi
5,217,381 A 6/1993 Zell et al.
5,222,649 A 6/1993 Funari et al.
5,224,867 A 7/1993 Ohtsuki et al.
5,228,864 A 7/1993 Fusselman et al.
5,229,016 A 7/1993 Hayes et al.
5,238,414 A 8/1993 Yaegashi et al.
5,254,012 A 10/1993 Wang
5,255,839 A 10/1993 Da Costa Alves et al.
5,257,941 A 11/1993 Lwee et al.
5,261,155 A 11/1993 Angulas et al.
5,269,453 A 12/1993 Melton et al.
5,274,918 A 1/1994 Reed
5,275,330 A 1/1994 Isaacs et al.
5,276,964 A 1/1994 Anderson, Jr. et al.
5,277,624 A 1/1994 Champion et al.
5,284,287 A 2/1994 Wilson et al.
5,285,163 A 2/1994 Liotta
5,286,212 A 2/1994 Broeksteeg
5,288,949 A 2/1994 Crafts
5,295,843 A 3/1994 Davis et al.
5,298,791 A 3/1994 Liberty et al.
5,302,135 A 4/1994 Lee
5,321,582 A 6/1994 Casperson
5,324,569 A 6/1994 Nagesh et al.
5,342,211 A 8/1994 Broeksteeg
5,344,327 A 9/1994 Brunker et al.
5,346,118 A 9/1994 Degani et al.
5,354,219 A 10/1994 Wanjura
5,355,283 A 10/1994 Marrs et al.
5,356,300 A 10/1994 Costello et al.
5,356,301 A 10/1994 Champion et al.
5,357,050 A 10/1994 Baran et al.
5,358,417 A 10/1994 Schmedding
5,377,902 A 1/1995 Hayes
5,381,314 A 1/1995 Rudy, Jr. et al.
5,382,168 A 1/1995 Azuma et al.
D355,409 S 2/1995 Krokaugger
5,387,111 A 2/1995 DeSantis et al.
5,387,139 A 2/1995 McKee et al.
5,395,250 A 3/1995 Englert, Jr. et al.
5,400,949 A 3/1995 Hirvonen et al.
5,403,206 A 4/1995 McNamara et al.
5,409,157 A 4/1995 Nagesh et al.
5,410,807 A 5/1995 Bross et al.
5,427,543 A 6/1995 Dynia
5,429,520 A 7/1995 Morlion et al.
5,429,521 A 7/1995 Morlion et al.
5,431,332 A 7/1995 Kirby et al.
5,431,578 A 7/1995 Wayne
5,433,617 A 7/1995 Morlion et al.
5,433,618 A 7/1995 Morlion et al.
5,435,482 A 7/1995 Variot et al.
5,442,852 A 8/1995 Danner
5,445,313 A 8/1995 Boyd et al.
5,457,342 A 10/1995 Herbst, II
5,458,426 A 10/1995 Ito
5,462,456 A 10/1995 Howell
5,467,913 A 11/1995 Namekawa et al.
5,474,472 A 12/1995 Niwa et al.
5,475,922 A 12/1995 Tamura et al.
5,477,933 A 12/1995 Nguyen
5,489,750 A 2/1996 Sakemi et al.
5,490,040 A 2/1996 Gaudenzi et al.
5,491,303 A 2/1996 Weiss
5,492,266 A 2/1996 Hoebener et al.
5,495,668 A 3/1996 Furusawa et al.
5,496,183 A 3/1996 Soes et al.
5,498,167 A 3/1996 Seto et al.
5,499,487 A 3/1996 McGill
5,504,277 A 4/1996 Danner
5,511,987 A 4/1996 Shinchi
5,512,519 A 4/1996 Hwang
5,516,030 A 5/1996 Denton
5,516,032 A 5/1996 Sakemi et al.
5,518,410 A 5/1996 Masami
5,519,580 A 5/1996 Natarajan et al.
5,522,727 A 6/1996 Saito et al.
5,533,915 A 7/1996 Deans
5,534,127 A 7/1996 Sakai
5,539,153 A 7/1996 Schwiebert et al.
5,542,174 A 8/1996 Chiu
5,558,542 A 9/1996 O'Sullivan et al.
5,564,952 A 10/1996 Davis et al.
5,575,688 A 11/1996 Crane, Jr.
5,577,928 A 11/1996 Duclos
5,580,283 A 12/1996 O'Sullivan et al.
5,586,908 A 12/1996 Lorrain
5,586,914 A 12/1996 Foster, Jr. et al.
5,588,859 A 12/1996 Maurice
5,590,463 A 1/1997 Feldman et al.
5,591,118 A 1/1997 Bierck
5,591,941 A 1/1997 Acocella et al.
5,593,322 A 1/1997 Swamy et al.
5,605,417 A 2/1997 Englert et al.
5,609,502 A 3/1997 Thumma
5,613,882 A 3/1997 Hnatuck et al.
5,618,187 A 4/1997 Goto
5,634,821 A 6/1997 Crane, Jr.
5,637,008 A 6/1997 Kozel
5,637,019 A 6/1997 Crane, Jr. et al.
5,643,009 A 7/1997 Dinkel et al.
5,664,968 A 9/1997 Micklevicz
5,664,973 A 9/1997 Emmert et al.
5,667,392 A 9/1997 Kocher et al.
5,672,064 A 9/1997 Provencher et al.
5,691,041 A 11/1997 Frankeny et al.
D387,733 S 12/1997 Lee
5,697,799 A 12/1997 Consoli et al.
5,702,255 A 12/1997 Murphy et al.
5,713,746 A 2/1998 Olson et al.
5,718,606 A 2/1998 Rigby et al.
5,727,963 A 3/1998 LeMaster
5,730,609 A 3/1998 Harwath
5,733,453 A 3/1998 DeBusk
5,741,144 A 4/1998 Elco et al.
5,741,161 A 4/1998 Cahaly et al.

(56) References Cited

U.S. PATENT DOCUMENTS 5,742,484 A 4/1998 Gillette et al.
5,743,009 A 4/1998 Matsui et al.
5,743,765 A 4/1998 Andrews et al.
5,745,349 A 4/1998 Lemke
5,746,608 A 5/1998 Taylor
5,749,746 A 5/1998 Tan et al.
5,755,595 A 5/1998 Davis et al.
5,766,023 A 6/1998 Noschese et al.
5,772,451 A 6/1998 Dozier, II et al.
5,782,644 A 7/1998 Kiat
5,787,971 A 8/1998 Dodson
5,795,191 A 8/1998 Preputnick et al.
5,810,607 A 9/1998 Shih et al.
5,817,973 A 10/1998 Elco et al.
5,827,094 A 10/1998 Aizawa et al.
5,831,314 A 11/1998 Wen
5,833,475 A 11/1998 Mitra
5,846,024 A 12/1998 Mao et al.
5,851,121 A 12/1998 Thenaisie et al.
5,853,797 A 12/1998 Fuchs et al.
5,857,857 A 1/1999 Fukuda
5,860,814 A 1/1999 Akama et al.
5,860,816 A 1/1999 Provencher et al.
5,871,362 A 2/1999 Campbell et al.
5,874,776 A 2/1999 Kresge et al.
5,876,219 A 3/1999 Taylor
5,876,222 A 3/1999 Gardner et al.
5,876,248 A 3/1999 Brunker et al.
5,882,214 A 3/1999 Hillbish et al.
5,883,782 A 3/1999 Thurston et al.
5,887,158 A 3/1999 Sample et al.
5,888,884 A 3/1999 Wojnarowski
5,892,791 A 4/1999 Moon
5,893,761 A 4/1999 Longueville
5,902,136 A 5/1999 Lemke et al.
5,904,581 A 5/1999 Pope et al.
5,908,333 A 6/1999 Perino et al.
5,913,702 A 6/1999 Garcin
5,919,050 A 7/1999 Kehley et al.
5,930,114 A 7/1999 Kuzmin et al.
5,938,479 A 8/1999 Paulson et al.
5,943,770 A 8/1999 Thenaisie et al.
5,955,888 A 9/1999 Frederickson et al.
5,961,355 A 10/1999 Morlion et al.
5,967,844 A 10/1999 Doutrich et al.
5,971,817 A 10/1999 Longueville
5,975,921 A 11/1999 Shuey
5,980,270 A 11/1999 Fjelstad et al.
5,980,321 A 11/1999 Cohen et al.
5,982,249 A 11/1999 Bruns
5,984,690 A 11/1999 Riechelmann et al.
5,984,726 A 11/1999 Wu
5,992,953 A 11/1999 Rabinovitz
5,993,259 A 11/1999 Stokoe et al.
6,012,948 A 1/2000 Wu
6,022,227 A 2/2000 Huang
6,024,584 A 2/2000 Lemke et al.
6,027,381 A 2/2000 Lok
6,036,549 A 3/2000 Wulff
6,041,498 A 3/2000 Hillbish et al.
6,042,389 A 3/2000 Lemke et al.
6,042,394 A 3/2000 Mitra et al.
6,042,427 A 3/2000 Adriaenssens et al.
6,048,213 A 4/2000 Lai et al.
6,050,842 A 4/2000 Ferrill et al.
6,050,862 A 4/2000 Ishii
6,053,751 A 4/2000 Humphrey
6,059,170 A 5/2000 Jimarez et al.
6,066,048 A 5/2000 Lees
6,068,518 A 5/2000 McEuen
6,068,520 A 5/2000 Winings et al.
6,071,152 A 6/2000 Achammer et al.
6,077,130 A 6/2000 Hughes et al.
6,083,047 A 7/2000 Paagman
6,086,386 A 7/2000 Fjelstad et al.
6,089,878 A 7/2000 Meng
6,095,827 A 8/2000 Dutkowsky et al.
6,113,418 A 9/2000 Kjeldahl
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,132,255 A 10/2000 Verhoeven
6,139,336 A 10/2000 Olson
6,146,157 A 11/2000 Lenoir et al.
6,146,202 A 11/2000 Ramey et al.
6,146,203 A 11/2000 Elco et al.
6,152,747 A 11/2000 McNamara
6,152,756 A 11/2000 Huang et al.
6,154,742 A 11/2000 Herriot
6,171,115 B1 1/2001 Mickievicz et al.
6,171,149 B1 1/2001 Van Zanten
6,174,198 B1 1/2001 Wu et al.
6,179,663 B1 1/2001 Bradley et al.
6,180,891 B1 1/2001 Murdeshwar
6,183,287 B1 2/2001 Po
6,183,301 B1 2/2001 Paagman
6,190,213 B1 2/2001 Reichart et al.
6,193,537 B1 2/2001 Harper, Jr. et al.
6,196,871 B1 3/2001 Szu
6,202,916 B1 3/2001 Updike et al.
6,206,722 B1 3/2001 Ko et al.
6,206,735 B1 3/2001 Zanolli
6,210,197 B1 4/2001 Yu
6,210,240 B1 4/2001 Comerci et al.
6,212,755 B1 4/2001 Shimada et al.
6,215,180 B1 4/2001 Chen et al.
6,219,913 B1 4/2001 Uchiyama
6,220,884 B1 4/2001 Lin
6,220,895 B1 4/2001 Lin
6,220,896 B1 4/2001 Bertoncini et al.
6,227,882 B1 5/2001 Ortega et al.
6,231,391 B1 5/2001 Ramey et al.
6,234,851 B1 5/2001 Phillips
6,238,225 B1 5/2001 Middlehurst et al.
6,241,535 B1 6/2001 Lemke et al.
6,244,887 B1 6/2001 Commerci et al.
6,257,478 B1 7/2001 Straub
6,259,039 B1 7/2001 Chroneos, Jr. et al.
6,261,132 B1 7/2001 Koseki et al.
6,267,604 B1 7/2001 Mickievicz et al.
6,269,539 B1 8/2001 Takahashi et al.
6,274,474 B1 8/2001 Caletka et al.
6,280,209 B1 8/2001 Bassler et al.
6,280,230 B1 8/2001 Takase et al.
6,280,809 B1 8/2001 Wang et al.
6,290,552 B1 9/2001 Saito et al.
6,293,827 B1 9/2001 Stokoe
6,299,483 B1 10/2001 Cohen et al.
6,299,484 B2 10/2001 Van Woensel et al.
6,299,492 B1 10/2001 Pierini et al.
6,302,711 B1 10/2001 Ito
6,309,245 B1 10/2001 Sweeney
6,319,075 B1 11/2001 Clark et al.
6,322,377 B2 11/2001 Middlehurst et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,347,962 B1 2/2002 Kline
6,350,134 B1 2/2002 Fogg et al.
6,354,877 B1 3/2002 Shuey et al.
6,358,061 B1 3/2002 Regnier
6,359,783 B1 3/2002 Noble
6,360,940 B1 3/2002 Bolde et al.
6,361,366 B1 3/2002 Shuey et al.
6,361,376 B1 3/2002 Onoda
6,362,961 B1 3/2002 Chiou
6,363,607 B1 4/2002 Chen et al.
6,364,710 B1 4/2002 Billman et al.
6,371,773 B1 4/2002 Crofoot et al.

(56) References Cited

U.S. PATENT DOCUMENTS

| | | | |
|---|---|---|---|
| 6,371,813 | B2 | 4/2002 | Ramey et al. |
| 6,375,478 | B1 | 4/2002 | Kikuchi |
| 6,375,508 | B1 | 4/2002 | Pickles et al. |
| 6,379,188 | B1 | 4/2002 | Cohen et al. |
| 6,386,914 | B1 | 5/2002 | Collins et al. |
| 6,386,924 | B2 | 5/2002 | Long |
| 6,390,826 | B1 | 5/2002 | Affolter et al. |
| 6,394,818 | B1 | 5/2002 | Smalley, Jr. |
| 6,402,566 | B1 | 6/2002 | Middlehurst et al. |
| 6,409,543 | B1 | 6/2002 | Astbury, Jr. et al. |
| 6,414,248 | B1 | 7/2002 | Sundstrom |
| 6,420,778 | B1 | 7/2002 | Sinyansky |
| 6,425,785 | B1 | 7/2002 | Azuma |
| 6,428,328 | B2 | 8/2002 | Haba et al. |
| 6,431,914 | B1 | 8/2002 | Billman |
| 6,431,921 | B2 | 8/2002 | Saito et al. |
| 6,435,914 | B1 | 8/2002 | Billman |
| 6,450,829 | B1 | 9/2002 | Weisz-Margulescu |
| 6,457,983 | B1 | 10/2002 | Bassler et al. |
| 6,461,183 | B1 | 10/2002 | Ohkita et al. |
| 6,461,202 | B2 | 10/2002 | Kline |
| 6,464,529 | B1 | 10/2002 | Jensen et al. |
| 6,471,523 | B1 | 10/2002 | Shuey |
| 6,471,548 | B2 | 10/2002 | Bertoncini et al. |
| 6,472,474 | B2 | 10/2002 | Burkhardt et al. |
| 6,482,038 | B2 | 11/2002 | Olson |
| 6,485,330 | B1 | 11/2002 | Doutrich |
| 6,488,549 | B1 | 12/2002 | Weller et al. |
| 6,489,567 | B2 | 12/2002 | Zachrai |
| 6,491,545 | B1 | 12/2002 | Spiegel et al. |
| 6,494,734 | B1 | 12/2002 | Shuey |
| 6,503,103 | B1 | 1/2003 | Cohen et al. |
| 6,506,076 | B2 | 1/2003 | Cohen et al. |
| 6,506,081 | B2 | 1/2003 | Blanchfield et al. |
| 6,514,103 | B2 | 2/2003 | Pape et al. |
| 6,517,360 | B1 | 2/2003 | Cohen |
| 6,520,803 | B1 | 2/2003 | Dunn |
| 6,526,519 | B1 | 2/2003 | Cuthbert |
| 6,527,587 | B1 | 3/2003 | Ortega et al. |
| 6,527,588 | B2 | 3/2003 | Paagman |
| 6,528,737 | B1 | 3/2003 | Kwong et al. |
| 6,530,134 | B1 | 3/2003 | Laphan et al. |
| 6,537,086 | B1 | 3/2003 | Mac Mullin |
| 6,537,111 | B2 | 3/2003 | Brammer et al. |
| 6,540,522 | B2 | 4/2003 | Sipe |
| 6,540,558 | B1 | 4/2003 | Paagman |
| 6,540,559 | B1 | 4/2003 | Kemmick et al. |
| 6,544,046 | B1 | 4/2003 | Hahn et al. |
| 6,544,072 | B2 | 4/2003 | Olson |
| 6,547,066 | B2 | 4/2003 | Koch |
| 6,551,112 | B1 | 4/2003 | Li et al. |
| 6,551,140 | B2 | 4/2003 | Billman et al. |
| 6,554,647 | B1 | 4/2003 | Cohen et al. |
| 6,565,387 | B2 | 5/2003 | Cohen |
| 6,565,388 | B1 | 5/2003 | Van Woensel et al. |
| 6,572,409 | B2 | 6/2003 | Nitta et al. |
| 6,572,410 | B1 | 6/2003 | Volstorf et al. |
| 6,575,774 | B2 | 6/2003 | Ling et al. |
| 6,575,776 | B1 | 6/2003 | Conner et al. |
| 6,589,071 | B1 | 7/2003 | Lias et al. |
| 6,592,381 | B2 | 7/2003 | Cohen et al. |
| 6,602,095 | B2 | 8/2003 | Astbury, Jr. et al. |
| 6,604,967 | B2 | 8/2003 | Middlehurst et al. |
| 6,607,402 | B2 | 8/2003 | Cohen et al. |
| 6,623,310 | B1 | 9/2003 | Billman et al. |
| 6,629,854 | B2 | 10/2003 | Murakami |
| 6,633,490 | B2 | 10/2003 | Centola et al. |
| 6,641,410 | B2 | 11/2003 | McNamara et al. |
| 6,641,411 | B1 | 11/2003 | Stoddard et al. |
| 6,641,825 | B2 | 11/2003 | Scholz et al. |
| 6,652,318 | B1 | 11/2003 | Winings et al. |
| 6,663,426 | B2 | 12/2003 | Hasircoglu et al. |
| 6,665,189 | B1 | 12/2003 | Lebo |
| 6,666,693 | B2 | 12/2003 | Belopolsky et al. |
| 6,669,514 | B2 | 12/2003 | Wiebking et al. |
| 6,672,884 | B1 | 1/2004 | Toh et al. |
| 6,672,907 | B2 | 1/2004 | Azuma |
| 6,679,709 | B2 | 1/2004 | Takeuchi |
| 6,692,272 | B2 | 2/2004 | Lemke et al. |
| 6,695,627 | B2 | 2/2004 | Ortega et al. |
| 6,702,590 | B2 | 3/2004 | Zaderej et al. |
| 6,702,594 | B2 | 3/2004 | Lee et al. |
| 6,705,902 | B1 | 3/2004 | Yi et al. |
| 6,709,294 | B1 | 3/2004 | Cohen et al. |
| 6,712,621 | B2 | 3/2004 | Li et al. |
| 6,712,646 | B2 | 3/2004 | Shindo |
| 6,716,045 | B2 | 4/2004 | Meredith |
| 6,716,068 | B2 | 4/2004 | Wu |
| 6,717,825 | B2 | 4/2004 | Volstorf |
| 6,726,492 | B1 | 4/2004 | Yu |
| 6,736,664 | B2 | 5/2004 | Ueda et al. |
| 6,739,910 | B1 | 5/2004 | Wu |
| 6,740,820 | B2 | 5/2004 | Cheng |
| D492,295 | S | 6/2004 | Glatt |
| 6,743,037 | B2 | 6/2004 | Kassa et al. |
| 6,743,059 | B1 | 6/2004 | Korsunsky et al. |
| 6,746,278 | B2 | 6/2004 | Nelson et al. |
| 6,749,439 | B1 | 6/2004 | Potter et al. |
| 6,762,067 | B1 | 7/2004 | Quinones et al. |
| 6,764,341 | B2 | 7/2004 | Lappoehn |
| 6,769,883 | B2 | 8/2004 | Brid et al. |
| 6,769,935 | B2 | 8/2004 | Stokoe et al. |
| 6,776,635 | B2 | 8/2004 | Blanchfield et al. |
| 6,776,649 | B2 | 8/2004 | Pape et al. |
| 6,780,027 | B2 | 8/2004 | Allison et al. |
| 6,786,771 | B2 | 9/2004 | Gailus |
| 6,790,088 | B2 | 9/2004 | Ono et al. |
| 6,796,831 | B1 | 9/2004 | Yasufuku et al. |
| 6,797,215 | B2 | 9/2004 | Bonk et al. |
| D497,343 | S | 10/2004 | Busse et al. |
| 6,805,278 | B1 | 10/2004 | Olson et al. |
| 6,808,399 | B2 | 10/2004 | Rothermel et al. |
| 6,808,420 | B2 | 10/2004 | Whiteman, Jr. et al. |
| 6,810,783 | B1 | 11/2004 | Larose |
| 6,811,440 | B1 | 11/2004 | Rothermel et al. |
| 6,814,590 | B2 | 11/2004 | Minich et al. |
| 6,814,619 | B1 | 11/2004 | Stokoe et al. |
| 6,824,391 | B2 | 11/2004 | Mickievicz et al. |
| 6,829,143 | B2 | 12/2004 | Russell et al. |
| 6,835,072 | B2 | 12/2004 | Simons et al. |
| 6,835,103 | B2 | 12/2004 | Middlehurst et al. |
| 6,843,686 | B2 | 1/2005 | Ohnishi et al. |
| 6,843,687 | B2 | 1/2005 | McGowan et al. |
| 6,846,202 | B1 | 1/2005 | Schmidt et al. |
| 6,848,886 | B2 | 2/2005 | Schmaling et al. |
| 6,848,944 | B2 | 2/2005 | Evans |
| 6,848,950 | B2 | 2/2005 | Allison et al. |
| 6,848,953 | B2 | 2/2005 | Schell et al. |
| 6,851,974 | B2 | 2/2005 | Doutrich |
| 6,851,980 | B2 | 2/2005 | Nelson et al. |
| 6,852,567 | B1 | 2/2005 | Lee et al. |
| D502,919 | S | 3/2005 | Studnicky, III |
| 6,866,549 | B2 | 3/2005 | Kimura et al. |
| 6,869,292 | B2 | 3/2005 | Johnescu et al. |
| 6,869,294 | B2 | 3/2005 | Clark et al. |
| 6,872,085 | B1 | 3/2005 | Cohen et al. |
| 6,884,117 | B2 | 4/2005 | Korsunsky et al. |
| 6,890,184 | B2 | 5/2005 | Doblar et al. |
| 6,890,214 | B2 | 5/2005 | Brown et al. |
| 6,890,221 | B2 | 5/2005 | Wagner |
| 6,893,272 | B2 | 5/2005 | Yu |
| 6,893,300 | B2 | 5/2005 | Zhou et al. |
| 6,893,686 | B2 | 5/2005 | Egan |
| 6,899,566 | B2 | 5/2005 | Kline et al. |
| 6,902,411 | B2 | 6/2005 | Kubo |
| 6,905,367 | B2 | 6/2005 | Crane, Jr. et al. |
| 6,913,490 | B2 | 7/2005 | Whiteman, Jr. et al. |
| 6,918,776 | B2 | 7/2005 | Spink, Jr. |
| 6,918,789 | B2 | 7/2005 | Lang et al. |
| 6,929,504 | B2 | 8/2005 | Ling et al. |
| 6,932,649 | B1 | 8/2005 | Rothermel et al. |
| 6,939,173 | B1 | 9/2005 | Elco et al. |
| 6,945,796 | B2 | 9/2005 | Bassler et al. |
| 6,947,012 | B2 | 9/2005 | Aisenbrey |

(56) References Cited

U.S. PATENT DOCUMENTS 6,951,466 B2 10/2005 Sandoval et al.
6,953,351 B2 10/2005 Fromm et al.
6,969,268 B2 11/2005 Brunker
6,969,280 B2 11/2005 Chien et al.
6,975,511 B1 12/2005 Lebo et al.
6,976,886 B2 12/2005 Winings et al.
6,979,202 B2 12/2005 Benham et al.
6,979,215 B2 12/2005 Avery et al.
6,981,883 B2 1/2006 Raistrick et al.
6,988,902 B2 1/2006 Winings et al.
6,994,569 B2 2/2006 Minich et al.
7,001,189 B1 2/2006 McGowan et al.
7,021,975 B2 4/2006 Lappohn
7,040,901 B2 5/2006 Benham et al.
7,044,794 B2 5/2006 Consoli et al.
7,059,892 B1 6/2006 Trout
7,059,919 B2 6/2006 Clark et al.
7,065,871 B2 6/2006 Minich et al.
7,070,464 B2 7/2006 Clark et al.
7,074,096 B2 7/2006 Copper et al.
7,086,147 B2 8/2006 Caletka et al.
7,090,501 B1 8/2006 Scherer et al.
7,094,102 B2 8/2006 Cohen et al.
7,097,465 B1 8/2006 Korsunsky et al.
7,097,506 B2 8/2006 Nakada
7,101,191 B2 9/2006 Benham et al.
7,101,228 B2 9/2006 Hamner et al.
7,104,812 B1 9/2006 Bogiel et al.
7,108,556 B2 9/2006 Cohen et al.
7,114,963 B2 10/2006 Shuey et al.
7,114,964 B2 10/2006 Winings et al.
7,118,391 B2 10/2006 Minich et al.
RE39,380 E 11/2006 Davis
7,131,870 B2 11/2006 Whiteman, Jr. et al.
7,137,848 B1 11/2006 Trout et al.
7,153,162 B2 12/2006 Mizumura et al.
7,160,151 B1 1/2007 Rigby et al.
7,163,421 B1 1/2007 Cohen et al.
7,168,963 B2 1/2007 Minich et al.
7,172,461 B2 2/2007 Davis et al.
7,182,608 B2 2/2007 Soh et al.
7,182,642 B2 2/2007 Ngo et al.
7,182,643 B2 2/2007 Winings et al.
7,195,497 B2 3/2007 Hull et al.
D540,258 S 4/2007 Peng et al.
7,204,699 B2 4/2007 Stoner
7,207,807 B2 4/2007 Fogg
D541,748 S 5/2007 Peng et al
D542,736 S 5/2007 Riku
7,220,141 B2 5/2007 Daily et al.
7,239,526 B1 7/2007 Bibee
7,241,168 B2 7/2007 Sakurai et al.
7,258,562 B2 8/2007 Daily et al.
D550,158 S 9/2007 Victor
D550,628 S 9/2007 Whiteman, Jr. et al.
7,267,515 B2 9/2007 Lappohn
7,270,574 B1 9/2007 Ngo
7,273,382 B2 9/2007 Igarashi et al.
7,278,856 B2 10/2007 Minich
7,281,950 B2 10/2007 Belopolsky
D554,591 S 11/2007 Victor
7,292,055 B2 11/2007 Egitto
7,303,427 B2 12/2007 Swain
7,309,239 B2 12/2007 Shuey et al.
7,316,585 B2 1/2008 Smith et al.
7,322,855 B2 1/2008 Mongold et al.
7,322,856 B2 * 1/2008 Laurx et al. ..... 439/607.1
7,331,802 B2 2/2008 Rothermel et al.
7,335,043 B2 2/2008 Hgo et al.
7,338,321 B2 3/2008 Laurx
7,344,383 B1 3/2008 Lu et al.
7,347,740 B2 3/2008 Minich
7,351,071 B2 4/2008 Korsunsky et al.
7,381,092 B2 6/2008 Nakada
7,384,289 B2 6/2008 Minich
7,384,311 B2 6/2008 Sharf et al.
7,402,064 B2 7/2008 Daily
7,407,387 B2 8/2008 Johnescu
7,422,483 B2 9/2008 Avery et al.
7,425,145 B2 9/2008 Ngo et al.
7,429,176 B2 9/2008 Johnescu
7,445,457 B1 11/2008 Frangioso, Jr. et al.
7,452,242 B2 11/2008 Poh et al.
7,452,249 B2 11/2008 Daily
7,442,054 B2 12/2008 Lemke et al.
7,458,839 B2 12/2008 Ngo
7,467,955 B2 12/2008 Raistrick et al.
7,476,108 B2 1/2009 Swain
7,497,735 B2 3/2009 Belopolsky
7,497,736 B2 3/2009 Minich et al.
7,500,871 B2 3/2009 Minich et al.
7,503,804 B2 3/2009 Minich
7,541,135 B2 6/2009 Swain
7,549,897 B2 6/2009 Fedder et al.
7,553,182 B2 6/2009 Buck
7,588,462 B2 9/2009 Ngo
7,588,463 B2 9/2009 Yamada et al.
7,621,781 B2 11/2009 Rothermel et al.
D607,822 S 1/2010 Dennes
D611,908 S 3/2010 Takada et al.
7,682,193 B2 3/2010 Stoner
7,708,569 B2 5/2010 Sercu et al.
D618,180 S 6/2010 Gross et al.
D618,181 S 6/2010 Gross et al.
7,753,731 B2 7/2010 Cohen et al.
7,762,843 B2 7/2010 Minich et al.
7,794,278 B2 * 9/2010 Cohen et al. ..... 439/607.09
D626,075 S 10/2010 Truskett et al.
7,833,065 B2 11/2010 Lin et al.
D628,963 S 12/2010 Sau et al.
7,883,366 B2 2/2011 Davis et al.
7,931,474 B2 4/2011 Laurx et al.
7,976,326 B2 7/2011 Stoner
7,988,456 B2 8/2011 Davis et al.
8,011,957 B2 9/2011 Pan
D651,177 S 12/2011 Luo
8,079,847 B2 12/2011 Davis et al.
D653,621 S 2/2012 Gross et al.
8,109,770 B2 2/2012 Perugini et al.
8,119,926 B2 2/2012 Murphy
8,157,599 B2 4/2012 Wei
8,231,415 B2 7/2012 Johnescu et al.
8,267,721 B2 * 9/2012 Minich ..... 439/607.05
8,277,241 B2 10/2012 Horchler et al.
8,366,485 B2 * 2/2013 Johnescu ..... H01R 13/514 439/108
8,374,470 B2 2/2013 Ban et al.
8,408,939 B2 4/2013 Davis et al.
8,414,199 B2 4/2013 Ishigami
8,465,213 B2 6/2013 Tamura et al.
8,480,413 B2 7/2013 Minich et al.
RE44,556 E 10/2013 Minich
8,550,861 B2 * 10/2013 Cohen et al. ..... 439/858
8,632,263 B2 1/2014 Nekado et al.
8,657,627 B2 2/2014 McNamara
8,708,757 B2 4/2014 Trout et al.
D712,843 S 9/2014 Buck et al.
D714,227 S 9/2014 Buck et al.
8,864,521 B2 * 10/2014 Atkinson et al. ..... 439/607.07
8,888,529 B2 * 11/2014 Buck et al. ..... 439/607.05
D720,698 S 1/2015 Zerebilov et al.
8,944,831 B2 * 2/2015 Stoner et al. ..... 439/108
8,998,645 B2 4/2015 Vanaleck et al.
2001/0003685 A1 6/2001 Aritani
2001/0008189 A1 7/2001 Reede
2001/0012729 A1 8/2001 Van Woensel
2001/0041477 A1 11/2001 Billman et al.
2001/0046810 A1 11/2001 Cohen et al.
2001/0046816 A1 11/2001 Saito et al.
2002/0013101 A1 1/2002 Long
2002/0039857 A1 4/2002 Naito et al.
2002/0084105 A1 7/2002 Geng et al.
2002/0098727 A1 7/2002 McNamara et al.
2002/0106930 A1 8/2002 Pape et al.

(56) References Cited

U.S. PATENT DOCUMENTS

| | | | |
|---|---|---|---|
| 2002/0106932 | A1 | 8/2002 | Holland et al. |
| 2002/0111068 | A1 | 8/2002 | Cohen et al. |
| 2002/0127903 | A1 | 9/2002 | Billman et al. |
| 2002/0142629 | A1 | 10/2002 | Zaderej et al. |
| 2002/0142676 | A1 | 10/2002 | Hosaka et al. |
| 2002/0159235 | A1 | 10/2002 | Miller et al. |
| 2002/0173177 | A1 | 11/2002 | Korsunsky |
| 2002/0187688 | A1 | 12/2002 | Marvin et al. |
| 2002/0193019 | A1 | 12/2002 | Blanchfield et al. |
| 2003/0116857 | A1 | 6/2003 | Taniguchi et al. |
| 2003/0119378 | A1 | 6/2003 | Avery |
| 2003/0143894 | A1 | 7/2003 | Kline et al. |
| 2003/0171010 | A1 | 9/2003 | Winings et al. |
| 2003/0203665 | A1 | 10/2003 | Ohnishi et al. |
| 2003/0219999 | A1 | 11/2003 | Minich et al. |
| 2003/0220021 | A1 | 11/2003 | Whiteman, Jr. et al. |
| 2003/0236035 | A1 | 12/2003 | Kuroda et al. |
| 2004/0018757 | A1 | 1/2004 | Lang et al. |
| 2004/0038590 | A1 | 2/2004 | Lang et al. |
| 2004/0072470 | A1 | 4/2004 | Lang et al. |
| 2004/0077224 | A1 | 4/2004 | Marchese |
| 2004/0087196 | A1 | 5/2004 | Lang et al. |
| 2004/0114866 | A1 | 6/2004 | Hiramatsu |
| 2004/0157477 | A1 | 8/2004 | Johnson et al. |
| 2004/0224559 | A1 | 11/2004 | Nelson et al. |
| 2004/0235321 | A1 | 11/2004 | Mizumura et al. |
| 2004/0259420 | A1 | 12/2004 | Wu |
| 2005/0009402 | A1 | 1/2005 | Chien et al. |
| 2005/0026503 | A1 | 2/2005 | Trout et al. |
| 2005/0032401 | A1 | 2/2005 | Kobayashi |
| 2005/0048838 | A1 | 3/2005 | Korsunsky et al. |
| 2005/0079763 | A1 | 4/2005 | Lemke et al. |
| 2005/0101166 | A1 | 5/2005 | Kameyama |
| 2005/0101188 | A1 | 5/2005 | Benham et al. |
| 2005/0112952 | A1 | 5/2005 | Wang et al. |
| 2005/0118869 | A1 | 6/2005 | Evans |
| 2005/0170700 | A1 | 8/2005 | Shuey et al. |
| 2005/0196987 | A1 | 9/2005 | Shuey et al. |
| 2005/0202722 | A1 | 9/2005 | Regnier et al. |
| 2005/0215121 | A1 | 9/2005 | Tokunaga |
| 2005/0227552 | A1 | 10/2005 | Yamashita et al. |
| 2005/0277315 | A1 | 12/2005 | Mongold et al. |
| 2005/0287869 | A1 | 12/2005 | Kenny et al. |
| 2006/0003620 | A1 | 1/2006 | Daily et al. |
| 2006/0014433 | A1 | 1/2006 | Consoli et al. |
| 2006/0024983 | A1 | 2/2006 | Cohen et al. |
| 2006/0024984 | A1 | 2/2006 | Cohen et al. |
| 2006/0046526 | A1 | 3/2006 | Minich |
| 2006/0051987 | A1 | 3/2006 | Goodman et al. |
| 2006/0068610 | A1 | 3/2006 | Belopolsky |
| 2006/0068641 | A1 | 3/2006 | Hull et al. |
| 2006/0073709 | A1 | 4/2006 | Reid |
| 2006/0116857 | A1 | 6/2006 | Sevic et al. |
| 2006/0121749 | A1 | 6/2006 | Fogg |
| 2006/0128197 | A1 | 6/2006 | McGowan et al. |
| 2006/0141818 | A1 | 6/2006 | Ngo |
| 2006/0183377 | A1 | 8/2006 | Sinsheimer |
| 2006/0192274 | A1 | 8/2006 | Lee et al. |
| 2006/0216969 | A1 | 9/2006 | Bright et al. |
| 2006/0228912 | A1 | 10/2006 | Morlion et al. |
| 2006/0232301 | A1 | 10/2006 | Morlion et al. |
| 2006/0281354 | A1 | 12/2006 | Ngo et al. |
| 2007/0004287 | A1 | 1/2007 | Marshall |
| 2007/0021002 | A1 | 1/2007 | Laurx et al. |
| 2007/0042639 | A1 | 2/2007 | Manter et al. |
| 2007/0071391 | A1 | 3/2007 | Mazotti et al. |
| 2007/0099455 | A1 | 5/2007 | Rothermel et al. |
| 2007/0099512 | A1 | 5/2007 | Sato |
| 2007/0183707 | A1 | 8/2007 | Umezawa |
| 2007/0183724 | A1 | 8/2007 | Sato |
| 2007/0202715 | A1 | 8/2007 | Daily et al. |
| 2007/0202747 | A1 | 8/2007 | Sharf et al. |
| 2007/0205774 | A1 | 9/2007 | Minich |
| 2007/0207641 | A1 | 9/2007 | Minich |
| 2007/0293084 | A1 | 12/2007 | Ngo |
| 2008/0032524 | A1 | 2/2008 | Lemke et al. |
| 2008/0045079 | A1 | 2/2008 | Minich et al. |
| 2008/0176453 | A1 | 7/2008 | Minich et al. |
| 2008/0232737 | A1 | 9/2008 | Ishigami et al. |
| 2008/0246555 | A1 | 10/2008 | Kirk et al. |
| 2008/0248670 | A1 | 10/2008 | Daily et al. |
| 2008/0316729 | A1 | 12/2008 | Rothermel et al. |
| 2009/0011643 | A1 | 1/2009 | Amleshi et al. |
| 2010/0055983 | A1 | 3/2010 | Wu |
| 2010/0093209 | A1 | 4/2010 | Liu et al. |
| 2010/0216342 | A1 | 8/2010 | Lin |
| 2010/0240233 | A1 | 9/2010 | Johnescu et al. |
| 2010/0291803 | A1 | 11/2010 | Kirk |
| 2011/0159744 | A1 | 6/2011 | Buck |
| 2011/0195593 | A1 | 8/2011 | McGrath et al. |
| 2012/0214343 | A1 | 8/2012 | Buck et al. |
| 2012/0289095 | A1 | 11/2012 | Kirk |
| 2013/0005160 | A1 | 1/2013 | Minich |
| 2013/0122744 | A1 | 5/2013 | Morgan et al. |
| 2013/0149881 | A1 | 6/2013 | Johnescu et al. |
| 2013/0149890 | A1 | 6/2013 | Schroll et al. |
| 2013/0195408 | A1 | 8/2013 | Hermeline et al. |
| 2013/0210246 | A1 | 8/2013 | Davis et al. |
| 2013/0273756 | A1 | 10/2013 | Stoner et al. |
| 2013/0273781 | A1 | 10/2013 | Buck et al. |
| 2014/0017957 | A1 | 1/2014 | Horchler et al. |
| 2014/0227911 | A1 | 8/2014 | Lim et al. |

FOREIGN PATENT DOCUMENTS

| | | |
|---|---|---|
| DE | 3605316 | 8/1987 |
| DE | 4040551 | 4/1993 |
| DE | 10226279 | 11/2003 |
| DE | 102010005001 | 8/2010 |
| EP | 0212764 | 3/1987 |
| EP | 0273683 | 7/1988 |
| EP | 0337634 | 10/1989 |
| EP | 0442785 | 8/1991 |
| EP | 0486298 | 5/1992 |
| EP | 0321257 | 4/1993 |
| EP | 0560550 | 9/1993 |
| EP | 0562691 | 9/1993 |
| EP | 0591772 | 4/1994 |
| EP | 0623248 | 11/1995 |
| EP | 0706240 | 4/1996 |
| EP | 0782220 | 7/1997 |
| EP | 0789422 | 8/1997 |
| EP | 0843383 | 5/1998 |
| EP | 0635910 | 6/2000 |
| EP | 1024556 | 8/2000 |
| EP | 1111730 | 6/2001 |
| EP | 0891016 | 10/2002 |
| EP | 1091449 | 9/2004 |
| EP | 1148587 | 4/2005 |
| GB | 1162705 | 8/1969 |
| JP | 57/058115 | 4/1982 |
| JP | 60/072663 | 4/1985 |
| JP | 02/278893 | 11/1990 |
| JP | 05/21119 | 1/1993 |
| JP | 05344728 | 12/1993 |
| JP | 0668943 | 3/1994 |
| JP | 06236788 | 8/1994 |
| JP | 07114958 | 5/1995 |
| JP | 07169523 | 7/1995 |
| JP | 0896918 | 4/1996 |
| JP | 08125379 | 5/1996 |
| JP | 09199215 | 7/1997 |
| JP | 11185886 | 7/1999 |
| JP | 2000/003743 | 1/2000 |
| JP | 2000/003744 | 1/2000 |
| JP | 2000/003745 | 1/2000 |
| JP | 2000/003746 | 1/2000 |
| JP | 2000/228243 | 8/2000 |
| JP | 2001/135388 | 5/2001 |
| JP | 2001/305182 | 10/2001 |
| JP | 2002/008790 | 1/2002 |
| JP | 2003/217785 | 7/2003 |
| JP | 2007/128706 | 5/2007 |
| KR | 100517561 | 9/2005 |

(56) References Cited

FOREIGN PATENT DOCUMENTS

| | | |
|---|---|---|
| TW | 576555 | 8/1990 |
| TW | 546872 | 8/2003 |
| WO | WO 90/16093 | 12/1990 |
| WO | WO 96/38889 | 12/1996 |
| WO | WO 96/42123 | 12/1996 |
| WO | WO 97/20454 | 6/1997 |
| WO | WO 97/43885 | 11/1997 |
| WO | WO 97/44859 | 11/1997 |
| WO | WO 97/45896 | 12/1997 |
| WO | WO 98/15989 | 4/1998 |
| WO | WO 00/16445 | 3/2000 |
| WO | WO 01/29931 | 4/2001 |
| WO | WO 01/39332 | 5/2001 |
| WO | WO 02/058191 | 7/2002 |
| WO | WO 02/101882 | 12/2002 |
| WO | WO 02/103847 | 12/2002 |
| WO | WO 2005/065254 | 7/2005 |
| WO | WO 2006/031296 | 3/2006 |
| WO | WO 2006/105535 | 10/2006 |
| WO | WO 2007/064632 | 6/2007 |
| WO | WO 2008/082548 | 7/2008 |
| WO | WO 2008/117180 | 10/2008 |
| WO | WO 2012/047619 | 4/2012 |
| WO | WO 2012/174120 | 12/2012 |

OTHER PUBLICATIONS

Research Disclosure, Kenneth Mason Publications Ltd., England, Oct. 1992, No. 342, 1 page.
U.S. Appl. No. 29/426,921, filed Jul. 11, 2012, Horchler.
U.S. Appl. No. 29/444,125, filed Jan. 25, 2013, Harper, Jr. et al.
U.S. Appl. No. 29/449,794, filed Mar. 15, 2013, Zerebilov et al.
"1.0 HDMI Right Angle Header Assembly (19 Pin) Lead Free", Molex Incorporated, Jul. 20, 2004, 7 pages.
"AMP Z-Dok and Z-Dok and Connectors", Tyco Electronics/AMP, Application Specification #114-13068, Aug. 30, 2005, 17 pages.
"AMP Z-Pack 2mm HM Connector, 2mm Centerline, Eight-Row, Right-Angle Applications", Electrical Performance Report, EPR 889065, Issued Sep. 1998, 59 pages.
"AMP Z-Pack HM-Zd Performance at Gigabit Speeds", Tyco Electronics, Report #20GC014, Rev.B., May 4, 2001, 32 pages.
"Backplane Connectors", http://www.amphenol-tcs.com/products/connectors/backplane/index.html, Amphenol TCS (ATCS), Jun. 19, 2008, 1-3.
"Champ Z-Dok Connector System", Tyco Electronics, Jan. 2002, 3 pages.
Chen et al., "Characteristics of Coplanar Transmission Lines on Multilayer Substrates: Modeling and Experiments", IEEE Transactions on Microwave Theory and Techniques, Jun. 1997, 45(6), 939-945.
Derman "Speed, Density Push Design Xomplexities," Electronic Engineering Times, May 1998, 2 pages.
European Patent Application No. 12305119.5: European Search Report dated Jul. 11, 2012, 5 pages.
European Patent Application No. 10753953.8: Extended European Search Report dated Nov. 7, 2013, 6 pages.
"Framatome Connector Specification", May 10, 1999, 1 page.
Fusi et al., "Differential Signal Transmission through Backplanes and Connectors", Electronic Packaging and Production, Mar. 1996, 27-31.
"Gig-Array High Speed Mezzanine Connectors 15-40 mm Board to Board", FCI Corporation, Jun. 5, 2006, 1 page.
"HDM Separable Interface Detail", Molex, Feb. 17, 1993, 3 pages.
"HDM Stacker Signal Integrity", http://www.teradyne.com/prods/tcs/products/connectors/mezzanine/hdm_stacker/signintegrity.html, Amphenol TCS (ATCS), Feb. 2, 2006, 3 pages.
"High Definition Multimedia Interface (HDMI)", www.molex.com, Molex, Jun. 19, 2008, 2 pages.
"Honda High-Speed Backplane Connector NSP Series", Honda Connectors, Feb. 7, 2003, 25 pages.
Hunsaker, "Ventura Application Design", TB-2127, Amphenol, Aug. 25, 2005, 13 pages.
"Impact 3 Pair 10 Column Signal Module", Tyco Electronics, Mar. 25, 2008, 1 page.
"Impact 3 Pair Header Unguided Open Assembly", Tyco Electronics, Apr. 11, 2008, 1 page.
"Impact Connector Offered by Tyco Electronic, High Speed Backplane Connector System", Tyco Electronics, Apr. 15, 2008, 12 pages.
International Application No. PCT/US2003/014370, International Search Report dated Aug. 6, 2003, 2 pages.
International Application No. PCT/US2010/040899, International Search Report dated Jan. 25, 2011, 2 pages.
International Patent Application No. PCT/US2013/035775: International Search Report dated Jul. 18, 2013, 3 pages.
International Patent Application No. PCT/US2013/035915: International Search Report and Written Opinion dated Jul. 25, 2013, 17 pages.
International Patent Application No. PCT/US2013/049995: International Search Report dated Oct. 28, 2013, 18 pages.
"Lucent Technologies' Bell Labs and FCI Demonstrate 25gb-S Data Transmission Over Electrical Backplane Connectors", http:--www.lucent.com-press-0205-050201,bla.html, Lucent Tech Bell Labs, Feb. 1, 2005,1-4.
"Metral Speed & Density Extensions", FCI, Jun. 3, 1999, 1-25.
"MILLIPACS Connector, Type A Specification", Dec. 14, 2004,1 page.
Nadolny et al., "Optimizing Connector Selection for Gigabit Signal Speeds", http:--www.ecnmag.com-article-CA45245, ECN, Sep. 1, 2000, 6 pages.
Ogando, "And now-An Injection-Molded Heat Exchanger", Sure, plastics are thermal insulators, but additive packages allow them to conduct heat instead, Global Design News, Nov. 1, 2000, 4 pages.
"Overview: Backplane Products", http,--www.molex.com-cgi-bin-bv-molex-super_family-super_family.jsp?BV_SessionID=@, Molex, Feb. 8, 2006, 4 pages.
Power TwinBlade I/O Cable Connector RA-North-South, No. GS-20_072, Aug. 6, 2007, 11 pages.
Sherman, "Plastics that Conduct Heat", Plastics Technology Online, Jun. 2001, http://www.plasticstechnology.com, 4 pages.
Straus, "Shielded In-Line Electrical Multiconnector", IBM Technical Disclosure Bulletin, Aug. 3, 1967, 10(3), 3 pages.
"Tyco Unveils Z-Pack TinMan Orthogonal Connector System", http://www.epn-online.com/page/new59327/tyco-unveils-z-pack-orthogonal-conn, Oct. 13, 2009, 4 pages.
"Ventura High Performance, Highest Density Available", http://www.amphenol-tcs.com/products/connectors/backplane/ventura/index.html, Amphenol TCS (ATCS), Jun. 19, 2008, 1-2.
"VHDM Connector", http://www.teradyne.com/prods/tcs/products/connectors/backplane/vhdm/index.html, Amphenol TCS (ATCS), Jan. 31, 2006, 2 pages.
"VHDM Daughterboard Connectors Feature Press-Fit Terminations and a Non-Stubbing Separable Interface", Teradyne, Inc. Connections Sys Div, Oct. 8, 1997, 46 pages.
"VHDM High-Speed Differential (VHDM HSD)", http://www.teradyne.com/prods/bps/vhdm/hsd.html, Teradyne, Jan. 24, 2000, 6 pages.
"XCede® Connector", http://www.amphenol-tcs.com/products/connectors/backplane/xcede/index.html, Amphenol TCS (ATCS), Jun. 19, 2008, 1-5.
"Z-Dok and Connector", http://2dok.tyco.electronics.com, Tyco Electronics, May 23, 2003, 1-15.
"Z-Pack TinMan Product Portofolio Expanded to Include 6-Pair Module", Tyco Electronics, Jun. 19, 2008, 1 page.
U.S. Appl. No. 29/418,299, filed Apr. 13, 2012, Buck et al.
U.S. Appl. No. 29/418,310, filed Apr. 13, 2012, Buck et al.
U.S. Appl. No. 29/418,313, filed Apr. 13, 2012, Zerebilov et al.
"1.90 by 1.35mm (.075 by.053) Pitch Impact, Backplane Connector System 3 and 4 Pair, Features and Specification", Molex, www.molex.com/link/Impact.html, 2008, 5 pages.
"4.0 UHD Connector Differential Signal Crosstalk, Reflections", 1998, p. 8-9.

(56) References Cited

OTHER PUBLICATIONS

Ahn et al., "A Design of the Low-Pass Filter Using the Novel Microstrip Defected Ground Structure", IEEE Transactions on Microwave Theory and Techniques, 2001, 49(1), 86-93.
"AMP Z-Pack 2mm HM Interconnection System", 1992/1994, AMP Incorporated, 6 pages.
"B.? 9 Bandwidth and Rise Time Budgets, Module 1-8 Fiber Optic Telecommunications (E-XVI-2a)", http:--cord.org-step_online-st1-8-st18exvi2a.htm, 2006, 1-3.
Cheng et al., "Terahertz-Bandwidth Characteristics of Coplanar Transmission Lines on Low Permittivity Substrates", IEEE Transactions on Microwave Theory and Techniques, 1994, 42(12), 2399-2406.
Chua et al., "Broadband Characterisation of CPW Transition and Transmission Line Parameters for Small Reflection Up to 100 GHZ", RF and Microwave Conference, 2004, 269-271.
"Daughtercard Hole Pattern: Signal Modules (10 & 25 positions) Connector Assembly", Customer No. C-163-5101-500, Teradyne Connection Systems, Inc., 2001, 1 page.
"FCI's Airmax VS Connector System Honored at DesignCon 2005", http:--www.heilind.com-products-fci-airmax-vs-design.asp, Heilind Electronics, Inc., 2005, 1 page.
Finan, "Thermally Conductive Thermoplastics", LNP Engineering Plastics, Inc., Plastics Engineering 2000, www.4spe.org, 4 pages.
"GbXI-Trac Backplane Connector System", www.molex.com/cgi-bin, Molex, 2007, 1-3.
"Gig-Array Connector System, Board to Board Connectors", 2005, 4 pages.
Goel et al., "AMP Z-Pack Interconnect System", AMP Incorporated, 1990, 9 pages.
"HDM, HDM Plus Connectors", http:--www.teradyne.com-prods-tcs-products-connectors-backplane-hdm-index.html, Amphenol TCS, 2006, 1 page.
"HDM/HDM Plus, 2mm, Backplane Interconnection System", Teradyne Connection Systems, 1993, 22 pages.
Hettak et al., "Simultaneous Realization of Millimeter Wave Uniplanar Shunt Stubs and DC Block", IEEE MTT-S Digest, 1998, 809-812.
"High Speed Backplane Interconnect Solutions", Tyco Electronics, 2007, 6 pages.
"High Speed Characterization Report, SEAM-30-02.0-S-10-2", www.samtec.com, SAMTEC, 2005, 55 pages.
Hult, "FCI's Problem Solving Approach Changes Market, The FCI Electronics AirMax VS", http:--www.connecotrsupplier.com-tech_updates_FCI-Airmax_archive.htm, ConnectorSupplier.com, 2006, 1-4.
Lee et al., "Characteristic of the Coplanar Waveguide to Microstrip Right-Angled Transition", Department of Electronics Engineering, 1998, 3 pages.
Leung et al., "Low-Loss Coplanar Waveguides Interconnects on Low-Resistivity Silicon Substrate", IEEE Transactions on Components and Packaging Technologies, 2004, 27(3), 507-512.
Lim et al., "A Spiral-Shaped Defected Ground Structure for Coplanar Waveguide", IEEE Microwave and Wireless Components Letters, 2002, 12(9), 330-332.
Machac et al., "Space Leakage of Power from Uniplanar Transmission Lines", Czech Technical University, 1998, 565-568.
Mao et al., "Characterization of Coplanar Waveguide Open End Capacitance-Theory and Experiment", IEEE Transactions on Microwave Theory and Techniques, 1994, 42(6), 1016-1024.
"Metrel 1000 Series, 5 Row Receptacle, Right Angle, Press Fit, PCB Mounted Receptacle Assembly", FCI 2001, 1 page.
"Metrel 2mm High-Speed Connectors, 1000, 2000, 3000 Series, Electrical Performance Data for Differential Applications", FCI Framatome Group, 2000, 2 pages.
Mezzanine High Speed High-Density Connectors Gig-Array and Meg-Array Electrical Performance Data, FCI Corporation, 10 pages.
Mottonen et al., "Novel Wide-Band Coplanar Waveguide-to-Rectangular Waveguide Transition", IEEE Transactions on Microwave Theory and Techniques, 2004, 52(8), 1836-1842.
"NSP Series, Backplane High-Speed Data Transmission Cable Connectors", http:--www.honda-connectors.co.jp, Honda Connectors, 2006, 6 pages, English Translation attached.
"Open Pin Field Array Seaf Series", www.samtec.com, SAMTEC, 2005, 1 page.
"Overview for High Density Backplane Connector (Z-Pack TinMan)", Tyco Electronics, 2008, 1 page.
"Overview for High Density Backplane Connectors (Impact) Offered by Tyco Elecctronics", www.tycoelectronics.com/catalog , Tyco Electronics, 2007, 1-2.
"PCB-Mounted Receptacle Assemblies, 2.00 mm (0.079 In) Centerlines, Right-Angle Solder-to-Board Signal Receptacle", Metrel, Berg Electronics, 2 pages.
"Product Datasheets, 10 Bgit/s XENPAK 850 nm Transponder (TRP10GVP2045)", MergeOptics GmbH, 2005, 13 pages.
"Product Datasheets, Welcome to XENPAK.org.", http://www.xenpak.org., 2001, 1 page.
Soliman. et al., "Multimodel Characterization ofPlanar Microwave Structures", IEEE Transactions on Microwave Theory and Techniques, 2004, 52(1), 175-182.
Son et al., "Picosecond Pulse Propagation on Coplanar Striplines Fabricated on Lossy Semiconductor Substrates: Modeling and Experiments", IEEE Transactions on Microwave Theory and Techniques, 1993, 41(9), 1574-1580.
Tzuang et al., "Leaky Mode Perspective on Printed Antenna", Proc. Natl. Sci. Counc. ROC(A), 1999, 23(4), 544-549.
"VHDM L-Series Connector", http://www.teradyne.com/prods/tcs/products/connectors/backplane/vhdm_1-series/index.html, Amphenol TCS(ATCS), 2006, 4 pages.
Weller et al., "High Performance Microshield Line Components", IEEE Transactions on Microwave Theory and Techniques, 1995, 43(3), 534-543.
Williams et al., "Accurate Transmission Line Characterization", IEEE Microwave and Guided Wave Letters, 1993, 3(8), 247-249.
Wu et al., "Full-Wave Characterization of the Mode Conversion in a Coplanar Waveguide Right-Angled Bend", IEEE Transactions on Microwave Theory and Techniques, 1995, 43(11), 2532-2538.
Ya et al., "Microstrip and Slotline Two-Pole Microwave Filters with Additional Transmission Zeros", Int. Crimean Conference, Microwave & Telecommunication Technology, 2004, 405-407 (English Abstract provided).
"Z-Pack Slim UHD", http:/ww.zpackuhd.com, Tyco Electronics, 2007, 8 pages.
"Z-Pack TinMan High Speed Orthogonal Connector Product Feature Selector", Tyco Electronics, 2009, 2 pages.
Berg Electronics Catalog, p. 13-96, Solder Washers, 1996, 1 page.
IBM Technical Disclosure Bulletin, 1972, 14(8), 2 pages.
IBM Technical Disclosure Bulletin, 1977, 20(2), 2 pages.
IBM Technical Disclosure Bulletin, 1990, 32(11), 2 pages.
Kazmierowicz, "Profiling Your Solder Reflow Oven in Three Passes or Less", KIC Oven Profiling, Surface Mount Technology, 1990, 2 pages.
Kazmierowicz, "The Science Behind Conveyor Oven Thermal Profiling", KIC Oven Profiling, Surface Mount Technology,1990, 9 pages.
"Micro Electronic Interconnects", Alphametals, 1990, 4 pages.
Siemens, "SpeedPac: A New Concept for the Next Generation of Transmission Speed," Backplane Interconnection, Issue 1/96.
U.S. Appl. No. 29/504,773, filed Oct. 9, 2014, Horchler.
U.S. Appl. No. 29/508,070, filed Nov. 3, 2014, Zerebilov et al.
Suh et al., "Coplanar Strip Line Resonators Modeling and Applications to Filters," IEEE Transactions on Microwave Theory and Techniques, vol. 50, No. 5, May 2002, 1289-1296.
"Two-Piece, High-Speed Connectors," www.tycoelectronics.com/catalog, Tyco Electronics, 2007, 1-3.

* cited by examiner

HIGH SPEED ELECTRICAL CONNECTOR

CROSS-REFERENCE TO RELATED APPLICATIONS

This claims priority to U.S. Patent Application Ser. No. 61/624,247 filed Apr. 13, 2012 and U.S. Patent Application Ser. No. 61/624,238 filed Apr. 13, 2012, the disclosure of each of which is hereby incorporated by reference as if set forth in its entirety herein.

BACKGROUND

U.S. Patent Pub. No. 2011/0009011 discloses an electrical connector with edge-coupled differential signal pairs that can operate at 13 GHz (approximately 26 Gbits/sec) with an acceptable level of crosstalk. Amphenol TCS and FCI commercially produce the XCEDE brand of electrical connector. The XCEDE brand electrical connector is designed for 25 Gigabit/sec performance. ERNI Electronics manufactures the ERmet ZDHD electrical connector. The ERmet ZDHD connector is designed for data rates up to 25 Gbits/sec. MOLEX also manufactures the IMPEL brand of electrical connector. The IMPEL brand of electrical connector is advertised to provide a scalable price-for-performance solution enabling customers to secure a high-speed 25 and 40 Gigabit/sec footprint. All of these electrical connectors have edge-to-edge differential signal pairs and a beam on blade mating interface. TE Connectivity manufactures the commercially available STRADA WHISPER electrical connector. The STRADA WHISPER electrical connector has individually shielded broadside-to-broadside differential signal pairs (twinax) and is designed for data rates up to 40 Gigabits/sec. The STRADA WHISPER electrical connector also uses a beam on blade mating interface. No admission is made that any of the connectors described above are qualifying prior art with respect to any invention described below.

SUMMARY

An electrical connector is configured to be mated to a complementary electrical connector along a first direction. The electrical connector can include an electrically insulative connector housing, and a plurality of signal contacts supported by the connector housing. Each of the plurality of signal contacts can define a mounting end and a receptacle mating end, each receptacle mating end defining a tip that defines a concave surface and a convex surface opposite the concave surface. The signal contacts can be arranged in at least first and second linear arrays, the second linear array disposed immediately adjacent the first linear array along a second direction that is perpendicular to the first direction, such that the concave surfaces of the signal contacts of the first linear array face the concave surfaces of the signal contacts of the second linear array. Immediately adjacent signal contacts along each of the linear arrays can define respective differential signal pairs.

DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
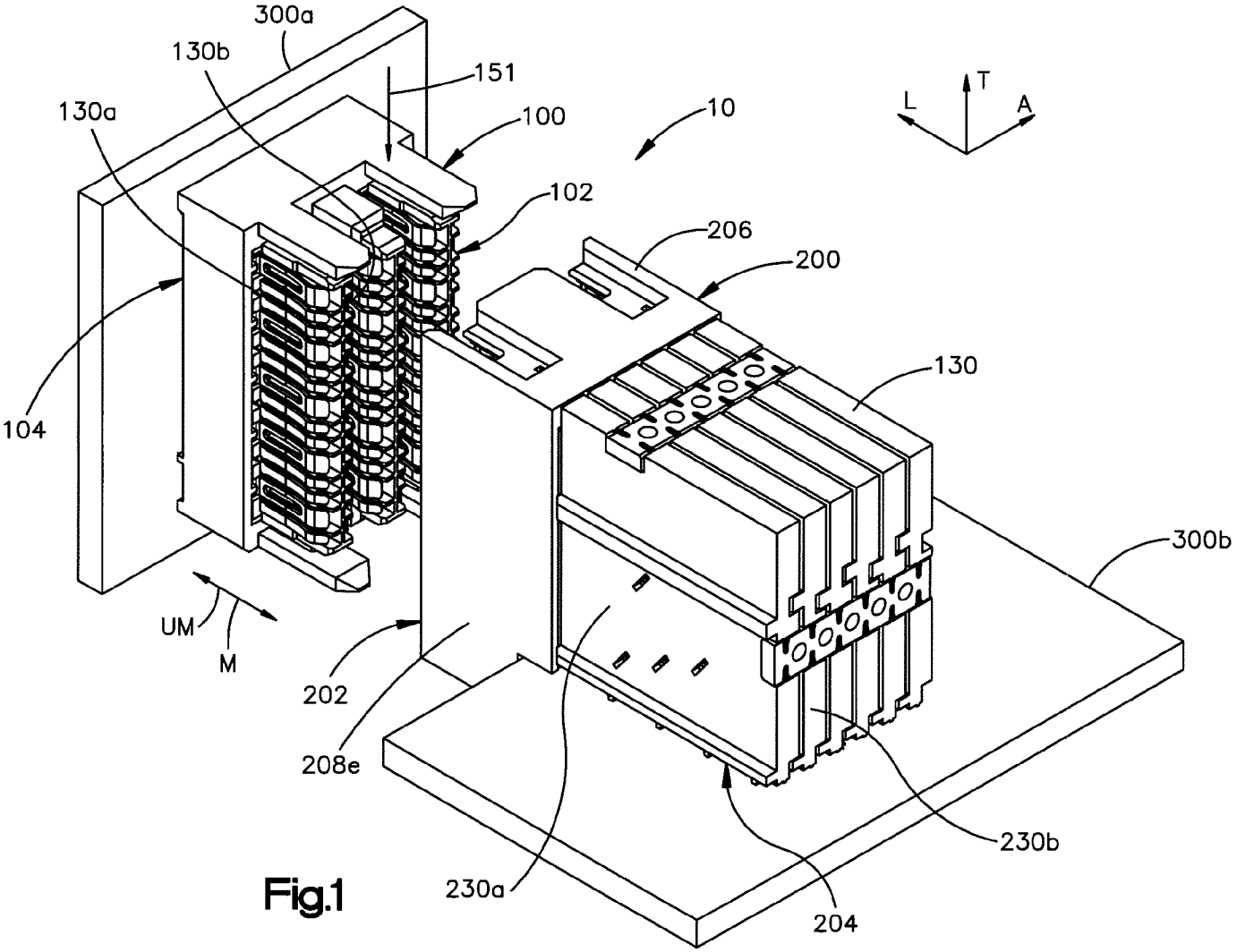
FIG. 1 is a perspective view of an electrical connector assembly in accordance with an embodiment, the electrical connector assembly including first and second substrates, and first and second electrical connectors configured to be mounted to first and second substrates, respectively.

Referring initially to FIGS. 1-3B, an electrical connector assembly 10 can include a first electrical connector 100, a second electrical connector 200 configured to be mated with the first electrical connector 100, a first electrical component such as a first substrate 300*a*, and a second electrical component such as a second substrate 300*b*. The first and second substrates 300*a* and 300*b* can be configured as a first and second printed circuit boards, respectively. For instance, the first substrate 300*a* can be configured as a backplane, or alternatively can be configured as a midplane, daughter card, or any suitable alternative electrical component. The second substrate 300*b* can be configured as a daughter card, or can alternatively be configured as a backplane, a midplane, or any suitable alternative electrical component. The first electrical connector 100 can be configured to be mounted to the first substrate 300*a* so as to place the first electrical connector 100 in electrical communication with the first substrate 300*a*. Similarly, the second electrical connector 200 can be configured to be mounted to the second substrate 300*b* so as to place the second electrical connector 200 in electrical communication with the second substrate 300*b*. The first and second electrical connectors 100 and 200 are further configured to be mated with each other along a mating direction so as to place the first electrical connector 100 in electrical communication with the second electrical connector 200. The mating direction can, for instance, define a longitudinal direction L. Accordingly, the first and second electrical connectors 100 and 200 can be mated to one another so as to place the first substrate 300*a* in electrical communication with the second substrate 300*b*. The first and second electrical connectors 100 and 200 can be easily manufactured by stamped leadframes, stamped crosstalk shields, and simple resin overmolding. No expensive plastics with conductive coatings are required. A flexible beam to flexible beam mating interface has been shown in simulation to reduce stub length, which in turn significantly shifts or lessens the severity of unwanted insertion loss resonances.

In accordance with the illustrated embodiment, the first electrical connector 100 can be constructed as a vertical electrical connector that defines a mating interface 102 and a mounting interface 104 that is oriented substantially parallel to the mating interface 102. Alternatively, the first electrical connector 100 can be configured as a right-angle electrical connector whereby the mating interface 102 is oriented substantially perpendicular with respect to the mounting interface 104. The second electrical connector 200 can be constructed as a right-angle electrical connector that defines a mating interface 202 and a mounting interface 204 that is oriented substantially perpendicular to the mating interface 202. Alternatively, the second electrical connector 200 can be configured as a vertical electrical connector whereby the mating interface 202 is oriented substantially perpendicular with respect to the mounting interface 204. The first electrical connector 100 is configured to mate with the mating interface 202 of the second electrical connector 200 at its mating interface 102. Similarly, the second electrical connector 200 is configured to mate with the mating interface 102 of the first electrical connector 100 at its mating interface 202.

The first electrical connector 100 can include a dielectric, or electrically insulative connector housing 106 and a plurality of electrical contacts 150 that are supported by the connector housing 106. The plurality of electrical contacts 150 can be referred to as a first plurality of electrical contacts with respect to the electrical connector assembly 10. The plurality of electrical contacts 150 can include a first plurality of signal contacts 152 and a first plurality of ground contacts 154.

With continuing reference to FIGS. 1-3B, the first electrical connector 100 can include a plurality of leadframe assemblies 130 that include select ones of the plurality of electrical signal contacts 152 and at least one ground contact 154. The leadframe assemblies 130 can be supported by the connector housing 106 such that they are spaced from each other along a row direction, which can define a lateral direction A that is substantially perpendicular to the longitudinal direction L. The electrical contacts 150 of each leadframe assembly 130 can be arranged along a column direction, which can be defined by a transverse direction T that is substantially perpendicular to both the longitudinal direction L and the lateral direction A.

The electrical signal contacts 152 can define respective mating ends 156 that extend along the mating interface 102, and mounting ends 158 that extend along the mounting interface 104. Each of the ground contacts 154 can define respective ground mating ends 172 that extend along the mating interface 102, and ground mounting ends 174 that extend along the mounting interface 104 and can be in electrical communication with the ground mating ends 172. Thus, it can be said that the electrical contacts 150 can define mating ends, which can include the mating ends 156 of the electrical signal contacts 152 and the ground mating ends 172, and the electrical contacts 150 can further define mounting ends, which can include the mounting ends 158 of the electrical signal contacts 152 and the ground mounting ends 174. As will be appreciated from the description below, each ground contact 154, including the ground mating ends 172 and the ground mounting ends 174, can be defined by a ground plate 168 of the respective leadframe assembly 130. The ground plate 168 can be electrically conductive as desired. Alternatively, the ground mating ends 172 and ground mounting ends 174 can be defined by individual ground contacts as desired.

The signal contacts 152 can be constructed as vertical contacts, whereby the mating ends 156 and the mounting ends 158 are oriented substantially parallel to each other. Alternatively, the signal contacts 152 can be constructed as right-angle contacts, for instance when the first electrical connector 100 is configured as a right-angle connector, whereby the mating ends 156 and the mounting ends 158 are oriented substantially perpendicular to each other. Each signal contact 152 can define a pair of opposed broadsides 160 and a pair of opposed edges 162 that extend between the opposed broadsides 160. Each of the opposed broadsides 160 can be spaced apart from each other along the lateral direction A, and thus the row direction, a first distance. Each of the opposed edges 162 can be spaced apart from each other along a transverse direction T, and thus the column direction, a second distance that is greater than the first distance. Thus, the broadsides 160 can define a length between the opposed edges 162 along the transverse direction T, and the edges 162 can define a length between the opposed broadsides along the lateral direction A. Otherwise stated, the edges 162 and the broadsides 160 can define respective lengths in a plane that is oriented substantially perpendicular to both the edges 162 and the broadsides 160. The length of the broadsides 160 is greater than the length of the edges 162.

The mating end 156 of the each signal contacts 152 can be constructed as a flexible beam, which can also referred to as a receptacle mating end, that defines a bent, such as curved, distal tip 164 that can define a free end of the signal contact 152. Bent structures as described herein refer to bent shapes that can be fabricated, for instance, by bending the end or by stamping a bent shape, or by any other suitable manufacturing process. At least a portion of the curved tip 164 can be offset with respect to the mounting end 158 along the lateral direction. For instance, the tip 164 can flare outward along the lateral direction A as the electrical signal contact 152 extends along the mating direction, and then inward along the lateral direction A as the electrical signal contact 152 further extends along the mating direction. The electrical contacts 150 can be arranged such that adjacent ones of the electrical signal contacts 152 along the column direction can define pairs 166. Each pair 166 of electrical signal contacts 152 can define a differential signal pair. Further, one of the edges 162 of each electrical signal contacts 152 of each pair 166 can face one of the edges 162 of the other electrical signal contact 152 of the respective pair 166. Thus, the pairs 166 can be referred to as edge-coupled differential signal pairs. The electrical contacts 150 can include a ground mating end 172 that is disposed between immediately adjacent ones of the pairs 166 of electrical signal contacts 152 along the column direction. The electrical contacts 150 can include a ground mounting end 174 that is disposed between the mounting ends 156 of immediately adjacent ones pairs 166 of electrical signal contacts 152 along the column direction. Immediately adjacent can refer to the fact that there are no additional differential signal pairs, or signal contacts, between the immediately adjacent differential signal pairs 166.

It should be appreciated that the electrical contacts 150, including the mating ends 156 of the electrical signal contacts 152 and the ground mating ends 172, can be spaced from each other along a linear array of the electrical contacts 150 that extends along the column direction. The linear array 151 can be defined by the respective leadframe assembly 130. For instance, the electrical contacts 150 can be spaced from each other along in a first direction, such as the column direction, along the linear array from a first end 151*a* to a second end 151*b*, and a second direction that is opposite the first direction from the second end 151*b* to the first end 151*a* along the linear array. Both the first and second directions thus extend along the column direction. The electrical contacts 150, including the mating ends 156 and ground mating ends 172, and further including the mounting ends 158 and ground mounting ends 174, can define any repeating contact pattern as in each of the desired in the first direction, including S-S-G, G-S-S, S-G-S, or any suitable alternative contact pattern, where "S" represents an electrical signal and "G" represents a ground. Furthermore, the electrical contacts 150 of the leadframe assemblies 130 that are adjacent each other along the row direction can define different contact patterns. In accordance with one embodiment, the leadframe assemblies 130 can be arranged pairs 161 of first and second leadframe assemblies 130*a* and 130*b*, respectively that are adjacent each other along the row direction. The electrical contacts 150 of the first leadframe assemblies 130*a* are arranged along first linear arrays 151 at the mating ends. The electrical contacts 150 of the first leadframe assemblies 130*a* are arranged along second linear arrays 151 at the mating ends. The first leadframe assembly 130*a* can define a first contact pattern in the first direction, and the second leadframe assembly 130*b* can define a second contact pattern in the first direction that is different than the first contact pattern of the first leadframe assembly.

Each of the first and second linear arrays 151 can include a ground mating end 172 adjacent the mating ends 156 of every differential signal pair 166 of each of the respective linear array 151 along both the first and the second directions. Thus, the mating ends 156 of every differential signal pair 166 is flanked on opposite sides along the respective linear array by a respective ground mating end 172. Similarly, each of the first and second linear arrays 151 can include a ground mounting end 174 adjacent the mounting ends 154 of every differential signal pair 166 of each of the respective linear array 151 along both the first and the second directions. Thus, the mounting ends 154 of every differential signal pair 166 is flanked on opposite sides along the respective linear array by a respective ground mounting end 174.

For instance, the first leadframe assembly 130*a* can define a repeating contact pattern of G-S-S along the first direction, such that the last electrical contact 150 at the second end 151*b*, which can be the lowermost end, is a single widow contact 152*a* that can be overmolded by the leadframe housing or stitched into the leadframe housing as described with respect to the electrical signal contacts 152. It should be appreciated for the purposes of clarity that reference to the signal contacts 152 includes the single widow contacts 152. The mating ends 156 and the mounting ends 158 of the single widow contact 152*a* can be disposed adjacent a select one of the ground mating ends 172 and ground mounting ends 174 along the column direction, and is not disposed adjacent any other electrical contacts 150, including mating ends or mounting ends, along the column direction. Thus, the select one of the ground mating ends 172 and ground mounting ends 176 can be spaced from the single widow contact 152*a* in the first direction along the linear array 151. The second leadframe assembly 130*b* can define a repeating contact pattern of G-S-S along the second direction, such that the last electrical contact 150 at the first end 151*a*, which can be an uppermost end, of the linear array is a single widow contact 152*a*. The single widow contact 152*a* of the second leadframe assembly 130*b* can be disposed adjacent a select ground mating end 172 and ground mounting end 174 along the column direction, and is not disposed adjacent any other electrical contacts 150, including mating ends and mounting ends, along the column direction. Thus, the select one of the ground mating ends 172 and ground mounting ends 174 can be spaced from the single widow contact 152*a* in the second direction along the linear array. Thus, the position of the single widow contacts 152*a* can alternate from the first end 151*a* of a respective first linear array 151 to the second opposed end 151*b* of a respective second linear array 151 that is immediately adjacent the first linear array and oriented parallel to the first linear array. The single widow contacts 152*a* can be single-ended signal contacts, low speed or low frequency signal contacts, power contacts, ground contacts, or some other utility contacts.

In accordance with the illustrated embodiment, the mating ends 156 of the signal contacts 152 and the ground mating ends 172 can be aligned along the linear array 151, and thus along the transverse direction T, at the mating interface 102. Further, the mounting ends 158 of the signal contacts 152 and the ground mounting ends 174 can be aligned along the linear array 151, and thus along the transverse direction T at the mounting interface 104. The mounting ends 158 of the signal contacts 152 and the ground mounting ends 174 can be spaced apart from each other along the transverse direction T at the mounting interface 104 so as to define a constant contact pitch along the linear array, or along a plane that includes the linear array, also referred to as a row pitch, at the mounting interface 104. That is, the center-to-center distance between adjacent mounting ends of the electrical contacts 150 can be constant along the linear array 151. Thus, the electrical contacts 150 can define first, second, and third mounting ends, whereby both the first and the third mounting ends are immediately adjacent the second mounting end. The electrical contacts 150 define respective centerlines that that extend along the lateral direction A and bifurcate the mounting ends along the transverse direction T. The electrical contacts 150 define a first distance between the centerline of the first mounting end and the centerline of the second mounting end, and a second distance between the centerline of the second mounting end and the centerline of the third mounting end. The first distance can be equal to the second distance.

The mating ends 156 of the signal contacts 152 and the ground mating ends 172 can be spaced apart from each other along the transverse direction T at the mating interface 102 so as to define a variable contact pitch along the column direction or the linear array 151 at the mating interface 102, also known as a row pitch. That is, the center-to-center distance between adjacent mating ends of the electrical contacts 150 can vary along the linear array 151. Thus, the electrical contacts 150 can define first second and third mating ends, whereby both the first and the third mating ends are immediately adjacent the second mating end. The electrical contacts 150 define respective centerlines that extend along the lateral direction A and bifurcate the mating ends along the transverse direction T. The electrical contacts 150 define a first distance between the centerline of the first mating end and the centerline of the second mating end, and a second distance between the centerline of the second mating end and the centerline of the third mating end. The second distance can be greater than the first distance.

The first and second mating ends and the first and second mounting ends can define the mating ends 156 and mounting ends 158 of respective first and second electrical signal contacts 152. The third mating end and mounting end can be defined by a ground mating end 172 and a ground mounting end 174, respectively. For instance, the ground mating end 172 can define a height along the transverse direction T that is greater than the height in the transverse direction of each of the electrical signal contacts 152 in the linear array 151. For instance, each ground mating end 172 can define a pair of opposed broadsides 176 and a pair of opposed edges 178 that extend between the opposed broadsides 176. Each of the opposed broadsides 176 can be spaced apart from each other along the lateral direction A, and thus the row direction, a first distance. Each of the opposed edges 178 can be spaced apart from each other along the transverse direction T, and thus the column direction, a second distance that is greater than the first distance. Thus, the broadsides 176 can define a length between the opposed edges 178 along the transverse direction T, and the edges 178 can define a length between the opposed broadsides 176 along the lateral direction A. Otherwise stated, the edges 178 and the broadsides 176 can define respective lengths in a plane that is oriented substantially perpendicular to both the edges 178 and the broadsides 176. The length of the broadsides 176 is greater than the length of the edges 178. Further, the length of the broadsides 176 is greater than the length of the broadsides 160 of the electrical signal contacts 152, in particular at the mating ends 156.

In accordance with one embodiment, immediately adjacent mating ends 156 of signal contacts 152, meaning that no other mating ends are between the immediately adjacent mating ends, define a contact pitch along the linear array 151 of approximately 1.0 mm. Mating ends 156 and ground mating ends 172 that are immediately adjacent each other along the linear array 151 define a contact patch along the linear array 151 of approximately 1.3 mm. Furthermore, the edges of immediately adjacent mating ends of the electrical contacts 150 can define a constant gap therebetween along the linear array 151. Immediately adjacent mounting ends of the electrical contacts can all be spaced from each other a constant distance, such as approximately 1.2 mm. Immediately adjacent mounting ends of the electrical contacts 150 along the linear array can define a substantially constant row pitch, for instance of approximately 1.2 mm. Accordingly, immediately adjacent mounting ends 158 of signal contacts 152 define a contact pitch along the linear array 151 of approximately 1.2 mm. Mounting ends 156 and ground mounting ends 174 that are immediately adjacent each other along the linear array 151 can also define a contact patch along the linear array 151 of approximately 1.2 mm. The ground mating ends can define a distance along the respective linear array, and thus the transverse direction T, from edge to edge that is greater than a distance defined by each of the mating ends of the signal contacts along the respective linear array, and thus the transverse direction T, from edge to edge.

The first electrical connector 100 can include any suitable dielectric material, such as air or plastic, that isolates the signal contacts 152 from one another along either or both of the row direction and the column direction. The mounting ends 158 and the ground mounting ends 174 can be configured as press-fit tails, surface mount tails, fusible elements such as solder balls, or combinations thereof, which are configured to electrically connect to a complementary electrical component such as the first substrate 300*a*. In this regard, the first substrate 300*a* can be configured as a backplane, such that the electrical connector assembly 10 can be referred to as a backplane electrical connector assembly in one embodiment.

As described above, the first electrical connector 100 is configured to mate with and unmate from the second electrical connector 200 along a first direction, which can define the longitudinal direction L. For instance, the first electrical connector 100 is configured to mate with the second electrical connector 200 along a longitudinally forward mating direction M, and can unmate from the second connector 200 along a longitudinally rearward unmating direction UM. Each of the leadframe assemblies 130 can be oriented along a plane defined by the first direction and a second direction, which can define the transverse direction T that extends substantially perpendicular to the first direction. The signal contacts 152, including the respective mating ends 156 and mounting ends 158, and the ground mating ends 172 and ground mounting ends 174, of each leadframe assembly 130 are spaced from each other along the transverse direction T, which can define the column direction. The leadframe assemblies 130 can be spaced along a third direction, which can define the lateral direction A, that extends substantially perpendicular to both the first and second directions, and can define the row direction R. As illustrated, the longitudinal direction L and the lateral direction A extend horizontally and the transverse direction T extends vertically, though it should be appreciated that these directions may change depending, for instance, on the orientation of the electrical connector assembly 10 during use. Unless otherwise specified herein, the terms "lateral," "longitudinal," and "transverse" are used to describe the orthogonal directional components of the components of the electrical connector assembly 10 being referred to.

Figure 3A:
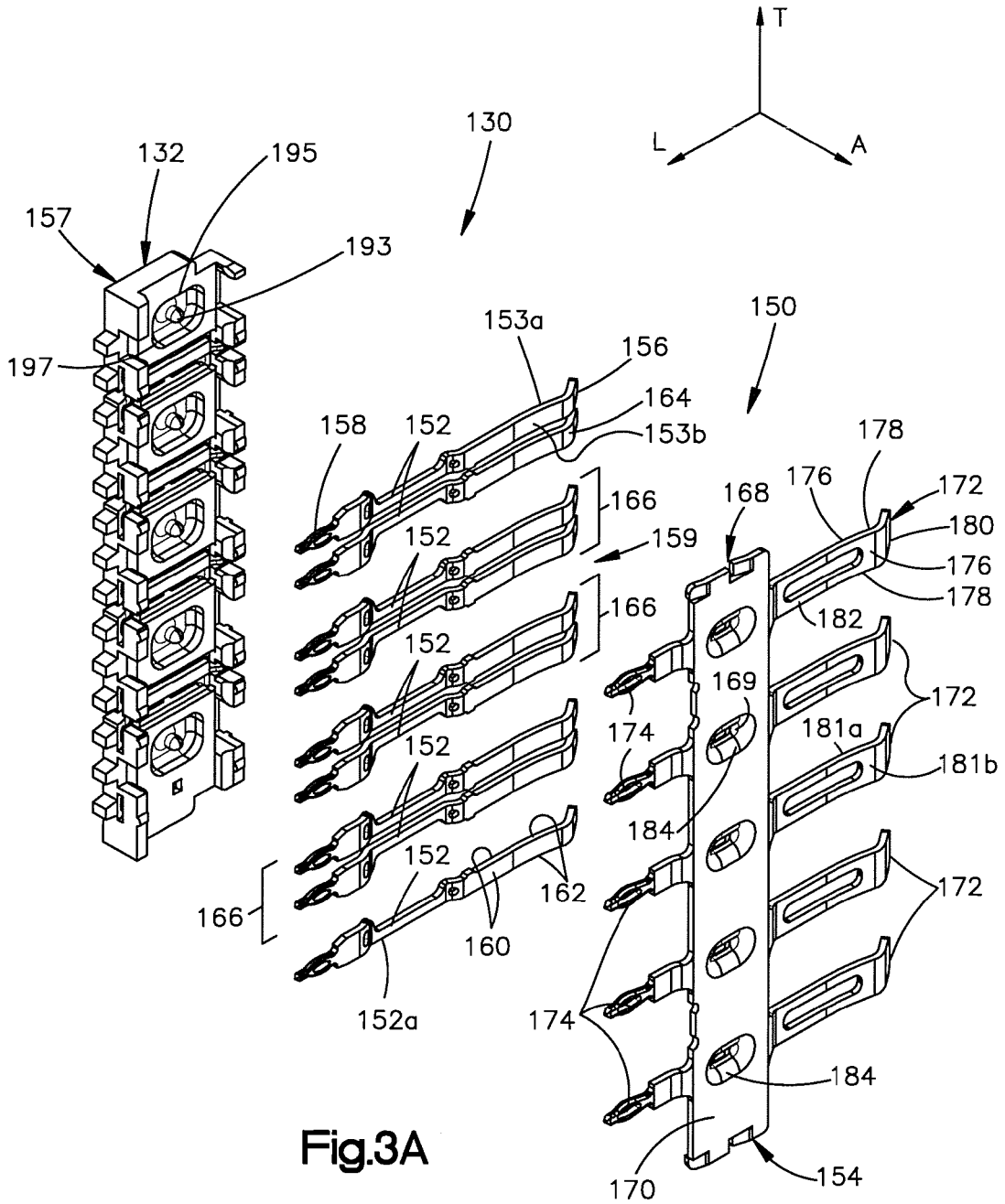
FIG. 3A is an exploded perspective view of a leadframe assembly of the first electrical connector illustrated in FIG. 2A.
Figure 3B:
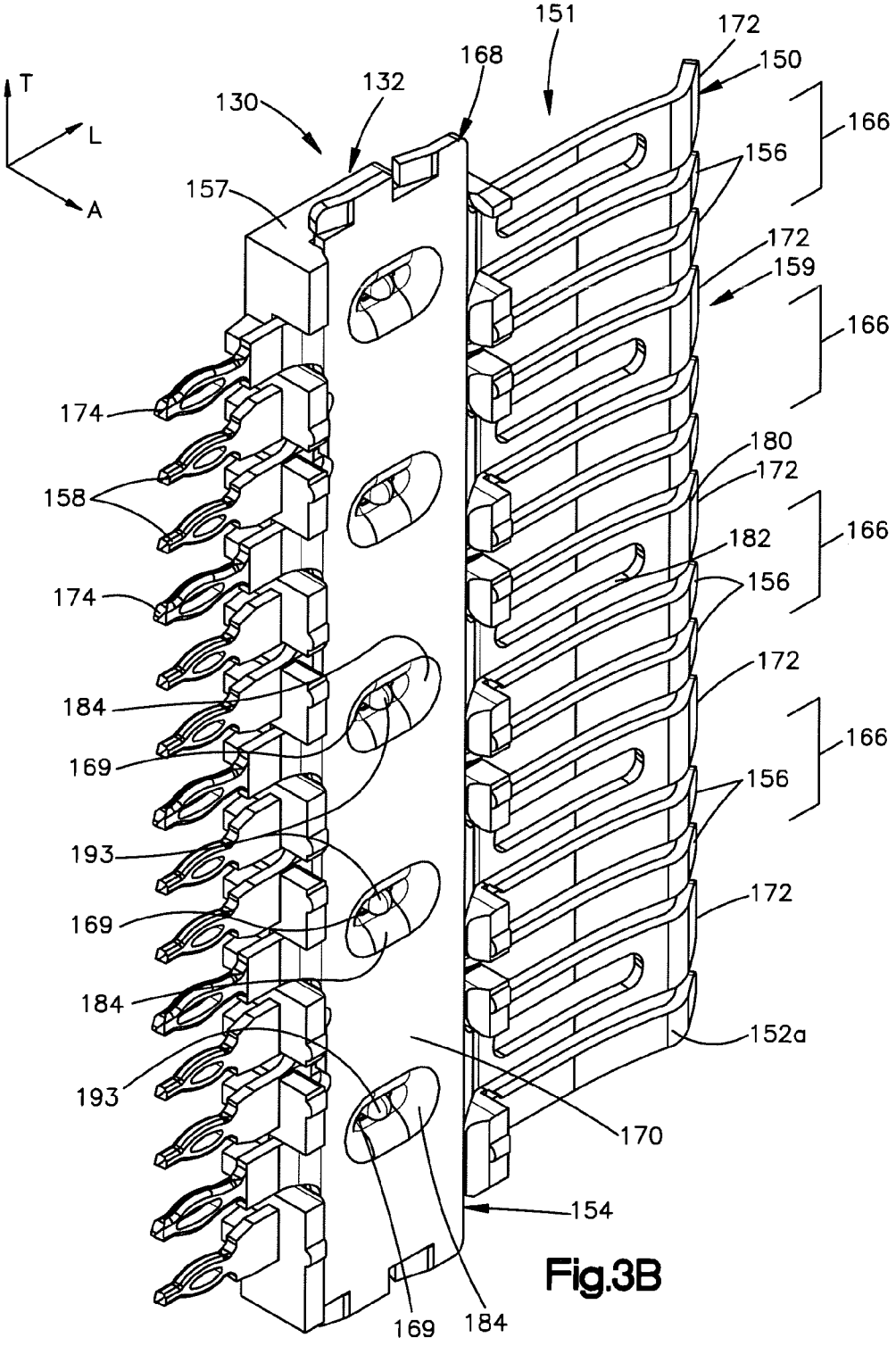
FIG. 3B is an assembled perspective view of the leadframe assembly illustrated in FIG. 3A.

Referring now to FIGS. 3A-3B in particular, the first electrical connector 100 can include a plurality of leadframe assemblies 130 that are supported by the connector housing 106 and arranged along the row direction. The electrical connector 100 can include as many leadframe assemblies 130 as desired, such as six in accordance with the illustrated embodiment. In accordance with one embodiment, each leadframe assembly 130 can include a dielectric, or electrically insulative, leadframe housing 132 and a plurality of the electrical contacts 150 that are supported by the leadframe housing 132. In accordance with the illustrated embodiment, each leadframe assembly 130 includes a plurality of signal contacts 152 that are supported by the leadframe housing 132 and a ground contact 154 that can be configured as a ground plate 168. The signal contacts 152 can be overmolded by the dielectric leadframe housing 132 such that the leadframe assemblies 130 are configured as insert molded leadframe assemblies (IMLAs), or can be stitched into or otherwise supported by the leadframe housing 132. The ground plate 168 can be attached to the leadframe housing 132.

The ground plate 168 includes a plate body 170 and a plurality of ground mating ends 172 that extend out from the plate body 170. For instance, the ground mating ends can extend forward from the plate body 170 along the longitudinal direction L. The ground mating ends 172 can thus be aligned along the transverse direction T and the linear array 151. The ground plate 168 further includes a plurality of ground mounting ends 174 that extend out from the plate body 170. For instance, the ground mounting ends 174 can extend rearward from the plate body 170, opposite the ground mating ends 172, along the longitudinal direction L. Thus, the ground mating ends 172 and the ground mounting ends 174 can be oriented substantially parallel to each other. It should be appreciated, of course, that the ground plate 168 can be configured to attach to a right-angle leadframe housing such that the ground mating ends 172 and the ground mounting ends 174 are oriented substantially perpendicular to each other. The ground mating ends 172 can be configured to electrically connect to complementary ground mating ends 172 of a complementary electrical connector, such as the second electrical connector 200. The ground mounting ends 174 can be configured to electrically connect to electrical traces of a substrate, such as the first substrate 300*a*.

Each ground mating end 172 can be constructed as a receptacle ground mating end that defines a bent, such as curved, tip 180 that can define a free end of the ground mating end. At least a portion of the curved tip 180 can be offset with respect to the ground mounting end 174 along the lateral direction. For instance, the tip 180 can flare outward along the lateral direction A as it extends along the mating direction, and then inward along the lateral direction A as it further extends along the mating direction. The electrical contacts 150, and in particular the ground contact 154, can define an aperture 182 that extends through at least one or more, such as all, of the ground mating ends 172 along the lateral direction A. Thus, at least one or more up to all of the ground mating ends can define a respective one of the apertures 182 that extend into and through each of the broadsides 176. The apertures 182 can be sized and shaped as desired so as to control the amount of normal force exerted by the ground mating end 172 on a complementary electrical contact of a complementary electrical connector, for instance of the second electrical connector 200 as the ground mating end 172 mates with the complementary electrical contact. The apertures 182 can be constructed as slots that are elongate along the longitudinal direction L, whose opposed ends along the longitudinal direction L are rounded. The apertures 182 can extend from first a location that is spaced forward from the leadframe housing 168 along the longitudinal direction to a second location that is spaced rearward from the curved tip 180 along the longitudinal direction L. Thus, the apertures 182 can be fully enclosed and contained between the leadframe housing 168 and the curved tip 180. However it should be appreciated that the ground mating ends 172 can be alternatively constructed with any other suitable aperture geometry as desired, or with no aperture as desired.

Because the mating ends 156 of the signal contacts 152 and the ground mating ends 172 of the ground plate 168 are provided as receptacle mating ends and receptacle ground mating ends, respectively, the first electrical connector 100 can be referred to as a receptacle connector as illustrated. The ground mounting ends 174 can be constructed as described above with respect to the mounting ends 158 of the signal contacts 152. In accordance with the illustrated embodiment, each leadframe assembly 130 can include a ground plate 168 that defines five ground mating ends 172 and nine signal contacts 152. The nine signal contacts 152 can include four pairs 166 of signal contacts 152 configured as edge-coupled differential signal pairs, with the ninth signal contact 152 reserved as the single widow contact 152*a* as described above. The mating ends 156 of the electrical signal contacts 152 of each differential signal pair can be disposed between successive ground mating ends 172, and single widow contact 152*a* can be disposed adjacent one of the ground mating ends 172 at the end of the column. It should be appreciated, of course, that each leadframe assembly 130 can include as many signal contacts 152 and as many ground mating ends 172 as desired. In accordance with one embodiment, each leadframe assembly can include an odd number of signal contacts 152.

The ground mating ends 172 and the mating ends 156 of the signal contacts 152 of each leadframe assembly 130 can be aligned along the column direction in the linear array 151. One or more up to all of adjacent differential signal pairs 166 can be separated from each other along the transverse direction T by a gap 159. Otherwise stated, the electrical signal contacts 152 as supported by the leadframe housing 132 can define a gap 159 disposed between adjacent differential signal pairs 166. The ground mating ends 172 are configured to be disposed in the gap 159 between the mating ends 156 of the electrical signal contacts 152 of each differential signal pair 166. Similarly, the ground mounting ends 174 are configured to be disposed in the gap 159 between the mounting ends 158 of the electrical signal contacts 152 of each differential signal pair 166 when the ground plate 168 is attached to the leadframe housing 132.

Each leadframe assembly 130 can further include an engagement assembly that is configured to attach the ground plate 168 to the leadframe housing 132. For instance, the engagement assembly can include at least one engagement member of the ground plate 168, supported by the ground plate body 170, and a complementary at least one engagement member of the leadframe housing 132. The engagement member of the ground plate 168 is configured to attach to the engagement member of the leadframe housing 132 so as to secure the ground plate 168 to the leadframe housing 132. In accordance with the illustrated embodiment, the engagement member of the ground plate 168 can be configured as an aperture 169 that extends through the ground plate body 170 along the lateral direction A. The apertures 169 can be aligned with, and disposed between the ground mating ends 172 and the ground mounting ends 174 along the longitudinal direction L.

The leadframe housing 132 can include a leadframe housing body 157, and the engagement member of the leadframe housing 132 can be configured as a protrusion 193 that can extend out from the housing body 157 along the lateral direction A. At least a portion of the protrusion 193 can define a cross-sectional dimension along a select direction that is substantially equal to or slightly greater than a cross-sectional dimension of the aperture 169 of the ground plate 168 to be attached to the leadframe housing 132. Accordingly, the at least a portion of the protrusion 193 can extend through the aperture 169 and can be press fit into the aperture 169 so as to attach the ground plate 168 to the leadframe housing 132. The electrical signal contacts 152 can reside in channels of the leadframe housing 132 that extend to a front surface of the leadframe housing body 157 along the longitudinal direction L, such that the mating ends 156 extend forward from the front surface of the leadframe housing body 157 of the leadframe housing 132.

The leadframe housing 132 can define a recessed region 195 that extends into the leadframe housing body 157 along the lateral direction A. For instance, the recessed region 195 can extend into a first surface and terminate without extending through a second surface that is opposite the first surface along the lateral direction A. Thus, the recessed region 195 can define a recessed surface 197 that is disposed between the first and second surfaces of the leadframe housing body 157 along the lateral direction A. The recessed surface 197 and the first surface of the leadframe housing body 157 can cooperate to define the external surface of the leadframe housing 132 that faces the ground plate 168 when the ground plate 168 is attached to the leadframe housing 132. The protrusions 193 can extend out from the recessed region 195, for instance from the recessed surface 197 along a direction away from the second surface and toward the first surface.

The leadframe assembly 130 can further include a lossy material, or magnetic absorbing material. For instance, the ground plate 168 can be made of any suitable electrically conductive metal, any suitable lossy material, or a combination of electrically conductive metal and lossy material. Thus, the ground plate 168 can be electrically conductive, and thus configured to reflect electromagnetic energy produced by the electrical signal contacts 152 during use, though it should be appreciated that the ground plate 168 can alternatively be configured to absorb electromagnetic energy. The lossy material can be any suitable magnetically absorbing material, and can be either electrically conductive or electrically nonconductive. For instance the ground plate 168 can be made from one or more ECCOSORB® absorber products, commercially available from Emerson & Cuming, located in Randolph, Mass. The ground plate 168 can alternatively be made from one or more SRC PolyIron® absorber products, commercially available from SRC Cables, Inc, located in Santa Rosa, Ca. Electrically conductive or electrically nonconductive lossy material can be coated, for instance injection molded, onto the opposed first and second plate body surfaces of the ground plate body 170 that carry the ribs 184 as described below with reference to FIGS. 3A-3B. Alternatively, electrically conductive or electrically nonconductive lossy material can be formed, for instance injection molded, to define a lossy ground plate body 170 of the type described herein. The ground mating ends 172 and the ground mounting ends 174 can be attached to the lossy ground plate body 170 so as to extend from the lossy ground plate body 170 as described herein. Alternatively, the lossy ground plate body 170 can be overmolded onto the ground mating ends 172 and the ground mounting ends 174. Alternatively still, when the lossy ground plate body 170 is nonconductive, the lossy ground plate 168 can be devoid of ground mating ends 172 and ground mounting ends 174.

With continuing reference to FIGS. 3A-B, at least a portion, such as a projection, of each of the plurality of ground plates 168 can be oriented out of plane with respect to the plate body 170. For example, the ground plate 168 can include at least one rib 184, such as a plurality of ribs 184 supported by the ground plate body 170. In accordance with the illustrated embodiment, each of the plurality of ribs 184 can be stamped or embossed into the plate body 170, and are thus integral and monolithic with the plate body 170. Thus, the ribs 184 can further be referred to as embossments. Accordingly, the ribs 184 can define projections that extend out from a first surface of plate body 170 along the lateral direction A, and can further define a plurality of recesses that extend into a second plate body surface opposite the first plate body surface along the lateral direction A. The ribs 184 define respective enclosed outer perimeters that are spaced from each other along the ground plate body 170. Thus, the ribs 184 are fully contained in the ground plate body 170.

The recessed regions 195 of the leadframe housing 132 can be configured to at least partially receive the ribs 184 when the ground plate 168 is attached to the leadframe housing 132. The ribs 184 can be spaced apart along the transverse direction T, such that each rib 184 is disposed between a respective one of the ground mating ends 172 and a corresponding one of the ground mounting ends 174 and is aligned with the corresponding ground mating and mounting ends 172 and 174 along the longitudinal direction L. The ribs 184 can be elongate along the longitudinal direction L between the ground mating ends 172 and the ground mounting ends 174.

The ribs 184 can extend from the ground plate body 170, for instance from the first surface of the plate body 170, a distance along the lateral direction A sufficient such that a portion of each rib 184 extends into a plane that is defined by at least a portion of the electrical signal contacts 152. The plane can be defined by the longitudinal and transverse directions L and T. For instance, a portion of each rib can define a flat that extends along a plane that is co-planar with a surface of the ground mating ends 172, and thus also with a surface of the mating ends 156 of the signal contacts 152 when the ground plate 168 is attached to the leadframe housing 132. Thus, an outermost surface of the ribs 184 that is outermost along the lateral direction A can be said to be aligned, along a plane that is defined by the longitudinal direction L and the transverse direction T, with respective outermost surfaces of the ground mating ends 172 and the mating ends 156 of the signal contacts 152 along the lateral direction A.

The ribs 184 are aligned with the gaps 159 along the longitudinal direction L, such that the ribs 184 can extend into the recessed region 195 of the leadframe housing 132, when the ground plate 168 is attached to the leadframe housing 132. In this respect, the ribs 184 can operate as ground contacts within the leadframe housing 132. It should be appreciated ground mating ends 172 and the ground mounting ends 174 can be positioned as desired on the ground plate 168, such that the ground plate 168 can be constructed for inclusion in the first or the second leadframe assembly 130*a-b* as described above. Further, while the ground contacts 154 can include the ground mating ends 172, the ground mounting ends 174, the ribs 184, and the ground plate body 170, it should be appreciated that the ground contacts 154 can comprise individual discrete ground contacts that each include a mating end, a mounting end, and a body that extends from the mating end to the mounting end in lieu of the ground plate 168. The apertures 169 that extend through the ground plate body 170 can extend through respective ones of the ribs 184, such that each rib 184 defines a corresponding one of the apertures 169. Thus, it can be said that the engagement members of the ground plate 168 are supported by respective ones of the ribs 184. Accordingly, the ground plate 168 can include at least one engagement member that is supported by a rib 184.

It should be appreciated that the leadframe assembly 130 is not limited to the illustrated ground contact 154 configuration. For example, in accordance with alternative embodiments the leadframe assembly 130 can include discrete ground contacts supported by the leadframe housing 132 as described above with respect to the electrical signal contacts 152. The ribs 184 can be alternatively constructed to contact the discrete ground contacts within the leadframe housing 132. Alternatively, the plate body 170 can be substantially flat and can be devoid of the ribs 184 or other embossments, and the discrete ground contacts can be otherwise electrically connected to the ground plate 168 or electrically isolated from the ground plate 168.

Figure 2A:
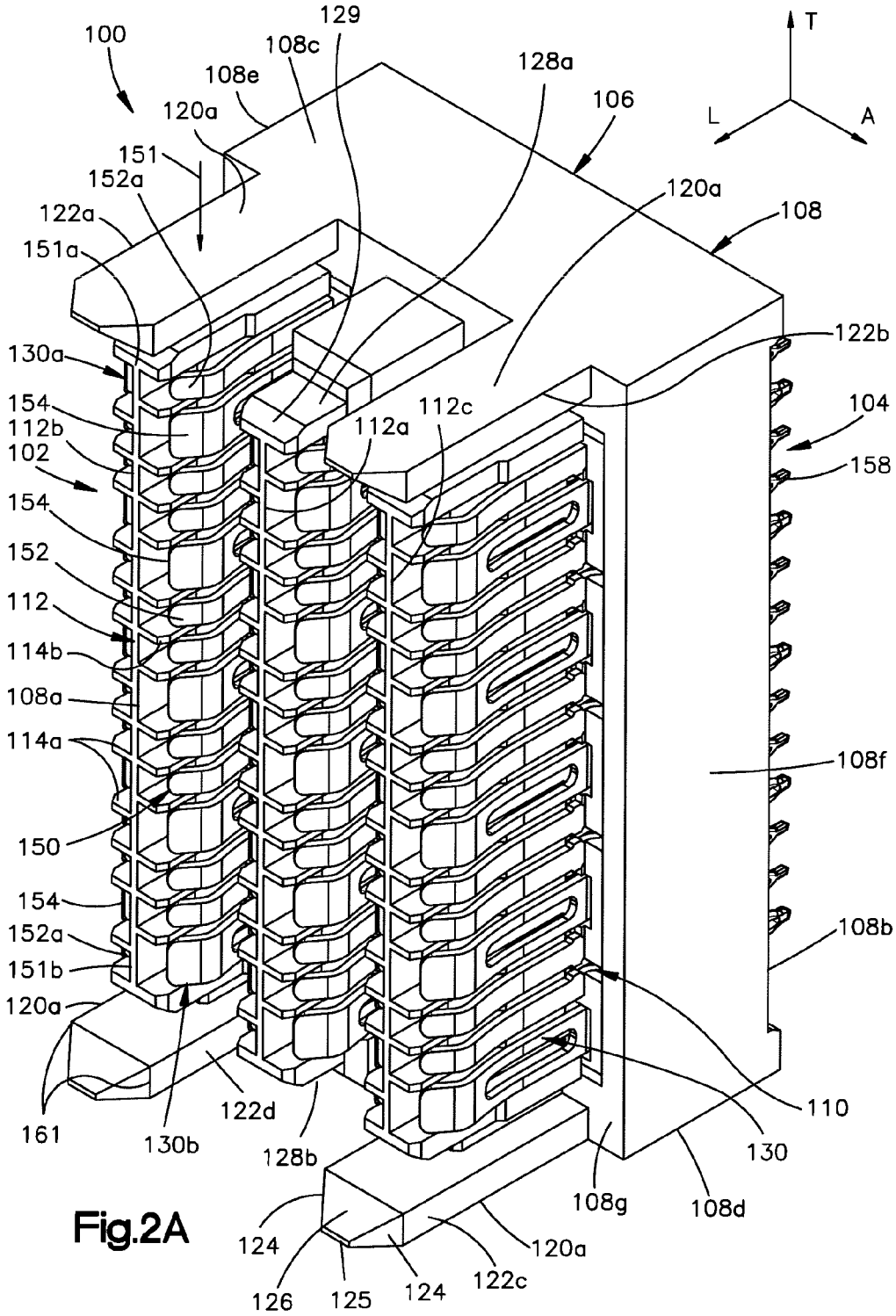
FIG. 2A is a perspective view of the first electrical connector illustrated in FIG. 1.
Figure 2B:
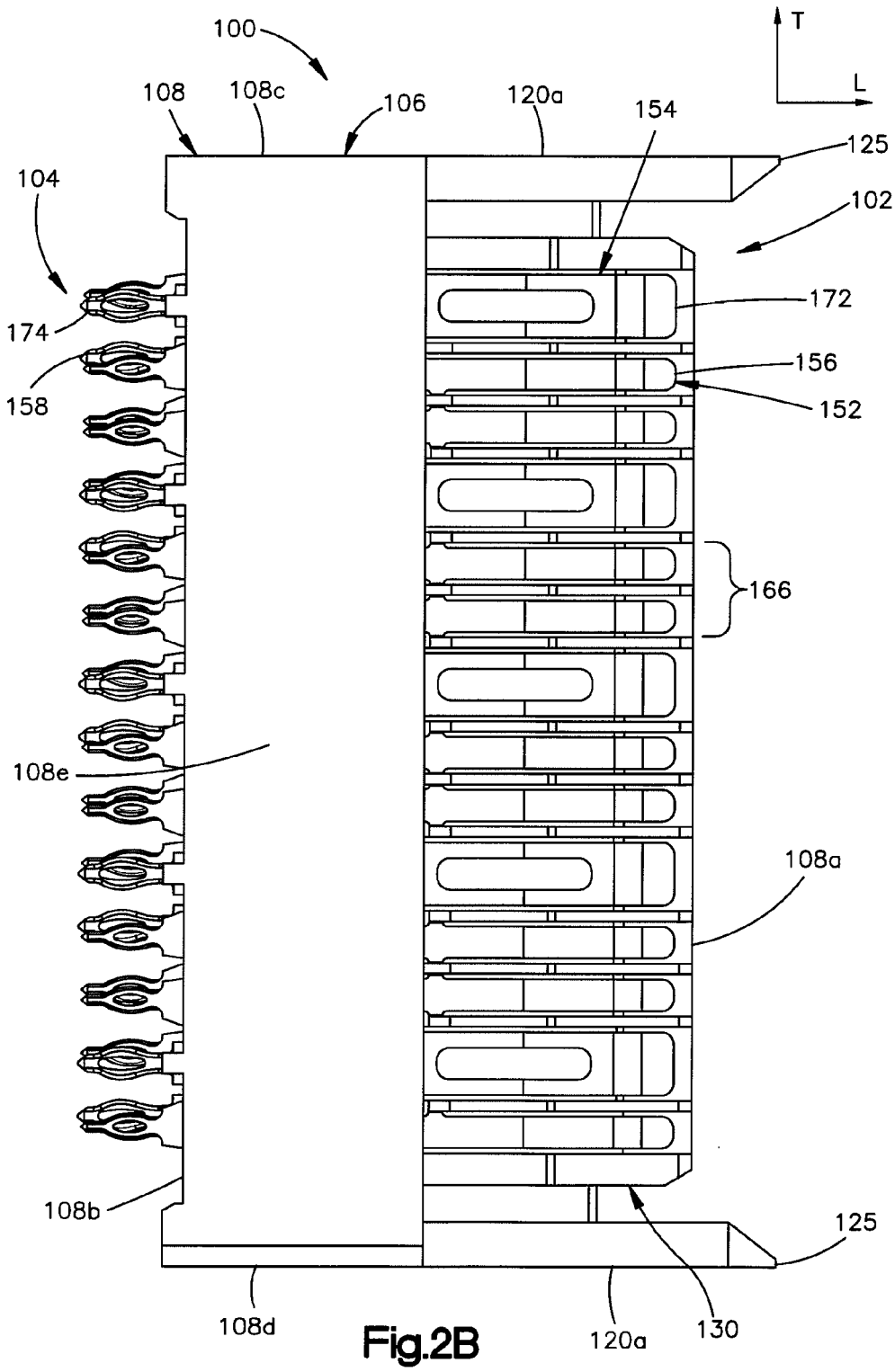
FIG. 2B is a side elevation view of the first electrical connector illustrated in FIG. 2A.
Figure 2C:
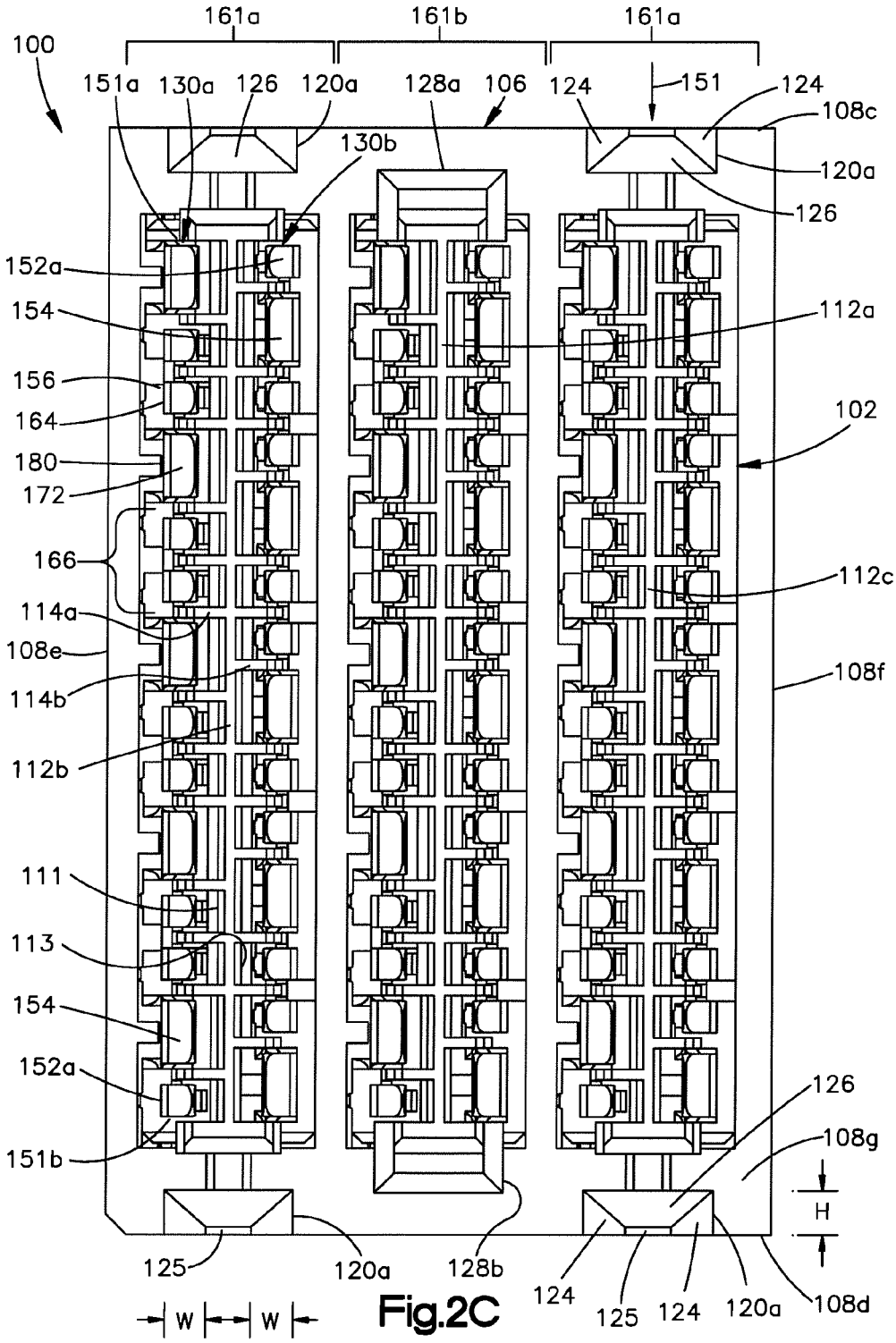
FIG. 2C is a front elevation view of the first electrical connector illustrated in FIG. 2A.

Referring now to FIGS. 2A-2C in particular, the connector housing 106 can include a housing body 108 that can be constructed of any suitable dielectric or electrically insulative material, such as plastic. The housing body 108 can define a front end 108*a*, an opposed rear end 108*b* that is spaced from the front end 108*a* along the longitudinal direction L, a top wall 108*c*, a bottom wall 108*d* that is spaced from the top wall 108*c* along the transverse direction T, and opposed first and second side walls 108*e* and 108*f* that are spaced from each other along the lateral direction A. The first and second side walls 108*e* and 108*f* can extend between the top and bottom walls 108*c* and 108*d*, for instance from the top wall 108*c* to the bottom wall 108*d*.

The housing body 108 can further define an abutment wall 108*g* that is configured to abut a complementary housing of complementary electrical connector, such as the second electrical connector 200, when the first electrical connector 100 is mated with the complementary electrical connector. The abutment wall 108*g* can be disposed at a location between the front and rear ends 108*a* and 108*b* of the housing body 108, respectively, and can thus be referred to as an intermediate surface (for instance, in embodiments where the wall 108*g* does not contact the other connector to which the electrical connector 100 is mated). The abutment wall 108*g* can extend between the first and second side walls 108*e* and 108*f*, and further between the top and bottom walls 108*c* and 108*d*, respectively. For instance, the abutment wall 108*g* can extend along a plane that is defined by the lateral direction A and the transverse direction T. Thus, at least a portion up to all of the abutment wall 108*g* can be disposed between the top and bottom walls 108*c* and 108*d* and first and second side walls 108*e* and 108*f*. The top and bottom walls 108*c* and 108*d* and the first and second side walls 108*e* and 108*f* can extend between the rear end 108*b* and the abutment wall 108*g*, for instance from the rear end 108*b* to the abutment wall 108*g*. The illustrated housing body 108 is constructed such that the mating interface 102 is spaced from the mounting interface 104 along the longitudinal direction L. The housing body 108 can further define a void 110 that is configured to receive the leadframe assemblies 130 that are supported by the connector housing 106. In accordance with the illustrated embodiment, the void 110 can be defined between the top and bottom walls 108*c* and 108*d*, the first and second side walls 108*e* and 108*f*, and the rear wall 108*b* and the abutment wall 108*g*.

The housing body 108 can further define at least one alignment member 120, such as a plurality of alignment members 120 that are configured to mate with complementary alignment members of the second electrical connector 200 so as to align components of the first and second electrical connectors 100 and 200 that are to be mated with each other as the first and second electrical connectors 100 and 200 are mated with each other. For instance, the at least one alignment member 120, such as the plurality of alignment members 120, are configured to mate with the complementary alignment members of the of the second electrical connector so as to align the mating ends of the electrical contacts 150 with the respective mating ends of the complementary electrical contacts of the second electrical connector 200 along the mating direction M. The alignment members 120 and the complementary alignment members can mate before the mating ends of the first electrical connector 100 contact the mating ends of the second electrical connector 200.

The plurality of alignment members 120 can include at least one first or gross alignment member 120*a*, such as a plurality of first alignment members 120*a* that are configured to mate with complementary first alignment members of the second electrical connector 200 so as to perform a preliminary, or first stage, of alignment that can be considered a gross alignment. Thus, the first alignment members 120*a* can be referred to as gross alignment members. The plurality of alignment members 120 can further include at least one second or fine alignment member 120*b* such as a plurality of second alignment members 120*b* that are configured to mate with complementary second alignment members of the second electrical connector 200, after the first alignment members 120 have mated, so as to perform a secondary, or second stage, of alignment that can be considered a fine alignment that is more precise alignment than the gross alignment. One or both of the first alignment members 120*a* or the second alignment members 120*b* can engage with complementary alignment members of the second electrical connector 200 before the electrical contacts 150 come into contact with respective complementary electrical contacts of the second electrical connector 200.

In accordance with the illustrated embodiment, the first or gross alignment members 120*a* can be configured as alignment beams, including a first alignment beam 122*a*, a second alignment beam 122*b*, a third alignment beam 122*c*, and a fourth alignment beam 122*d*. Thus, reference to the alignment beams 122*a-d* can apply to the gross alignment members 120*a*, unless otherwise indicated. The alignment beams 122*a-d* can be positioned such that a first, second, third, and fourth lines connected between centers of the first and second alignment beams 122*a-b*, centers of the second and third alignment beams 122*b-c*, centers of the third and fourth alignment beams 122*c-d*, and centers of the fourth and first alignment beams 122*d-a*, respectively, define a rectangle. The second and fourth lines can be longer than the first and third lines. Each of the alignment beams 122*a-d* can project outward, or forward along the mating direction, from the abutment wall 108*g* substantially along the longitudinal direction L to respective free ends 125. The ends 125 can be disposed outward with respect to the front end 108*a* of the housing body 108 in the forward longitudinal direction L, and thus the mating direction. Accordingly, it can be said that each of the alignment beams 122*a-d* project outward, such as forward, along the longitudinal direction L beyond the front end 108*a* of the housing body 108. Thus, the alignment beams 122*a-d* can further project outward, such as forward, along the longitudinal direction L with respect to the mating interface 102. The free ends 125 can all be in alignment with each other in a plane defined by the transverse direction T and the lateral direction A.

In accordance with the illustrated embodiment, the alignment beams 122*a-d* can be disposed at respective quadrants of the abutment wall 108*g*. For instance, the first alignment beam 122*a* can be disposed proximate to an interface between a plane that contains the first side wall 108*e*, and a plane that contains the top wall 108*c*. The second alignment beam 122*b* can be disposed proximate to an interface between the plane that contains the top wall 108*c* and a plane that contains the second side wall 108*f*. The third alignment beam 122*c* can be disposed proximate to an interface between the plane that contains the first side wall 108*e* and a plane that contains the bottom wall 108*d*. The fourth alignment beam 122*d* can be disposed proximate to an interface between the plane that contains the bottom wall 108*d* and the plane that contains the second side wall 108*f*.

Thus, the first beam 122*a* can be aligned with the second beam 122*b* along the lateral direction A, and aligned with the fourth beam 122*d* along the transverse direction T. The first beam 122*a* can be spaced from the third beam 122*c* along both the lateral A and transverse T directions. The second beam 122*b* can be aligned with the first beam 122*a* along the lateral direction A, and aligned with the third beam 122*c* along the transverse direction T. The second beam 122*b* can be spaced from the fourth beam 122*d* along both the lateral A and transverse T directions. The third beam 122*c* can be aligned with the fourth beam 122*d* along the lateral direction A, and aligned with the second beam 122*b* along the transverse direction T. The third beam 122*c* can be spaced from the first beam 122*a* along both the lateral A and transverse T directions. The fourth beam 122*d* can be aligned with the third beam 122*c* along the lateral direction A, and aligned with the first beam 122*a* along the transverse direction T. The fourth beam 122*d* can be spaced from the second beam 122*b* along both the lateral A and transverse T directions. Each of the beams 122*a-d* can extend substantially parallel to each other as they extend from the abutment wall 108*g* toward the free ends 125, or can alternatively converge or diverge with respect to one or more up to all of the other beams 122*a-d* as they extend out from the abutment wall 108*g* toward the free ends 125.

Each of the alignment beams 122*a-d* can define at least one first chamfered surface such as a pair of first chamfered surfaces 124 that are spaced from each other along the lateral direction A, and are tapered inwardly toward each other along the lateral direction A to the free end 115 as they extend forward along the mating direction. The pair of first chamfered surfaces 124 are configured to grossly align, or perform the first stage alignment of, the first and second electrical connectors 100 and 200 with respect to each other along the lateral direction A as the first and second electrical connectors 100 and 200 are mated with each other. Each of the alignment beams 122*a-d* can further define a second chamfered surface 126 that is configured to grossly align the first and second electrical connectors 100 and 200 with respect to each other along the transverse direction T as the first and second electrical connectors 100 and 200 are mated with each other. The second chamfered surface 126 can be disposed between each of the first chamfered surfaces 124 along an inner transverse surface of the respective alignment beams 122*a-d*. The second chamfered surfaces 126 can flare outward along the transverse direction toward the free end 125 as they extend forward along the mating direction.

As described above, the first electrical connector 100 can define as many leadframe assemblies 130 as desired, and thus as many pairs of first and second leadframe assemblies 130*a-b* as desired. As illustrated, the first electrical connector can include first and second outer pairs 161*a* of leadframe assemblies 130*a-b*, and at least one inner pair 161*b* of leadframe assemblies 130*a-b* between the outer pairs 161*a* with respect to the lateral direction A. While the first electrical connector 100 illustrates a single inner pair 161*b*, it should be appreciated that the first electrical connector can include a plurality of the inner pairs 161*b*. The pairs 161*a* and 161*b* can be spaced equidistantly from each other along the lateral direction A. The first and second leadframe assemblies 130*a* and 130*b* of a select one of the pairs 161*a* and 161*b* can be spaced apart a distance along the lateral direction A that can be equal to or different than, for instance greater or less than, the distance between one of the first and second leadframe assemblies of the select one of the pairs 161*a* and 161*b* from an immediately adjacent leadframe assembly of an immediately adjacent one of the pairs 161*a* and 161*b*. Thus, the second leadframe assembly 130*b* of the pair 161*b* is spaced from the first leadframe assembly 130*a* of the pair 161*b* a distance that can be equal to or less than the distance between the second leadframe assembly 130*b* of the pair 161*b* and the first leadframe assembly 130*a* of the pair 161*a* that is disposed immediately adjacent the second leadframe assembly 130*b* of the inner pair 161*b*. The first and fourth alignment beams 122*a* and 122*d* can be disposed on opposed sides of the first one of the outer pairs 161*a*, and can be aligned with at least one of the leadframe assemblies 130 of the first one of the outer pairs 161*a* along the transverse direction T. The second and third alignment beams 122*b* and 122*c* can be disposed on opposed sides of the second one of the outer pairs 161*a*, and can be aligned with at least one of the leadframe assemblies 130 of the second one of the outer pairs 161*a* along the transverse direction T.

Each of the pair of first chamfered surfaces 124 defines a respective width W along the lateral direction A and the second chamfered surface 126 defines a height H along the transverse direction T. In accordance with the illustrated embodiment, the sum of the widths W of the first chamfered surfaces 124 is greater than the height H of the second chamfered surface 126 of each alignment beam. Each of the alignment beams 122*a*-122*d* can be shaped the same so that the first electrical connector 100 can mate with the second electrical connector 200 in one of two different orientations. Alternatively, one or more of the alignment beams 122*a-d* can define at least one of a size or shape that differs from a corresponding size or shape of one or more of the others of the alignment beams 122*a-d*, such that the alignment beams 122*a* and 122*b* can operate as polarization members during that allow the first electrical connector 100 to mate with the second electrical connector 200 only when the first electrical connector 100 is in a predetermined orientation.

The housing body 108 can further define second or fine alignment members 120*b* in the form of fine alignment beams 128, for example first and second alignment beams 128*a* and 128*b*. Thus, reference to the alignment beams 128 can apply to the fine alignment members 120*b*, unless otherwise indicated. The alignment beams 128 can be configured to provide fine alignment, or second stage alignment, of the first and second electrical connectors 100 and 200 with respect to each other along the lateral direction A as the first and second electrical connectors 100 and 200 are mated with each other, so as to align the electrical contacts 150 with the complementary electrical contacts of the second electrical connector 200, for instance with respect to the lateral direction A and the transverse direction T. The alignment beams 128*a-b* can project outward from the abutment wall 108*g* forward substantially along the longitudinal direction L. The alignment beams 128*a-b* can terminate substantially at free ends 135, which can be disposed in substantial alignment with the front end 108*a* of the housing body 108 or at a location recessed rearward from the front end 108*a* along the longitudinal direction L, and thus between the front end 108*a* and the abutment wall 108*g*. In this regard, it can be said that the alignment beams 122*a-d* project further along the longitudinal direction L with respect to the abutment wall 108*g* than do the alignment beams 128*a-b*.

The alignment beams 128*a-b* can define at least one guide surface that can be configured to provide fine alignment, or second stage alignment, of the first and second electrical connectors 100 and 200 with respect to each other along the lateral direction A as the first and second electrical connectors 100 and 200 are mated with each other, so as to align the electrical contacts 150 with the complementary electrical contacts of the second electrical connector 200, for instance with respect to the lateral direction A and the transverse direction T. For instance, the alignment beams 128*a-b* can define at least one first chamfered guide surface such as a pair of first chamfered surfaces 131 that are spaced from each other along the lateral direction A, and are tapered inwardly toward each other along the lateral direction A to the free end 135 as they extend forward along the mating direction. The pair of first chamfered surfaces 131 are configured to provide fine alignment of the first and second electrical connectors 100 and 200 with respect to each other along the lateral direction A as the first and second electrical connectors 100 and 200 are mated with each other. The alignment beams 128*a-b* can further define a respective second guide surface 129 that can be disposed on the outer transverse surface of the respective alignment beam, and chamfered along the inner transverse direction T, that is toward the other alignment beam 128*a* and 128*b*, as the guide surface 129 extends along the mating direction. The guide surfaces 129 are configured to provide fine alignment of the first and second electrical connectors 100 and 200 with respect to each other along the lateral direction T as the first and second electrical connectors 100 and 200 are mated with each other.

In accordance with the illustrated embodiment, the first and second alignment beams 128*a* and 128*b* are spaced apart from each other, and substantially aligned with each other, along the transverse direction T. In accordance with the illustrated embodiment, the first and second alignment beams 128*a* and 128*b* can be disposed on opposed sides of the inner pair 161*b*, and can be aligned with at least one of the leadframe assemblies 130 of the inner pair 161*b* along the transverse direction T. It should be appreciated that the first electrical connector can include a pair of alignment beams 128 on opposed sides of one or more up to all inner pairs 161*b* of the electrical connector 100 as desired, for instance when the first electrical connector 100 includes a plurality of inner pairs 161*b* (e.g., greater than six leadframe assemblies, such as eight, ten, twelve, fourteen, or any suitable alternative number as desired). Thus, the first and second alignment beams 128*a* and 128*b* can be disposed substantially centrally between the first and second side walls 108*e* and 108*f*. The first alignment beam 128*a* can be disposed proximate to the top wall 108*c*, and the second alignment beam 128*b* can be disposed proximate to the bottom wall 108*d*, such that the first and second alignment beams 128*a-b* are spaced apart along the transverse direction T. Further in accordance with the illustrated the first and second alignment beams 122*a* and 122*b* can be angled toward each other.

With continuing reference to FIGS. 2A-2C, the housing body 108 can further define at least one divider wall 112, such as a plurality of divider walls 112 that are configured to at least partially enclose, and thereby protect, the electrical contacts 150 at the mating interface 102. Each of the divider walls 112 can extend forward from the abutment wall 108*g* along the longitudinal direction L between the abutment wall 108*g* and the front end 108*a* of the housing body 108, such as from the abutment wall 108*g* to the front end 108*a*. In this regard, it can be said that the at least one divider wall 112 can define the front end 108*a* of the housing body 108. Each of the divider walls 112 can further extend along the transverse direction T, and thus can lie in a respective plane that is defined by the longitudinal direction L and the transverse direction T. The divider walls 112 are spaced apart from each other along the lateral direction A, and located between the first and second side walls 108*e* and 108*f*. Each divider wall 112 can define a first side surface 111 and an opposed second side surface 113 that is spaced from the first side surface 111 along the lateral direction A and faces opposite the first side surface 111.

In accordance with the illustrated embodiment, the housing body 108 defines a plurality of divider walls 112, including a first divider wall 112*a*, a second divider wall 112*b*, and a third divider wall 112*c*. The first divider wall 112*a* extends between the first and second alignment beams 128*a* and 128*b*, the second divider wall 112*b* extends between the first and fourth alignment beams 122*a* and 122*d*, and the third divider wall 112*c* extends between the second and third alignment beams 122*b* and 122*c*.

As described above, the first electrical connector 100 can include a plurality of leadframe assemblies 130 that are disposed into the void 110 of the connector housing 106 and are spaced apart from each other along the lateral direction A. The leadframe assemblies 130 can include the first and second outer pairs 161*a* of immediately adjacent first and second respective leadframe assemblies 130*a-b*, and the at least one inner pair 161*b* of immediately adjacent first and second respective leadframe assemblies 130*a-b*. The tips 164 of the mating ends 156 of the signal contacts 152 and the tips 180 of the ground mating ends 172 of at least one up to all of the first leadframe assemblies 130*a* can be arranged in accordance with a first orientation wherein the tips 164 and 180 are curved and oriented toward the first side wall 108*e*, of the housing body 108 along a direction from the respective mounting ends to the respective mating ends, and thus are concave with respect to the first side wall 108*e*. The tips 164 of the mating ends 156 of the signal contacts 152 and the tips 180 of the ground mating ends 172 of at least one up to all of the second leadframe assemblies 130*b* can be arranged in accordance with a second orientation wherein the tips 164 and 180 are oriented toward the first side wall 108*e* of the housing body 108 along a direction from the respective mounting ends to the respective mating ends, and thus are concave with respect to the first side wall 108*e*. The first electrical connector 100 can be constructed with alternating first and second leadframe assemblies 130*a* and 130*b*, respectively, disposed in the connector housing 106 from left to right between the first side wall 108*e* and the second side wall 108*f* with respect to a front view of the first electrical connector 100.

Each of the divider walls 112 can be configured to at least partially enclose, and thereby protect, the mating ends 156 and ground mating ends 172 of respective ones of the electrical contacts 150 of two of the respective one of the columns of electrical contacts 150. For example, the mating ends 156 and ground mating ends 172 of the first leadframe assemblies 130*a* can be disposed adjacent the first surface 111 of the respective divider walls 112*a-c*, and can be spaced from the first surface 111 of the respective divider walls 112*a-c*. The mating ends 156 and ground mating ends 172 of the second leadframe assemblies 130 can be disposed adjacent the second surface 113 of the respective divider walls 112*a-c*, and can be spaced from the second surface 113 of the respective divider walls 112*a-c*. The divider walls 112 can thus operate to protect the electrical contacts 150, for example by preventing contact between electrical contacts 150 disposed in adjacent linear arrays 151.

The housing body 108, can be configured to at least partially enclose, and thereby protect, the electrical contacts 150 at the mating interface 102. For example, the housing body 108 can further define at least one rib 114, such as a plurality of ribs 114 that extend from a corresponding at least one of the divider walls 112 including a corresponding plurality of the divider walls 112 up to all of the divider walls 112 along the lateral direction A and are configured to be disposed between immediately adjacent ones of the electrical contacts 150 at their respective mating ends. For example one of the ribs 114 can be disposed between a respective one of the ground mating ends 172 and a respective one of the mating ends 156 of the electrical contacts 150 within a particular linear array 151, or can be disposed between the mating ends of respective ones of the electrical contacts 150 within a particular linear array, for instance between the mating ends 156 of a pair 166 of signal contacts 152. Thus, the connector housing 106 along each linear array 151 can include respective ribs 114 that extend out from the divider walls 112 between immediately adjacent ones of the mating ends of at least two up to all of the electrical contacts 150 of the linear array.

In accordance with the illustrated embodiment the housing body 108 can define a first plurality of ribs 114*a* that extend from the first surface 111 of the divider wall and a second plurality of ribs 114*b* that extend from the second surface 113 of the divider wall 112. Immediately adjacent ones of the ribs 114 that project from a common one of the first and second surfaces 111 and 113 can extend from the divider wall 112 so as to be spaced on opposite sides of a select one of the electrical contacts 150 along the transverse direction T, and can be spaced a distance along the transverse direction T a distance that is greater than the length of the respective broadsides of the select one of the electrical contacts 150. It should be appreciated that the broadsides can extend continuously from one of the opposed edges to the other of the opposed edges along an entirety of the length of the mating ends 156, such that each of the mating ends 156 are not bifurcated between the opposed edges. In accordance with one embodiment, each electrical signal contact 152 defines only one mating end 156 and only one mounting end 158. At least one or more of the ribs 114 can be disposed adjacent, and spaced from, the edges of immediately adjacent electrical contacts 150, wherein the edges face each other. It should thus be appreciated that the respective first and second surfaces 111 and 113 of each of the divider walls 112 can each define a base 141 that extends along the broadsides of the electrical contacts 150 along the transverse direction T of the first and second leadframe assemblies 130*a* and 130*b*, respectively, of a given pair 161. At least a portion of each of the bases 141 can be aligned with the tip of the respective electrical contact 150 along the lateral direction A. The housing body 108 can further define ribs 114 that extend out from opposed ends of the bases 141 of the divider walls 112 along a direction away from the divider walls 112, for instance along the lateral direction A at a location between the edges of the electrical contacts 150 of the first and second leadframe assemblies 130*a* and 130*b*, respectively, of a given one of the differential signal pairs 161.

The bases 141 of the divider walls 112 can be integral and monolithic with each other. It should be appreciated that the divider walls 112, including the bases 141 and the ribs 114, can extend along, and can be elongate along, three out of the four sides of the electrical contacts 150, such as both edges and one of the broadsides. The ribs 114 can extend along an entirety of the respective edges at the mating ends, or can terminate prior to extending along the entirety of the respective edges at the mating ends. Thus, it can be said that the divider walls 112 at least partially surround three sides of the electrical contacts 150, one of the three sides being oriented substantially perpendicular with respect to two others of the three sides. It can be further said that the divider walls 212, including the bases 141 and respective ribs 114, can define respective pockets that receive at least a portion of the electrical contacts 150, for instance at their mating ends. At least one or more up to all of the pockets can be sized so as to receive only a single one of the mating ends of the electrical contacts 150. As will be appreciated from the description below, as the electrical contacts 150 mate with the electrical contacts of the second electrical connector 200, the electrical contacts 150 flex such that the mating ends 156 of the electrical signal contacts 152 and the ground mating ends 172 are biased to move along the lateral direction A toward, but in one embodiment not against, the respective bases 141 of the divider walls 112. Thus, when mated, the mating ends 156 and 172 are disposed closer to the respective bases 141 as opposed to when not mated.

It should be appreciated that the tips 164 of the mating ends 156 of the signal contacts 152 and the tips 180 of the ground mating ends 172 can be concave with respect to the respective outer surface of the respective divider wall 112, for instance at the respective base 141. For instance, the electrical signal contacts 152 can define respective first or inner surfaces 153*a* that are concave with respect to the respective bases 141 and one of the side walls 108*e* and 108*f*, for instance at the mating ends 156, and in particular at the tips 164, as described above. Further, the inner surfaces 153*a* of the signal contacts 152 of first and second leadframe assemblies 130 that are arranged along respective first and second linear arrays 151 and disposed on opposite surfaces 111 and 113 of a common divider wall can be concave with respect to each other, even though they may be offset with respect to each other along their respective linear arrays. Thus, the inner surfaces 153*a* of the signal contacts 152 of the first linear array 151 can face the inner surfaces 153*a* of the signal contacts 152 of the second linear array 151. The electrical signal contacts 152 can further define respective second or outer surfaces 153*b* that can be convex and opposite the inner surfaces 153*a* along the lateral direction A. Similarly, the ground mating ends 172 can define respective first or inner surfaces 181*a* that are concave with respect to the respective bases 141 and one of the side walls 108*e* and 108*f*, for instance at the tips 180, as described above. Further, the inner surfaces 181*a* of the ground mating ends 172 of first and second leadframe assemblies 130 that are arranged along respective first and second linear arrays 151 and disposed on opposite surfaces 111 and 113 of a common divider wall can be concave with respect to each other. Thus, the inner surfaces 181*a* of the ground mating ends 172 of the first linear array 151 can face the inner surfaces 181*a* of the ground mating ends 172 of the second linear array 151. The ground mating ends 172 can further define respective second or outer surfaces 181*b* that can be concave and opposite the inner surfaces 181*a* along the lateral direction A. The inner surfaces 153*a* and 181*a* can define the first broadside surfaces, and the outer surfaces 153*b* and 181*b* can define the second broadside surfaces.

In accordance with the illustrated embodiment, the mating ends 156 of the signal contacts 152 of a first linear array adjacent the first surface 111 of the common divider wall can be mirror images of the signal contacts 152 of a second linear array that is immediately adjacent the first linear array, and adjacent the second surface 113 of the common divider wall, such that the common divider wall is disposed between the first and second linear arrays. The term "immediately adjacent" can mean that no linear arrays of electrical contacts are disposed between the first and second linear arrays. Furthermore, the ground mating ends 172 of the first linear array can be mirror images of the ground mating ends 172 of the second linear array. It should be appreciated that the mating ends can be mirror images even though they may be offset with respect to each other along the respective linear arrays, or the transverse direction T. Select ones of the mating ends 156 of the signal contacts 152, for instance at every third mating end of the electrical contacts 150 along the first and second linear arrays, can be mirror images with each other and aligned with each other along the lateral direction A.

It should be appreciated that the signal contacts 152 can be arranged in a plurality of linear arrays 151 as described above, including first, second, and third linear arrays 151 that are spaced from each other along the lateral direction A. The second linear array can be disposed between the first linear array. The first and second linear arrays 151 can be defined by the first and second leadframe assemblies 130*a-b*, respectively, and thus the concave inner surface 153*a* of the first linear array 151 can face the concave inner surfaces 153*a* of the second linear array 151. Furthermore, a select differential signal pair 166 of the second linear array 151 can define a victim differential signal pair that can be positioned adjacent aggressor differential signal pairs 166 that can be disposed adjacent the victim differential signal pair. For instance, ones of aggressor differential signal pairs 166 can be disposed along the second linear array and spaced from the victim differential signal pair along the transverse direction T. Furthermore, ones of aggressor differential signal pairs 166 can be disposed in the first linear array, and thus spaced from the victim differential signal pair 166 along one or both of the lateral direction A and the transverse direction T. Furthermore, ones of aggressor differential signal pairs 166 can be disposed in the third linear arrays 151, and thus spaced from the victim differential signal pair 166 along one or both of the lateral direction A and the transverse direction T. The differential signal contacts of all of the linear arrays, including the aggressor differential signal pairs, are configured to transfer differential signals between the respective mating ends and mounting ends at data transfer rates while producing produce no more than six percent asynchronous worst-case, multi-active cross talk on the victim differential signal pair. The data transfer rates can be between and include six-and-one-quarter gigabits per second (6.25 Gb/s) and approximately fifty gigabits per second (50 Gb/s) (including approximately fifteen gigabits per second (15 Gb/s), eighteen gigabits per second (18 Gb/s), twenty gigabits per second (20 Gb/s), twenty-five gigabits per second (25 Gb/s), thirty gigabits per second (30 Gb/s), and approximately forty gigabits per second (40 Gb/s)).

The edges of the electrical contacts 150 can also be spaced from the ribs 114 along the transverse direction T. Select ones of the first plurality of ribs 114*a* can thus be disposed between the respective ground mating ends 172 and an adjacent mating end 156 of one of the first leadframe assemblies 130*a*, and further between the mating ends 156 of each pair 166 of signal contacts 152 of the one first leadframe assemblies 130*a*. Select ones of the second plurality of ribs 114*b* can thus be disposed between the respective ground mating ends 172 and an adjacent mating end 156 of one of the second leadframe assemblies 130*b*, and further between the mating ends 156 of each pair 166 of signal contacts 152 of the one second leadframe assemblies 130*b*. The ribs 114 can operate to protect the electrical mating ends 156 and the ground mating ends 172, for example by preventing contact between the mating ends 156 and the ground mating ends 172 of the electrical contacts 150 within a respective linear array 151.

When the plurality of leadframe assemblies 130 are disposed in the connector housing 106 in accordance with the illustrated embodiment, the tips 164 of the signal contacts 152 and the tips 180 of the ground mating ends 172 of each of the plurality of electrical contacts 150 can be disposed in the connector housing 106 such that the tips 164 and 180 are recessed from the front end 108*a* of the housing body 108 with respect to the longitudinal direction L. In this regard, it can be said that the connector housing 106 extends beyond the tips 164 of the receptacle mating ends 156 of the signal contacts 152 and beyond the tips 180 of the receptacle ground mating ends 172 of the ground plate 168 along the mating direction. Thus, the front end 108*a* can protect the electrical contacts 150, for example by preventing contact between the tips 164 and 180 and objects disposed adjacent the front end 108*a* of the housing body 108.

Referring now to FIGS. 4A-5C, the second electrical connector 200 can include a dielectric, or electrically insulative connector housing 206 and a plurality of electrical contacts 250 that are supported by the connector housing 206. The plurality of electrical contacts 250 can be referred to as a second plurality of electrical contacts with respect to the electrical connector assembly 10. Each of the plurality of electrical contacts 250 can include a first plurality of signal contacts 252 and a first plurality of ground contacts 254.

The second electrical connector 200 can include a plurality of leadframe assemblies 230 that each include a dielectric, or electrically insulative, leadframe housing 232 and select ones of the plurality of electrical signal contacts 252 and at least one ground contact 254. In accordance with the illustrated embodiment, each leadframe assembly 230 includes a respective plurality of the signal contacts 252 that are supported by the leadframe housing 232 and a ground contact 254 that is supported by the leadframe housing 232. The ground contact 254 can be configured as a ground plate 268 that can be attached to the dielectric housing 232. The ground plate 268 can be electrically conductive. The leadframe assemblies 230 can be supported by the connector housing 206 such that they are spaced from each other along the row direction, which can define a lateral direction A that is substantially perpendicular to the longitudinal direction L. The electrical contacts 250 of each leadframe assembly 230 can be arranged along a column direction, which can be defined by the transverse direction T that is substantially perpendicular to both the longitudinal direction L and the lateral direction A.

The electrical signal contacts 252 can define respective mating ends 256 that extend along the mating interface 202, and mounting ends 258 that extend along the mounting interface 204. Each of the ground contacts 254 can define respective ground mating ends 272 that extend along the mating interface 202, and ground mounting ends 274 that extend along the mounting interface 204.

Thus, it can be said that the electrical contacts 250 can define mating ends, which can include the mating ends 256 of the electrical signal contacts 252 and the ground mating ends 272, and the electrical contacts 250 can further define mounting ends, which can include the mounting ends 258 of the electrical signal contacts 252 and the ground mounting ends 274. As will be appreciated from the description below, each ground contact 254, including the ground mating ends 272 and the ground mounting ends 274, can be defined by the ground plate 268 of the respective leadframe assembly 230. Alternatively, the ground mating ends 272 and ground mounting ends 274 can be defined by individual ground contacts as desired.

The electrical contacts 250, including the electrical signal contacts 252, can be constructed as right-angle contacts, whereby the mating ends 256 and the mounting ends 258 are oriented substantially perpendicular to each other. Alternatively, the electrical contacts 250, including the signal contacts 252, can be constructed as vertical contacts, for instance when the second electrical connector 200 is configured as a vertical connector, whereby the mating ends 256 and the mounting ends 258 are oriented substantially parallel with each other. The mounting ends 258 and the ground mounting ends 274 can be provided as press-fit tails, surface mount tails, fusible elements such as solder balls, or combinations thereof, which are configured to electrically connect to a complementary electrical component such as the second substrate 300*b*.

Each signal contact 252 can define a pair of opposed broadsides 260 and a pair of opposed edges 262 that extend between the opposed broadsides 260. Each of the opposed broadsides 260 can be spaced apart from each other along the lateral direction A, and thus the row direction, a first distance. Each of the opposed edges 262 can be spaced apart from each other along a transverse direction T, and thus a column direction, a second distance that is greater than the first distance. Thus, the broadsides 260 can define a length between the opposed edges 262 along the transverse direction T, and the edges 262 can define a length between the opposed broadsides along the lateral direction A. Otherwise stated, the edges 262 and the broadsides 260 can define respective lengths in a plane that is oriented substantially perpendicular to both the edges 262 and the broadsides 260. The length of the broadsides 260 is greater than the length of the edges 262.

The electrical contacts 250 can be arranged such that adjacent ones of the electrical signal contacts 252 along the column direction can define pairs 266. Each pair 266 of electrical signal contacts 252 can define a differential signal pair 266. Further, one of the edges 262 of each electrical signal contacts 252 of each pair 266 can face one of the edges 262 of the other electrical signal contact 252 of the respective pair 266. Thus, the pairs 266 can be referred to as edge-coupled differential signal pairs. The electrical contacts 250 can include a ground mating end 272 that is disposed between the mating ends 256 of immediately adjacent pairs 266 of electrical signal contacts 252 along the column direction. The electrical contacts 250 can include a ground mounting end 274 that is disposed between the mounting ends 258 of immediately adjacent pairs 266 of electrical signal contacts 252 along the column direction. Immediately adjacent can refer to the fact that there are no additional differential signal pairs, or signal contacts, between the immediately adjacent differential signal pairs 266.

It should be appreciated that the electrical contacts 250, including the mating ends 256 of the electrical signal contacts 252 and the ground mating ends 272, can be spaced from each other along a linear array 251 of the electrical contacts 250 that extends along the column direction. The linear array 251 can be defined by the respective leadframe assembly 130. For instance, the electrical contacts 250 can be spaced from each other along in a first direction, such as the column direction, along the linear array 251 from a first end 251*a* to a second end 251*b*, and a second direction that is opposite the first direction from the second end 251*b* to the first end 251*a* along the linear array. Both the first and second directions thus extend along the column direction. The electrical contacts 250, including the mating ends 256 and ground mating ends 272, and further including the mounting ends 258 and ground mounting ends 274, can define any repeating contact pattern as in each of the desired in the first direction, including S-S-G, G-S-S, S-G-S, or any suitable alternative contact pattern, where "S" represents an electrical signal and "G" represents a ground. Furthermore, the electrical contacts 250 of the leadframe assemblies 230 that are adjacent each other along the row direction can define different contact patterns.

In accordance with one embodiment, the leadframe assemblies 230 can be arranged in at least one or more pairs 261 of first and second leadframe assemblies 230*a* and 230*b*, respectively that are adjacent each other along the row direction. The first leadframe assembly 230*a* can define a first contact pattern in the first direction, and the second leadframe assembly 230*b* can define a second contact pattern in the first direction that is different than the first contact pattern of the first leadframe assembly. The second electrical connector can further include individual leadframe assemblies, such as first and second individual leadframe assemblies 230*c* and 230*d*, that are spaced from the pairs 261 of leadframe assemblies, such that the pairs of leadframe assemblies 261 are disposed between the first and second individual leadframe assemblies 230*c* and 230*d*. This, the individual leadframe assemblies 230*c* and 230*d* can be referred to as outer leadframe assemblies, and the leadframe assemblies 230 of the pairs of leadframe assemblies 261 can be referred to as inner leadframe assemblies. The second electrical connector can define equally or variably sized gaps 263 that are disposed between each of the immediately adjacent pairs 261 of leadframe assemblies 230 along the lateral direction A, and are also disposed between each of the individual leadframe assemblies 230*c* and 230*d* and their respective immediately adjacent pairs 261 of leadframe assemblies.

Each of the first and second linear arrays 251 can include a ground mating end 272 adjacent the mating ends 252 of every differential signal pair 266 of each of the respective linear array 251 along both the first and the second directions. Thus, the mating ends 252 of every differential signal pair 266 is flanked on opposite sides along the respective linear array by a respective ground mating end 272. Similarly, each of the first and second linear arrays 251 can include a ground mounting end 274 adjacent the mounting ends 254 of every differential signal pair 266 of each of the respective linear array 251 along both the first and the second directions. Thus, the mounting ends 254 of every differential signal pair 266 is flanked on opposite sides along the respective linear array by a respective ground mounting end 274.

For instance, the first leadframe assembly 230*a* can define a repeating contact pattern of G-S-S along the first direction, such that the last electrical contact 250 at the second end

251*b*, which can be the lowermost end, is a single widow contact 252*a* that can be overmolded by the leadframe housing or stitched into the leadframe housing as described with respect to the electrical signal contacts 152. The mating end 256 and the mounting end 258 of each of the single widow contacts 252*a* can be disposed adjacent a select one of the ground mating ends 272 and ground mounting ends 274 along the column direction, and is not disposed adjacent any other electrical contacts 250, including mating ends or mounting ends, along the column direction. Thus, the select one of the ground mating ends 272 and ground mounting ends 274 can be spaced from the respective single widow contact 252*a* in the first direction along the linear array 251. The second leadframe assembly 230*b* can define a repeating contact pattern of G-S-S along the second direction, such that the last electrical contact 250 at the first end 251*a*, which can be an uppermost end, of the linear array is a single widow contact 252*a*. The single widow contact 252*a* of the second leadframe assembly 230*b* can be disposed adjacent a select ground mating end 272 and ground mounting end 274 along the column direction, and is not disposed adjacent any other electrical contacts 250, including mating ends and mounting ends, along the column direction. Thus, the select one of the ground mating ends 272 and ground mounting ends 274 can be spaced from the single widow contact 252*a* in the second direction along the linear array. Thus, the position of the single widow contacts 252*a* can alternate from the first end 251*a* of a respective first linear array 251 to the second opposed end 251*b* of a respective second linear array 251 that is immediately adjacent the first linear array and oriented parallel to the first linear array. The single widow contacts 252*a* can be single-ended signal contacts, low speed or low frequency signal contacts, power contacts, ground contacts, or some other utility contacts.

In accordance with the illustrated embodiment, the mating ends 256 of the signal contacts 252 and the ground mating ends 272 can be aligned along the linear array 251, and thus along the transverse direction T, at the mating interface 202. Further, the mounting ends 258 of the signal contacts 252 and the ground mounting ends 274 can be aligned along the longitudinal direction L at the mounting interface 204. The mounting ends 258 of the signal contacts 252 and the ground mounting ends 274 can be spaced apart from each other along the longitudinal direction L at the mounting interface 204 so as to define a constant contact pitch along the linear array or a plane that includes the linear array. That is, the center-to-center distance between adjacent mounting ends of the electrical contacts 250 can be constant along the linear array 251. Thus, the electrical contacts 250 can define first, second, and third mounting ends, whereby both the first and the third mounting ends are immediately adjacent the second mating end. The electrical contacts 250 define respective centerlines that bifurcate that mating ends along the transverse direction T. The electrical contacts 250 define a first distance between the centerline of the first mating end and the centerline of the second mating end, and a second distance between the centerline of the second mating end and the centerline of the third mating end. The first distance can be equal to the second distance.

The mating ends 256 of the signal contacts 252 and the ground mating ends 272 can be spaced apart from each other along the transverse direction T at the mating interface 202 so as to define a variable contact pitch. That is, the center-to-center distance between adjacent mounting ends of the electrical contacts 250 can vary along the linear array 251. Thus, the electrical contacts 250 can define first second and third mating ends, whereby both the first and the third mating ends are immediately adjacent the second mating end. The electrical contacts 150 define respective centerlines that extend along the lateral direction A and bifurcate that mating ends along the transverse direction T. The electrical contacts 250 define a first distance between the centerline of the first mating end and the centerline of the second mating end, and a second distance between the centerline of the second mating end and the centerline of the third mating end. The second distance can be greater than the first distance.

The first and second mating ends and the first and second mounting ends can define the mating ends 256 and mounting ends 258 of respective first and second electrical signal contacts 252. The third mating end and mounting end can be defined by a ground mating end 272 and a ground mounting end 274, respectively. For instance, the ground mating end 272 can define a height along the transverse direction T that is greater than the height in the transverse direction of each of the electrical signal contacts 252 in the linear array 251. For instance, each ground mating end 272 can define a pair of opposed broadsides 276 and a pair of opposed edges 278 that extend between the opposed broadsides 276. Each of the opposed broadsides 276 can be spaced apart from each other along the lateral direction A, and thus the row direction, a first distance. Each of the opposed edges 278 can be spaced apart from each other along the transverse direction T, and thus the column direction, a second distance that is greater than the first distance. Thus, the broadsides 276 can define a length between the opposed edges 278 along the transverse direction T, and the edges 278 can define a length between the opposed broadsides 276 along the lateral direction A. Otherwise stated, the edges 278 and the broadsides 276 can define respective lengths in a plane that is oriented substantially perpendicular to both the edges 278 and the broadsides 276. The length of the broadsides 276 is greater than the length of the edges 278. Further, the length of the broadsides 276 is greater than the length of the broadsides 260 of the electrical signal contacts 252, in particular at the mating ends 256.

In accordance with one embodiment, immediately adjacent mating ends 256 of signal contacts 252, meaning that no other mating ends are between the immediately adjacent mating ends, define a contact pitch along the linear array 251 of approximately 1.0 mm. Mating ends 256 and ground mating ends 272 that are immediately adjacent each other along the linear array 251 define a contact patch along the linear array 251 of approximately 1.3 mm. Furthermore, the edges of immediately adjacent mating ends of the electrical contacts 150 can define a constant gap therebetween along the linear array 251. Immediately adjacent mounting ends of the electrical contacts can all be spaced from each other a constant distance, such as approximately 1.2 mm. Immediately adjacent mounting ends of the electrical contacts 150 along the linear array can define a substantially constant row pitch, for instance of approximately 1.2 mm. Accordingly, immediately adjacent mounting ends 258 of signal contacts 252 define a contact pitch along the linear array 251 of approximately 1.2 mm. Mounting ends 256 and ground mounting ends 274 that are immediately adjacent each other along the linear array 251 can also define a contact patch along the linear array 251 of approximately 1.2 mm. The ground mating ends 272 can define a distance along the respective linear array 251, and thus the transverse direction T, from edge to edge that is greater than a distance defined by each of the mating ends 256 of the signal contacts 252 along the respective linear array, and thus the transverse direction T, from edge to edge.

The second electrical connector 200 can include any suitable dielectric material, such as air or plastic, that isolates the signal contacts 252 from one another along either or both of the row direction and the column direction. The mounting ends 258 and the ground mounting ends 274 can be configured as press-fit tails, surface mount tails, or fusible elements such as solder balls, which are configured to electrically connect to a complementary electrical component such as the second substrate 300*b*. In this regard, the second substrate 300*b* can be configured as a daughtercard that is configured to be placed in electrical communication with a backplane, which can be defined by the first substrate 300*a*, such that the electrical connector assembly 10 can be referred to as a backplane electrical connector assembly in one embodiment.

As described above, the second electrical connector 200 is configured to mate with and unmate from the first electrical connector 100 along a first direction, which can define the longitudinal direction L. For instance, the second electrical connector 200 is configured to mate with the first electrical connector 100 along a longitudinally forward mating direction M, and can unmate from the second connector 200 along a longitudinally rearward unmating direction UM. Each of the leadframe assemblies 230 can be oriented along a plane defined by the first direction and a second direction, which can define the transverse direction T that extends substantially perpendicular to the first direction. The mating ends of the electrical contacts 150 of each leadframe assembly 130 are spaced from each other along the second or transverse direction T, which can define the column direction. The mounting ends of the electrical contacts 150 of each leadframe assembly 130 are spaced from each other along the longitudinal direction L. The leadframe assemblies 230 can be spaced along a third direction, which can define the lateral direction A, that extends substantially perpendicular to both the first and second directions, and can define the row direction R. As illustrated, the longitudinal direction L and the lateral direction A extend horizontally and the transverse direction T extends vertically, though it should be appreciated that these directions may change depending, for instance, on the orientation of the electrical connector assembly 10 during use. Unless otherwise specified herein, the terms "lateral," "longitudinal," and "transverse" are used to describe the orthogonal directional components of the components of the electrical connector assembly 10 being referred to.

Figure 5A:
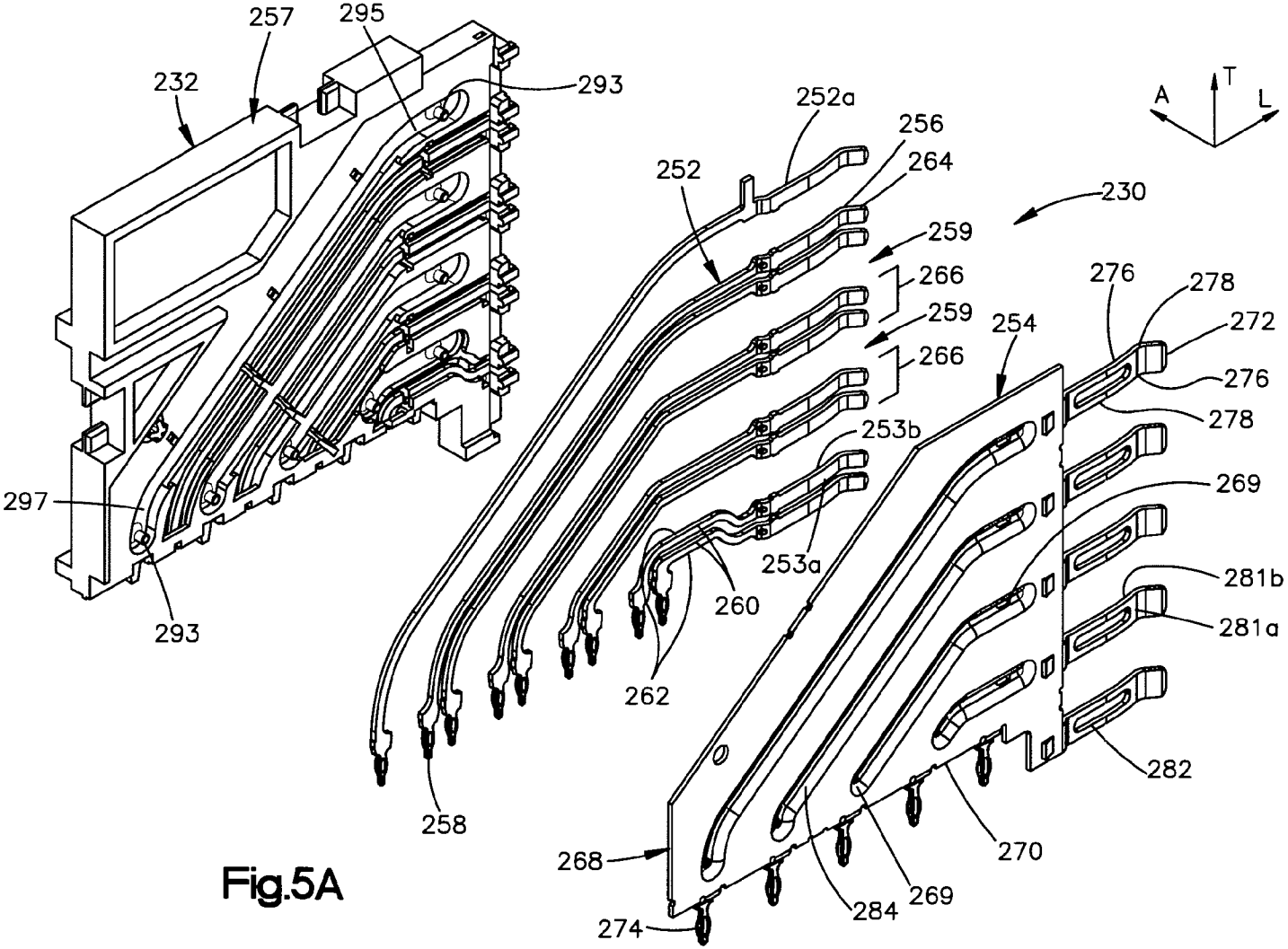
FIG. 5A is an exploded perspective view of a leadframe assembly of the second electrical connector illustrated in FIG. 4A.
Figure 5B:
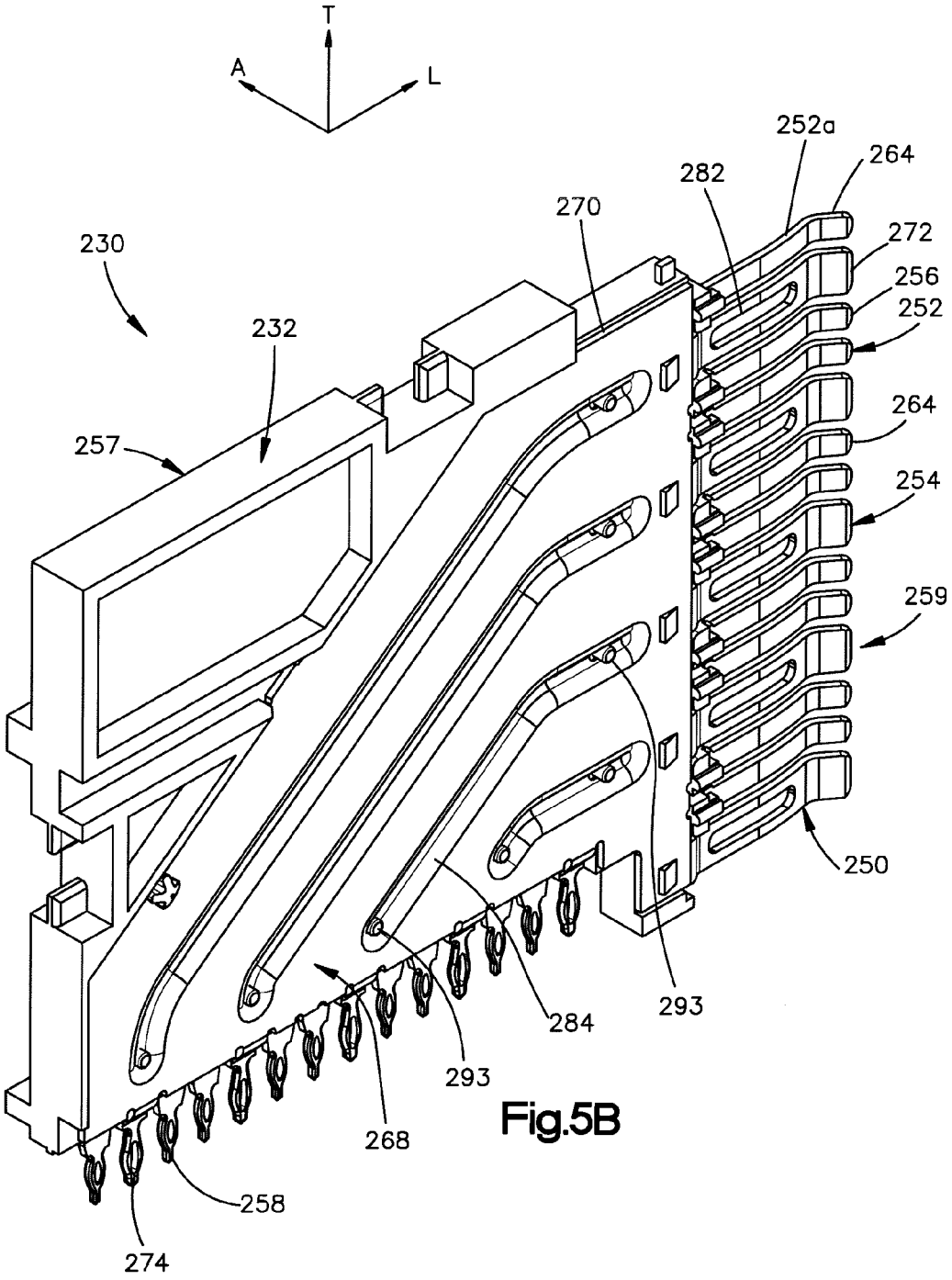
FIG. 5B is an assembled perspective view of the leadframe assembly illustrated in FIG. 5A.
Figure 5C:
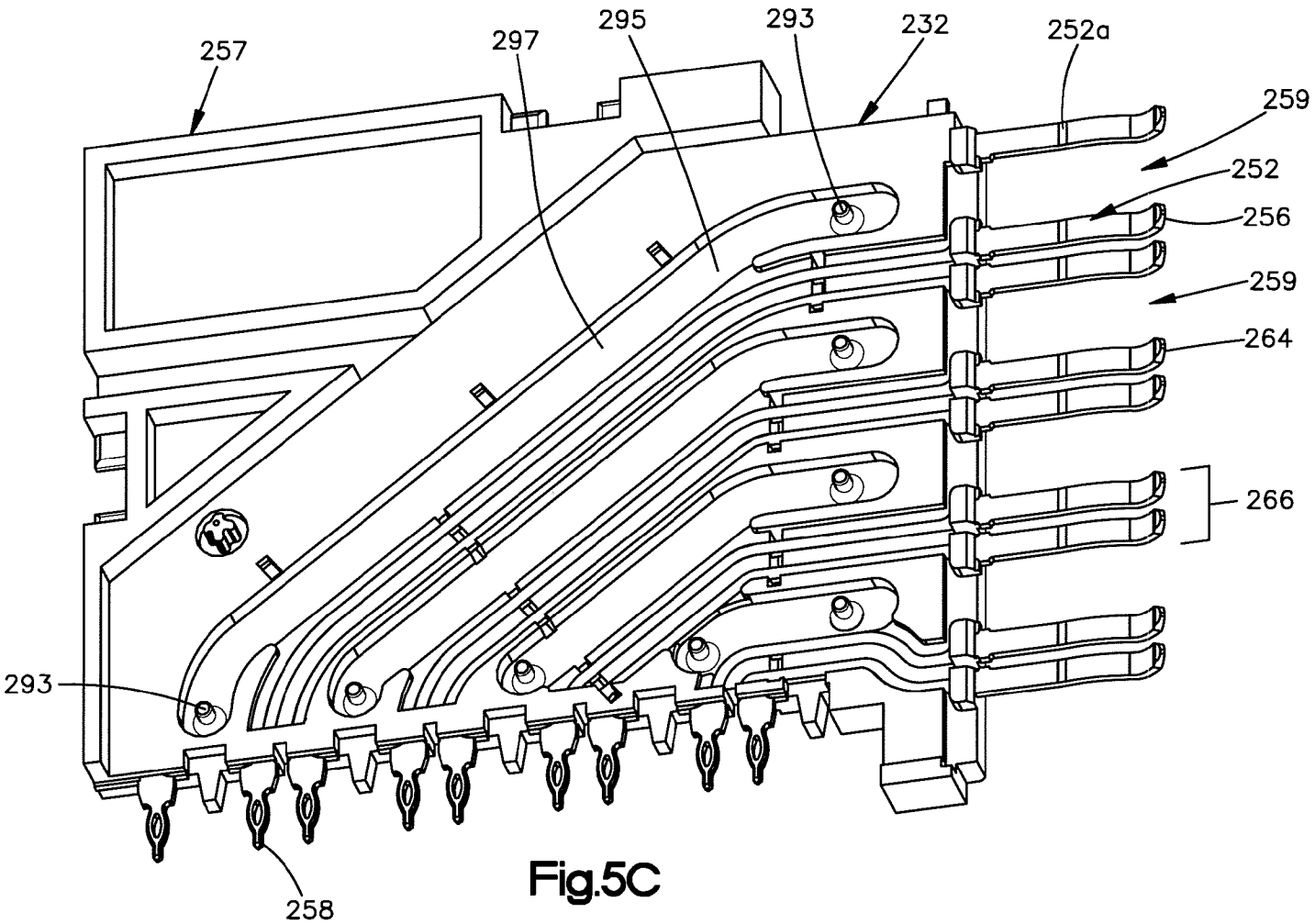
FIG. 5C is a perspective view of a portion of the leadframe assembly illustrated in FIG. 5A, showing a leadframe housing overmolded onto a plurality of signal contacts.

Referring now to FIGS. 5A-5C in particular, the second electrical connector 200 can include a plurality of leadframe assemblies 230 that are supported by the connector housing 206 and arranged along the row direction as described above. The second electrical connector 200 can include as many leadframe assemblies 230 as desired, such as six in accordance with the illustrated embodiment. In accordance with one embodiment, each leadframe assembly 230 can include a dielectric, or electrically insulative, leadframe housing 232 and a plurality of the electrical contacts 250 that are supported by the leadframe housing 232. In accordance with the illustrated embodiment, each leadframe assembly 230 includes a plurality of signal contacts 252 that are supported by the leadframe housing 232 and a ground contact 254 that can be configured as a ground plate 268.

The ground plate 268 includes a plate body 270 and a plurality of ground mating ends 272 that extend out from the plate body 270. For instance, the ground mating ends can extend forward from the plate body 270 along the longitudinal direction L. The ground mating ends 272 can thus be aligned along the transverse direction T and the linear array 251. The ground plate 268 further includes a plurality of ground mounting ends 274 that extend out from the plate body 270. For instance, the ground mounting ends 274 can extend down from the plate body 270, perpendicular to the ground mating ends 272, along the transverse direction T. Thus, the ground mating ends 272 and the ground mounting ends 274 can be oriented substantially perpendicular to each other. It should be appreciated, of course, that the ground plate 268 can be configured to attach to a vertical leadframe housing, such that the ground mating ends 272 and the ground mounting ends 274 are oriented substantially parallel with each other. The ground mating ends 272 can be configured to electrically connect to complementary ground mating ends of a complementary electrical connector, such as the ground mating ends 172 of the first electrical connector 100. The ground mounting ends 274 can be configured to electrically connect to electrical traces of a substrate, such as the second substrate 300*b*.

Each ground mating end 272 can be constructed as a flexible beam, which can also referred to as a receptacle ground mating end, that defines a bent, for instance curved, tip 280. At least a portion of the bent tip 280 can flare outward along the lateral direction A as it extends along the mating direction, and then inward along the lateral direction A as it further extends along the mating direction. The electrical contacts 250, and in particular the ground contact 254, can define an aperture 282 that extends through at least one or more, such as all, of the ground mating ends 272 along the lateral direction A. Thus, at least one or more up to all of the ground mating ends can define a respective one of the apertures 282 that extend into and through each of the broadsides 276. The apertures 282 can be sized and shaped as desired so as to control the amount of normal force exerted by the ground mating end 272 on a complementary electrical contact of a complementary electrical connector, for instance of the ground mating end 172 of the first electrical connector 100 as the ground mating end 272 mates with the complementary electrical contact. The apertures 282 can be constructed as slots that are elongate along the longitudinal direction L, whose opposed ends along the longitudinal direction L are rounded. The apertures 282 can extend from first a location that is spaced forward from the leadframe housing 268 along the longitudinal direction L to a second location that is spaced rearward from the curved tip 280 along the longitudinal direction L. Thus, the apertures 282 can be fully contained between the leadframe housing 268 and the curved tip 280. However it should be appreciated that the ground mating ends 272 can be alternatively constructed with any other suitable aperture geometry as desired, or with no aperture as desired.

Because the mating ends 256 of the signal contacts 252 and the ground mating ends 272 of the ground plate 268 are provided as receptacle mating ends and receptacle ground mating ends, respectively, the second electrical connector 200 can be referred to as a receptacle connector as illustrated. The ground mounting ends 274 can be constructed as described above with respect to the mounting ends 258 of the signal contacts 252. In accordance with the illustrated embodiment, each leadframe assembly 230 can include a ground plate 268 that defines five ground mating ends 272 and nine signal contacts 252. The nine signal contacts 252 can include four pairs 266 of signal contacts 252 configured as edge-coupled differential signal pairs, with the ninth signal contact 252 reserved as the single widow contact 252*a* as described above. The mating ends 256 of the electrical signal contacts 252 of each differential signal pair can be disposed between successive ground mating ends 272, and single widow contact 252*a* can be disposed adjacent one of the ground mating ends 272 at the end of the column. It should be appreciated, of course, that each leadframe assembly 230 can include as many signal contacts 252 and as many ground mating ends 272 as desired. In accordance with one embodiment, each leadframe assembly can include an odd number of signal contacts 252. The second electrical connector can have an equal number of leadframe assemblies 230, and an equal number of electrical contacts in each leadframe assembly 130, as those of the first electrical connector 100.

The ground mating ends 272 and the mating ends 256 of the signal contacts 252 of each leadframe assembly 230 can be aligned along the column direction in the linear array 251. One or more up to all of adjacent differential signal pairs 266 can be separated from each other along the transverse direction T by a gap 259. Otherwise stated, the electrical signal contacts 252 as supported by the leadframe housing 232 can define a gap 259 disposed between adjacent differential signal pairs 266. The ground mating ends 272 are configured to be disposed in the gap 259 between the mating ends 256 of the electrical signal contacts 252 of each differential signal pair 266. Similarly, the ground mounting ends 274 are configured to be disposed in the gap 259 between the mounting ends 258 of the electrical signal contacts 252 of each differential signal pair 266

Each leadframe assembly 230 can further include an engagement assembly that is configured to attach the ground plate 268 to the leadframe housing 232. For instance, the engagement assembly can include at least one engagement member of the ground plate 268, supported by the ground plate body 270, and a complementary at least one engagement member of the leadframe housing 232. The engagement member of the ground plate 268 is configured to attach to the engagement member of the leadframe housing 232 so as to secure the ground plate 268 to the leadframe housing 232. In accordance with the illustrated embodiment, the engagement member of the ground plate 268 can be configured as at least one aperture such as a plurality, including a pair, of aperture 269 that extend through the ground plate body 270 along the lateral direction A. The apertures 269 can be aligned with, and disposed between the ground mating ends 272 and the ground mounting ends 274.

The leadframe housing 232 can include a leadframe housing body 257, and the engagement member of the leadframe housing 232 can be configured as at least one protrusion 293, such as a plurality, including a pair, of protrusions 293 that can extend out from the housing body 257 along the lateral direction A. At least a portion of the protrusion 293 can define a cross-sectional dimension along a select direction that is substantially equal to or slightly greater than a cross-sectional dimension of the aperture 269 of the ground plate 268 to be attached to the leadframe housing 232. Accordingly, the at least a portion of the protrusion 293 can extend through the aperture 269 and can be press fit into the aperture 269 so as to attach the ground plate 268 to the leadframe housing 232. The electrical signal contacts 252 can reside in channels of the leadframe housing 232 that extend to a front surface of the leadframe housing body 257 along the longitudinal direction L, such that the mating ends 256 extend forward from the front surface of the leadframe housing body 257 of the leadframe housing 232.

The leadframe housing 232 can define a recessed region 295 that extends into the leadframe housing body 257 along the lateral direction A. For instance, the recessed region 295 can extend into a first surface and terminate without extending through a second surface that is opposite the first surface along the lateral direction A. Thus, the recessed region 295 can define a recessed surface 297 that is disposed between the first and second surfaces of the leadframe housing body 257 along the lateral direction A. The recessed surface 297 and the first surface of the leadframe housing body 257 can cooperate to define the external surface of the leadframe housing 232 that faces the ground plate 268 when the ground plate 268 is attached to the leadframe housing 232. The protrusions 293 can extend out from the recessed region 295, for instance from the recessed surface 297 along a direction away from the second surface and toward the first surface.

The leadframe assembly 230 can further include a lossy material, or magnetic absorbing material. For instance, the ground plate 268 can be made of any suitable electrically conductive metal, any suitable lossy material, or a combination of electrically conductive metal and lossy material. The ground plate 268 can be electrically conductive, and thus configured to reflect electromagnetic energy produced by the electrical signal contacts 252 during use, though it should be appreciated that the ground plate 268 could alternatively be configured to absorb electromagnetic energy. The lossy material can be magnetically lossy, and either electrically conductive or electrically nonconductive. For instance the ground plate 268 can be made from one or more ECCOSORB® absorber products, commercially available from Emerson & Cuming, located in Randolph, Mass. The ground plate 268 can alternatively be made from one or more SRC PolyIron® absorber products, commercially available from SRC Cables, Inc, located in Santa Rosa, Ca. Electrically conductive or electrically nonconductive lossy material can be coated, for instance injection molded, onto the opposed first and second plate body surfaces of the ground plate body 270 that carry the ribs 284 as described below with reference to FIGS. 5A-5C. Alternatively, electrically conductive or electrically nonconductive lossy material can be formed, for instance injection molded, to define a lossy ground plate body 270 constructed as described herein. The ground mating ends 272 and the ground mounting ends 274 can be attached to the lossy ground plate body 270 so as to extend from the lossy ground plate body 270 as described herein. Alternatively, the lossy ground plate body 270 can be overmolded onto the ground mating ends 272 and the ground mounting ends 274. Alternatively still, when the lossy ground plate body 270 is nonconductive, the lossy ground plate 268 can be devoid of ground mating ends 272 and ground mounting ends 274.

With continuing reference to FIGS. 5A-5C, at least a portion, such as a projection, of each of the plurality of ground plates 268 can be oriented out of plane with respect to the plate body 270. For example, the ground plate 268 can include at least one rib 284, such as a plurality of ribs 284 supported by the ground plate body 270. In accordance with the illustrated embodiment, each of the plurality of ribs 284 can be stamped or embossed into the plate body 270, and are thus integral and monolithic with the plate body 270. Thus, the ribs 284 can further be referred to as embossments. Accordingly, the ribs 284 can define projections that extend out from a first surface of plate body 270 along the lateral direction A, and can further define a plurality of recesses that extend into a second plate body surface opposite the first plate body surface along the lateral direction A. The ribs 284 define respective enclosed outer perimeters that are spaced from each other along the ground plate body 270. Thus, the ribs 284 are fully contained in the ground plate body 270. The ribs 284 can include a first and proximate to the mating interface 202 and a second end proximate to the mounting interface 204 that is substantially perpendicular with respect to the first end. The ribs 284 can be bent or otherwise curved between the first and second ends.

The recessed regions 295 of the leadframe housing 232 can be configured to at least partially receive the ribs 284 when the ground plate 268 is attached to the leadframe housing 232. The ribs 284 can be spaced apart along the transverse direction T, such that each rib 284 is disposed between a respective one of the ground mating ends 272 and a corresponding one of the ground mounting ends 274 and is aligned with the corresponding ground mating and mounting ends 272 and 274 along the longitudinal direction L. The ribs 284 can be elongate along the longitudinal direction L between the ground mating ends 272 and the ground mounting ends 274.

The ribs 284 can extend from the ground plate body 270, for instance from the first surface of the plate body 270, a distance along the lateral direction A sufficient such that a portion of each rib 284 extends into a plane that is defined by at least a portion of the electrical signal contacts 252. The plane can be defined by the longitudinal and transverse directions L and T. For instance, a portion of each rib can define a flat that extends along a plane that is co-planar with a surface of the ground mating ends 272, and thus also with a surface of the mating ends 256 of the signal contacts 252 when the ground plate 268 is attached to the leadframe housing 232. Thus, an outermost surface of the ribs 284 that is outermost along the lateral direction A can be said to be aligned, along a plane that is defined by the longitudinal direction L and the transverse direction T, with respective outermost surfaces of the ground mating ends 272 and the mating ends 256 of the signal contacts 252 along the lateral direction A The ribs 284 are aligned with the gaps 259 along the longitudinal direction L, such that the ribs 284 can extend into the recessed region 295 of the leadframe housing 232, when the ground plate 268 is attached to the leadframe housing 232. In this respect, the ribs 284 can operate as ground contacts within the leadframe housing 232. It should be appreciated ground mating ends 272 and the ground mounting ends 274 can be positioned as desired on the ground plate 268, such that the ground plate 268 can be constructed for inclusion in the first or the second leadframe assembly 230*a-b* as described above. Further, while the ground contacts 254 can include the ground mating ends 272, the ground mounting ends 274, the ribs 284, and the ground plate body 270, it should be appreciated that the ground contacts 254 can comprise individual discrete ground contacts that each include a mating end, a mounting end, and a body that extends from the mating end to the mounting end in lieu of the ground plate 268. The apertures 269 that extend through the ground plate body 270 can extend through respective ones of the ribs 284, such that each rib 284 defines a corresponding one of the apertures 269. Thus, it can be said that the engagement members of the ground plate 268 are supported by respective ones of the ribs 184. Accordingly, the ground plate 268 can include at least one engagement member that is supported by a rib 284.

It should be appreciated that the leadframe assembly 230 is not limited to the illustrated ground contact 254 configuration. For example, in accordance with alternative embodiments the leadframe assembly 230 can include discrete ground contacts supported by the leadframe housing 232 as described above with respect to the electrical signal contacts 252. The ribs 284 can be alternatively constructed to contact the discrete ground contacts within the leadframe housing 232. Alternatively, the plate body 270 can be substantially flat and can be devoid of the ribs 284 or other embossments, and the discrete ground contacts can be otherwise electrically connected to the ground plate 268 or electrically isolated from the ground plate 268.

Referring again to FIGS. 4A-4B in particular, the connector housing 206 can include a housing body 208 that can be constructed of any suitable dielectric or electrically insulative material, such as plastic. The housing body 208 can define a front end 208*a*, an opposed rear end 208*b* that is spaced from the front end 208*a* along the longitudinal direction L, a top wall 208*c*, a bottom wall 208*d* that is spaced from the top wall 208*c* along the transverse direction T, and opposed first and second side walls 208*e* and 208*f* that are spaced from each other along the lateral direction A. The first and second side walls 208*e* and 208*f* can extend between the top and bottom walls 208*c* and 208*d*, for instance from the top wall 208*c* to the bottom wall 208*d*. The first and second side walls 208*e* and 208*f* can further extend from the rear end 208*b* of the housing body 208 to the front end 208*a* of the housing body 208. As will be appreciated from the description below, each of the top and bottom walls 208*c* and 208*d* and the side walls 208*e* and 208*f* can define abutment surfaces, for instance at their front ends, that are configured to face or abut the abutment wall 108*g* of the first connector housing body 108.

The front end 208*a* of the housing body 208 can be configured to abut the abutment wall 108*g* of the first electrical connector 100 when the first and second electrical connectors 100 and 200 are mated. For example, in accordance with the illustrated embodiment, the front end 208*a* can lie in a plane that is defined by the lateral direction A and the transverse direction T. The illustrated housing body 208 is constructed such that the mating interface 202 is spaced forward with respect to the mounting interface 204 along the mating direction. The housing body 208 can further define a void 210, such that the leadframe assemblies 230 are disposed in the void 210 when they are supported by the connector housing 206. In accordance with the illustrated embodiment, the void 210 can be defined by the top and bottom walls 208*c* and 208*d*, and the first and second side walls 208*e* and 208*f*.

The second housing body 208 can further define at least one alignment member 220, such as a plurality of alignment members 220 that are configured to mate with the complementary alignment members 120 of the first electrical connector 100 so as to align components of the first and second electrical connectors 100 and 200 that are to be mated with each other as the first and second electrical connectors 100 and 200 are mated with each other. For instance, the at least one alignment member 220, such as the plurality of alignment members 220, are configured to mate with the complementary alignment members 120 of the of the first electrical connector 100 so as to align the mating ends of the electrical contacts 250 with respective mating ends of the complementary electrical contacts of the second electrical connector 200 along the mating direction M. The alignment members 220 and the complementary alignment members 120 can mate before the mating ends of the second electrical connector 200 contact the mating ends of the first electrical connector 100.

The plurality of alignment members 220 can include at least one first or gross alignment member 220*a*, such as a plurality of first alignment members 220*a* that are configured to mate with the complementary first alignment members 120*a* of the first electrical connector 100 so as to perform a preliminary, or first stage, of alignment that can be considered a gross alignment. Thus, the first alignment members 220*a* can be referred to as gross alignment members. The plurality of alignment members 220 can further include at least one second or fine alignment member 220*b* such as a plurality of second alignment members 220*b* that are configured to mate with the complementary second alignment members 120*a* of the first electrical connector 100, after the first alignment members 220*a* and 120*a* have mated, so as to perform a secondary, or second stage, of alignment that can be considered a fine alignment that is more precise alignment than the gross alignment. One or both of the first alignment members 220*a* or the second alignment members 220*b* can engage with the complementary first and second alignment members 120*a-b* of the first electrical connector 100 before the electrical contacts 250 come into contact with the respective complementary electrical contacts 150 of the first electrical connector 100.

In accordance with the illustrated embodiment, first or gross alignment members 220*a* can be configured as alignment recesses 222 that extend into the housing body 208. Thus, reference to the alignment recesses 222*a-d* can apply to the gross alignment members 220*a*, unless otherwise indicated. For instance, the second electrical connector can include a first recess 222*a* that is configured to receive the first alignment beam 122*a* of the first electrical connector 100, a second recess 222*b* that is configured to receive the second alignment beam 122*b* of the first electrical connector 100, a third recess 222*c* that is configured to receive the third alignment beam 122*c*, and a fourth recess 222*d* that is configured to receive the fourth alignment beam 122*d*.

In accordance with the illustrated embodiment, each of the first and second recesses 222*a* and 222*b*, respectively, extend into the top wall 208*c* of the housing body 208 along the inner transverse direction T to a floor 224 that defines an inner transverse boundary of the respective first and second recesses 222*a* and 222*b*. The housing body 208 can further define first and second side surfaces 225*a-b* that are spaced along the lateral direction A and extend out from the floor 224 along the transverse direction T. For instance, the side surfaces 225*a-b* can at least partially define the first and second recesses 222*a* and 222*b*, and can extend from the respective floor 224 to the top wall 208*c* along the transverse direction T. Each of the first and second recesses 222*a* and 222*b* can thus extend between the respective first and second side surfaces 225*a-b*. One or more up to all of the first and second side surfaces 225*a-b* and the floor 224 can be chamfered at an interface with the front end 208*a* of the housing body 208. The chamfers of each of the first and second side surfaces 225*a-b* can extend outward along the lateral direction A away from the other of the side surfaces 225*a-b* as the chamfers extend along the mating direction. The chamfers of the floor 224 can extend outward along the transverse direction away from the top wall 208*c* of the housing body 208 as the floor 224 extends along the mating direction. The housing body 208 further defines a rear wall 226 that is rearwardly recessed from the front end 208*a* of the housing body 208 along the longitudinal direction in the direction opposite the mating direction. The rear wall 226 can extend between the first and second side surfaces 225*a-b*, and further between the top wall 208*c* and the floor 224. Each of the first and second recesses 222*a* and 222*b* can extend from the front end 208*a* to the rear wall 226. Thus, each of the respective floor 224, the side surfaces 225*a-b*, and the rear wall 226 can at least partially define, and can cumulatively define, the corresponding ones of the first and second recesses 222*a* and 222*b*, respectively. Furthermore, each of the first and second recesses 222*a* and 222*b* can define a slot 227 that extends rearward from the front end 208*a* through the floor 224 and is configured to receive one of the divider walls 112, such as the third divider wall 112*c*, of the first electrical connector 100.

Further, in accordance with the illustrated embodiment, each of the third and fourth recesses 222*c* and 222*d*, respectively, extend into the bottom wall 208*d* of the housing body 208 along the inner transverse direction T to a floor 224 that defines an inner transverse boundary of the respective third and fourth recesses 222*c* and 222*d*. The housing body 208 can further define first and second side surfaces 225*a-b* that are spaced along the lateral direction A and extend out from the respective floor 224 to the bottom wall 208*d* along the transverse direction T. Each of the first and second recesses 222*a* and 222*b* can thus extend between the respective first and second side surfaces 225*a-b*. One or more up to all of the first and second side surfaces 225*a-b* and the floor 224 can be chamfered at an interface with the front end 208*a* of the housing body 208. The chamfers of each of the first and second side surfaces 225*a-b* can extend outward along the lateral direction A away from the other of the side surfaces 225*a-b* as the chamfers extend along the mating direction. The chamfers of the floor 224 can extend outward along the transverse direction T away from the bottom wall 208*d* of the housing body 208 as the floor 224 extends along the mating direction. The side surfaces 225*a-b* at least partially define the first and second recesses 222*a* and 222*b*, and can extend from the respective floor 224 to the bottom wall 208*d* along the transverse direction T. The housing body 208 further defines a rear wall 226 that is rearwardly recessed from the front end 208*a* of the housing body 208 along the longitudinal direction in the direction opposite the mating direction. The rear wall 226 can extend between the first and second side surfaces 225*a-b*, and further between the bottom wall 208*d* and the floor 224. Each of the second and third recesses 222*c* and 222*d* can extend from the front end 208*a* to the rear wall 226. Thus, each of the respective floor 224, the side surfaces 225*a-b*, and the rear wall 226 can at least partially define, and can cumulatively define, the corresponding ones of the second and third recesses 222*c* and 222*d*, respectively. Furthermore, each of the third and fourth recesses 222*c* and 222*d* can define a slot 227 that extends rearward from the front end 208*a* through the floor 224 and is configured to receive one of the divider walls 112, such as the third divider wall 112*c*, of the first electrical connector 100.

The recesses 222*a-d* can be positioned such that a first, second, third, and fourth lines connected between centers of the first and second recesses 222*a-b*, centers of the second and third recesses 222*b-c*, centers of the third and fourth recesses 222*c-d*, and centers of the fourth and first recesses 222*d-a*, respectively, define a rectangle. The second and fourth lines can be longer than the first and third lines. In accordance with the illustrated embodiment, the recesses 222*a-d* can be disposed at respective quadrants of the front end 208*a* of the housing body 208. For instance, the first recess 222*a* can be disposed proximate to an interface between a plane that contains the first side wall 208*e*, and a plane that contains the top wall 208*c*. The second recess 222*b* can be disposed proximate to an interface between the plane that contains the top wall 208*c* and a plane that contains the second side wall 208*f*. The third recess 222*c* can be disposed proximate to an interface between the plane that contains the second side wall 208*e* and a plane that contains the bottom wall 208*d*. The fourth recess 222*d* can be disposed proximate to an interface between the plane that contains the bottom wall 208*d* and the plane that contains the first side wall 208*f*.

Thus, the first recess 222*a* can be aligned with the second recess 222*b* along the lateral direction A, and aligned with the fourth recess 222*d* along the transverse direction T. The first recess 222*a* can be spaced from the third recess 222*c* along both the lateral A and transverse T directions. The second recess 222*b* can be aligned with the first recess 222*a* along the lateral direction A, and aligned with the third recess 222*c* along the transverse direction T. The second recess 222*b* can be spaced from the fourth recess 222*d* along both the lateral A and transverse T directions. The third recess 222*c* can be aligned with the fourth recess 222*d* along the lateral direction A, and aligned with the second recess 222*b* along the transverse direction T. The third recess 222*c* can be spaced from the first recess 222*a* along both the lateral A and transverse T directions. The fourth recess 222*d* can be aligned with the third recess 222*c* along the lateral direction A, and aligned with the first recess 222*a* along the transverse direction T. The fourth recess 222*d* can be spaced from the second recess 222*b* along both the lateral A and transverse T directions. Each of the recesses 222*a-d*, including the respective floor 224 and side surfaces 225*a-b*, can extend substantially parallel to each other from the front wall 208*a* as they extend into the front wall 208*a* toward the rear wall 226, or can alternatively converge or diverge with respect to one or more up to all of the other recesses 222*a-d* as they extend into the front wall 208*a* toward the rear wall 226.

Referring now to FIGS. 1-4B in general, when the first and second electrical connectors 100 and 200 are mated, the first and second chamfered surfaces 124 and 126 of the alignment beams 122*a-d* can ride along the chamfered surfaces of the side surfaces 225*a-b* and the floor 224, respectively, of the complementary recesses 222*a-d* so as to perform first stage alignment of the first and second electrical connectors 100 and 200 along the lateral direction A and the transverse direction T. As described above, first stage alignment of the first and second electrical connectors 100 and 200 can include at least partially aligning the first and second connector housings 106 and 206 and the respective electrical contacts 150 and 250 in at least one or both of the lateral direction A and the transverse direction T. For example, if the first and second electrical connectors 100 and 200 are misaligned with respect to each other along the lateral direction A when mating the first and second electrical connectors 100 and 200 to each other is initiated, the first chamfered surfaces 124 can engage with one or both of the chamfers of the side surfaces 225*a-b* to correct alignment of the first electrical connector 100 with respect to the second electrical connector 200 along the lateral direction A. Similarly, if the first and second electrical connectors 100 and 200 are misaligned with respect to each other along the transverse direction T when mating of the first and second electrical connectors 100 and 200 is initiated, the chamfered surfaces 126 can engage with the chamfer of the floors 224 to correct alignment of the first electrical connector 100 with respect to the second electrical connector 200 along the transverse direction T. Thus, the alignment beams 122*a-d* can be aligned with the complementary recesses 222*a-d* so as to be inserted into the complementary recesses 222*a-d* as the first and second electrical connectors 100 and 200 are mated with each other.

Referring again to FIGS. 4A-B, each of the recesses 222*a-d* can be sized and shaped the same as each of the other ones of the recesses 222*a-d*, or can differ in shape or size from one or more up to all of the recesses 222*a-d*, such that at least one of the recesses 222*a-d* can define a polarization member that allows each of the first and second connectors 100 and 200 to mate with the other when in a predetermined orientation with respect to the other. For example, the distance between the side surfaces 225*a-b* along the lateral direction A of one of the recesses 222*a-d* can differ with respect to another of the recesses 222*a-d*. It should be appreciated that the size and/or shape that can differ between the recesses 222*a-d* are not limited to the respective widths, and that any other suitable characteristics of the first and second recesses 222*a-d* can be differed such that the first and second recesses 222*a-d* can define polarization members.

As described above, the second electrical connector 200 can define as many leadframe assemblies 230 as desired, and thus as many pairs 261 of first and second leadframe assemblies 230*a-b* as desired, alone or in combination with the outer leadframe assemblies 130*c* and 130*d*. As illustrated, the first electrical connector can include at least one pair 261 such as a plurality of pairs 261, for instance a first pair 261*a* and a second pair 261*b*, that are disposed between the outer leadframe assemblies 230*a* and 230*b* with respect to the lateral direction A. For instance, the first pair 261*a* can be disposed adjacent the first outer leadframe assembly 230*c* and the second pair 261*b*, and the second pair 261*b* can be disposed between the second outer leadframe assembly 230*d* and the first pair 261*a*. The second electrical connector 200 can further define respective gaps 263 that extend along the lateral direction A, including a first gap 263*a* between the first outer leadframe assembly 230*c* and the first pair 261*a*, a second gap 263*b* between the first and second pairs 261*a* and 261*b*, and a third gap 263*c* between the second pair 261*b* and the second outer leadframe assembly 230*d*. The first and third gaps 263*a* and 263*c* can be referred to as outer gaps, and the second gap 263*b* can be referred to as an inner gap disposed between the outer gaps with respect to the lateral direction A. The first and fourth alignment members 220*a*, for instance the alignment recesses 222*a* and 222*d*, can be aligned with the first gap 263*a* such that the first gap 263*a* extends between the first and fourth alignment recesses 222*a* and 222*d*. The second and third alignment members 220*a*, for instance the alignment recesses 222*b* and 222*c*, can be aligned with the third gap 263*c*, such that the third gape 263*c* is disposed between the second and third alignment recesses 222*b* and 222*c*.

The alignment recesses 222*a-d* can be referred to as gross alignment recesses, and the housing body 208 can further define fine alignment members 220*b* in the form of fine alignment recesses 228, for example first and second alignment recesses 228*a* and 228*b* that define a pair, such as a first pair of second alignment recesses. Thus, reference to the alignment recesses 228 *d* can apply to the gross alignment recesses 222*a*, unless otherwise indicated. The first and second recesses 228*a* and 228*b* are disposed on opposed ends of the second gap 263*b*, such that the second gap 263*b* is disposed between the first and second recesses 228*a* and 228*b* along the transverse direction T. Thus, the recesses 228 can be disposed between respective pairs of the first recesses 222 with respect to the lateral direction A. The alignment recesses 228*a-b* can be configured to receive the alignment beams 128*a* and 128*b* so as to provide fine alignment, or second stage alignment, of the first and second electrical connectors 100 and 200 with respect to each other along the lateral direction A as the first and second electrical connectors 100 and 200 are mated with each other, so as to align the electrical contacts 150 with the complementary electrical contacts of the second electrical connector 200, for instance with respect to the lateral direction A and the transverse direction T.

The first fine alignment recess 228*a* can extend into the top wall 208*c* of the housing body 208 along the outer transverse direction T, opposite the inner transverse direction T, to a floor 239 that defines an outer transverse boundary of the first recess 228*a*. The housing body 208 can further define first and second side surfaces 245*a-b* that are spaced along the lateral direction A and extend in from the floor 239 along the transverse direction T. For instance, the side surfaces 245*a-b* can at least partially define the first recess 228*a*, and can extend from the respective floor 239 to the inner surface of the top wall 208*c* along the transverse direction T. The first recess 228*a* can thus extend between the respective first and second side surfaces 245*a-b*. One or more up to all of the first and second side surfaces 245*a-b* and the floor 239 can be chamfered at an interface with the front end 208*a* of the housing body 208 as desired. The housing body 208 further defines a rear surface 247 that is rearwardly recessed from the front end 208*a* of the housing body 208 along the longitudinal direction L in the direction opposite the mating direction. The rear surface 247 can extend between the first and second side surfaces 245*a-b*, and further between the top wall 208*c* and the floor 239. The first recess 222*a* can extend from the front end 208*a* to the rear surface 247. Thus, each of the respective floor 239, the side surfaces 245*a-b*, and the rear surface 247 can at least partially define, and can cumulatively define, the corresponding first recess 228*a*.

Similarly, the second fine alignment recess 228*b* can extend into the bottom wall 208*d* of the housing body 208 along the outer transverse direction T, opposite the inner transverse direction T, to a floor 239 that defines an outer transverse boundary of the second recess 228*b*. The housing body 208 can further define first and second side surfaces 245*a-b* that are spaced along the lateral direction A and extend in from the floor 239 along the transverse direction T. For instance, the side surfaces 245*a-b* can at least partially define the second recess 228*b*, and can extend from the respective floor 239 to the inner surface of the top wall 208*c* along the transverse direction T. The second recess 228*b* can thus extend between the respective first and second side surfaces 245*a-b*. One or more up to all of the first and second side surfaces 245*a-b* and the floor 239 can be chamfered at an interface with the front end 208*a* of the housing body 208 as desired. The housing body 208 further defines a rear surface 247 that is rearwardly recessed from the front end 208*a* of the housing body 208 along the longitudinal direction L in the direction opposite the mating direction. The rear surface 247 can extend between the first and second side surfaces 245*a-b*, and further between the top wall 208*c* and the floor 239. The first recess 222*a* can extend from the front end 208*a* to the rear surface 247. Thus, each of the respective floor 239, the side surfaces 245*a-b*, and the rear surface 247 can at least partially define, and can cumulatively define, the corresponding second recess 228*b*.

Referring now to FIGS. 1-4B generally, the first stage of alignment described above aligns the has been completed as described above, each of the first and second fine alignment recesses 228*a-b* are aligned to receive the complementary first and second fine alignment beams 128*a* and 128*b* so as to perform the second stage alignment of components of the first and second electrical connectors 100 and 200 along the lateral and transverse directions A and T as the first and second electrical connectors 100 and 200 are mated. Thus, as the first and second electrical connectors 100 and 200 are further mated along the mating direction M after first stage alignment, second stage alignment will be initiated by insertion of the alignment beams 128*a-b* in the respective alignment recesses 228*a-b*, thereby aligning the mating ends of the electrical contacts 150 and 250 to mate with each other as described in more detail below. It should be appreciated that 1) one or more up to all of the gross alignment members and one or more up to all of the fine alignment members of the first electrical connector 100 can define projections, such as beams, or recesses in the manner described above, and 2) one or more up to all of the gross alignment members and one or more up to all of the fine alignment members of the second electrical connector 200 can define projections, such as beams, or recesses in the manner described above, such that 3) the gross alignment members of the first and second electrical connectors 100 and 200 can mate with each other in the manner described above, and the fine alignment members of the first and second electrical connectors 100 and 200 can mate with each other in the manner described above.

Referring again to FIGS. 4A-B, the second housing body 208 can further define at least one divider wall 212, such as a plurality of divider walls 212 that are configured to at least partially enclose, and thereby protect, the electrical contacts 250 at the mating interface 202. Each of the divider walls 212 can extend rearward from the front end 208*a* of the housing body along the longitudinal direction L into the void 210, such as from the front end 208*a* toward the rear end 208*b*. In this regard, it can be said that the at least one divider wall 212 can define the front end 208*a* of the housing body 208. Each of the divider walls 212 can further extend along the transverse direction T between the top and bottom walls 208*c* and 208*d*, and thus can lie in a respective plane that is defined by the longitudinal direction L and the transverse direction T. The divider walls 212 are spaced apart from each other along the lateral direction A, and located between the first and second side walls 208*e* and 208*f*. Each divider wall 212 can define a first side surface 211 and an opposed second side surface 213 that is spaced from the first side surface 211 along the lateral direction A and faces opposite the first side surface 211 along the lateral direction A.

In accordance with the illustrated embodiment, the housing body 208 defines a plurality of divider walls 212, including a first divider wall 212*a* and a second divider wall 212*b*. The first and second divider walls 212*a* can be located between the first and second pairs of gross alignment recesses 228*a* with respect to the lateral direction A, and can extend between the top and bottom walls 208*c* and 208*d*. The first and second side walls 208*e* and 208*f* can further define respective third and fourth divider walls 212*c* and 212*d*. Thus, the third and fourth divider walls 212*c* and 212*d* can be referred to as outer divider walls, and the first and second divider walls 212*a* and 212*b* can be referred to as inner divider walls that are disposed between the outer divider walls. The second electrical connector 200 can be constructed such that pairs 261 of the first and second leadframe assemblies 230*a* and 230*b* can be disposed on opposed sides of at least one up to all of the divider walls, for instance of the inner divider walls. The second electrical connector 200 can be further constructed such that individual leadframe assemblies 230*c* and 230*d* can be disposed adjacent one side of at least one up to all of the divider walls, for instance of the outer divider walls.

As described above, the second electrical connector 200 can include a plurality of leadframe assemblies 230 that are disposed into the void 210 of the connector housing 206 and are spaced apart from each other along the lateral direction A. At least some up to all of the leadframe assemblies 230 can be arranged in respective pairs 261 of immediately adjacent first and second respective leadframe assemblies 230*a-b*. The leadframe assemblies 230 can further define the first outer leadframe assembly 230*c*, which can be disposed adjacent the first side wall 208*e* and can be constructed as described herein with respect to the first leadframe assemblies 230*a*. The leadframe assemblies 230 can further define the second outer leadframe assembly 230*d*, which can be disposed adjacent the second side wall 208*f* and can be constructed as described herein with respect to the second leadframe assemblies 230*b*.

The mating end 256 of each of the signal contacts 252 can be constructed as a receptacle mating end that defines a bent, for instance curved, distal tip 264 that can define a free end of the mating end 256. For example, the tip 264 can define a first portion that flares outward along the lateral direction A away from the respective surface of the divider wall 212 as the electrical signal contact 252 extends along the mating direction, and a second portion that extends inward from the first portion along the lateral direction A toward the respective surface of the divider wall 212 as the electrical signal contact 252 further extends along the mating direction. Similarly, the ground mating ends 272 can be constructed as a receptacle mating end that defines a bent, for instance curved, distal tip 280 that can define a free end of the ground mating ends 272. For example, the tip 280 can define a first portion that flares outward along the lateral direction A away from the respective surface of the divider wall 212 as the ground mating end 272 extends along the mating direction, and a second portion that extends inward from the first portion along the lateral direction A toward the respective surface of the divider wall 212 as the ground mating end 272 further extends along the mating direction.

Thus, the tips 264 of the mating ends 256 of the signal contacts 252 and the tips 280 of the ground mating ends 272 of at least one up to all of the first leadframe assemblies 230*a* can be arranged in accordance with a first orientation wherein the tips 264 and 280 are concave with respect to the second side wall 208*e* of the housing body 108 along the respective mating ends in a direction from the respective mounting ends to the respective mating ends, for instance along the ribs 284 from the ground mounting ends 274 to the ground mating ends 272. Thus, the tips 264 and 280 can be concave with respect to the second side wall 208*e*. The tips 264 of the mating ends 256 of the signal contacts 252 and the tips 280 of the ground mating ends 272 of at least one up to all of the second leadframe assemblies 230*b* can be arranged in accordance with a second orientation wherein the tips 264 and 280 are concave with respect to the first side wall 208*e* of the housing body 208. Thus, the tips 264 and 280 of the second leadframe assemblies 230*b* can be concave with respect to the first side wall 208*e*. The tips 264 of the mating ends 256 of the signal contacts 252 and the tips 280 of the ground mating ends 272 of at least one up to all of the second leadframe assemblies 130*b* can be arranged in accordance with a second orientation wherein the tips 264 and 280 are bent, for instance curved, toward the first side wall 208*e* of the housing body 208 along the respective mating ends in a direction from the respective mounting ends to the respective mating ends, for instance along the ribs 284 from the ground mounting ends 274 to the ground mating ends 272. The second electrical connector 200 can be constructed with alternating first and second leadframe assemblies 230*a* and 230*b*, respectively, disposed in the connector housing 206 from right to left between the first side wall 208*e* and the second side wall 208*f* from a front view of the second electrical connector 200.

Each of the divider walls 212 can be configured to at least partially enclose, and thereby protect, the mating ends 256 and ground mating ends 272 of respective ones of the electrical contacts 250 of two of the respective one of the columns of electrical contacts 250. For example, the mating ends 256 and ground mating ends 272 of the first leadframe assemblies 230*a* can be disposed adjacent the first surface 211 of the respective divider walls 212*a-c*, and can be spaced from the first surface 211 of the respective divider walls 212*a-c*. The mating ends 256 and ground mating ends 272 of the second leadframe assemblies 230 can be disposed adjacent the second surface 213 of the respective divider walls 212*a-c*, and can be spaced from the second surface 213 of the respective divider walls 212*a-c*. The divider walls 212 can thus operate to protect the electrical contacts 250, for example by preventing contact between electrical contacts 250 disposed in adjacent linear arrays 251.

The divider walls 212, and thus the housing body 208 can be further configured to at least partially enclose, and thereby protect, the electrical contacts 250 at the mating interface 202. For example, the housing body 208 can further define at least one rib 214, such as a plurality of ribs 214 that extend along the lateral direction A and are configured to be disposed between immediately adjacent ones of the electrical contacts 250 at their respective mating ends. For example one of the ribs 214 can be disposed between a respective one of the ground mating ends 272 and a respective one of the mating ends 256 of the electrical contacts 250 within a particular linear array 251, or can be disposed between the mating ends of respective ones of the electrical contacts 250 within a particular linear array, for instance between the mating ends 256 of a pair 266 of signal contacts 252. Thus, the connector housing 206 along each linear array 251 can include respective ribs 214 that extend out from the divider walls 212 between immediately adjacent ones of the mating ends of at least two up to all of the electrical contacts 250 of the linear array.

In accordance with the illustrated embodiment at least one divider wall 212, such as each divider wall 212 can define a plurality of ribs 214 that extend from at least one of a first surface 111 or a second surface 213, which can include both surfaces 211 and 213, of the divider wall 212. For instance, the first side wall 208*e* that defines the third divider wall 212*c* can further define a first surface 211 that faces the second surface 213 of the first divider wall 212*a* The second side wall 208*f* that defines the fourth divider wall 212*d* can further define a second surface 213 that faces the first surface 211 of the second divider wall 212*b*

The first, second, and third divider walls 212*a-c* can define respective first pluralities of ribs 214*a* that project out from the first side 211 of the divider wall along the lateral direction A. The first, second, and fourth divider walls 212*a*, 212*b*, and 212*d* can define respective second pluralities of ribs 214*b* that extend from the second side 213 of the divider wall. Immediately adjacent ones of the ribs 214 that project from a common side of the respective divider wall along the transverse direction T can extend from the divider wall 212 so as to be spaced on opposite sides of a select one of the electrical contacts 250, and can be spaced a distance along the transverse direction T that is greater than the length of the respective broadsides of the select one of the electrical contacts 250 between the opposed edges. It should be appreciated that the broadsides can extend continuously from one of the opposed edges to the other of the opposed edges along an entirety of the length of the mating ends 156, such that each of the mating ends 256 are not bifurcated between the opposed edges. In accordance with one embodiment, each electrical signal contact 152 defines only one mating end 156 and only one mounting end 158. At least one or more of the ribs 214 can be disposed adjacent, and spaced from, the edges of immediately adjacent electrical contacts 250, wherein the edges of the immediately adjacent electrical contacts 250 face each other.

It should thus be appreciated that the respective first and second surfaces 211 and 213 of each of the first and second divider walls 212*a-b* can each define a base 241 that extends along the broadsides of the electrical contacts 250 along the transverse direction T of the first and second leadframe assemblies 230*a* and 230*b*, respectively, of a given pair 261, and ribs 214 that project out along the lateral direction A from opposed ends of the bases 241 at a location between the edges of the electrical contacts 250 of the first and second leadframe assemblies 230*a* and 230*b*, respectively, of the given pair 261. It should be further appreciated that the respective first and second surfaces 211 and 213 of the third and fourth divider walls 212*c* and 212*d*, respectively, can each define a base 241 that extends along the broadsides of the electrical contacts 250 along the transverse direction T of the respective first and second leadframe assemblies 230*a* and 230*b*, respectively, and ribs 214 that extend out along the lateral direction A from opposed ends of the bases 241 at a location between the edges of the electrical contacts 250 of the first and second leadframe assemblies 230*a* and 230*b*, respectively. The opposed ends of the bases 241 can be spaced from each other along the transverse direction T.

The bases 241 of the divider walls 212 can be integral and monolithic with each other. It should be appreciated that the divider walls 212, including the bases 241 and the ribs 214, can extend along, and can be elongate along, three out of the four sides of the electrical contacts 250, such as both edges and one of the broadsides. The ribs 214 can extend along an entirety of the respective edges at the mating ends, or can terminate prior to extending along the entirety of the respective edges at the mating ends. Thus, it can be said that the divider walls 212 at least partially surround three sides of the electrical contacts 250, one of the three sides being oriented substantially perpendicular with respect to two of the others of the three sides. It can be further said that the divider walls 212, including the bases 241 and respective ribs 214, can define respective pockets that receive at least a portion of the electrical contacts 250, for instance at their mating ends. As will be appreciated from the description below, as the electrical contacts 250 mate with the electrical contacts of the second electrical connector 200, the electrical contacts 250 flex such that the mating ends 256 of the electrical signal contacts 252 and the ground mating ends 272 are biased to move along the lateral direction A toward, but in one embodiment not against, the respective bases 241 of the divider walls 214. Thus, when mated, the mating ends 256 and 272 are disposed closer to the respective bases 241 as opposed to when not mated. It should be appreciated that the tips 264 of the mating ends 256 of the signal contacts 252 and the tips 280 of the ground mating ends 272 can be concave with respect to the respective outer surface of the respective divider wall 212, for instance at the respective base 241.

For instance, the electrical signal contacts 252 can define respective first or inner surfaces 253*a* that are concave with respect to the respective bases 241 and one of the side walls 108*e* and 108*f*, for instance at the mating ends 256, and in particular at the tips 264, as described above. The electrical signal contacts 252 can further define respective second or outer surfaces 253*b* that can be convex and opposite the inner surfaces 253*a* along the lateral direction A. Similarly, the ground mating ends 272 can define respective first or inner surfaces 281*a* that are concave with respect to the respective bases 241 and one of the side walls 108*e* and 108*f*, for instance at the tips 280, as described above. The ground mating ends 272 can further define respective second or outer surfaces 281*b* that can be concave and opposite the inner surfaces 253*a* along the lateral direction A. The inner surfaces 253*a* and 181*a* can define the first broadside surfaces, and the outer surfaces 253*b* and 281*b* can define the second broadside surfaces. Further, the inner surfaces 253*a* of the signal contacts 252 of first and second leadframe assemblies 230 that are arranged along respective first and second linear arrays 251 and disposed on opposite surfaces 211 and 213 of a common divider wall 212 can be concave with respect to each other, even though they may be offset with respect to each other along their respective linear arrays. Thus, the inner surfaces 253*a* of the signal contacts 252 of the first linear array 251 can face the inner surfaces 253*a* of the signal contacts 252 of the second linear array 251. Further still, the inner surfaces 281*a* of the ground mating ends 272 of first and second leadframe assemblies 230 that are arranged along respective first and second linear arrays 251 and disposed on opposite surfaces 211 and 213 of a common divider wall can be concave with respect to each other. Thus, the inner surfaces 281*a* of the ground mating ends 272 of the first linear array 251 can face the inner surfaces 281*a* of the ground mating ends 272 of the second linear array 251.

In accordance with the illustrated embodiment, the mating ends 256 of the signal contacts 252 of a first linear array adjacent the first surface 211 of the common divider wall can be mirror images of the signal contacts 252 of a second linear array that is immediately adjacent the first linear array, and adjacent the second surface 213 of the common divider wall, such that the common divider wall is disposed between the first and second linear arrays. The term "immediately adjacent" can mean that no linear arrays of electrical contacts are disposed between the first and second linear arrays. Furthermore, the ground mating ends 272 of the first linear array can be mirror images of the ground mating ends 272 of the second linear array. It should be appreciated that the mating ends can be mirror images even though they may be offset with respect to each other along the respective linear arrays, or the transverse direction T. Select ones of the mating ends 256 of the signal contacts 252, for instance at every third mating end of the electrical contacts 250 along the first and second linear arrays, can be mirror images with each other and aligned with each other along the lateral direction A.

It should be appreciated that the signal contacts 252 can be arranged in a plurality of linear arrays 251 as described above, including first, second, and third linear arrays 251 that are spaced from each other along the lateral direction A. The second linear array can be disposed between the first linear array. The first and second linear arrays 251 can be defined by the first and second leadframe assemblies 230*a-b*, respectively, and thus the concave inner surface 253*a* of the first linear array 251 can face the concave inner surfaces 253*a* of the second linear array 251. Furthermore, a select differential signal pair 266 of the second linear array 251 can define a victim differential signal pair that can be positioned adjacent aggressor differential signal pairs 266 that can be disposed adjacent the victim differential signal pair. For instance, ones of aggressor differential signal pairs 266 can be disposed along the second linear array and spaced from the victim differential signal pair along the transverse direction T. Furthermore, ones of aggressor differential signal pairs 266 can be disposed first and third linear arrays 251, and thus spaced from the victim differential signal pair 266 along one or both of the lateral direction A and the transverse direction T. The differential signal contacts of all of the linear arrays, including the aggressor differential signal pairs, are configured to transfer differential signals between the respective mating ends and mounting ends at data transfer rates while producing produce no more than six percent worst-case, asynchronous multi-active cross talk on the victim differential signal pair. The data transfer rates can be between and include six-and-one-quarter gigabits per second (6.25 Gb/s) and approximately fifty gigabits per second (50 Gb/s) (including approximately fifteen gigabits per second (15 Gb/s), eighteen gigabits per second (18 Gb/s), twenty gigabits per second (20 Gb/s), twenty-five gigabits per second (25 Gb/s), thirty gigabits per second (30 Gb/s), and approximately forty gigabits per second (40 Gb/s)).

The edges of the electrical contacts 250 can also be spaced from the ribs 214 along the transverse direction T. Select ones of the first plurality of ribs 214*a* can thus be disposed between the respective ground mating ends 272 and an adjacent mating end 256 of one of the first leadframe assemblies 230*a*, and further between the mating ends 256 of each pair 266 of signal contacts 252 of the one first leadframe assemblies 230*a*. Select ones of the second plurality of ribs 214*b* can thus be disposed between the respective ground mating ends 272 and an adjacent mating end 256 of one of the second leadframe assemblies 230*b*, and further between the mating ends 256 of each pair 266 of signal contacts 252 of the one second leadframe assemblies 230*b*. The ribs 214 can operate to protect the electrical mating ends 256 and the ground mating ends

272, for example by preventing contact between the mating ends 256 and the ground mating ends 272 of the electrical contacts 250 within a respective linear array 251. It should be appreciated in one embodiment that the divider walls 212, including the ribs 214 and the bases 241 extend along at least one or more up to all of the signal contacts 252 a distance less than half of the distance from the respective mating ends 256 to the respective mounting ends 258.

When the plurality of leadframe assemblies 230 are disposed in the connector housing 206 in accordance with the illustrated embodiment, the tips 264 of the signal contacts 252 and the tips 280 of the ground mating ends 272 of each of the plurality of electrical contacts 250 can be disposed in the connector housing 206 such that the tips 264 and 280 are rearwardly recessed from the front end 208*a* of the housing body 208 with respect to the longitudinal direction L. In this regard, it can be said that the connector housing 206 extends beyond the tips 264 of the receptacle mating ends 256 of the signal contacts 252 and beyond the tips 280 of the receptacle ground mating ends 272 of the ground plate 268 along the mating direction. Thus, the front end 208*a* can protect the electrical contacts 250, for example by preventing contact between the tips 264 and 280 and objects disposed adjacent the front end 208*a* of the housing body 208.

Figure 6:
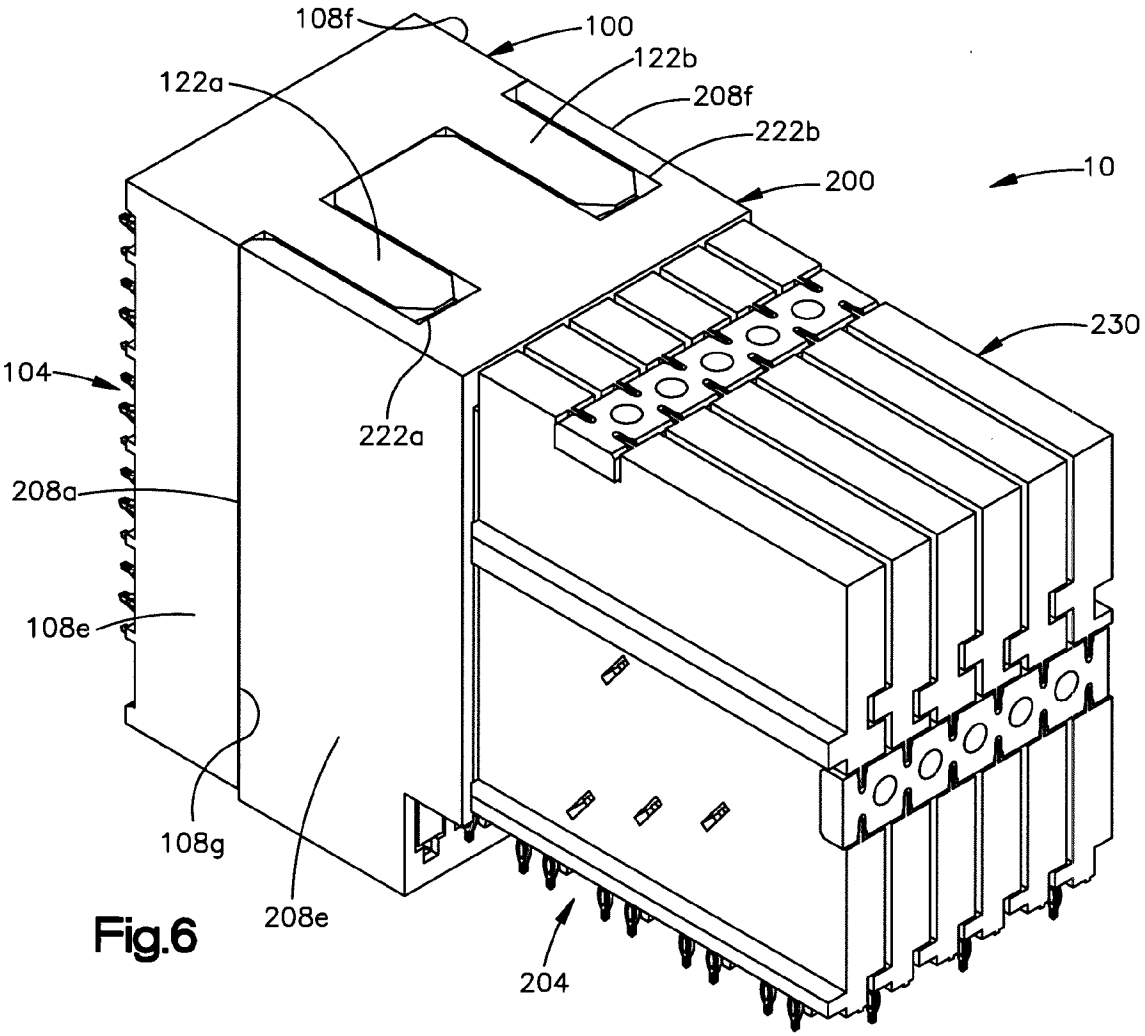
FIG. 6 is a perspective view of the first and second electrical connectors illustrated in FIG. 1, shown mated to each other.

Referring also to FIG. 6, when the first and second electrical connectors 100 and 200 are mated to one another, the side walls 108*e* and 208*e* can abut each other, for instance at the abutment surface 208*g* and the front end 208*a* of the side wall 208*e*. Further, the side walls 108*f* and 208*f* can abut each other, for instance at the abutment surface 208*g* and the front end 208*a* of the side wall 208*f*. The side walls 208*e* and 208*e* can thus be substantially co-extensive with each other and aligned with each other along the longitudinal direction L. Similarly, the side walls 208*f* and 208*f* can be substantially co-extensive with each other and aligned with each other along the longitudinal direction L. Thus, the respective exterior surfaces of the walls of the first connector housing 106 and the second connector housing 206 that abut each other, when the first and second electrical connectors 100 and 200 are mated, can further be flush with each other.

Furthermore, when the first and second electrical connectors 100 and 200 are mated, the mating ends of the respective leadframe assemblies 230 are inserted into gaps between adjacent divider walls 121. Further, the mating ends of the leadframe assemblies 130 are inserted into respective ones of the gaps 263. Thus, the respective mating ends of each of first and second pluralities of electrical contacts 150 and 250 are brought into contact with each other so as to place the first and second electrical contacts 150 and 250 into electrical communication with each other. For instance, the electrical signal contacts 152 and 252 are brought into electrical communication with each other, the ground contacts 152 and 254 are brought into electrical communication with each other, and the widow contacts 152*a* and 252*a* are brought into electrical communication with each other. Each of the mating ends of the electrical contacts 150 can bias the electrical contacts 250 toward the respective divider walls 212, and each of the mating ends of the electrical contacts 250 can bias the electrical contacts 150 toward the respective divider walls. For instance, the outer surfaces 253*b* and 153*b* of the signal contacts 152 and 252, respectively, can ride along each other so as to bias the signal contacts 152 and 252 toward their respective divider walls, such as the bases, and into the respective pockets. Similarly, the outer surfaces 181*b* and 281*b* of the ground mating ends 172 and 272, respectively, can ride along each other so as to bias the signal contacts 152 and 252 toward their respective divider walls, such as the bases, and into the respective pockets.

Further, the mating ends of the electrical contacts 150 and 250 can be at least partially, such as substantially surrounded by the first and second connector housings 106 and 206. For example, when the electrical connectors 100 and 200 are mated, each of the electrical contacts 150 are disposed adjacent one of the divider walls 212 of the second connector housing, which extends along a fourth surface of the electrical contacts 150, such as a broadside of the electrical contacts 150 that is opposite the broadside that is adjacent the respective base 141 of the divider wall 112. Furthermore, when the electrical connectors 100 and 200 are mated, each of the electrical contacts 250 are disposed adjacent one of the divider walls 112 of the first connector housing 100, which extends along a fourth surface of the electrical contacts 250, such as a broadside of the electrical contacts 250 that is opposite the broadside that is adjacent the respective base 241 of the divider wall 212. Thus, the connector housings 106 and 206 combine to substantially surround the mating ends of each of the electrical contacts 150 and 250.

It is recognized that the mating ends of the electrical contacts 150, which includes the ground mating ends 172 and the mating ends 156 of the electrical signal contacts 152, can be constructed as gender neutral, such that each of the mating ends 156 and the ground mating ends 172 can mate with a mirror image of itself. Thus, the mating ends of the electrical contacts 150 of the first electrical connector 100 are mirror images and mate with the electrical contacts 250 of the second electrical connector. Because the first electrical connector 100 can be configured as a right-angle connector of the type described herein with respect to the second electrical connector 200, it should be appreciated that a method can be provided for fabricating two right-angle connectors, such as the first electrical connector 100 and the second electrical connector 200, whose respective electrical contacts 150 and 250 are gender neutral. The method can include the step of manufacturing a plurality of first leadframe assemblies, such as the first leadframe assemblies 130*a* as described herein, and a plurality of second leadframe assemblies, such as the second leadframe assemblies 130*b* as described herein. Thus, the first and second leadframe assemblies 130*a* and 130*b* define mating ends 156 and ground mating end s 172 that are aligned with each other along their respective first and second linear arrays 151. Each linear array defines a first end and a second end. The first end of the first linear array is substantially aligned with the first end of the second linear array, and the second end of the first linear array is substantially aligned with the second end of the second linear array. Along a common direction from the first end to the second end, the first leadframe assembly 130*a* can define a first contact pattern, such as a repeating pattern of G-S-S, and the second leadframe assembly 130*b* can define a second contact pattern, such as S-G-S, that is different than the first contact pattern. Furthermore, the mating ends of the first leadframe assembly 130*a* can be concave with respect to the mating ends of the second leadframe assembly 130*b*. Furthermore, the mating ends 156 and the ground mating ends 172 can be gender neutral mating ends. The method of fabricating the two right-angle electrical connectors can include supporting a first plurality of each of the first and second leadframe assemblies 130*a* and 130*b* in the connector housing of the first electrical connector, and supporting a second plurality of each of the first and second leadframe assemblies 130*a* and 130*b* in the connector housing of the second electrical connector.

It is appreciated that the first and second electrical right angle connectors can be mated to each other such that their mounting interfaces are co-planar with each other. Alternatively, one of the first and second electrical right angle connectors can be mated in an inverse orientation with respect to the other of the first and second electrical right angle connectors such that their mounting interfaces are spaced from each other along the transverse direction T, also known as an inverse co-planar configuration.

Without being bound by theory, it is believed that substantially encapsulating each of first and second pluralities of electrical contacts 150 and 250 enhances the electrical performance characteristics of the electrical connector assembly 10 and thus of the first and second electrical connectors 100 and 200. Furthermore, without being bound by theory, it is believed that the shape of the mating ends of the electrical contacts 150 and 250 enhances the electrical performance characteristics of the electrical connector assembly 10 and thus of the first and second electrical connectors 100 and 200. For instance, electrical simulation has demonstrated that the herein described embodiments of the first, second, and second electrical connectors 100, 200, and 400, respectively, can operate to transfer data, for example between the respective mating and mounting ends of each electrical contact, in the range between and including approximately eight gigabits per second (8 Gb/s) and approximately fifty gigabits per second (50 Gb/s) (including approximately twenty five gigabits per second (25 Gb/s), approximately thirty gigabits per second (30 Gb/s), and approximately forty gigabits per second (40 Gb/s)), such as at a minimum of approximately thirty gigabits per second (30 Gb/s), including any 0.25 gigabits per second (Gb/s) increments between approximately therebetween, with worst-case, multi-active crosstalk that does not exceed a range of about 0.1%-6%, including all sub ranges and all integers, for instance 1%-2%, 2%-3%, 3%-4%, 4%-5%, and 5%-6% including 1%, 2%, 3%, 4%, 5%, and 6% within acceptable crosstalk levels, such as below about six percent (6%), approximately. Furthermore, the herein described embodiments of the first, second, and second electrical connectors 100, 200, and 400, respectively can operate in the range between and including approximately 1 and 25 GHz, including any 0.25 GHz increments between 1 and 25 GHz, such as at approximately 15 GHz.

The electrical connectors as described herein can have edge-coupled differential signal pairs and can transfer data signals between the mating ends and the mounting ends of the electrical contacts 150 to at least approximately 28, 29, 30, 31, 32, 33, 34, 35, 36, 37, 38, 39 or 40 Gigabits per second (or any 0.1 Gigabits per second increment between) (at approximately 30 to 25 picosecond rise times) with asynchronous, multi-active, worst-case crosstalk on a victim pair of no more than six percent, while simultaneously maintaining differential impedance at plus or minus ten percent of a system impedance (typically 85 or 100 Ohms) and simultaneously keeping insertion loss within a range of at approximately zero to −1 dB through 20 GHz (simulated) through within a range of approximately 20 GHz zero to −2 dB through 30 GHz (simulated), and within a range of zero to −4 dB through 33 GHz, and within a range of approximately zero to −5 dB through 40 GHz. At a 10 Gbits/sec data transfer rate, simulation produces integrated crosstalk noise (ICN), which can be all NEXT values that do not exceed 3.5 and ICN (all FEXT) values below 1.3. At a 20 Gbit/sec data transfer rate, simulation produces ICN (all NEXT) values below 5.0 and ICN (all FEXT) values below 2.5. At a 30 Gbit/sec data transfer rate, simulation produces ICN (all NEXT) values below 5.3 and ICN (all FEXT) below 4.1. At a 40 Gbit/sec data transfer rate, simulation produces ICN (all NEXT) values below 8.0 and ICN (all FEXT) below 6.1. It is recognized that 2 Gbit/s is approximately 1 GHz.

It should be appreciated from the description herein that an electrical connector with edge-coupled differential signal pairs may include a crosstalk limiter such as a shield, metallic plate, or a resonance reduction member (lossy type of shield) positioned between adjacent columns (along the transverse direction T) or rows (along the lateral direction A) of differential signal pairs and between adjacent differential signal pairs within a column direction or row direction. The crosstalk limiter, in combination with a receptacle-to-receptacle electrical connector mating interface, has been shown in electrical model simulation to increase data transfer of an electrical connector to 40 Gigabits per second without an increase asynchronous, multi-active, worst-case crosstalk beyond six percent, with a differential impedance to plus or minus ten percent of a system impedance, with an insertion loss of approximately −0.5 dB at 15 GHz and approximately −1 dB at 21 GHz (a data transfer rate of approximately 42 Gbits/sec), and a differential pair density of approximately 70 to 83 or 84 to 100 differential signal pairs per linear inch of card edge or approximately 98 to 99 differential signal pairs per square inch), such that an inch in a column direction will contain a low speed signal contact and 7 differential pairs with interleaved grounds. In order to achieve this differential pair density, the center-to-center column pitch along the row direction can be in the range of 1.5 mm to 3.6 mm, including 1.5 mm to 3.0 mm, including 1.5 mm to 2.5 mm, such as 1.8 mm, and the center-to-center row pitch along the column direction can be in the range of 1.2 mm to 2.0 mm, and can be variable. Of course the contacts can be otherwise arranged to achieve any desired differential pair density as desired.

Figure 7B:
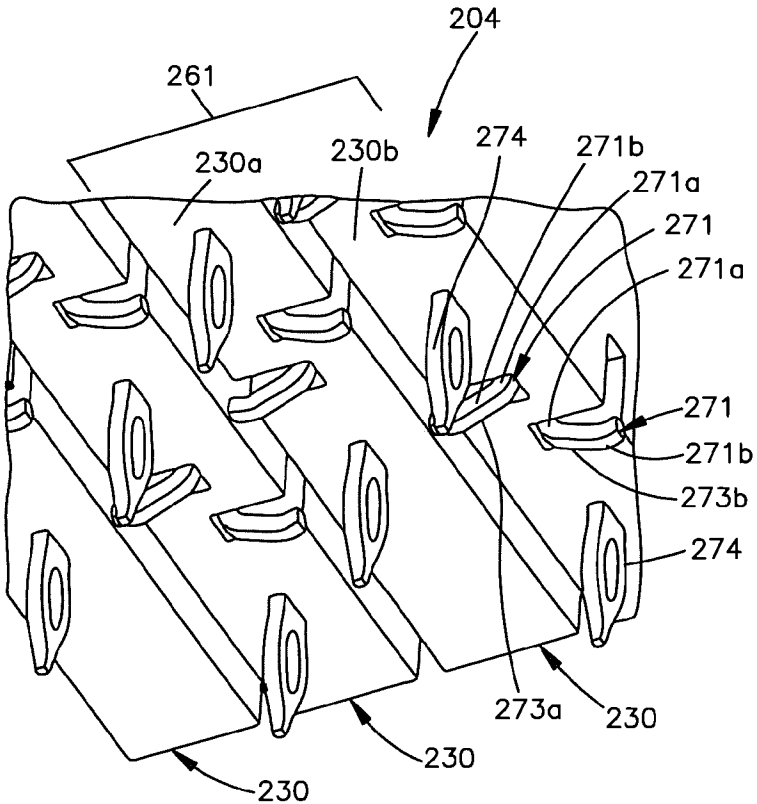
FIG. 7B is another perspective view of the portion of the mounting interface illustrated in FIG. 7A.
Figure 7A:
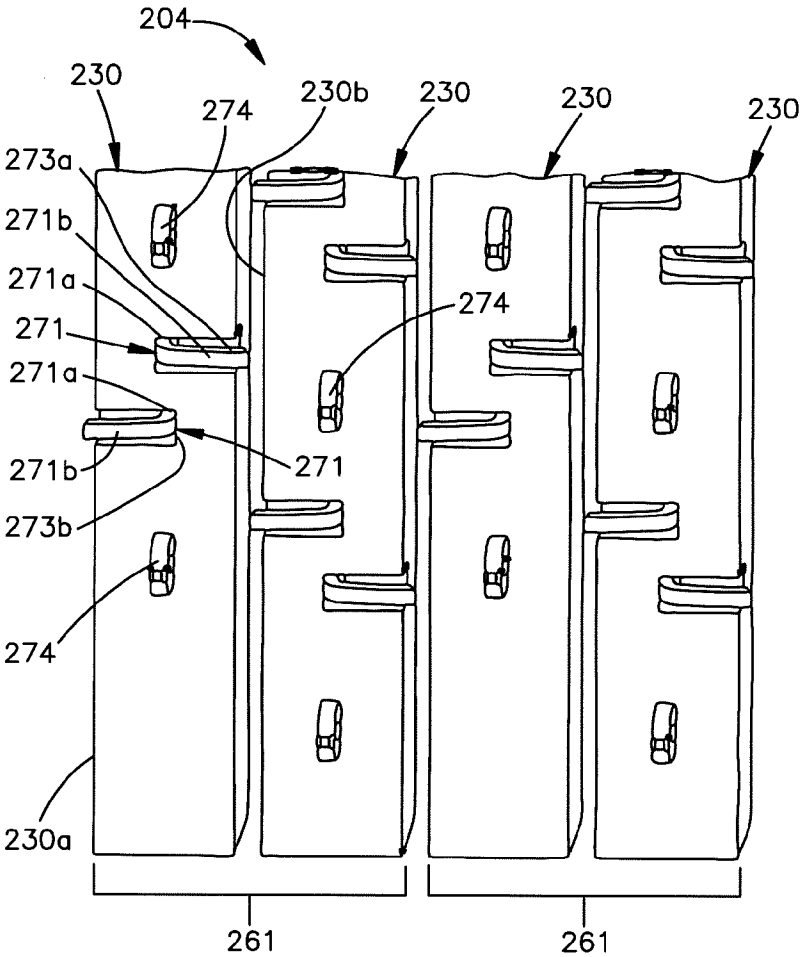
FIG. 7A is a perspective view of a portion of a mounting interface of an electrical connector in accordance with one embodiment.

Referring now to FIGS. 7A-B, as described above, the mounting ends of the electrical contacts 150 and 250 can be configured as press-fit tails, surface mount tails, fusible elements such as solder balls, or combinations thereof. Thus, while FIGS. 7A-B illustrate the mounting ends of the second electrical connector 200, it should be appreciated that the mounting ends of the first electrical connector 100 can also be constructed as illustrated and described with reference to FIGS. 7A-B. For example, the ground mounting ends 274 can be configured as eye-of-the-needle press-fit tails configured to be press-fit into respective vias of the respective second substrate 30*b*. The mounting ends 258 of the electrical signal contacts 252 can be configured as leads 271 that project out, from the respective leadframe housings 232. For instance, in accordance with a right-angle connector, the leads 271 can extend down from the bottom surface of the respective leadframe housings 232. In accordance with a vertical connector, the leads 271 can extend rearward from the rear surface of the respective leadframe housings 232. The leads 271 are configured to be compressed against, or otherwise brought into contact with, a surface, for instance an electrically conductive contact pad, of a complementary electrical component, such as the second substrate 300*b* so as to place the signal contacts 252 in electrical communication with the second substrate.

Each of the leads 271 can include a stem 271*a* that extends out from the respective leadframe housing 232 to a distal end, and a hook 271*b* that extends from the distal end of the stem 271*a* along a direction that is angularly offset from the stem 271*a*, and also angularly offset with respect to a plane that includes the respective linear array 251 and the longitudinal direction L. Thus, the leads 271 can be substantially "J-shaped" and can be referred to as J-shaped leads. For instance, the hooks 271*b* of immediately adjacent ones of the leads 271 can be oriented in different, for instance opposite, directions. In accordance with the illustrated embodiment, a first one 273*a* of the leads 271 can be oriented in a first direction and a second one 273*b* of the leads 271 can be oriented in a second direction that is angularly offset from, for instance opposite, the first direction. The first and second immediately adjacent first and second ones 273*a-b* of the leads 271 can be defined by signal contacts 252 that define a differential signal pair 266. Thus, the first and second signal contacts that define a differential signal pair can include 271 that are angularly offset with respect to each other, and for instance can be oriented in opposite directions with respect to each other, and with respect to a plane that is defined by the transverse and longitudinal directions T and L, the plane further passing through the ground mounting ends 274. For instance, the hook 271*b* of one of the first and second ones 273*a-b* of the leads 271 of each pair 266 can extend from the distal end of the stem 271*a* toward the ground plate 268, and the hook 271*b* other of one of the first and second ones 273*a-b* of the leads 271 of each pair 266 can extend from the distal end of the stem 271*a* away the ground plate 268. Each of the leads 271 of the first one of the leadframe assemblies 230*a* of a given pair 261 can be offset, for instance along the longitudinal direction L, with respect to each of the leads 271 of the second one of the leadframe assemblies 230*b* of the given pair. The leads 271 can be constructed as described in U.S. patent application Ser. No. 13/484,774, filed May 31, 2012, the disclosure of which is hereby incorporated by reference as if set forth in its entirety herein.

Figure 8A:
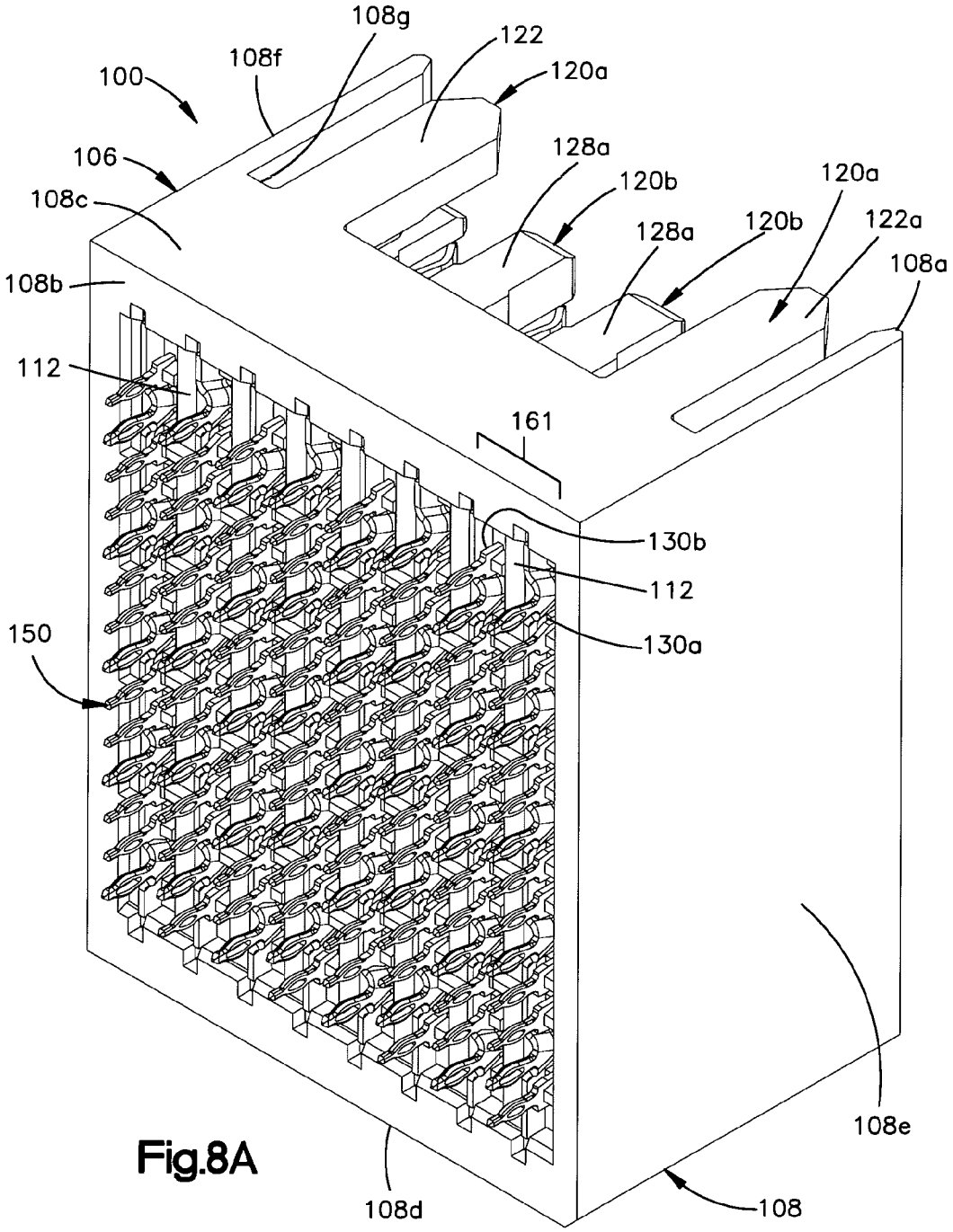
FIG. 8A is a perspective view of a first electrical connector similar to the first electrical connector illustrated in FIG. 2A, but constructed in accordance with an alternative embodiment.

As described above, either or both of the first and second electrical connectors 100 and 200 can include any number of leadframe assemblies 230, and thus any number of pairs 261 of leadframe assemblies 230 and corresponding gaps 263 therebetween. For instance, as illustrated in FIG. 8A, the first electrical connector 100 can include first and second inner pairs 161*b* of leadframe assemblies, and the fine alignment members 120*b* can include a second pair of first and second fine alignment beams 128*a* and 128*b*, respectively that are aligned and on opposite sides of with the divider wall 112 that is disposed between the first and second leadframe assemblies 130*a* and 130*b* of the second inner pair 161*b* in the manner described above. The first electrical connector 100 is configured to mate with a complementary second electrical connector having two pairs of inner fine alignment receptacles configured to receive each of the two pairs of inner alignment beams 128*a* and 128*b*. Furthermore, as illustrated in FIG. 8A, the side walls 108*e* and 108*f* can extend to the front end 108*a* of the housing body 108. Thus the connector housing 106 can define a gap between each of the side walls 108*e* and 108*f* and their immediately adjacent gross alignment members 120*a*.

Figure 8B:
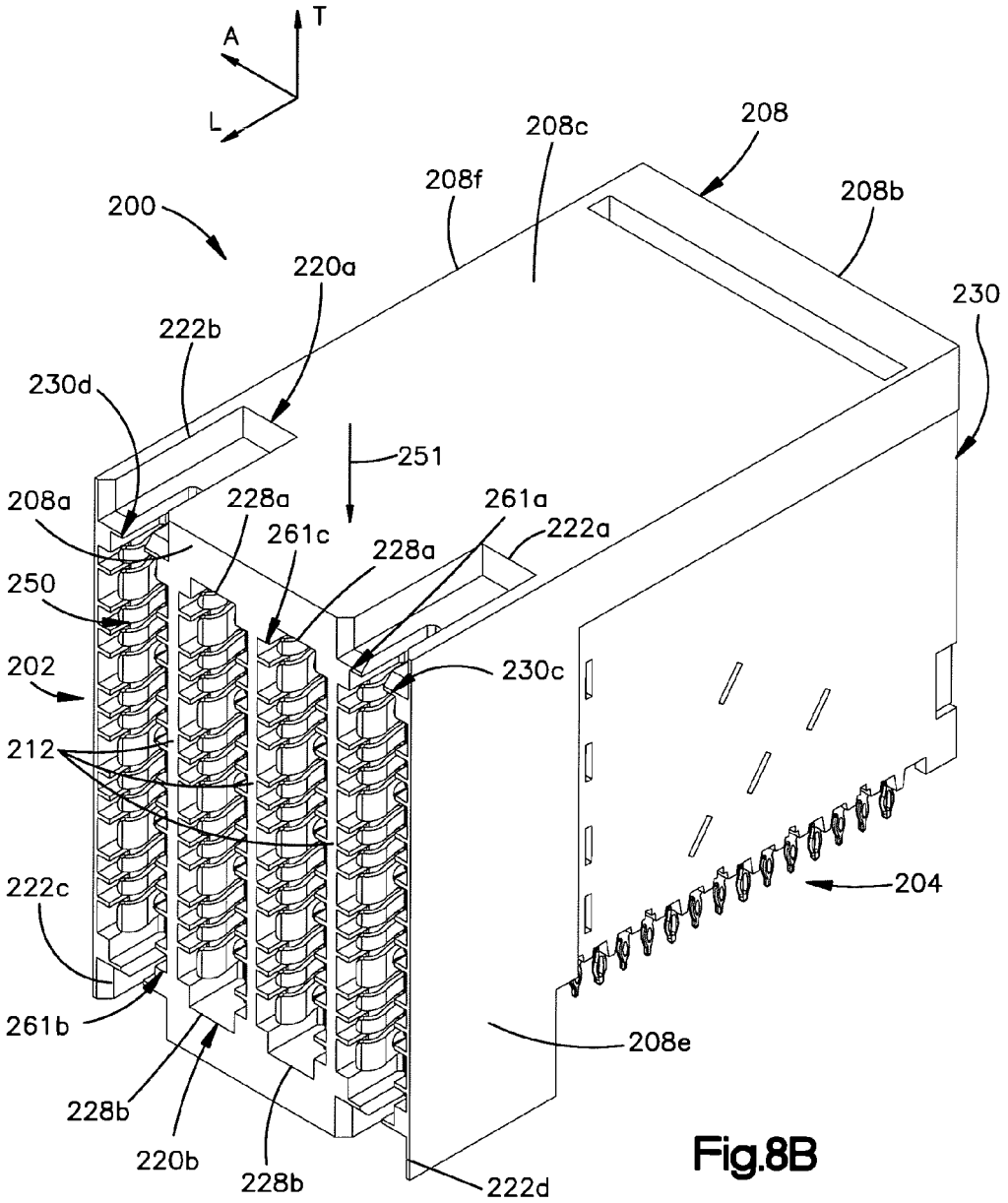
FIG. 8B is a perspective view of a second electrical connector similar to the second electrical connector illustrated in FIG. 4A, but constructed in accordance with an alternative embodiment.

Furthermore, as illustrated in FIG. 8B, the second electrical connector 200 can include at least one such as a plurality of leadframe assemblies 230, which can be arranged in pairs 261, between the pairs 261*a* and 261*b*. For instance, the second electrical connector can include a third pair 261*c* of leadframe assemblies 230*a-b* disposed between the first and second inner pairs 261*a* and 261*b* of leadframe assemblies 230*a-b*. Thus, the electrical connector 200 can define a second inner gap 263 disposed between respective ones of the inner pairs 261 of leadframe assemblies. Similarly, the electrical connector can include third and fourth alignment recesses 228*c* and 228*d* that define a second pair of fine alignment recesses, constructed as described above with respect to the first pair of first and second alignment recesses 228*c-d*, but aligned with a second inner gap 263 that is disposed between the third and fourth alignment recesses 228*c* and 228*d*. The second inner gap can be disposed adjacent the first inner gap 263 that is disposed between the first and second alignment recesses 228*a-b*, and separated by the first inner gap 263 by at least one leadframe assembly 230 such as a pair 261 of leadframe assemblies 230*a-b*. Further, it should be appreciated that the housing body of either or both of the first and second electrical connectors 100 and 200 can be configured in any shape and size as desired. For instance, the top wall 208*c* of the housing body 208 can extend from the front end 208*a* to the rear most surface of the leadframe assemblies 230 so as to define the rear end 208*b* of the housing body 208. Thus, the top wall 208*c* can cover a substantial entirety of the leadframe assemblies 230.

As described above, the connector housings of the first and second electrical connectors 100 and 200 can be constructed in accordance with any suitable embodiment. For example, referring now to FIGS. 9A-B, the first electrical connector 100, including the first connector housing 106, can be configured as described above with respect to FIGS. 1-2C or any alternative embodiment, unless otherwise indicated. For instance, the housing body 108 can include at least one cover wall 116 that is disposed forward from the mating ends of the electrical contacts 250 along the longitudinal mating direction, and can define a dimension in the lateral direction A that is greater than the width of the divider walls 112 in the lateral direction A. Thus, each of the cover walls 116 can be configured to overlap along the longitudinal direction L at least a portion up to all of at least some up to all of the mating ends, for instance the tips, of the leadframe assembly 130 or assemblies 130*a-b* that are disposed adjacent the corresponding divider wall 112, for instance disposed in the respective pockets defined by the divider wall 112, as described above. Thus, lines that extend along the longitudinal direction can pass through both one of the divider walls 112, and a respective one of the mating ends 156 or the ground mating ends 172.

Each of the plurality of cover walls 116 can extend from at least one of the first and second surfaces 111 and 113 of the respective divider wall 112 along the lateral direction A, such as from each of the first and second surfaces 111 and 113. Thus, each of the first and second surface 111 and 113 can be disposed between the opposed outermost ends of the respective cover wall 116 along the lateral direction A. Each cover wall 116 can accordingly extend along the lateral direction A toward the first side wall 108*e* from the respective divider wall 112 a sufficient distance such that the cover wall 116 overlaps, along the longitudinal direction L, at least a portion of the tips 164 of the mating ends 156 and the tips 180 of the ground mating ends 172 within a particular linear array 251 of electrical contacts 150 disposed adjacent the first surface 111 of the divider wall 112. Additionally, each cover wall 116 can extend along the lateral direction A toward the second side wall 108*f* a distance such that the cover wall 116 overlaps, along the longitudinal direction L, at least a portion of the tips 164 of the mating ends 156 and the tips 180 of the ground mating ends 172 that are disposed adjacent the second surface 113 of the divider wall 112. In accordance with the illustrated embodiment, each cover wall 116 extends from the respective divider wall 112 towards both the first and second sides 108*e* and 108*f* of the housing body 108, such that the divider wall 112 and the cover wall 116 define a substantially "T" shaped structure.

Further in accordance with the illustrated embodiment, each of the cover walls 116 can extend substantially perpendicular to the respective divider wall 112, and thus can lie in a plane defined by the longitudinal direction L and the lateral direction A. However it should be appreciated that the cover walls 116 can be alternatively constructed in accordance with any other geometry as desired. The plurality of cover walls 116 can operate to protect the electrical contacts 150 covered by the cover wall 116. The housing body 108 can further define slots 117 that extend through the cover walls 116. The slots 117 can be aligned with one or more up to all of the ground mating ends 172 that are disposed adjacent one or both of the surfaces 111 and 113, such as the surface 113 as illustrated. The slots 117 can also be fully contained between the edges of the ground mating ends 172 with which the slots are aligned.

Furthermore, the gross alignment members 120*a* can be aligned with the middle pair 161*b* of first and second leadframe assemblies 130*a-b* along the transverse direction T, and can include first and second alignment beams 128*a* and 128*b* that can be constructed substantially as described above. Thus, the alignment beams 128*a* and 128*b* can extend forward with respect to the both the abutment wall 108*g* and the front end 108*a* of the housing body 108 along the mating direction, and can define the chamfered surfaces 124 and 126 as described above. The alignment beams 128*a* and 128*b* can further forward with respect to the both the cover walls 116 along the mating direction. The alignment beams 128*a* and 128*b* can be spaced along the transverse direction T from the cover wall 116 that is aligned with the alignment beams 128*a* and 128*b* along the transverse direction T, so as to define a gap between each of the alignment beams 128*a* and 128*b* and the aligned one of the cover walls 116 along the transverse direction T.

Figure 9A:
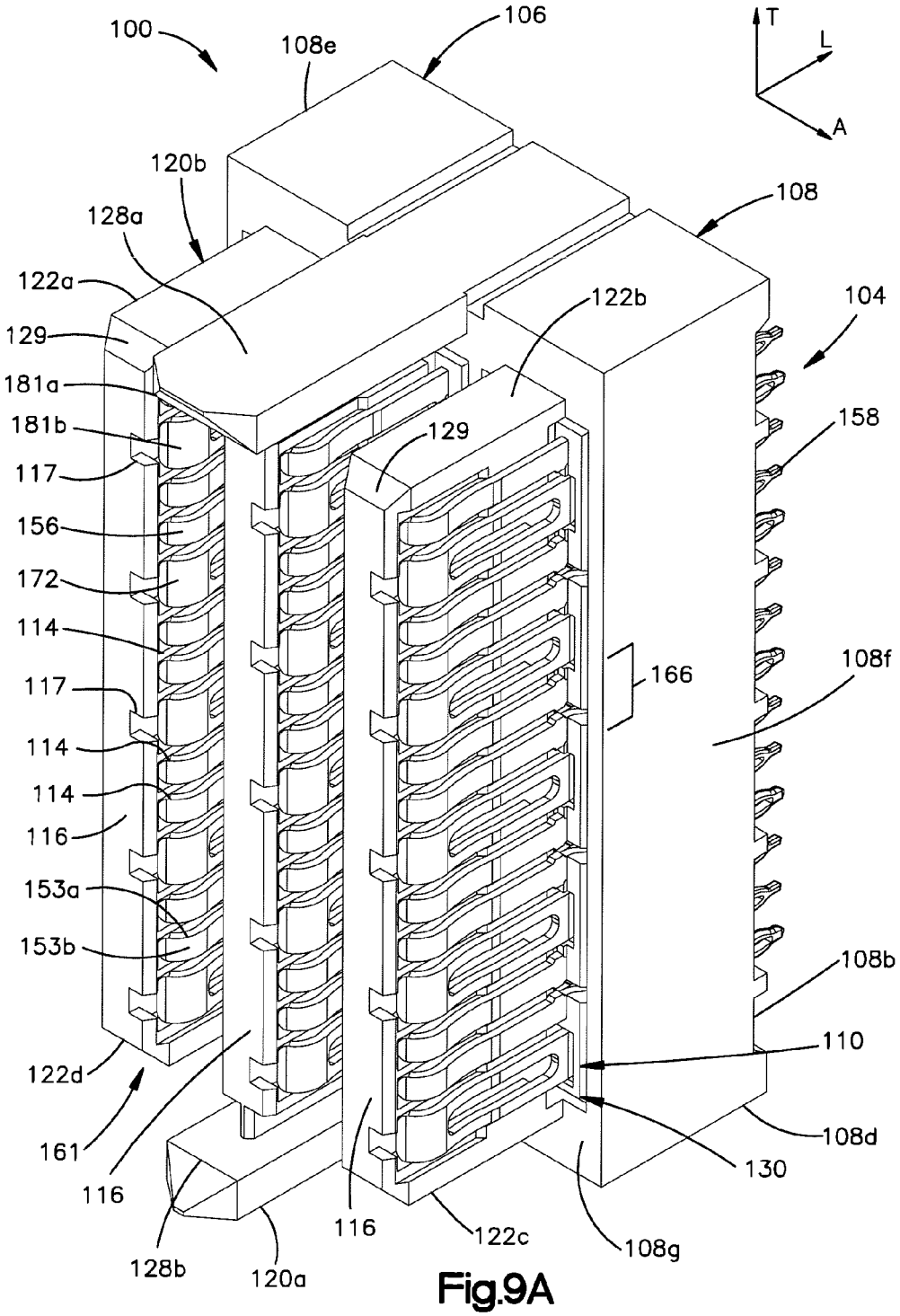
FIG. 9A is a perspective view of a first electrical connector similar to the first electrical connector as illustrated in FIG. 2A, but constructed in accordance with an alternative embodiment.
Figure 9B:
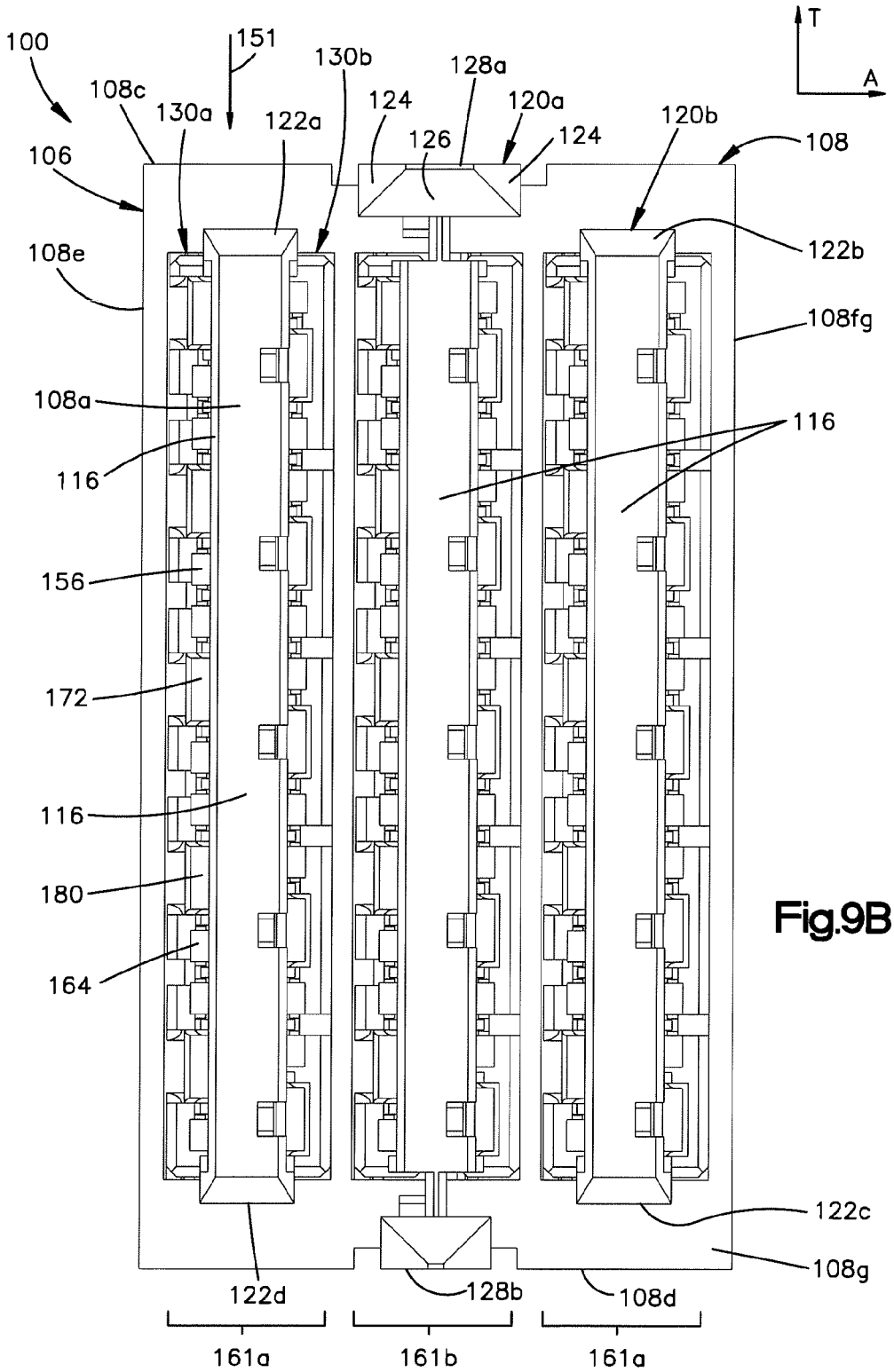
FIG. 9B is a front elevation view of the first electrical connector illustrated in FIG. 9A.
Figure 11:
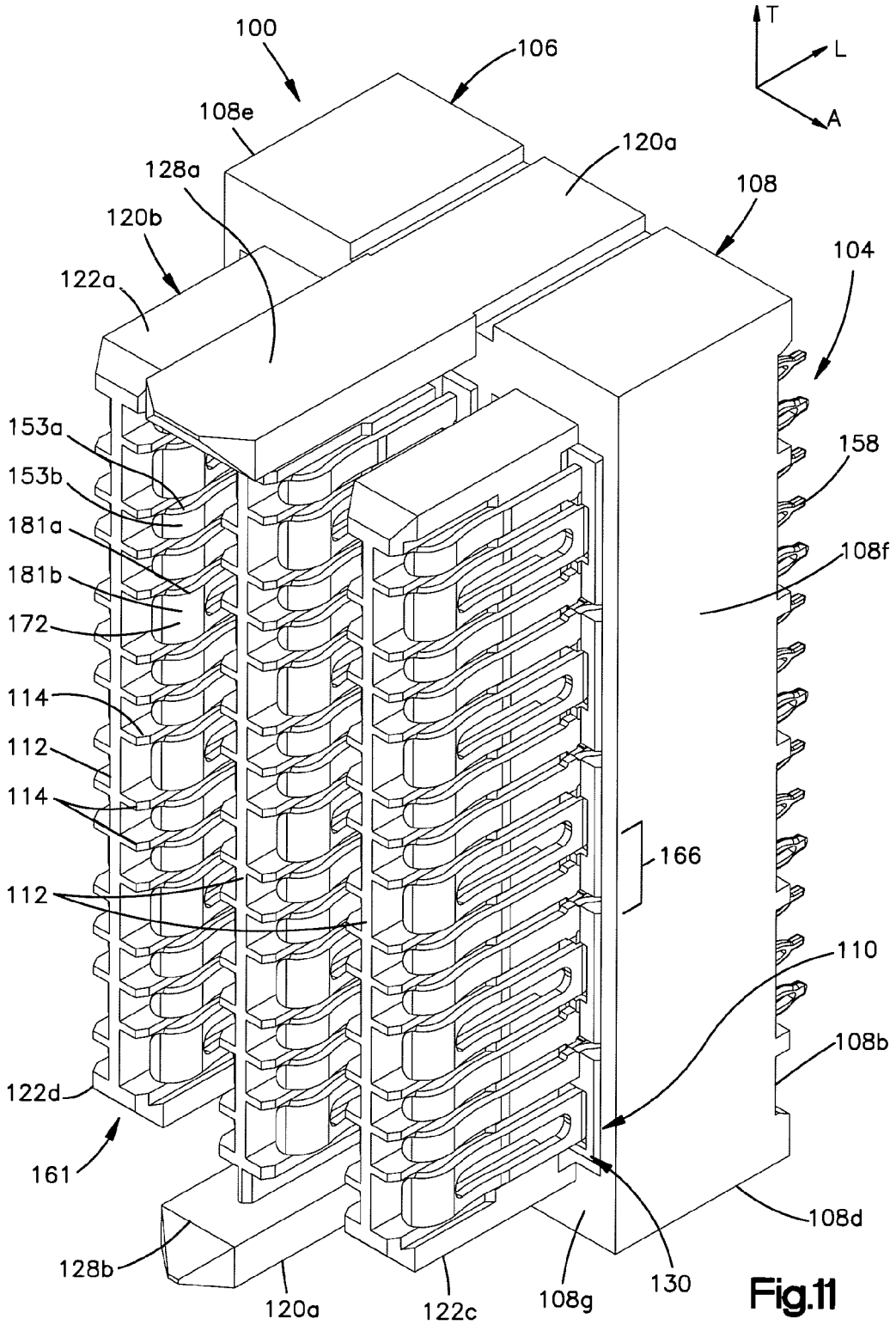
FIG. 11 is a perspective view of the first electrical connector illustrated in FIG. 9A, but devoid of cover walls.

The fine alignment members 120*b* can be configured as alignment beams 122*a-d*, arranged in pairs, including a first pair defined by the first and fourth alignment beams 122*a* and 122*d* that are aligned along the transverse direction T, and a second pair defined by the second and third alignment beams 122*b* and 122*c*, respectively, that are aligned along the transverse direction T. The first pair of alignment beams 122*a* and 122*d* can be disposed on opposed ends of a first one of the outer pairs 161*a* of leadframe assemblies 130, and aligned along the transverse direction T with the first one of the outer pairs 161*a*. The second pair of alignment beams 122*b* and 122*c* can be disposed on opposed ends of a second one of the outer pairs 161*a* of leadframe assemblies 130, and aligned along the transverse direction T with the second one of the outer pairs 161*a*. A first one of the cover walls 116 can extend between the alignment beams 122*a* and 122*d* of the first pair of alignment beams, for instance from the first alignment beam 122*a* to the fourth alignment beam 122*d*. A second one of the cover walls 116 can extend between the alignment beams 122*b* and 122*c* of the first pair of alignment beams, for instance from the second alignment beam 122*b* to the third alignment beam 122*c*. It should be appreciated that the first electrical connector 100 can include the cover walls 116 as illustrated in FIGS. 9A-B, or can be devoid of the cover walls 116, for instance as illustrated in FIG. 11.

Figure 10:
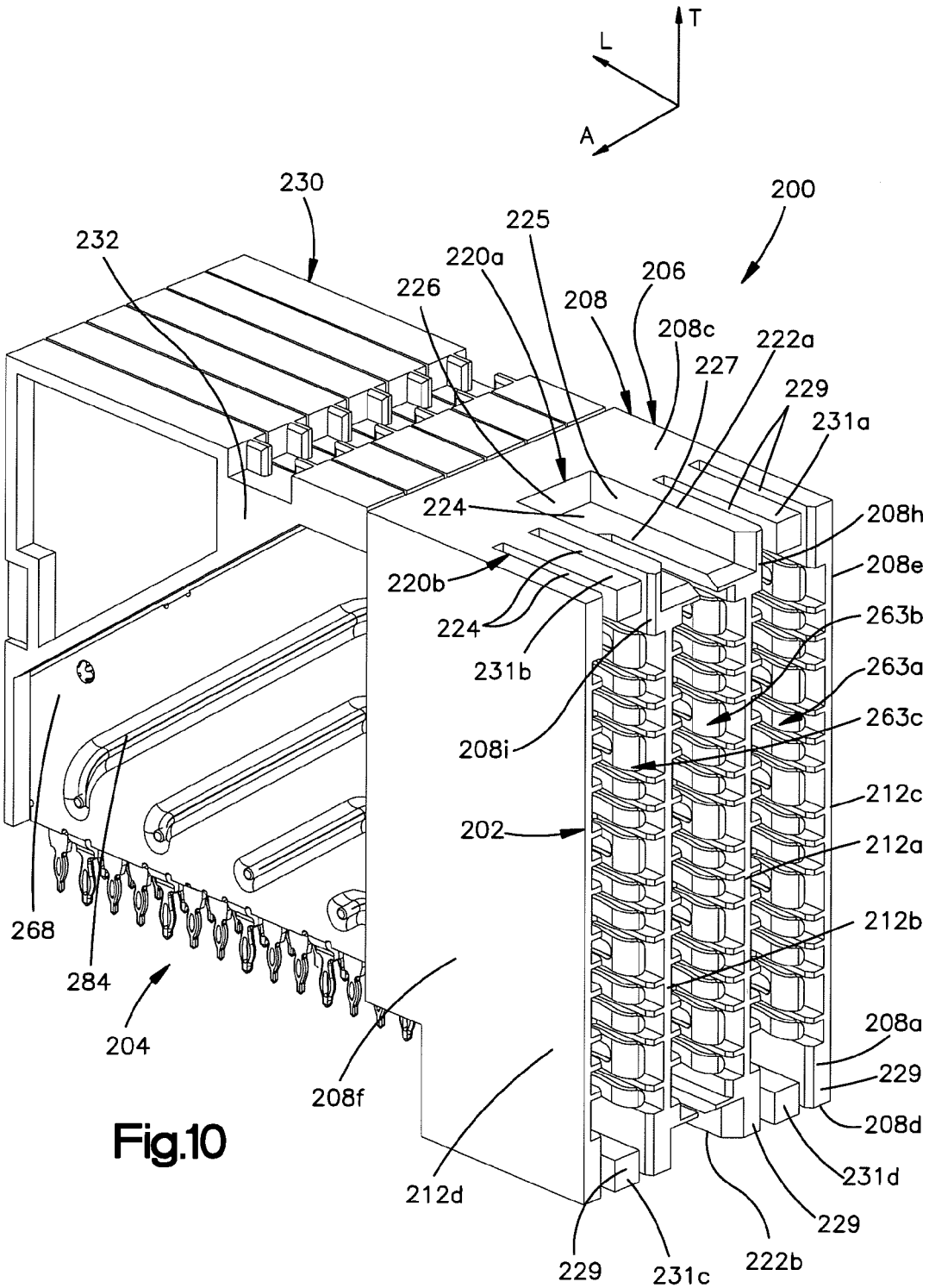
FIG. 10 is a perspective view of a second electrical connector similar to the second electrical connector as illustrated in FIG. 4A, but constructed in accordance with an alternative embodiment and configured to mate with the first electrical connector illustrated in FIG. 9A.

Referring now to FIG. 10, the second electrical connector 200, including the second connector housing 206, can be configured as described above with respect to FIGS. 4A-5C unless otherwise indicated below in accordance with an alternative embodiment. For instance, the second electrical connector 200 can be constructed so as to mate with the first electrical connector described above with reference to FIGS. 9A-B. Thus, the gross alignment members 220*a* of the second electrical connector 200 can be disposed between respective first and second pairs of the fine alignment members 220*b*, and can be configured as a pair of first and second recesses 222*a* and 222*b* that are sized to receive respective first and second ones of the alignment beams 128*a* and 128*b* of the first electrical connector 100 when the first and second electrical connectors are mated. The first and second recesses 222*a* and 222*b* can be aligned with the inner gap 263*b* along the transverse direction, and disposed on opposed ends of the inner gap 263, such that the inner gap 263*b* extends between the first and second recesses 222*a* and 222*b* along the transverse direction T.

In accordance with the illustrated embodiment, each of the first and second recesses 222*a* and 222*b* can be constructed as described with respect to the first and third recesses 222*a* and 222*c* with reference to FIGS. 4A-5C. Thus, the first recess 222*a* can extend into the top wall 208*c* of the housing body 208 along the inner transverse direction T to a floor 224 that defines an inner transverse boundary of the first recess 222*a*. The housing body 208 can further define first and second side surfaces 225 that are spaced along the lateral direction A and extend out from the floor 224 along the transverse direction T. For instance, the side surfaces 225 can at least partially define the first recess 222*a*, and can extend from the respective floor 224 to the top wall 208*c* along the transverse direction T. The first recess 222*a* can thus extend between the respective first and second side surfaces 225. One or more both of the first and second side surfaces 225 and the floor 224 can be chamfered at an interface with the front end 208*a* of the housing body 208. The chamfers of each of the first and second side surfaces 225 can extend outward along the lateral direction A away from the other of the side surfaces 225 as the chamfers extend along the mating direction. The chamfers of the floor 224 can extend outward along the transverse direction away from the top wall 208*c* of the housing body 208 as the floor 224 extends along the mating direction. The housing body 208 further defines a rear wall 226 that is rearwardly recessed from the front end 208*a* of the housing body 208 along the longitudinal direction in the direction opposite the mating direction. The rear wall 226 can extend between the first and second side surfaces 225, and further between the top wall 208*c* and the floor 224. The first recess 222*a* can extend from the front end 208*a* to the rear wall 226. Thus, each of the respective floor 224, the side surfaces 225, and the rear wall 226 can at least partially define, and can cumulatively define, the first recess 222*a*. Furthermore, the first recess 222*a* can define a slot 227 that extends rearward from the front end 208*a* through the floor 224 and is configured to receive one of the divider walls 112, such as the third divider wall 112*c*, of the first electrical connector 100. The second recess 222*b* can be configured as described with respect to the first recess 222*a*, except the second recess 222*b* extend into the bottom wall 208*d* of the housing body 208 along the inner transverse direction T to the floor 224 that defines the inner transverse boundary of the second recesses 222*b*.

The housing body 208 can further define second or fine alignment members 220*b* in the form of one or more resilient flexible arms 231 that can be configured to abut the respective outer transverse surfaces of the alignment beams 128 of the first electrical connector 100. Accordingly, the alignment beams 128 of a pair of alignment beams 128 can be disposed between the flexible arms 231 of a respective pair of flexible arms 231, along the transverse direction T. In accordance with the embodiment illustrated in FIG. 10, the housing body 208 can include first, second, third, and fourth flexible arms 231*a*, 231*b*, 231*c*, and 231*d*, respectively. The flexible arms 231 are configured to contact the respective alignment beams 128 of the first electrical connector 100 to perform the second stage alignment of the first and second electrical connectors 100 and 200 along the transverse direction T.

The flexible arms 231 can be cantilevered at respective locations of the housing body 208 between or including the front and rear ends 108*a* and 108*b*, and extend forward from the respective locations along the longitudinal direction L to a location that can be substantially aligned and co-planar with the front end 208*a* of the housing body 208. Alternatively, the flexible arms 231 can extend forward from the respective locations along the longitudinal direction L to a location that can be disposed forward or rearward from the front end 208*a* along the longitudinal direction L. For instance, the flexible arms 231 can be cantilevered from the abutment surface of the housing body 208. The housing body thus can define a pair of slots 229 that are disposed on opposed sides of each of the arms 231 that are spaced from each other along the lateral direction A. Ones of the slots 229 can, for instance separate the first and fourth flexible arms 231*a* and 231*d* from the first side wall 208*e*, and from a first internal wall 208*h* of the housing body 208. Similarly, ones of the slots 229 can, for instance separate the second and third flexible arms 231*b* and 231*c* from the second side wall 208*f*, and from a second internal wall 208*i* of the housing body 208.

In accordance with the illustrated embodiment, the first and fourth flexible arms 231*a* and 231*d* of the first pair of flexible arms 231 are spaced apart from each other, and substantially aligned with each other, along the transverse direction T. Similarly, the second and third flexible arms 231*b* and 231*c* of the second pair of flexible arms 231 can be spaced apart from each other, and substantially aligned with each other, along the transverse direction T. The pair of recesses 222*a* and 222*b* can be disposed between the first and second pairs of flexible arms 231 with respect to the lateral direction A.

The flexible arms 231*a-d* are configured to engage the respective ones of the alignment beams 122*a-d* to perform the second stage alignment of the first and second electrical connectors 100 and 200 along the transverse direction T. For example, after the first stage of alignment has occurred through engagement of the alignment beams 128*a* and 128*b* with the first and second recesses 222*a* and 222*b*, respectively, the first and second connector housings 106 and 206 of the first and second electrical connectors 100 and 200 are at least partially, such as substantially aligned with respect to each other along the lateral direction A and the longitudinal direction L, and can further be substantially aligned with each other along the transverse direction T.

Figure 12A:
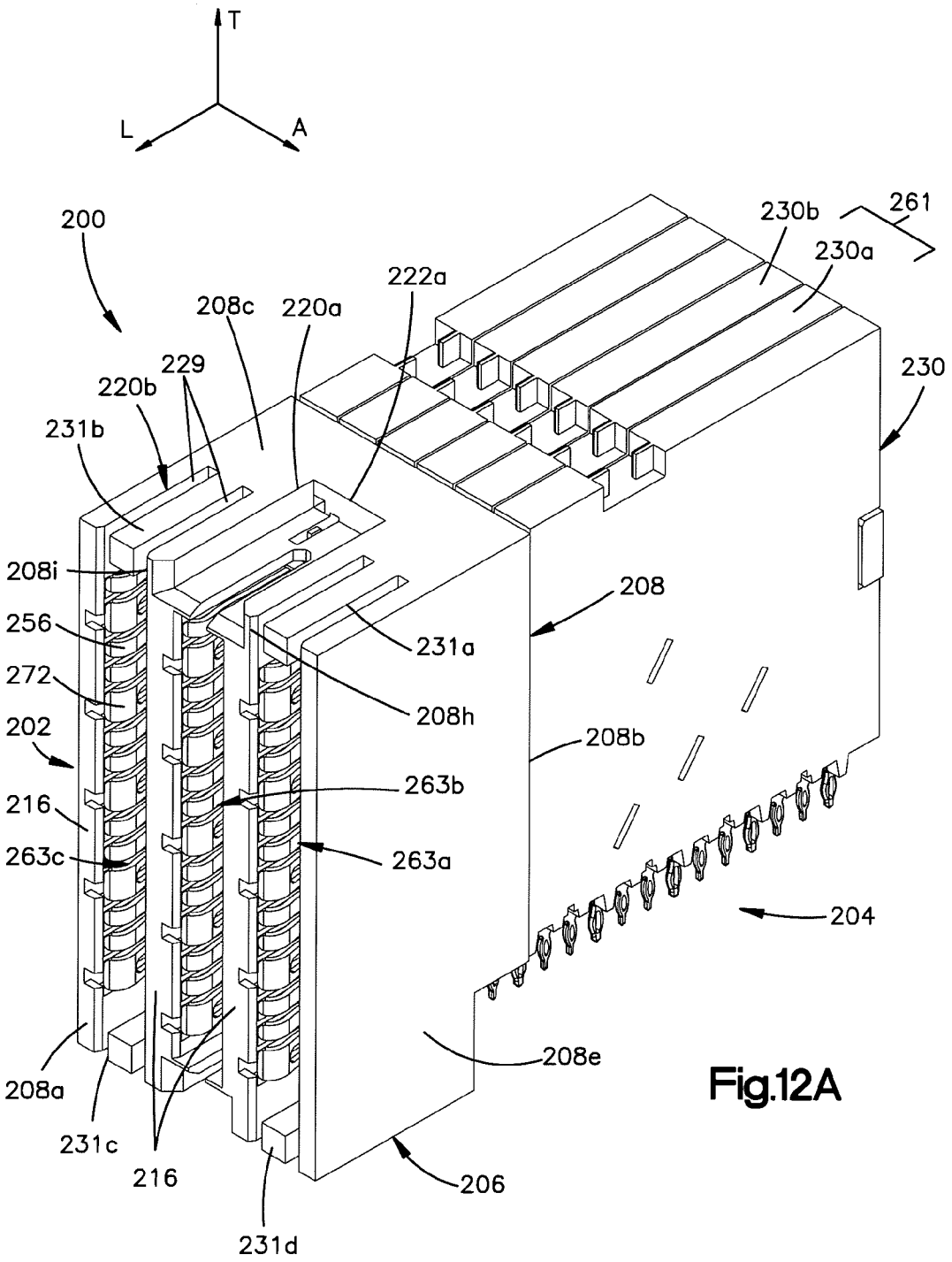
FIG. 12A is a perspective view of the second electrical connector illustrated in FIG. 10, but including cover walls.
Figure 12B:
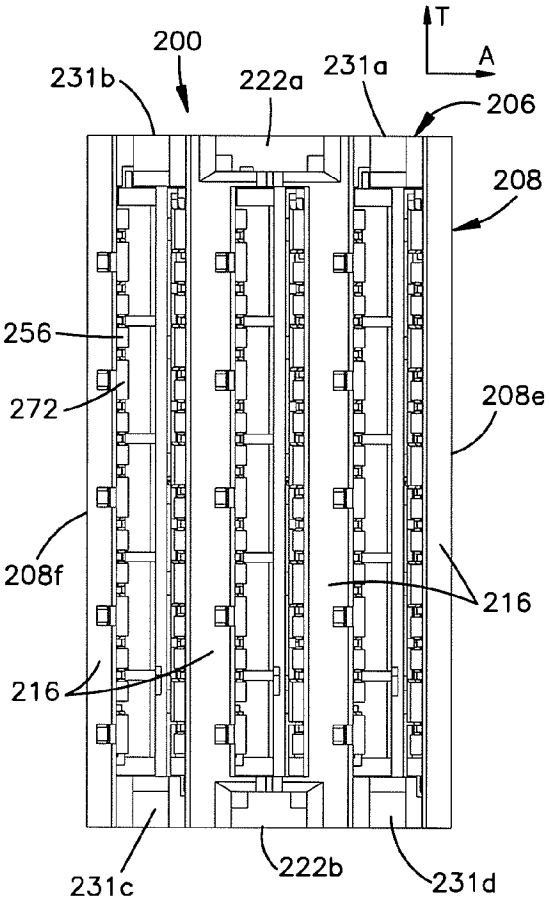
FIG. 12B is a front elevation view of the second electrical connector illustrated in FIG. 12A.

As described above, the connector housings of the first and second electrical connectors 100 and 200 can be constructed in accordance with any suitable embodiment. For example, as illustrated in FIG. 10, the second electrical connector 200 can be devoid of a cover wall of the type described with respect to the first electrical connector 100 in FIGS. 9A-B. Alternatively, referring to FIGS. 12A-B, the second electrical connector 200 can include one or more cover walls 216. As illustrated in FIGS. 12A-B, the second electrical connector, including the second connector housing 206, can be configured as described above with respect to FIG. 10 or any suitable alternative embodiment described herein, unless otherwise indicated. For instance, the housing body 208 can include at least one cover wall 216 that is disposed forward from the mating ends of the electrical contacts 250 along the longitudinal mating direction, and can define a dimension in the lateral direction A that is greater than the width of the divider walls 212 in the lateral direction A. Thus, each of the cover walls 216 can be configured to overlap along the longitudinal direction L at least a portion up to all of at least some up to all of the mating ends, for instance the tips, of the leadframe assembly 230 or assemblies 230*a-b* that are disposed adjacent the corresponding divider wall 212, for instance disposed in the respective pockets defined by the divider wall 212, as described above. Thus, lines that extend along the longitudinal direction can pass through both one of the divider walls 212, and a respective one of the mating ends 256 or the ground mating ends 272.

Each of the plurality of cover walls 216 can extend from at least one of the first and second surfaces 211 and 213 of the respective divider wall 212 along the lateral direction A, such as from each of the first and second surfaces 211 and 213. Thus, each of the first and second surface 211 and 213 can be disposed between the opposed outermost ends of the respective cover wall 216 along the lateral direction A. Each cover wall 216 can accordingly extend along the lateral direction A toward the first side wall 208*e* from the respective divider wall 212 a sufficient distance such that the cover wall 216 overlaps, along the longitudinal direction L, at least a portion of the tips 264 of the mating ends 256 and the tips 280 of the ground mating ends 272 within a particular linear array 251 of electrical contacts 250 disposed adjacent the first surface 211 of the divider wall 212. Additionally, each cover wall 216 can extend along the lateral direction A toward the second side wall 208*f* a distance such that the cover wall 216 overlaps, along the longitudinal direction L, at least a portion of the tips 264 of the mating ends 256 and the tips 280 of the ground mating ends 272 that are disposed adjacent the second surface 213 of the divider wall 212. In accordance with the illustrated embodiment, each cover wall 216 extends from the respective divider wall 212 towards both the first and second sides 208*e* and 208*f* of the housing body 208, such that the divider wall 212 and the cover wall 216 define a substantially "T" shaped structure.

Further in accordance with the illustrated embodiment, each of the cover walls 216 can extend substantially perpendicular to the respective divider wall 212, and thus can lie in a plane defined by the longitudinal direction L and the lateral direction A. However it should be appreciated that the cover walls 216 can be alternatively constructed in accordance with any other geometry as desired. The plurality of cover walls 216 can operate to protect the electrical contacts 250 covered by the cover wall 216. The housing body 208 can further define slots 217 that extend through the cover walls 216. The slots 217 can be aligned with one or more up to all of the ground mating ends 272 that are disposed adjacent one or both of the surfaces 211 and 213, such as the surface 213 as illustrated. The slots 217 can also be fully contained between the edges of the ground mating ends 272 with which the slots are aligned.

Figure 13:
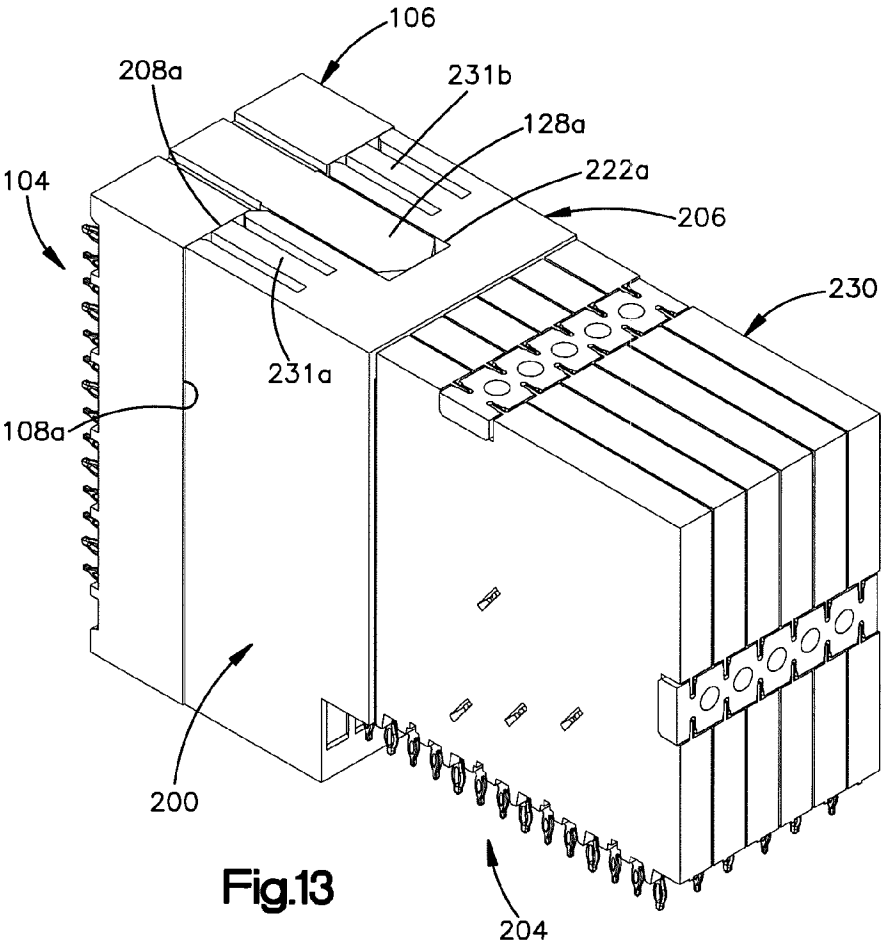
FIG. 13 is a perspective view of an electrical connector assembly including one of the first electrical connectors illustrated in FIGS. 9 and 11, and one of the second electrical connectors illustrated in FIGS. 10 and 12A, showing the first and second electrical connectors mated to each other.

Referring also to FIG. 13, one of the first electrical connectors 100 illustrated in FIGS. 9 and 11, can mate with one of the second electrical connectors 200 illustrated in FIGS. 10 and 12A as described above. For instance, the alignment beams 128*a-b* are received in the alignment recesses 222*a-b* so as to complete the first stage of alignment. As the first and second electrical connectors 100 and 200 are further mated along the respective mating directions M, the second stage alignment will be initiated by contact of the alignment beams 128 with the flexible arms 231. For example, as the guide surfaces 129 of the of the alignment beams 128 contact the flexible arms 231, the first and second alignment beams 122*a* and 122*b* can cause the first and second flexible arms 231*a* and 231*b* to be biased upward along the outer transverse direction T, and the third and fourth alignment beams 122*b* and 122*d* can cause the third and fourth flexible arms 231*c* and 231*d* to be biased downward along the outer transverse direction T. The flexible arms 231 can thus apply normal forces, normal to the mating direction, against the alignment beams 128, substantially along the transverse direction T.

The normal forces can bias the first electrical connector 100 to move to a substantially central alignment along the transverse direction T with respect to the second electrical connector 200. Thus, misalignments between the first and second electrical connectors 100 and 200 along the transverse direction T, for instance attributable to mating tolerances of the first and second electrical connectors 100 and 200, can be eliminated. This second stage of alignment allows the mating ends 156 and the ground mating ends 172 of the first plurality of electrical contacts 150 and the mating ends 256 and the ground mating ends 272 of the second plurality of electrical contacts 250 to achieve substantially ideal registration with respect to each other along the transverse direction T, such that the respective edges at the mating ends of mated electrical contacts can be substantially coplanar, thereby reduce impedance drops exhibited by the first and second electrical connectors 100 and 200 at the respective mating interfaces 102 and 202, and improving the performance characteristics of the electrical connector assembly 10.

Figure 14:
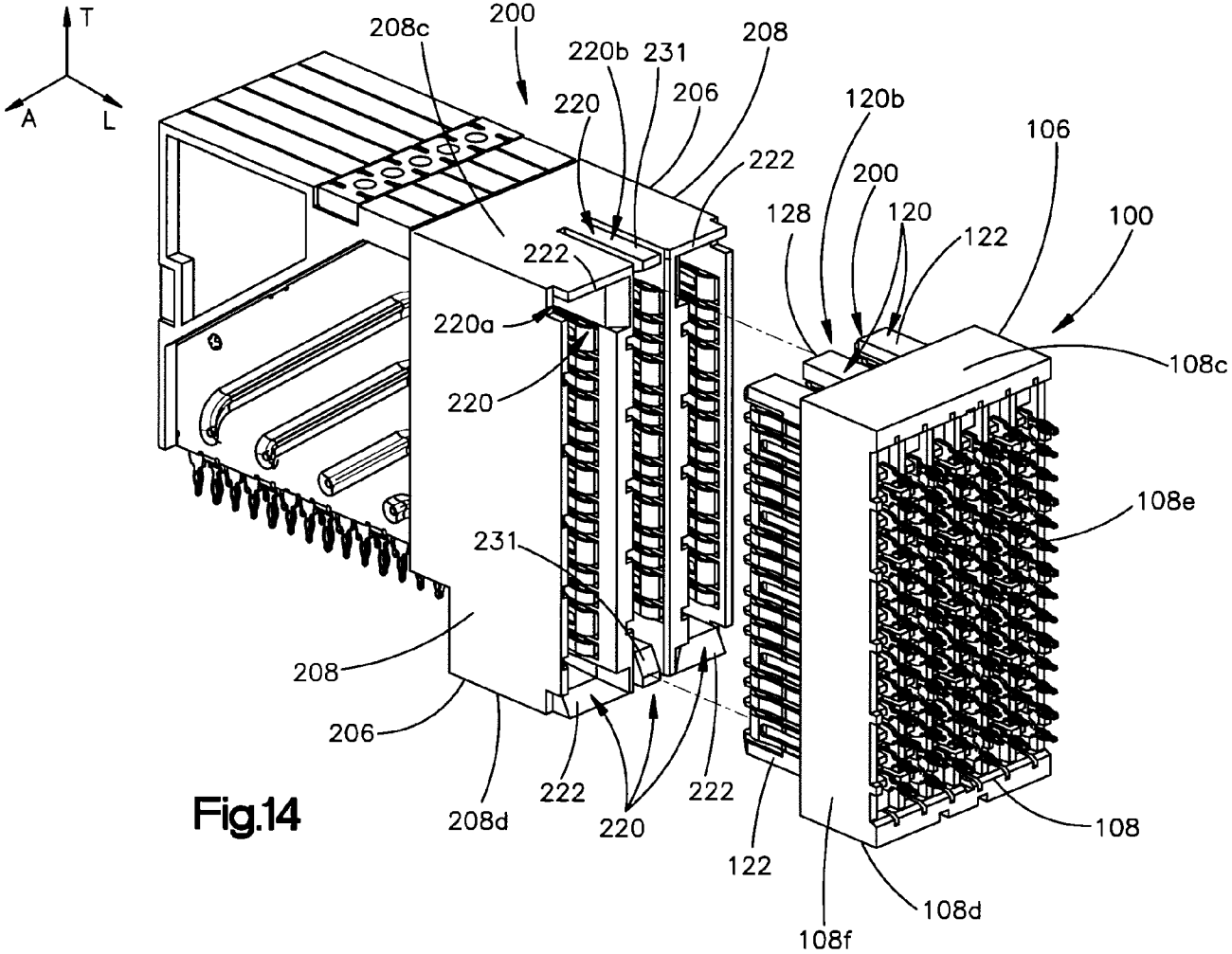
FIG. 14 is an exploded perspective view of an electrical connector assembly including a first and second electrical connectors configured to mate with each other, the first and second electrical connectors similar to the first and second electrical connectors illustrated in FIG. 1, but constructed in accordance with an alternative embodiment.

Referring now to FIG. 14, it should be appreciated that the first and second electrical connectors 100 and 200 are not limited to the illustrated alignment members 120, and that one or both of the first or second connector housings 106 or 206 can be alternatively constructed with any other suitable alignment members as desired. For instance, the gross alignment members 120*a* of the first electrical connector 100 can be configured as first and second pairs of alignment beams 122, wherein first and second alignment beams 122 of each of pairs are spaced apart and aligned along the transverse direction T in the manner described above. The fine alignment members 120*b* of the first electrical connector 100 can be configured as a pair of first and second alignment beams 128 that are spaced from and aligned with each other along the transverse direction T in the manner described above. The pair of alignment beams 128 can be disposed between, for instance equidistantly between the first and second pairs of alignment beams 122 along the lateral direction A. The alignment beams 122 can project to a location that is forward from the alignment beams 128 along the mating direction.

The gross alignment members 220*a* of the second electrical 200 can be configured as first and second pairs of alignment recesses 222, wherein first and second alignment recesses 222 of each of pairs are spaced apart and aligned along the transverse direction T in the manner described above. The recesses 222 can be at least partially defined by one of the top wall 208*c* and the bottom wall 208*d* of the housing body 208, for instance proximate to one of the first and second sides 208*e* and 208*f* of the housing body 208. The fine alignment members 220*b* of the second electrical connector 200 can be configured as resilient flexible arms 231 of the type described above. The fine alignment members 220*b* can be configured as a pair of first and second arms 231 that can be disposed between, for instance equidistantly between, the first and second pairs of alignment recesses 222 along the lateral direction A. The flexible arms 231 are configured to ride along the respective alignment beams 128 so as to provide the second stage of alignment of the first and second electrical connectors 100 and 200, as described above.

Figure 15A:
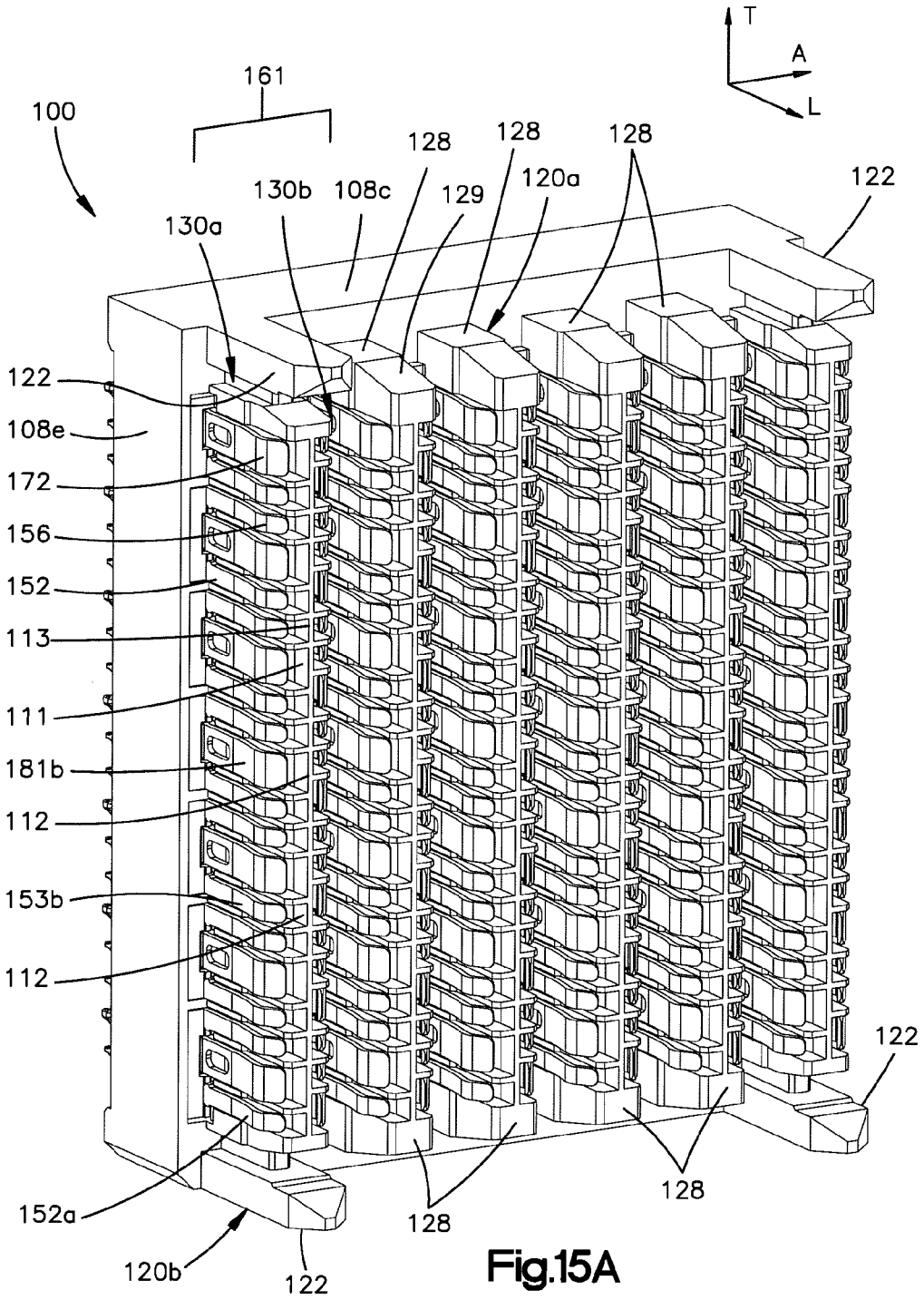
FIG. 15A is a perspective view of the first electrical connector substantially as illustrated in FIG. 2A, but constructed in accordance with an alternative embodiment, and including contact support projections.
Figure 15B:
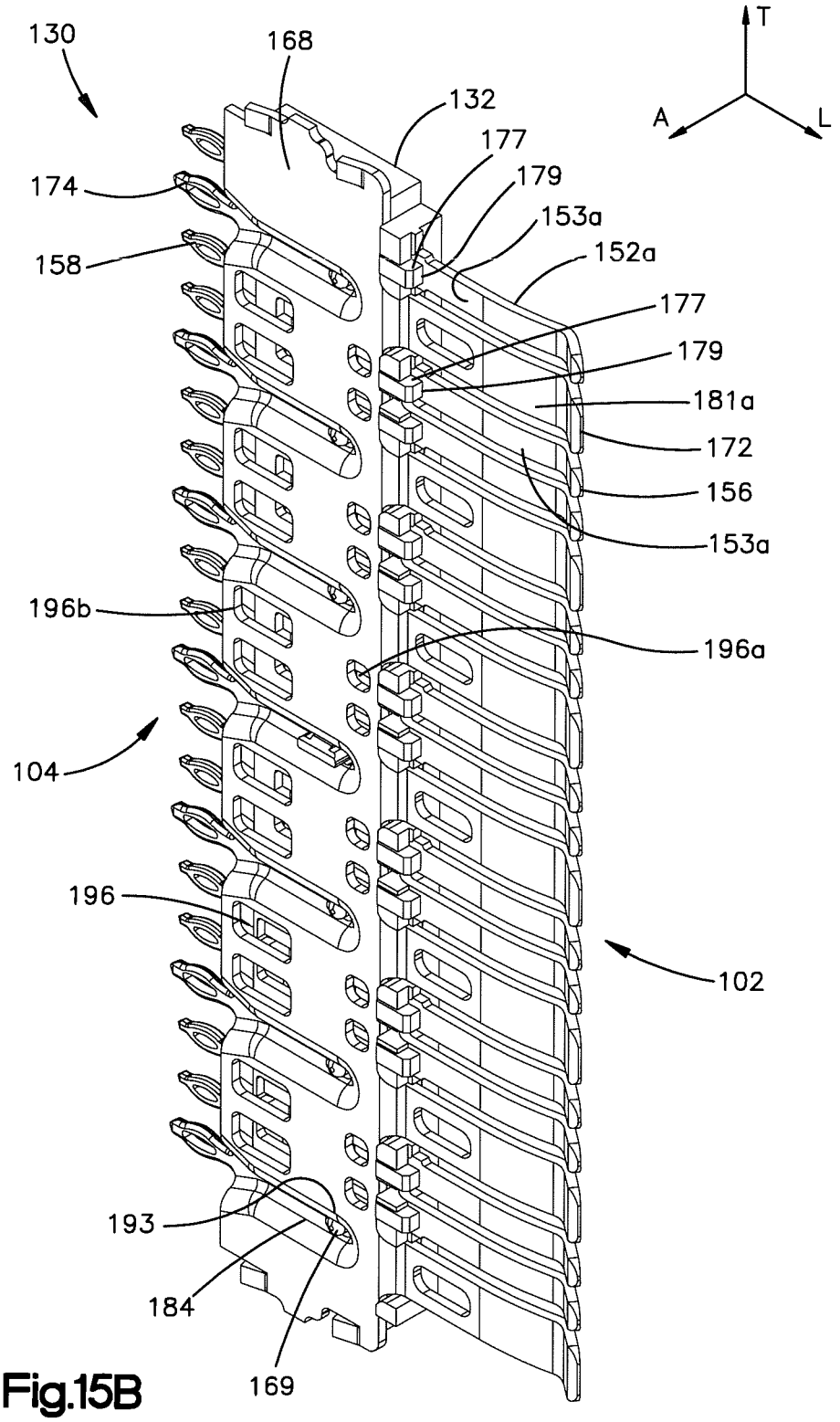
FIG. 15B is a perspective view of one of the leadframe assemblies of the first electrical connector illustrated in FIG. 15A.
Figure 15C:
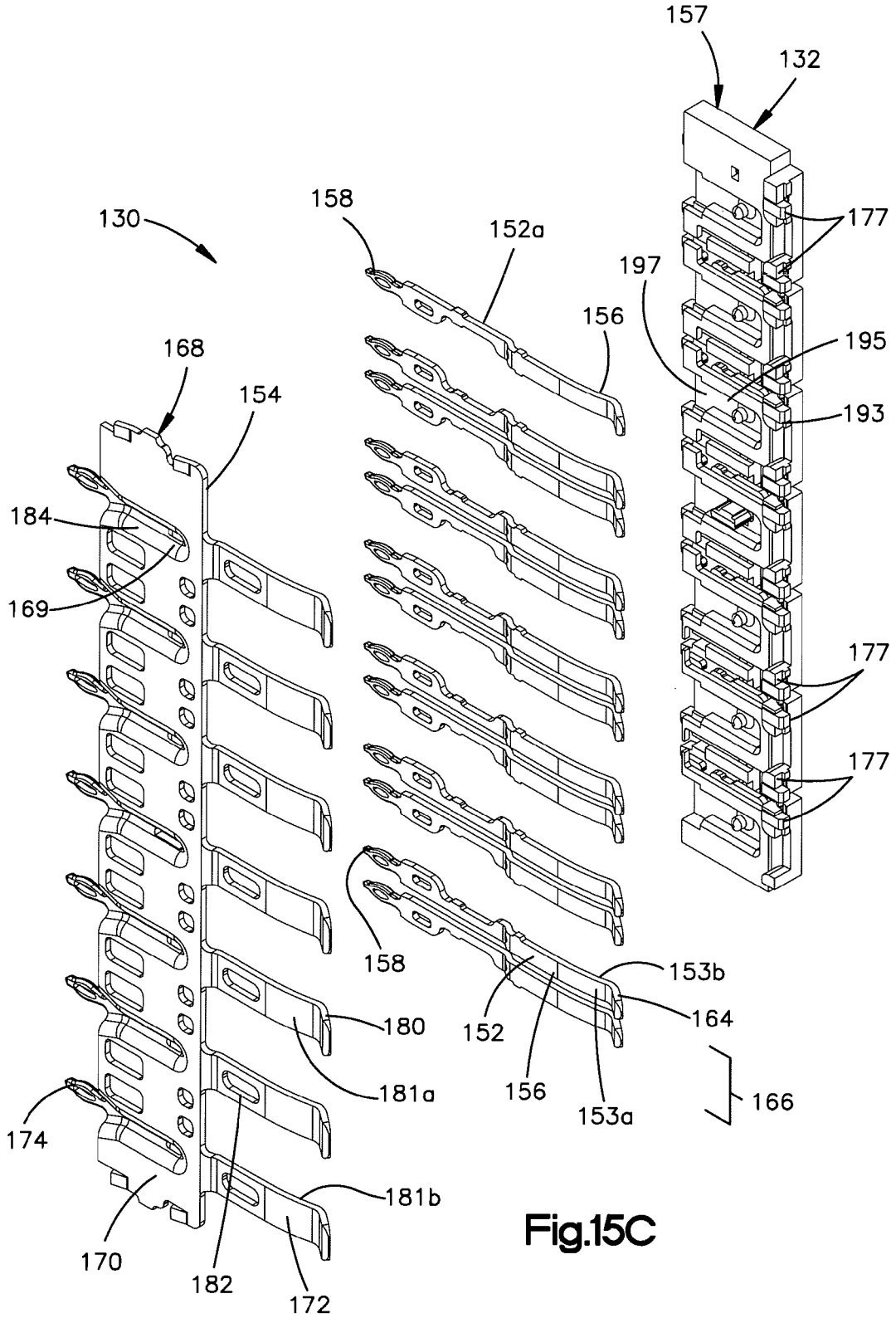
FIG. 15C is an exploded perspective view of the leadframe assembly illustrated in FIG. 15B.

Referring now to FIGS. 15A-C, the first electrical connector 100 can be constructed in accordance with an alternative embodiment. As described above with respect to FIGS. 2A-3B and FIG. 8A, the first electrical connector 100 can include as many leadframe assemblies 130 as desired, and as many gross alignment members 120*a* as desired, which can be positioned as inner alignment members. For instance, the first electrical connector can include at least one such as a plurality of pairs of gross alignment members 120*a*. FIG. 15A illustrates four pairs of gross alignment members 120*a* spaced from each other along the lateral direction A, and disposed between first and second pairs of fine alignment members 120*b*, which can be positioned as outer alignment members, along the lateral direction A. The gross alignment members 120*a* can be configured as gross alignment beams 128 as described above.

The gross alignment members 120*a* of each respective pairs of gross alignment members 120*a* can be aligned with each other and spaced from each other along the transverse direction T. At least one such as a pair 161 of leadframe assemblies, for instance first and second leadframe assemblies 130*a* and 130*b*, can extend between each of a pair of gross alignment members 120*a* along the transverse direction T. For instance, all of the inner pairs 161*b* of leadframe assemblies 130 of the electrical connector 100 along the lateral direction A can extend between ones of a respective pair of inner alignment members, which can be gross alignment members 120*a* along the transverse direction T. Each of the outer pairs 161*a* of leadframe assemblies 130 can extend between ones of a respective pair of outer alignment members, which can be the fine alignment members 120*b*. Further, each the gross alignment members of each pair of gross alignment members 120*a* can be disposed on opposed sides of at least one leadframe assembly, such as a pair 161 of first and second leadframe assemblies 130*a-b*. Further the first and second leadframe assemblies 130*a-b* of each pair 161 can be disposed adjacent the opposed surfaces 111 and 113 of a respective one of the divider walls 112 as described above.

Referring now to FIGS. 15B-C in particular, each leadframe assembly 130 can include at least one contact support projection 177 that is configured to abut the mating ends of at least some of the electrical contacts 150, and resist flexing of the mating ends as they mate with complementary mating ends of complementary signal contacts. As described above, the mating ends of the electrical contacts 250 can apply a force against the mating ends of the electrical contacts 150 that is normal to the mating direction. The normal force can bias each of the mating ends of the electrical contacts 150 and 250 to flex a toward their respective divider walls 112 and 212 any distance as desired. The contact support projections 177 are configured to support the electrical contacts 150, for instance at the mating ends, and provide a force against the electrical contacts 150 that opposes the normal force applied by the second electrical contacts 250 so as to reduce the distance that the mating ends flex toward the respective divider wall 112 as the first electrical connector 100 is mated to the second electrical connector 200. In accordance with one embodiment, the contact support projections 177 can stiffen the first electrical contacts 150 such that the flexibility of the first electrical contacts 150 is reduced at the mating ends. Thus, the contact support projections 177 can increase a contact force that the first electrical contacts 150 and second electrical contacts 250 apply to each other at the mating ends when mated.

In accordance with one embodiment, the contact support projections 177 can extend forward from the front surface of the leadframe housing body 157 along the longitudinal direction L, and thus forward from respective channels in the leadframe housing 132 that retains the electrical signal contacts 152. The projections 177 can abut a select one of the ground mating ends 172 and the mating ends 156 of the electrical signal contacts, for instance at the respective inner surfaces 153*a* and 181*a*, at respective abutment locations 179. Thus, as the respective concave outer surfaces 153*b* and 181*b* ride along the concave outer surfaces of the electrical contacts 150, the abutment locations 179 that would otherwise flex are held stationary by the contact support projections 177. In accordance with the illustrated embodiment, the contact support projections 177 are aligned with the mating ends 156, and contact the mating ends at the respective first surfaces 153*a*. For instance, all of the signal contacts 152 and the single widow contact 152*a* can abut a contact support projection 177 at their respective inner surfaces 153*a*. Accordingly, the contact support projections 177 can be disposed between the respective mating ends 156 and the corresponding divider wall 112.

The ground plate 168 can further include a plurality of impedance control apertures 196 that extend through the ground plate body 170 along the lateral direction A. For instance, the impedance control apertures 196 can extend through the ground plate body 70 at locations between immediately adjacent ones of the ribs 184 along the transverse direction T. The apertures 196 can be enclosed along a plane that is defined by the longitudinal direction L and the transverse direction T. In accordance with the illustrated embodiment, each of the impedance control apertures 196 can be aligned between a select one of the mating ends 156 of the electrical signal contacts 152 and a select one of the mounting ends 158 of the electrical signal contacts 152. For example, the impedance control apertures 196 can include a first plurality of impedance control apertures 196*a* disposed adjacent the mating ends 156 of the electrical signal contacts 152, and a second plurality of impedance control apertures 196*b* disposed adjacent the mounting ends 158 of the electrical signal contacts 152. Thus, the first plurality of impedance control apertures 196*a* are spaced closer to the mating ends 156 with respect to a distance that the second impedance control apertures 196*b* are spaced from the mating ends 156. Each of the first and second pluralities of impedance control apertures 196*a* and 196*b* can define a respective first dimension along the transverse direction T, and a respective second dimension in the longitudinal direction L. Both the first and second dimensions of the second impedance control aperture 196*b* can be greater than the respective first and second dimensions of the first impedance control aperture 196*a*. It is recognized that metal has a higher dielectric constant, and that impedance can be controlled, for instance, by removal of a portion of the ground plate body 170 to create the impedance control apertures 196. In accordance with the illustrated embodiment, a line drawn between each pair of aligned mating ends 156 and mounting ends 174 along the longitudinal direction L extends, for instance bisects one of the first plurality of impedance control apertures 196*a* and one of the second plurality of impedance control apertures 196*b*. The ground plate 168 can be devoid of the impedance control apertures at locations aligned with the ground mating ends 172, ribs 184, and ground mounting ends 174, respectively. It should be appreciated that the impedance control apertures 196 can include any number of apertures that extend through the ground plate body 170, of any size and shape as desired. Further, any of the electrical connectors described herein can include impedance control ribs of the type described herein.

Figure 16A:
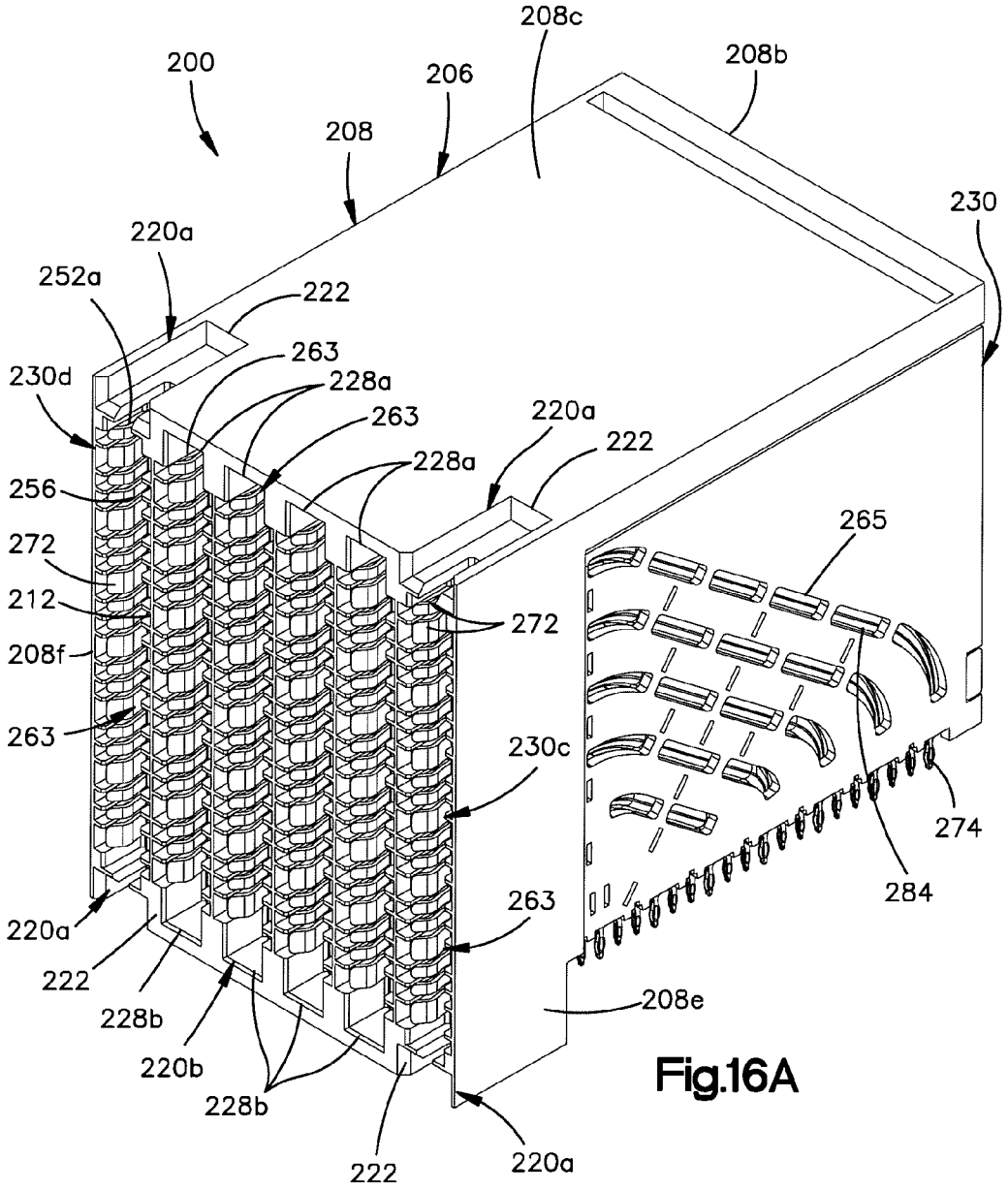
FIG. 16A is a perspective view of the second electrical connector substantially as illustrated in FIG. 4A, but constructed in accordance with an alternative embodiment, and including contact support projections and leadframe apertures.

Referring now to FIGS. 16A-D, the second electrical connector 200 can be constructed in accordance with an alternative embodiment. As described above with respect to FIGS. 4A-5C and FIG. 8B, the second electrical connector 200 can include as many leadframe assemblies 230 as desired, and as many gross alignment members 220*a* as desired, which can be positioned as inner alignment members. For instance, the second electrical connector 200 can include at least one such as a plurality of pairs of gross alignment members 220*a*. FIG. 16A illustrates four pairs of gross alignment members 220*a* spaced along the lateral direction A, and disposed between first and second pairs of fine alignment members 220*b*, which can be positioned as outer alignment members. The gross alignment members 220*a* can be configured as gross alignment recesses 222 as described above.

Each pair of gross alignment members 220*a* can be aligned with each other and spaced from each other along the transverse direction T. At least one such as a pair of the gaps 263, such as the outer gaps, can extend between each of a respective pair of gross alignment members 220*a* along the transverse direction T. At least one up to all of the inner pairs of the gaps 263 of the second electrical connector 200 along the lateral direction A can extend between ones of a respective pair of inner alignment members, which can be fine alignment members 220*b*, along the transverse direction T. Further, each of the gross alignment members of each pair of gross alignment members 220*a* can be disposed on opposed sides of one of the gaps 263. Further the first and second leadframe assemblies 230*a-b* of each pair 261 can be disposed adjacent opposed surfaces 211 and 213 of a respective one of the divider walls 212 as described above.

Figure 16B:
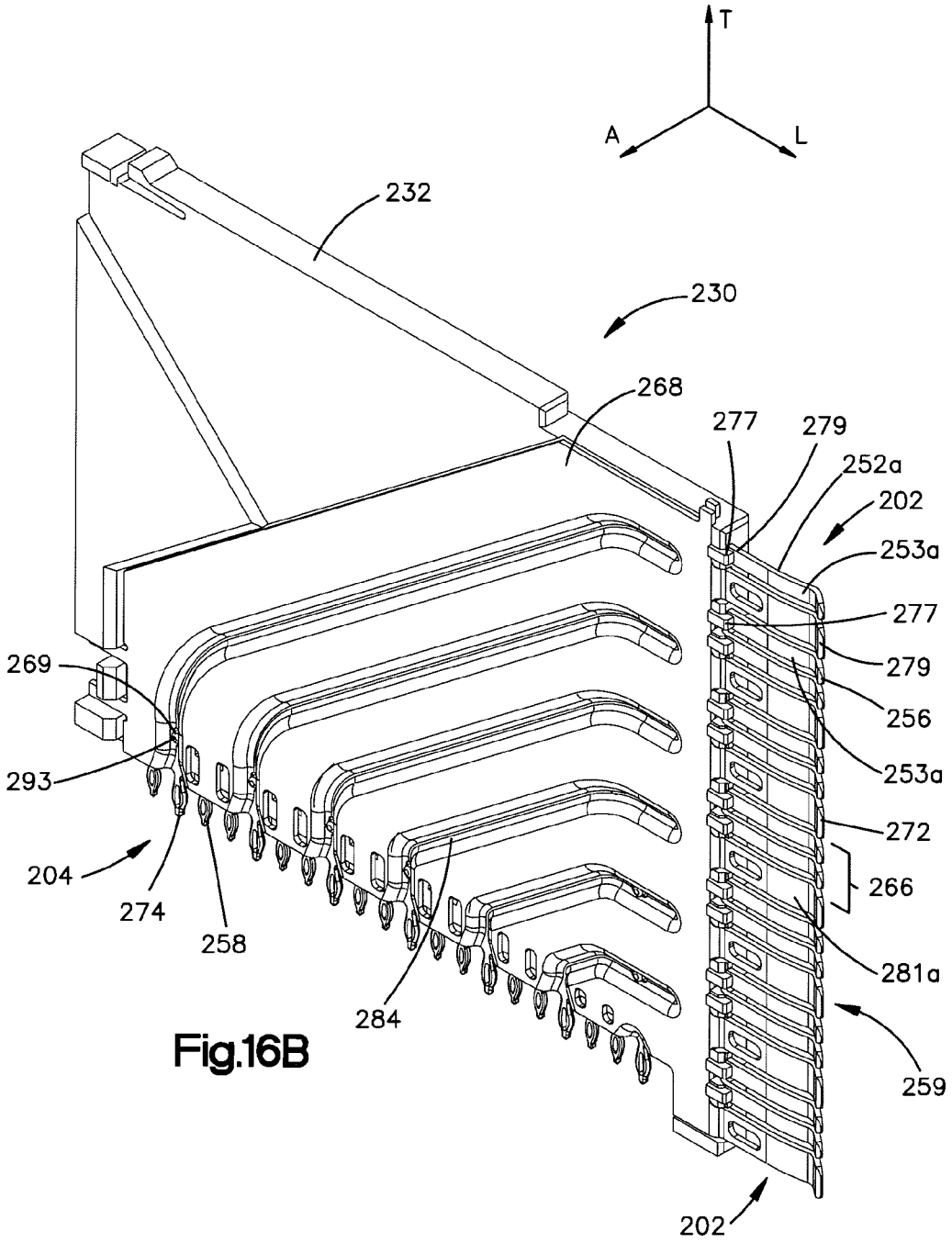
FIG. 16B is a first perspective view of a leadframe assembly of the first electrical connector illustrated in FIG. 15A.
Figure 16C:
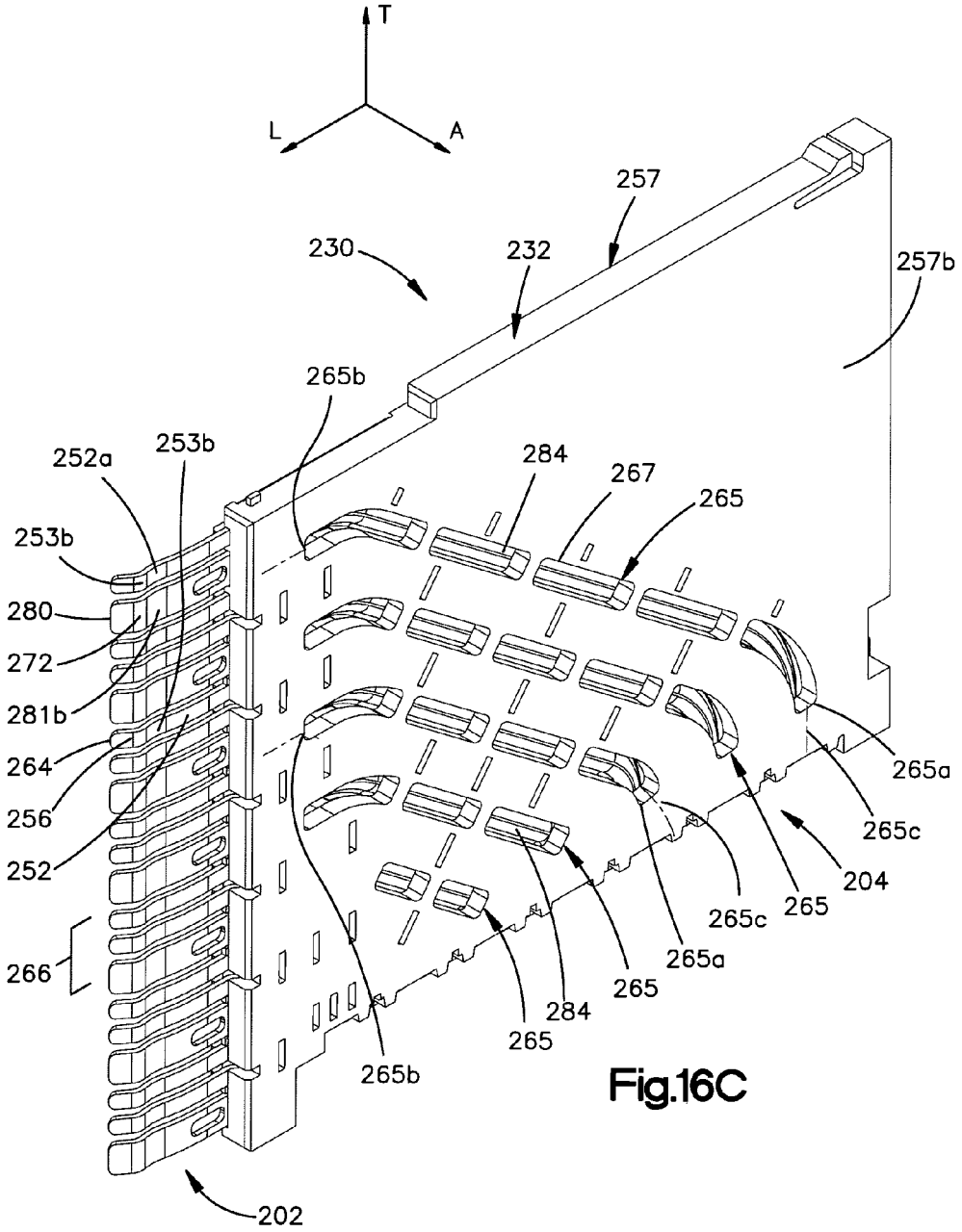
FIG. 16C is a second perspective view of the leadframe assembly illustrated in FIG. 16B.
Figure 16D:
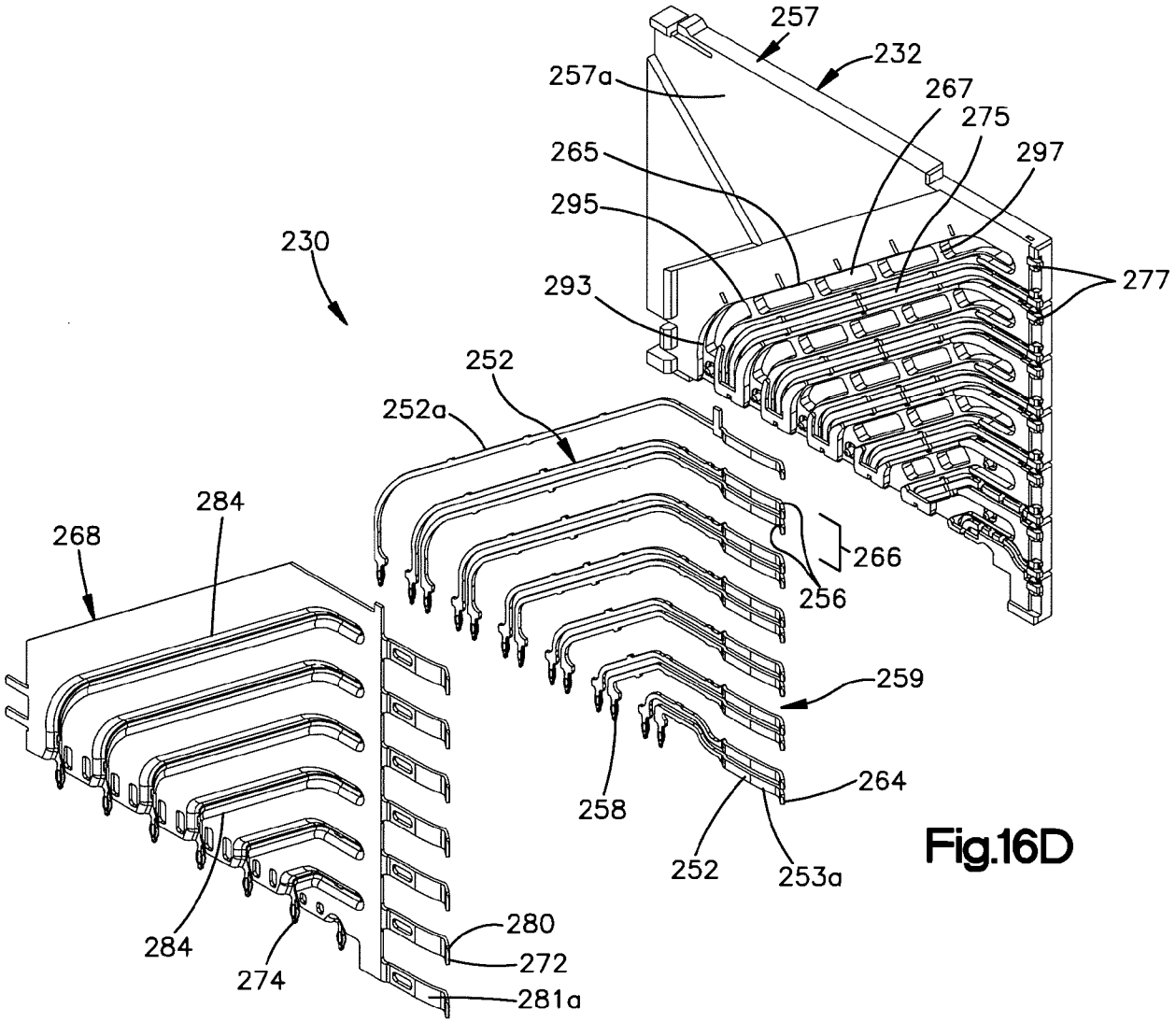
FIG. 16D is an exploded perspective view of the leadframe assembly illustrated in FIG. 16B.

Referring now to FIGS. 16B-D in particular, each leadframe assembly 230 can include at least one contact support projection 277 that is configured to abut the mating ends of at least some of the electrical contacts 250. As described above, the mating ends of the electrical contacts 150 can apply a force against the mating ends of the electrical contacts 250 that is normal to the mating direction. The normal force can bias each of the mating ends of the electrical contacts 150 and 250 to flex a toward their respective divider walls 112 and 212 any distance as desired. The contact support projections 277 are configured to support the electrical contacts 250, for instance at the mating ends, and provide a force against the electrical contacts 250 that opposes the normal force applied by the second electrical contacts 150 so as to reduce the distance that the mating ends flex toward the respective divider wall 212 as the second electrical connector 200 is mated to the first electrical connector 100. In accordance with one embodiment, the contact support projections 277 can stiffen the first electrical contacts 250 such that the flexibility of the first electrical contacts 250 is reduced at the mating ends. Thus, the contact support projections 277 can increase a contact force that the first electrical contacts 150 and second electrical contacts 250 apply to each other at the mating ends when mated.

In accordance with one embodiment, the contact support projections 277 can extend forward from a front surface of the leadframe housing body 257 along the longitudinal direction L, and thus forward from respective channels in the leadframe housing 232 that retains the electrical signal contacts 252. The projections 277 can abut a select one of the ground mating ends 272 and the mating ends 256 of the electrical signal contacts 252, for instance at the respective inner surfaces 253*a* and 281*a*, at respective abutment locations 279. Thus, as the respective concave outer surfaces 253*b* and 281*b* ride along the concave outer surfaces of the electrical contacts 250, the abutment locations 279 that would otherwise flex are held stationary by the contact support projections 277. In accordance with the illustrated embodiment, the contact support projections 277 are aligned with the mating ends 256, and contact the mating ends at the respective first or inner surfaces 253*a*. For instance, all of the signal contacts 252 and the single widow contact 252*a* can abut a contact support projection 277 at their respective inner surfaces 253*a*. Accordingly, the contact support projections 277 can be disposed between the respective mating ends 256 and the corresponding divider wall 212.

With continuing reference to FIGS. 16A-D, at least one or more up to all of the leadframe assemblies can include a plurality of leadframe apertures 265 that extend through the leadframe housing body 257 at locations aligned with the ribs 284. For instance, as described above, the ground plate 268 is configured to be attached to a first side 257*a* of the leadframe housing body 257, such that the projected surfaces of the ribs 284 are at least partially disposed in the recessed regions 295 of the leadframe housing 232, such that the projected surfaces of the ribs 284 face the recessed surface 297 of the leadframe housing 232. The leadframe housing body 257 further defines a second side 257*b* that is opposite the first side 257*a* along the lateral direction A. The leadframe housing 232 can define the leadframe apertures 265 that extend through the leadframe housing body 257 along the lateral direction A from the second side 257*b* through the recessed surface 297. Thus, the electrical signal contacts 252 can lie in a plane that extends between the leadframe apertures 265 and the ground plate 268. The leadframe apertures 265 can be aligned with respective ones of the gaps 259 along the lateral direction A, and can thus be aligned between the ground mating ends 272 and the ground mounting ends 274. Thus, respective ones of the leadframe apertures 265 can each be aligned with a respective gap 259, such that each gap 259 can be aligned with a select at least one such as a plurality of the leadframe apertures 265.

The leadframe apertures 265 define a first end 265*a* disposed proximate to the ground mounting end 274, and a second end 265*b* disposed proximate to the ground mating end 272. The leadframe apertures 265 defines a first portion that can be bent, such as curved, with respect to a second portion of the leadframe aperture 265, when the leadframe assembly 230 is a right-angle leadframe assembly and the second electrical connector 200 is a right-angle electrical connector. The first portion can, for instance, be defined at the first end 265*a*, and can be elongate along a direction away from the ground mounting end 274 along the transverse direction T, and toward the ground mating end 272 along the transverse direction T and the longitudinal direction L. The second portion can be defined at the second end 265*b*, and can be elongate along a direction away from the ground mating end 272 along the longitudinal direction L, and toward the ground mounting end 274 along the longitudinal direction L and the transverse direction T. At least one or more up to all of the leadframe apertures 265 can extend continuously from the first end 265*a* to the second end 265*b*, or can be segmented between the first end 265*a* and the second end 265*b*, so as to define at least two such as a plurality of aperture segments 267. At least one or more up to all of the segments 267 can be elongate along both the transverse direction T and the longitudinal direction L.

The leadframe apertures 265, including each of the respective segments 267, can be elongate along respective central axes 265*c* from the first end 265*a* to the second end 265*b*. The respective segments 267 of each aperture 265 can be aligned with each other along the central axis 265*c*. Each central axis 265*c* can extend between and can be aligned with a select ground mounting end 274 and a select ground mating end 272. The central axes 265*c* of at least two or more up to all of the leadframe apertures 265 can be parallel with each other.

The aperture segments 267 can be separated by respective portions of the leadframe housing body 257 that support the electrical signal contacts 252. The portions of the leadframe housing body 257 can, for instance, extend from the second side 257*b* toward the first side 257*a*, for instance to the recessed surface 297, and can define the recessed surface 297. Further, the portions of the leadframe housing body 257 can define the channels 275 that retain respective ones of the signal contacts 252. For instance the portions of the leadframe housing body 257 can be overmolded onto the signal contacts 252, and can define injection molding flow paths during construction of the leadframe assembly 230. Each of the leadframe apertures 265, including the aperture segments 267, can define a perimeter that is fully enclosed by the leadframe housing body 257. Alternatively, the perimeter of the leadframe apertures 265, including at least one or more of the aperture segments 267, can be open at the front end or the bottom end of the leadframe housing body 257.

As described above, each of the leadframe apertures 265 can be aligned along the lateral direction A with one of the ribs 284 and the respective one of the gaps 259 that are disposed between adjacent signal pairs 266. Thus, a line that extends along the lateral direction A can pass through one of the leadframe apertures 265, an aligned one of the ribs 284, and an aligned one of the gaps 259 without passing through any of the signal contacts 252. Further, in accordance with one embodiment, the leadframe assembly 230 does not define a line that extends along the lateral direction A through one of the leadframe apertures 265, an aligned one of the ribs 284, and an aligned one of the gaps 259, and a signal contacts 252. In accordance with one embodiment, each of the leadframe apertures 265, and in particular the central axis 265*c*, can be equidistantly spaced between adjacent ones of the differential signal pairs 266 that are disposed on opposed sides of the gap 259 that is aligned with the respective aperture 265.

Each of the leadframe apertures 265 can define a length along the central axis 265*c*. For instance, if the leadframe aperture 265 extends continuously from the first end 265*a* to the second end 265*b*, the length can be defined by the distance from the first end 265*a* to the second end 265*b* along the central axis 265*c*. If the leadframe aperture 265 is segmented into the segments 267, the length can be defined by a summation of the distances of all segments 267 of each aperture 265 along the central axis 265*c*. In accordance with one embodiment, the length of at least one or more up to all of the leadframe apertures 265 can be at least half, for instance a majority, for instance greater than 60%, for instance greater than 75%, for instance greater than 80%, for instance greater than 90%, up to and including 100% the length of the aligned one of the ribs 284 as measured along the a central axis 265*c*.

It is recognized that the dielectric constant of plastic is greater than the dielectric constant of air. Because the leadframe housings 232 can be made from plastic, the leadframe apertures 265 define a dielectric constant that is less than the dielectric constant of the leadframe housing 232. It has been found that the leadframe apertures 265 reduce far end crosstalk between adjacent ones of the differential signal pairs 266.

Figure 17:
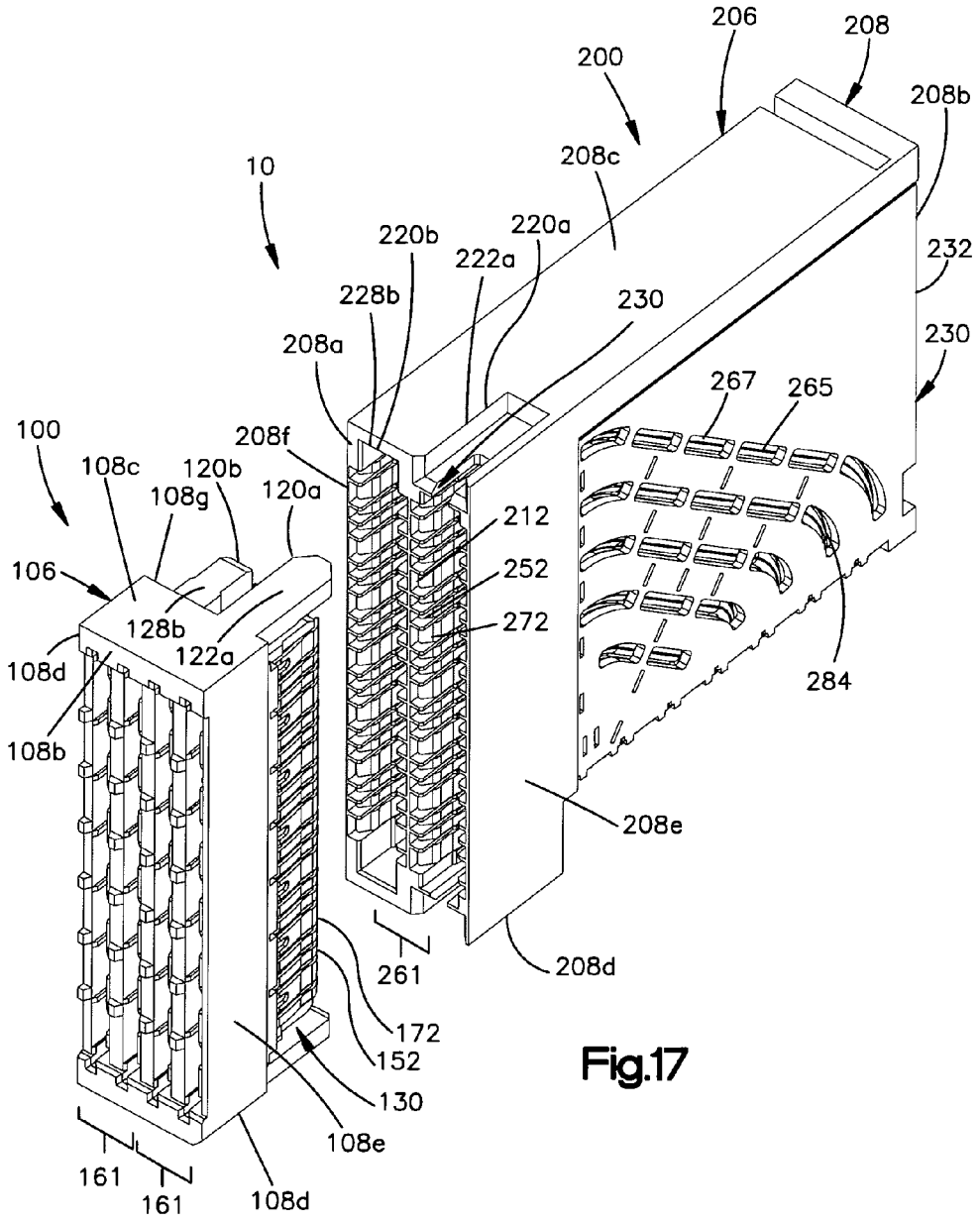
FIG. 17 is an exploded perspective view of an electrical connector assembly of the type illustrated in FIG. 1, but including first and second electrical connectors constructed in accordance with another embodiment, the first and second electrical connectors configured to be mated to each other, the first and second electrical connectors shown with mounting tails removed for illustrative purposes.

Referring now to FIG. 17, the electrical connector assembly 10 can include a first electrical connector 100 constructed in accordance with any embodiment described herein, unless otherwise indicated, and a second electrical connector 200 constructed in accordance any embodiment as described herein, unless otherwise indicated. For instance, the second electrical connector 200 can include the leadframe apertures 265 as described above. As will be appreciated from the description below, the first electrical connector 100 can further include respective leadframe apertures. Furthermore, as described above, the first and second electrical connectors 100 and 200 can include as many leadframe assemblies 230 as desired, can include as many gross alignment members 220*a* as desired, which can be positioned as inner alignment members or outer alignment members, and can include as many fine alignment members 220*b* as desired, which can be positioned as inner alignment members or outer alignment members. The inner alignment members are disposed between the outer alignment members along the lateral direction A.

For instance, the first electrical connector 100 can include at least one such as a pair of gross alignment members 120*a*, and a pair of fine alignment members 120*b* that is disposed adjacent the pair of gross alignment members 120*a*. FIG. 17 illustrates one pair of gross alignment members 120*a* and one pair of fine alignment members 120*b* spaced from the pair of gross alignment members 120*a* along the lateral direction A. Similarly, the second electrical connector 200 can include at least one such as a pair of gross alignment members 220*a*, and a pair of fine alignment members 220*b* that is disposed adjacent the pair of gross alignment members 220*a*. FIG. 17 illustrates one pair of gross alignment members 220*a* and one pair of fine alignment members 220*b* spaced from the pair of gross alignment members 220*a* along the lateral direction A.

Furthermore, the first and second electrical connectors 100 and 200 can include any number of leadframe assemblies 130 and 230, respectively, as desired, such as four as illustrated. The leadframe assemblies 130 of the first electrical connector 100 can be arranged in two pairs of first and second leadframe assemblies 130*a-b* each disposed adjacent opposed surfaces of a divider wall as described above. The leadframe assemblies 230 of the second electrical connector can be arranged in pairs that are disposed on opposite sides of a divider wall 212, or arranged as individual leadframe assemblies that are disposed adjacent a divider wall 212 or otherwise supported by the connector housing 208. In accordance with the illustrated embodiment, the second electrical connector includes first and second individual leadframe assemblies 230*c* and 230*d*, and a single pair 261 of first and second leadframe assemblies 230*a-b* disposed adjacent the respective first and second sides 111 and 113 of the divider wall, as described above. The second electrical connector defines a first gap 263 disposed between the pair 261 and the first individual leadframe assembly 230*c* along the lateral direction A, and a second gap 263 disposed between the pair 261 and the second individual leadframe assembly 230*d* along the lateral direction. The gross alignment members 220*a* can be aligned with the first gap 263 as described above, and the fine alignment members 220*b* can be aligned with the second gap 263 as described above.

It should be appreciated that connector assemblies of the type described herein can include first and second electrical connectors. One of the first and second electrical connectors can include a number of divider walls that is equal to half the number of leadframe assemblies, such that all leadframe assemblies are arranged in pairs of first and second leadframe assemblies disposed on opposite sides of a divider wall as described above. The other of the first and second electrical connectors can include a number of divider walls that is equal to one plus half the number of leadframe assemblies. The divider walls of the other of the first and second electrical connectors can include the side walls of the respective connector housing. Thus, the leadframe of assemblies the other of the first and second electrical connectors can be arranged in pairs of first and second leadframe assemblies disposed on opposite sides of respective divider wall as described above, and individual first and second leadframe assemblies disposed adjacent a respective divider wall that is dedicated to the corresponding individual leadframe assembly. The dedicated divider wall can, for instance, be defined by the side walls of the connector housing.

With continuing reference to FIG. 17, the gross alignment members 120*a* can include first and second gross alignment beams 122 of the type described above. The fine alignment members 120*b* can include first and second fine alignment beams 128 of the type described above. The fine alignment beams 128 can be outwardly disposed from the gross alignment beams 122 along the transverse direction. That is, the gross alignment members 120*a* can be disposed between the fine alignment members 120*b* with respect to the transverse direction T. The gross alignment members 120*a* can be offset from the fine alignment members 120*b* along the lateral direction A. The gross alignment members 220*a* of the second electrical connector 200 can include first and second gross alignment recesses 222 that extend into the top and bottom walls 208*c* and 208*d* along the outward transverse direction T. The fine alignment members 220*b* of the second electrical connector 200 can include first and second fine alignment recesses 228 that extend into the top and bottom walls 208*c* and 208*d* along the inner transverse direction T. Thus, the gross alignment members 220*a* can be disposed between the fine alignment members 220*b* with respect to the transverse direction T. The gross alignment members 220*a* can be offset from the fine alignment members 220*b* along the lateral direction A. The gross alignment members 120*a* and 220*a* are configured to engage so as to complete the first stage of alignment in the manner described above. After completion of the first stage of alignment, the fine alignment members 120*a* and 220*a* are configured to engage so as to complete the second stage of alignment in the manner described above.

Figure 18A:
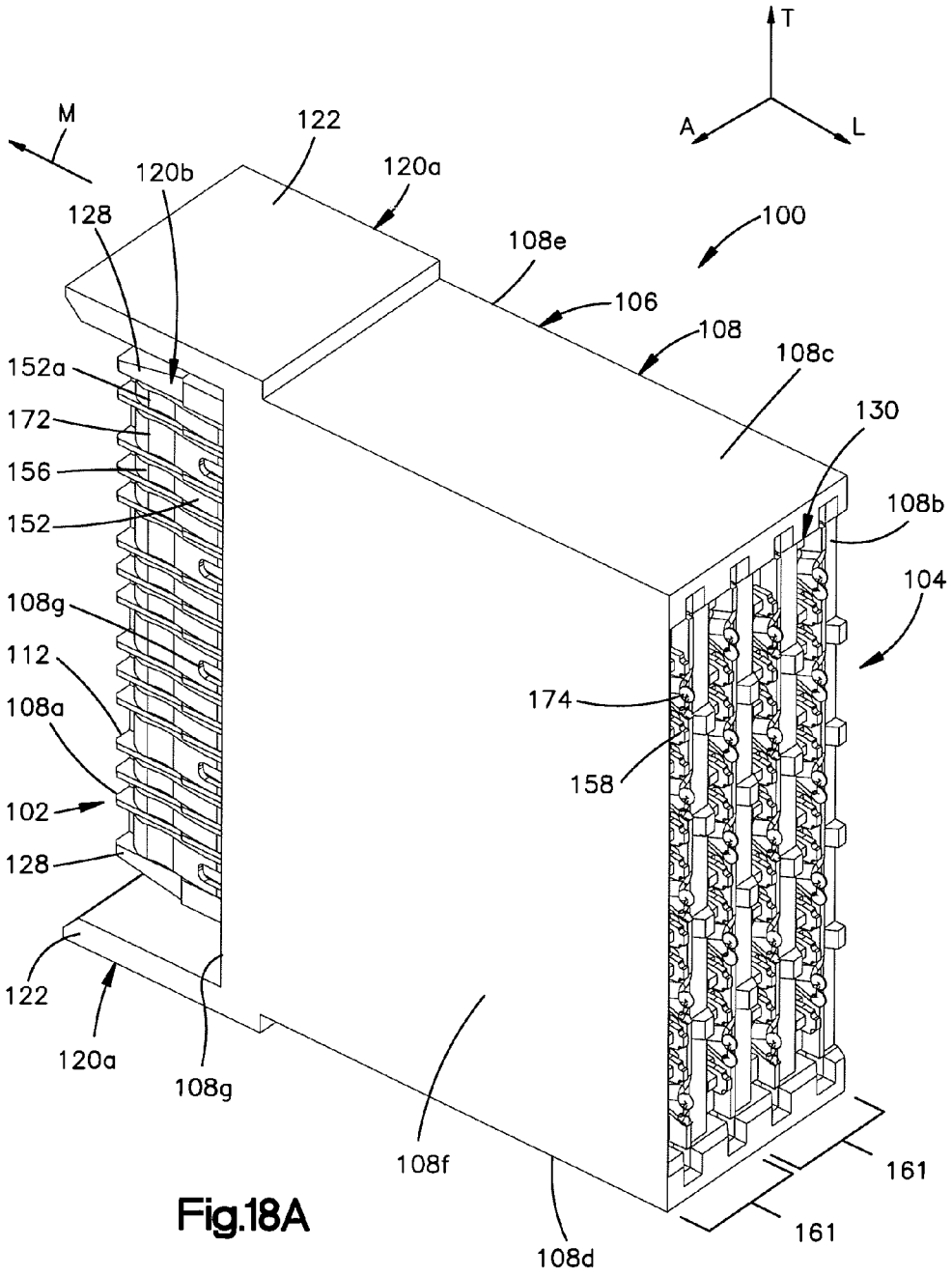
FIG. 18A is a perspective view of the first electrical connector as illustrated in FIG. 2A, but constructed in accordance with an alternative embodiment including leadframe apertures, shown with mounting tails removed for illustrative purposes.

Referring now to FIG. 18A, the first electrical connector 100 can be constructed in accordance with any embodiment described herein, unless otherwise indicated. The first electrical connector 100 can include alignment members 120 that are configured mate with complementary engagement members of a second electrical connector 200 (see FIG. 19A) so as to provide the first and second stages of alignment as the electrical connectors mate. In accordance with the illustrated embodiment, the gross alignment members 120*a* can be configured as gross alignment beams 122 that extend out forward from the abutment wall 108*g* to a location forward from the front end 108*a* along the mating direction M. The gross alignment beams 122 can extend between the first side 108*e* and the second side 108*f*, for instance from the first side 108*e* to the second side 108*f*. The alignment beams 122 can be aligned with one or more up to all of the leadframe assemblies 130 along the transverse direction T, such that one or more up to all of the leadframe assemblies 130 are disposed between and aligned with the alignment beams 122. The fine alignment members 120*b* can be configured as fine alignment beams 128 that extend out from the abutment surface at locations aligned with respective pairs of leadframe assemblies 130, such that each pair of leadframe assemblies can be aligned with and disposed between a pair of fine alignment beams 128. The first electrical connector 100 can be configured as a vertical electrical connector, whereby the mating interface 102 can be oriented substantially parallel with the mounting interface 104, as described above.

Figure 18B:
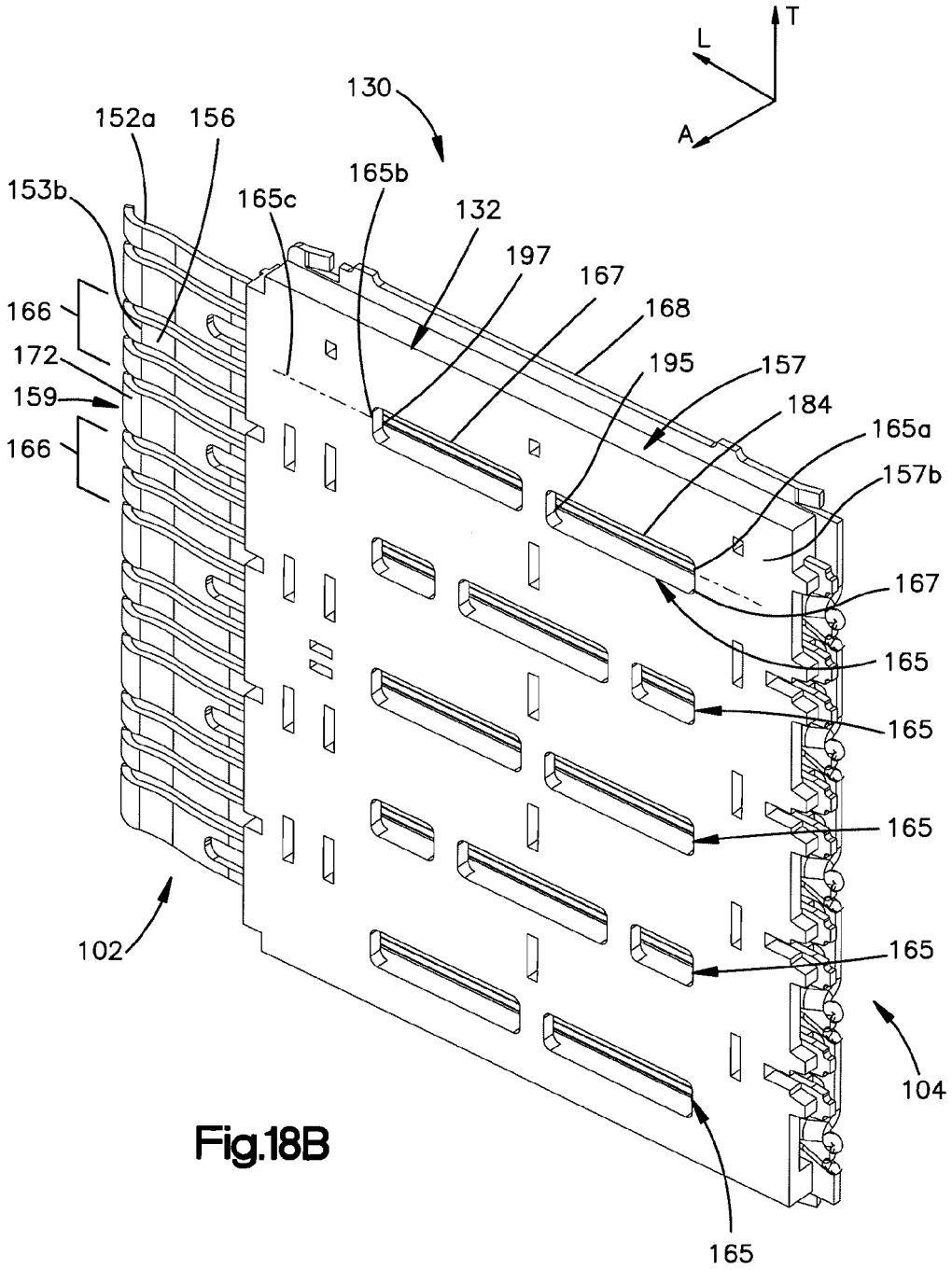
FIG. 18B is a perspective view of a leadframe assembly of the first electrical connector illustrated in FIG. 18A, shown with mounting tails removed for illustrative purposes.
Figure 18C:
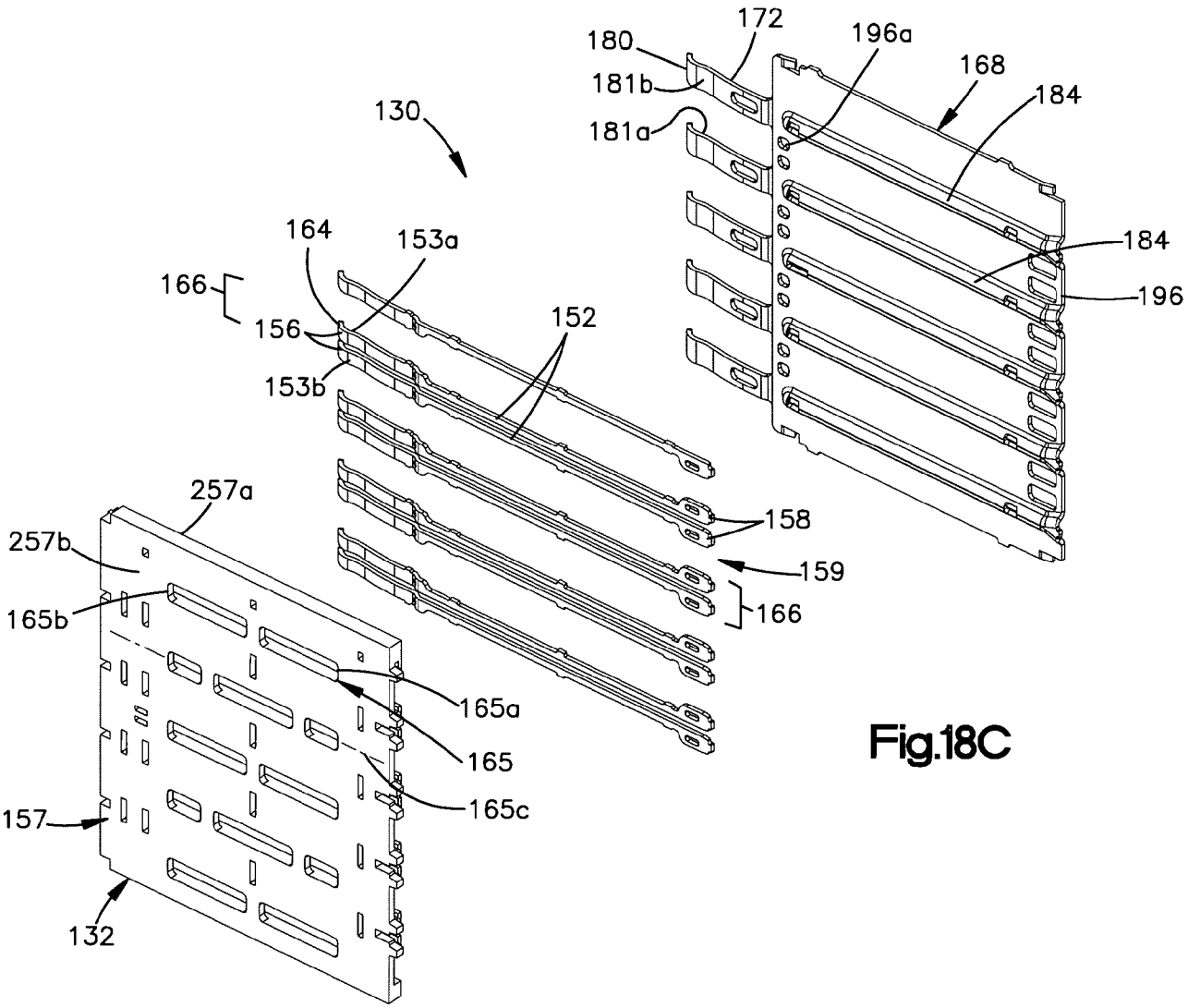
FIG. 18C is an exploded view of the leadframe assembly of the first electrical connector as illustrated in FIG. 18B.

Referring now to FIGS. 18B-18C, at least one or more up to all of the leadframe assemblies 130 can include a plurality of leadframe apertures 165 that extend through the leadframe housing body 157, and thus through the leadframe housing 132, at locations aligned with the ribs 184. For instance, as described above, the ground plate 168 is configured to be attached to a first side 157*a* of the leadframe housing body 157, such that the projected surfaces of the ribs 184 are at least partially disposed in the recessed regions 195 of the leadframe housing 132, such that the projected surfaces of the ribs 184 face the recessed surface 197 of the leadframe housing 132. The leadframe housing body 157 further defines a second side 157*b* that is opposite the first side 157*a* along the lateral direction A. The leadframe housing 132 can define the leadframe apertures 165 that extend through the leadframe housing body 157 along the lateral direction A from the second side 157*b* through the recessed surface 197. Thus, the electrical signal contacts 152 can lie in a plane that extends between the leadframe apertures 165 and the ground plate 168. The leadframe apertures 165 can be aligned with respective ones of the gaps 159 along the lateral direction A, and can thus be aligned between the ground mating ends 172 and the ground mounting ends 174. Thus, respective ones of the leadframe apertures 165 can each be aligned with a respective gap 159, such that each gap 159 can be aligned with a select at least one such as a plurality of the leadframe apertures 165.

The leadframe apertures 165 define a first end 165*a* disposed proximate to the ground mounting end 174, and a second end 165*b* disposed proximate to the ground mating end 172. At least one or more up to all of the leadframe apertures 165 can extend continuously from the first end 165*a* to the second end 165*b*, or can be segmented between the first end 165*a* and the second end 165*b*, so as to define at least two such as a plurality of aperture segments 167. At least one or more up to all of the segments 167 can be elongate along the longitudinal direction L between the ground mating ends 172 and the ground mounting ends 174.

The leadframe apertures 165, including each of the respective segments 167, can be elongate along respective central axes 165*c* from the first end 165*a* to the second end 165*b*. The respective segments 267 of each aperture 165 can be aligned with each other along the central axis 165*c*. Each central axis 165*c* can extend between and can be aligned with a select ground mounting end 174 and a select ground mating end 172. The central axes 165*c* of at least two or more up to all of the leadframe apertures 165 can be parallel with each other.

The aperture segments 167 can be separated by respective portions of the leadframe housing body 157 that support the electrical signal contacts 152. The portions of the leadframe housing body 157 can, for instance, extend from the second side 157*b* toward the first side 157*a*, for instance to the recessed surface 197, and can define the recessed surface 197. Further, the portions of the leadframe housing body 157 can define the channels that retain respective ones of the signal contacts 152. For instance the portions of the leadframe housing body 157 can be overmolded onto the signal contacts 152, and can define injection molding flow paths during construction of the leadframe assembly 130. Each of the leadframe apertures 165, including the aperture segments 167, can define a perimeter that is fully enclosed by the leadframe housing body 157. Alternatively, the perimeter of the leadframe apertures 165, including at least one or more of the aperture segments 167, can be open at the front end or the bottom end of the leadframe housing body 157.

As described above, each of the leadframe apertures 165 can be aligned along the lateral direction A with one of the ribs 184 and the respective one of the gaps 159 that are disposed between adjacent signal pairs 166. Thus, a line that extends along the lateral direction A can pass through one of the leadframe apertures 165, an aligned one of the ribs 184, and an aligned one of the gaps 159 without passing through any of the signal contacts 152. Further, in accordance with one embodiment, the leadframe assembly 130 does not define a line that extends along the lateral direction A through one of the leadframe apertures 165, an aligned one of the ribs 184, and an aligned one of the gaps 159, and a signal contacts 152. In accordance with one embodiment, each of the leadframe apertures 165, and in particular the central axis 165*c*, can be equidistantly spaced between adjacent ones of the differential signal pairs 166 that are disposed on opposed sides of the gap 159 that is aligned with the respective aperture 165.

Each of the leadframe apertures 165 can define a length along the central axis 165*c*. For instance, if the leadframe aperture 165 extends continuously from the first end 165*a* to the second end 165*b*, the length can be defined by the distance from the first end 165*a* to the second end 165*b* along the central axis 165*c*. If the leadframe aperture 165 is segmented into the segments 167, the length can be defined by a summation of the distances of all segments 167 of each aperture 165 along the central axis 165*c*. In accordance with one embodiment, the length of at least one or more up to all of the leadframe apertures 165 can be at least half, for instance a majority, for instance greater than 60%, for instance greater than 75%, for instance greater than 80%, for instance greater than 90%, up to and including 100% the length of the aligned one of the embossments 184 as measured along the a central axis 165*c*.

It is recognized that the dielectric constant of plastic is greater than the dielectric constant of air. Because the leadframe housings 132 can be made from plastic, the leadframe apertures 165 define a dielectric constant that is less than the dielectric constant of the leadframe housing 132. It has been found that the leadframe apertures 165 reduce far end crosstalk between adjacent ones of the differential signal pairs 166. Furthermore, the ground plate 170 can include the first and second pluralities of impedance control apertures 196*a* and 196*b* of the type described above.

Figure 19A:
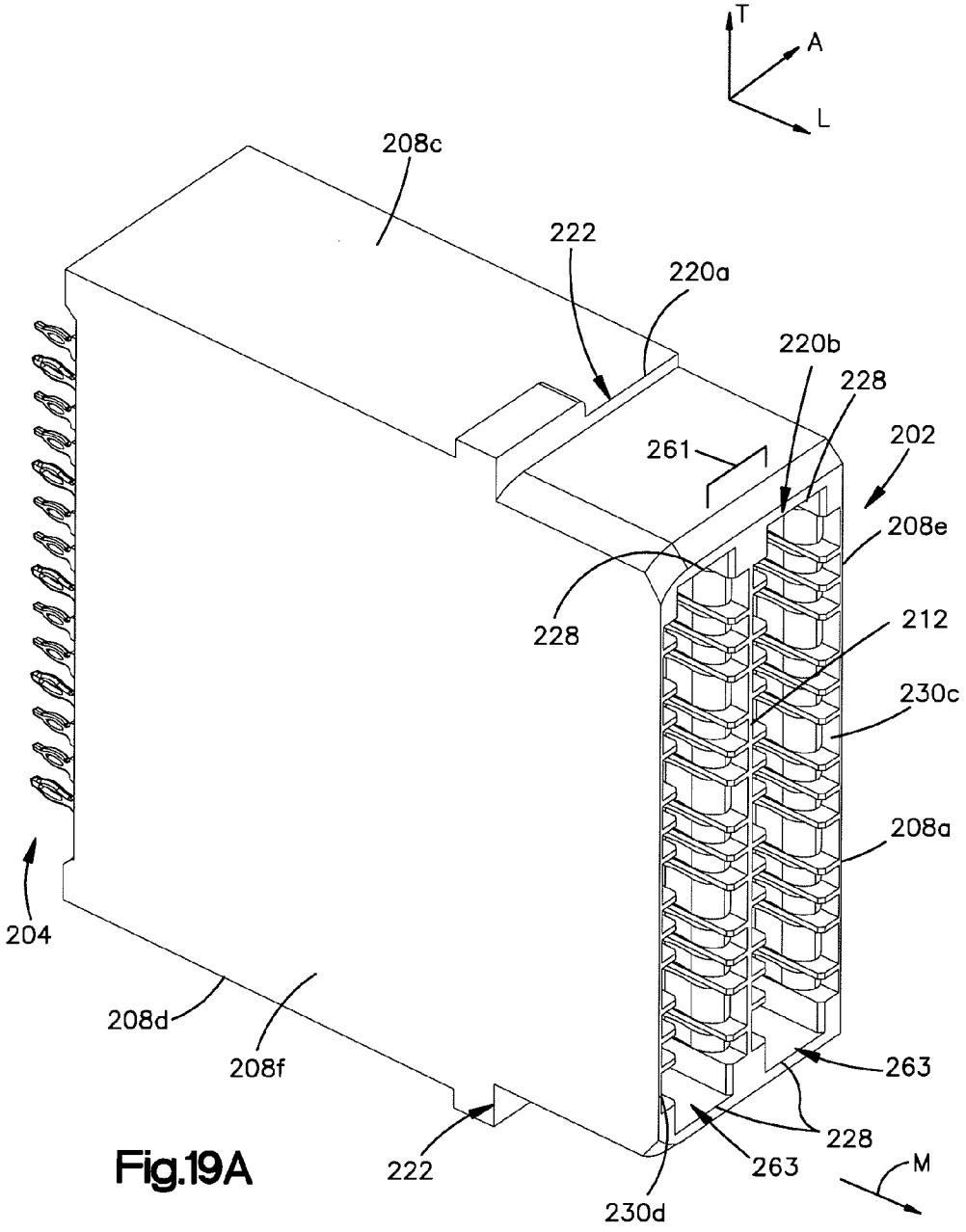
FIG. 19A is a perspective view of the second electrical connector as illustrated in FIG. 4A, but constructed in accordance with an alternative embodiment including leadframe apertures, and configured to mated with the first electrical connector illustrated in FIG. 18A.

Referring now to FIG. 19A, and as described above, the second electrical connector 200 can be configured as a vertical connector whereby the mating interface 202 is substantially perpendicular with respect to the mounting interface 204. The second electrical connector 200 can be configured to mate with the first electrical connector 100 of FIG. 18A in the manner described above. Thus, the electrical contacts 250 can be configured as vertical electrical contacts whose mating ends are oriented substantially parallel to the mounting ends. Thus, the first and second substrates 300*a* and 300*b* can be oriented substantially parallel with each other when the first electrical connector 100 is mounted to the first substrate 300*a*, the second electrical connector 200 is mounted to the second substrate 300*b*, and the first and second electrical connectors 100 and 200 are mated with each other (see FIG. 1).

The second electrical connector 200 can be constructed in accordance with any embodiment described herein, unless otherwise indicated. The second electrical connector 200 can include alignment members 220 that are configured mate with complementary engagement members of a first electrical connector 100 (see FIG. 18A). Thus, the gross alignment members 220*a* can be configured as gross alignment recesses 222 that extend down into the top wall 108*c* and bottom wall 108*d*, respectively, along a longitudinally rearward direction, that is along a direction opposite the mating direction M. The alignment recesses 222 can extend between the first side 208*e* and the second side 208*f*, for instance from the first side 208*e* to the second side 208*f*. The alignment recesses 222 can be aligned with one or more up to all of the leadframe assemblies 230 along the transverse direction T, such that one or more up to all of the leadframe assemblies 230 are disposed between and aligned with the alignment recesses 222. The gross alignment recesses 222*a* are configured to receive the gross alignment beams of the first electrical connector 100 described above with respect to FIG. 18A. The fine alignment members 220*b* can be configured as recesses 228 that extend into the top and bottom walls 203*c-d*, respectively, at locations aligned with respective ones of the apertures 265 along the transverse direction T, such that the apertures 265 are disposed between alignment recesses 228 of a pair of alignment recesses in the manner described above.

Figure 19B:
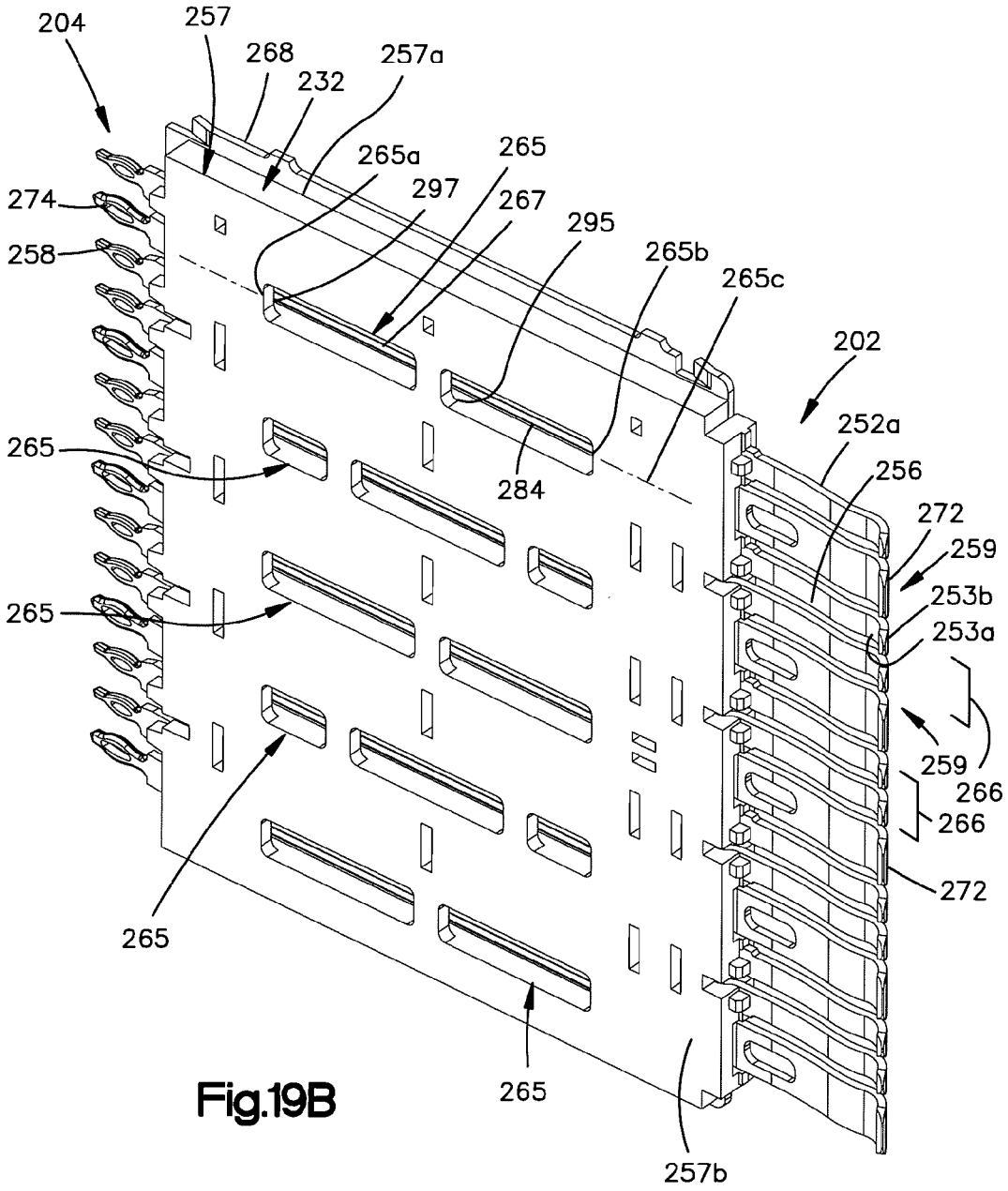
FIG. 19B is a perspective view of a leadframe assembly of the second electrical connector illustrated in FIG. 19A.
Figure 19C:
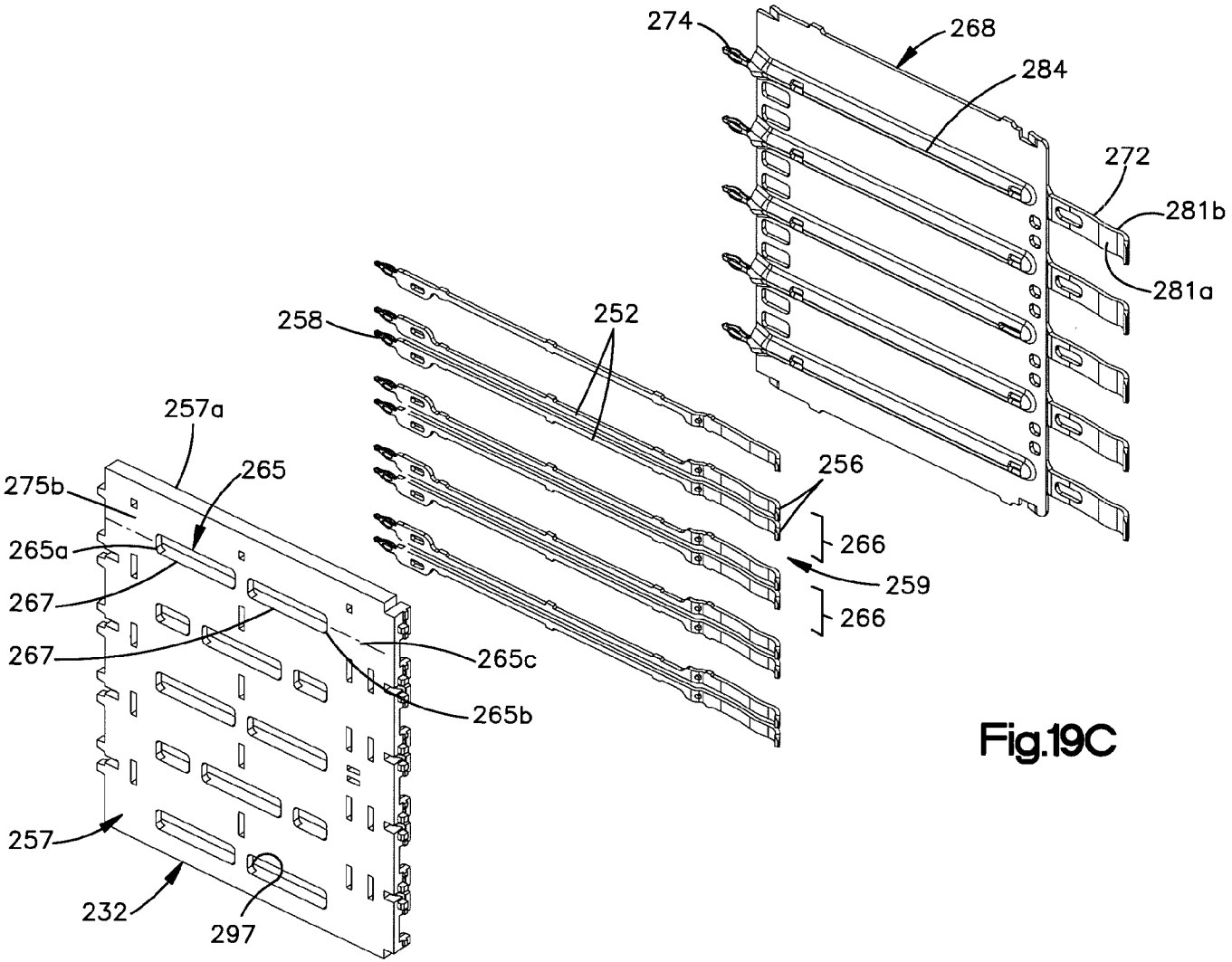
FIG. 19C is a exploded view of the leadframe assembly of the second electrical connector as illustrated in FIG. 19B.

Referring now to FIGS. 19B-C, at least one or more up to all of the leadframe assemblies 230 can include a plurality of leadframe apertures 265 that extend through the leadframe housing body 257 at locations aligned with the ribs 284. Thus, it should be appreciated that at least one or both electrical connectors of an electrical connector assembly 10 can include respective ones of the leadframe apertures. For instance, as described above, the ground plate 268 is configured to be attached to a first side 257*a* of the leadframe housing body 257, such that the projected surfaces of the ribs 284 are at least partially disposed in the recessed regions 295 of the leadframe housing 232, such that the projected surfaces of the ribs 284 face the recessed surface 297 of the leadframe housing 232. The leadframe housing body 257 further defines a second side 257*b* that is opposite the first side 257*a* along the lateral direction A. The leadframe housing 232 can define the leadframe apertures 265 that extend through the leadframe housing body 257 along the lateral direction A from the second side 257*b* through the recessed surface 297. Thus, the electrical signal contacts 252 can lie in a plane that extends between the leadframe apertures 265 and the ground plate 268. The leadframe apertures 265 can be aligned with respective ones of the gaps 259 along the lateral direction A, and can thus be aligned between the ground mating ends 272 and the ground mounting ends 274. Thus, respective ones of the leadframe apertures 265 can each be aligned with a respective gap 259, such that each gap 259 can be aligned with a select at least one such as a plurality of the leadframe apertures 265.

The leadframe apertures 265 define a first end 265*a* disposed proximate to the ground mounting end 274, and a second end 265*b* disposed proximate to the ground mating end 272. At least one or more up to all of the leadframe apertures 265 can extend continuously from the first end 265*a* to the second end 265*b*, or can be segmented between the first end 265*a* and the second end 265*b*, so as to define at least two such as a plurality of aperture segments 267. At least one or more up to all of the segments 267 can be elongate along the longitudinal direction L between the ground mating ends 272 and the ground mounting ends 274.

The leadframe apertures 265, including each of the respective segments 267, can be elongate along respective central axes 265*c* from the first end 265*a* to the second end 265*b*. The respective segments 267 of each aperture 265 can be aligned with each other along the central axis 265*c*. Each central axis 265*c* can extend between and can be aligned with a select ground mounting end 274 and a select ground mating end 272. The central axes 265*c* of at least two or more up to all of the leadframe apertures 265 can be parallel with each other.

The aperture segments 267 can be separated by respective portions of the leadframe housing body 257 that support the electrical signal contacts 252. The portions of the leadframe housing body 257 can, for instance, extend from the second side 257*b* toward the first side 257*a*, for instance to the recessed surface 297, and can define the recessed surface 297. Further, the portions of the leadframe housing body 257 can define the channels that retain respective ones of the signal contacts 252. For instance the portions of the leadframe housing body 257 can be overmolded onto the signal contacts 252, and can define injection molding flow paths during construction of the leadframe assembly 230. Each of the leadframe apertures 265, including the aperture segments 267, can define a perimeter that is fully enclosed by the leadframe housing body 257. Alternatively, the perimeter of the leadframe apertures 265, including at least one or more of the aperture segments 267, can be open at the front end or the bottom end of the leadframe housing body 257.

As described above, each of the leadframe apertures 265 can be aligned along the lateral direction A with one of the ribs 284 and the respective one of the gaps 259 that are disposed between adjacent signal pairs 266. Thus, a line that extends along the lateral direction A can pass through one of the leadframe apertures 265, an aligned one of the ribs 284, and an aligned one of the gaps 259 without passing through any of the signal contacts 252. Further, in accordance with one embodiment, the leadframe assembly 230 does not define a line that extends along the lateral direction A through one of the leadframe apertures 265, an aligned one of the ribs 284, and an aligned one of the gaps 259, and a signal contacts 252. In accordance with one embodiment, each of the leadframe apertures 265, and in particular the central axis 265*c*, can be equidistantly spaced between adjacent ones of the differential signal pairs 266 that are disposed on opposed sides of the gap 259 that is aligned with the respective aperture 265.

Each of the leadframe apertures 265 can define a length along the central axis 265*c*. For instance, if the leadframe aperture 265 extends continuously from the first end 265*a* to the second end 265*b*, the length can be defined by the distance from the first end 265*a* to the second end 265*b* along the central axis 265*c*. If the leadframe aperture 265 is segmented into the segments 267, the length can be defined by a summation of the distances of all segments 267 of each aperture 265 along the central axis 265*c*. In accordance with one embodiment, the length of at least one or more up to all of the leadframe apertures 265 can be at least half, for instance a majority, for instance greater than 60%, for instance greater than 75%, for instance greater than 80%, for instance greater than 90%, up to and including 100% the length of the aligned one of the ribs 284 as measured along the a central axis 265*c*.

It is recognized that the dielectric constant of plastic is greater than the dielectric constant of air. Because the leadframe housings 232 can be made from plastic, the leadframe apertures 265 define a dielectric constant that is less than the dielectric constant of the leadframe housing 232. It has been found that the leadframe apertures 265 reduce far end crosstalk between adjacent ones of the differential signal pairs 266.

Figure 20:
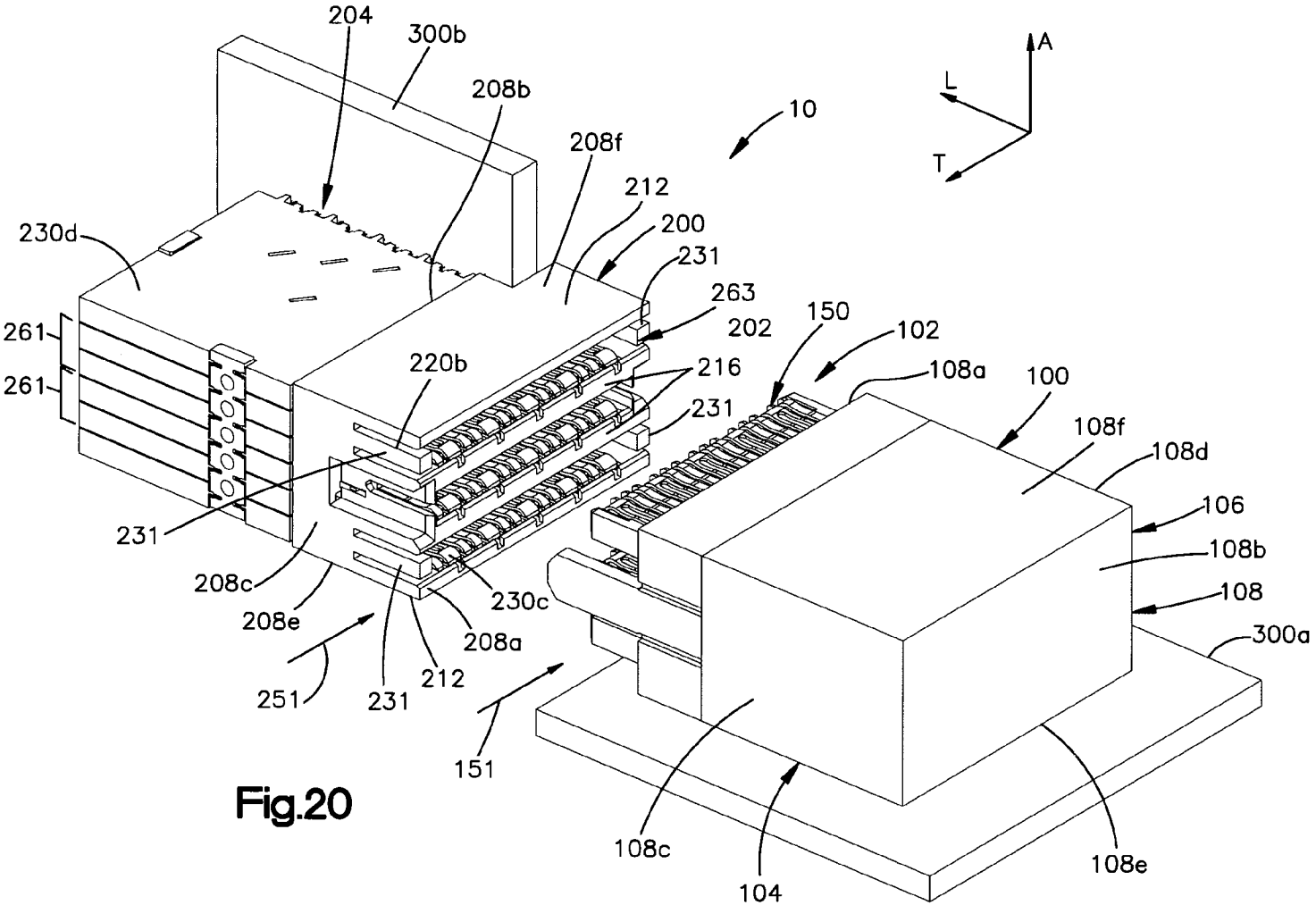
FIG. 20 is a perspective view of an orthogonal electrical connector assembly constructed in accordance with another embodiment, including first and second substrates, a first electrical connector configured to be mounted to the first substrate, a second electrical connector that is orthogonal to the first connector and configured to be mounted to the second substrate such that the first and second substrates are orthogonal to each other when the first and second electrical connectors are mounted to the first and second substrates, respectively, and mated with each other.
Figure 21A:
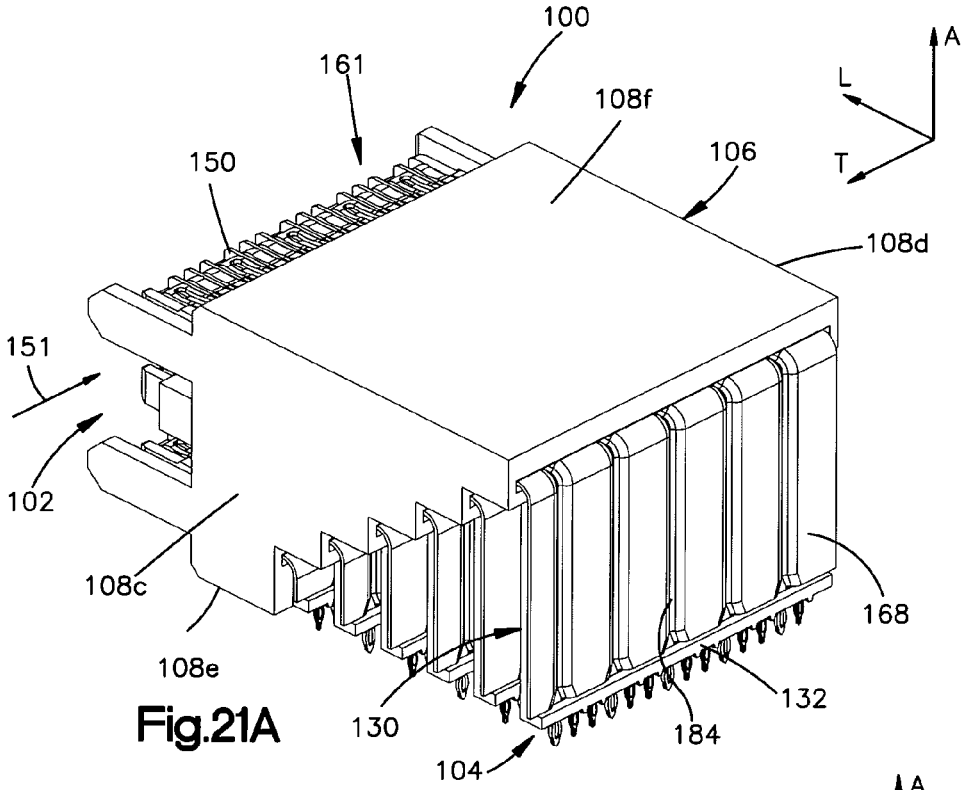
FIG. 21A is a perspective view of the first electrical connector illustrated in FIG. 20.
Figure 21B:
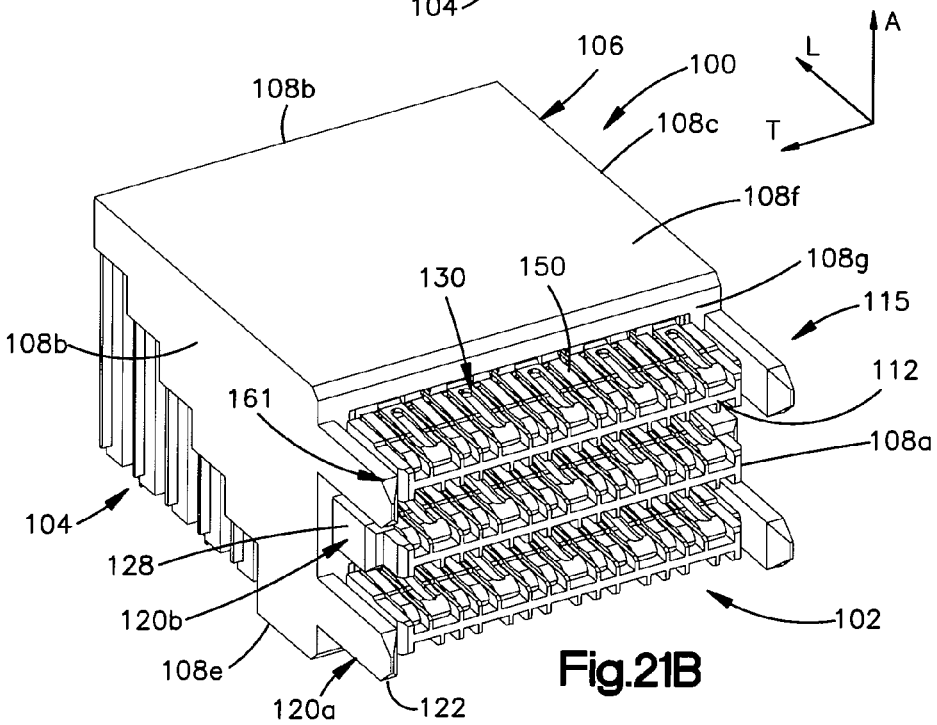
FIG. 21B is another perspective view of the first electrical connector illustrated in FIG. 20.
Figure 22A:
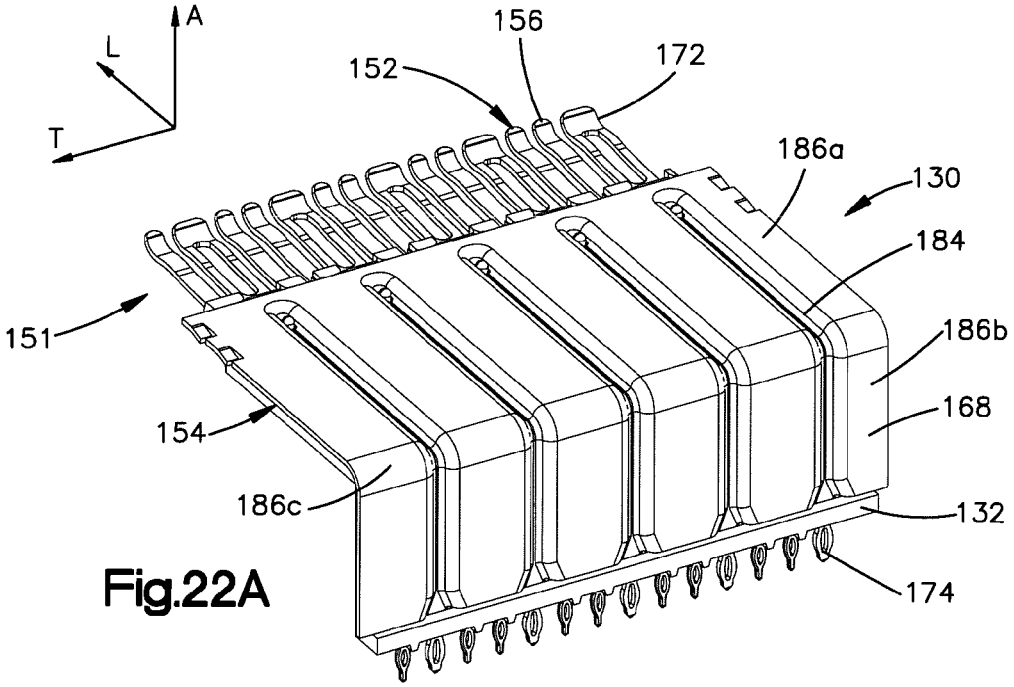
FIG. 22A is a perspective view of a leadframe assembly of the first electrical connector illustrated in FIG. 21A.
Figure 22B:
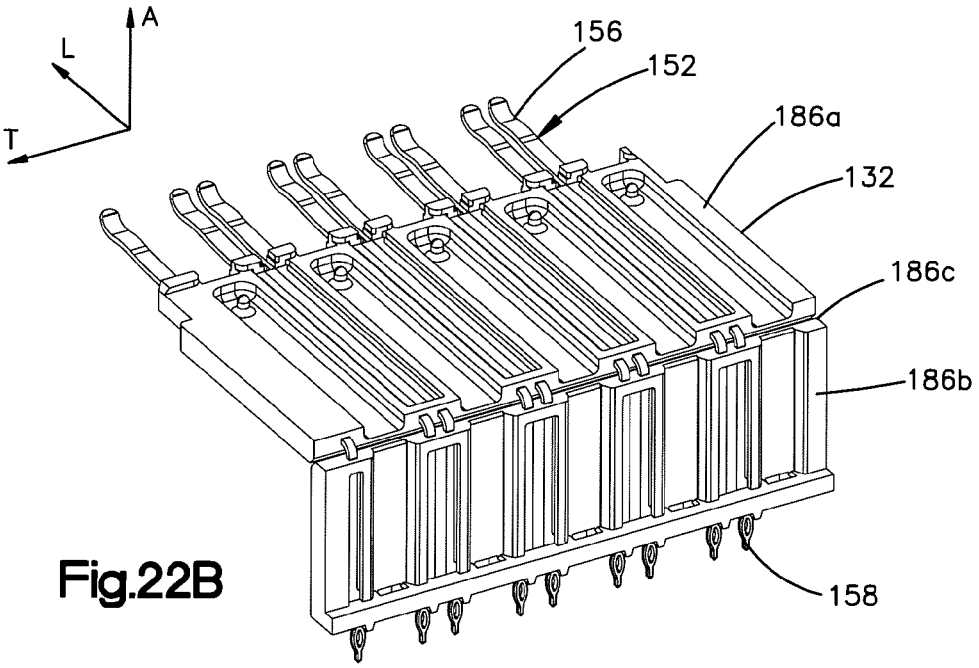
FIG. 22B is a perspective view of a portion of the leadframe assembly illustrated in FIG. 22A.

Referring now to FIG. 20, the electrical connector assembly 10 can be configured as an orthogonal electrical connector assembly, and can include a first electrical connector 100 and a second electrical connector 200 that is configured as an orthogonal connector. The first and second electrical connectors 100 and 200 can be constructed in accordance with any embodiment described herein, unless otherwise indicated. For instance, the first electrical connector 100 can be configured as an orthogonal connector as described below. The second electrical connector 200 can be configured as a right angle connector, for instance of the type described above with respect to FIG. 12A, though it should be appreciated that the second electrical connector 200 can be constructed in accordance with any alternative embodiment as described herein. For instance the second electrical connector 200 can be configured as a vertical electrical connector. Thus, the mating ends of the electrical contacts 250 and the mounting ends of the electrical contacts 250 of each leadframe assembly can be substantially in-plane with each other. That is, the mating ends of the electrical contacts 250 of each leadframe assembly 230 can lie in a first plane, the mounting ends of the electrical contacts 250 the respective leadframe assembly 230 can lie in a second plane, and the second plane and the first plane can be at least parallel with each other, and can be substantially coincident with each other. The first and second planes can be defined by the transverse direction T and the longitudinal direction L. Thus, the mounting interface 204 can be oriented orthogonally with respect to the mating interface 202. The mounting interface 204 can be disposed adjacent the bottom wall 208*d* of the housing body 208, for instance when the second electrical connector 200 is a right-angle connector. The mounting interface 204 can be disposed adjacent the rear wall 208*b* of the housing body 208, for instance when the second electrical connector 200 is a vertical connector.

The mating ends of the electrical contacts 250, including the mating ends 256 of the electrical signal contacts 252 and the ground mating ends 272 of each leadframe assembly 230 can be spaced from each other, and thus arranged, along respective linear arrays 251 that extend along the transverse direction T at the mating interface 202. The linear arrays 251 at the mating interface 202 can thus be oriented substantially perpendicular to the mounting interface 204, and thus also normal to the second substrate 300*b* to which the second electrical connector 200 is configured to be mounted.

Referring to FIGS. 20-23B, the first electrical connector 100 can be constructed substantially as described above with respect to FIG. 9A, though it should be appreciated that the first electrical connector 100 can be constructed in accordance with any embodiment as described herein, unless otherwise indicated. Thus, the first electrical connector 100 can include gross alignment members 120*a* configured as gross alignment beams 122, and fine alignment members 120*b* configured as fine alignment beams 128.

As noted above, the first electrical connector 100 can be configured as an orthogonal connector, whereby the mating interface 102 can be disposed adjacent the front end 108*a* of the housing body 108 in the manner described above. The mounting interface 104 can be disposed adjacent one of the sides, for instance the first side 108*e* of the housing body 108. As will be appreciated from the description below, the mating ends of the electrical contacts 150 can lie out-of-plane with respect to the mounting ends of the electrical contacts 150. For instance, the mating ends of the electrical contacts 150 of each leadframe assembly 130 can lie in a first plane, the mounting ends of the electrical contacts 150 of the respective leadframe assembly can lie in a second plane, and the second plane and the first plane can be orthogonal with respect to each other. In accordance with the illustrated embodiment, the first plane is defined by the transverse direction T and the longitudinal direction L, and the second plane is defined by the transverse direction T and the lateral direction A.

Thus, the mounting interfaces 104 and 204 are configured to be mounted to the respective first and second substrates 300*a* and 300*b*, and the first and second connectors 100 and 200 are configured to mate directly to each other at their respective mating interfaces 102 and 202. Alternatively, as described below with respect to FIG. 25, the first and second electrical connectors 100 and 200 can mate with each other indirectly through a midplane assembly.

In accordance with the illustrated embodiment, the mating ends of the electrical contacts 150 of each leadframe assembly 130, including the mating ends 156 of the electrical signal contacts 152 and the ground mating ends 172 of each leadframe assembly 130 can be spaced from each other, and thus arranged, along respective linear arrays 151 that extend along the transverse direction T at the mating interface 102. The linear arrays 151 are spaced from each other along the lateral direction A at the mating interface 102. However, in contrast to the linear arrays 251 of the second electrical connector 200, the linear arrays 151 are oriented substantially parallel to the mounting interface 104, and is accordingly also substantially parallel to the second substrate 200*b* to which the first electrical connector 100 is mounted. Thus, it should be appreciated that the second substrate 300*b* is oriented orthogonal with respect to the first substrate 300*a* when the first and second electrical connectors 100 and 200 are mounted to the respective first and second substrates 300*a* and 300*b* and mated to each other. Further, it should be appreciated that the first electrical connector 100 is symmetrical, and can be used in a 90 degree orthogonal application or a 270 degree orthogonal application. In other words, the first electrical connector 100 can be selectively oriented 90 degrees with respect to the second electrical connector 200 in both a clockwise or a counterclockwise direction from a neutral position to respective first or second positions, and subsequently mated to the second electrical connector in either the first or the second position.

Figure 23A:
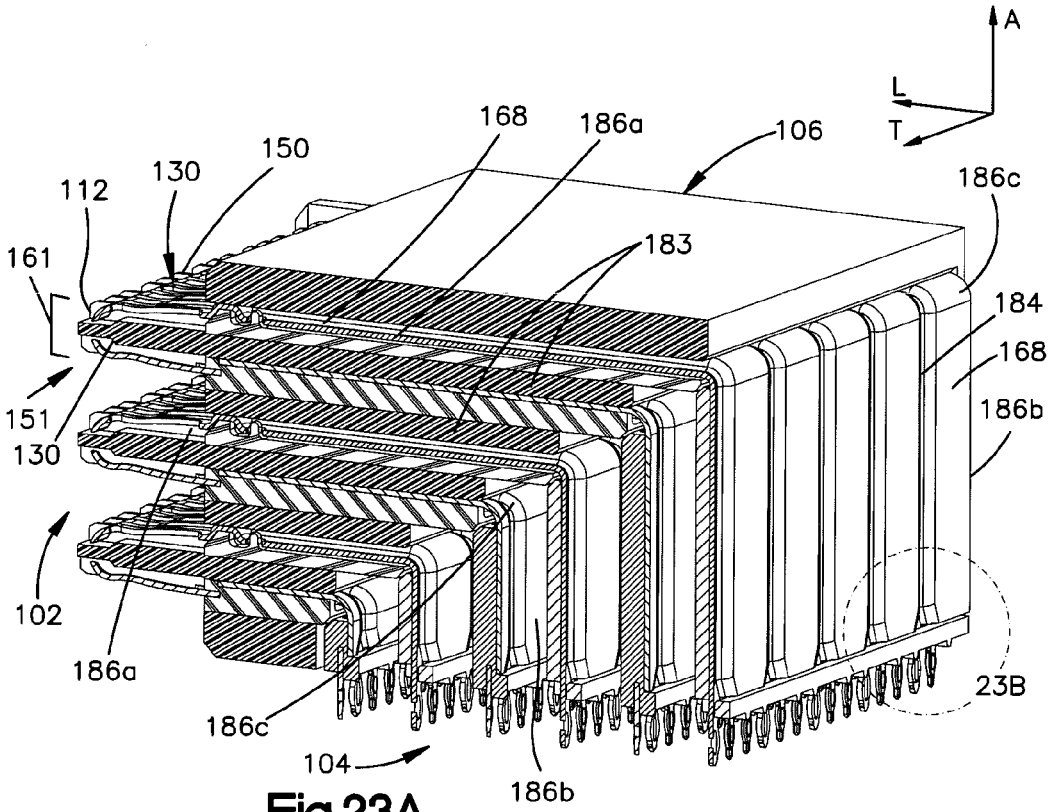
FIG. 23A is a sectional perspective view of the first electrical connector illustrated in FIG. 20.
Figure 23B:
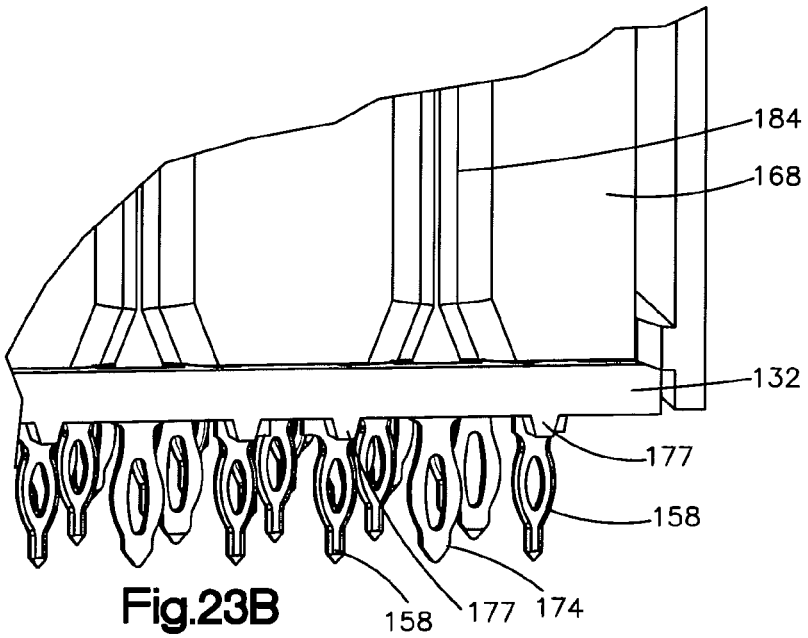
FIG. 23B is an enlarged perspective view of a portion of the first electrical connector illustrated in FIG. 23A, taken at region 23B.
Figure 24A:
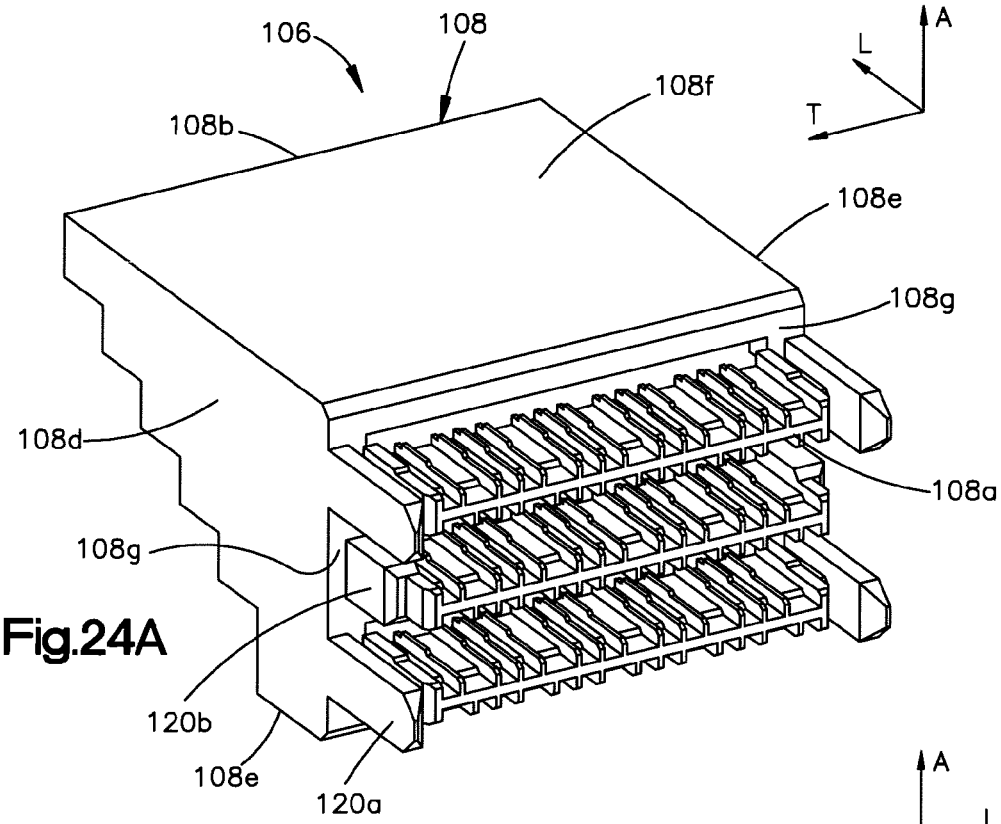
FIG. 24A is a front perspective view of the connector housing of the first electrical connector illustrated in FIG. 20.
Figure 24B:
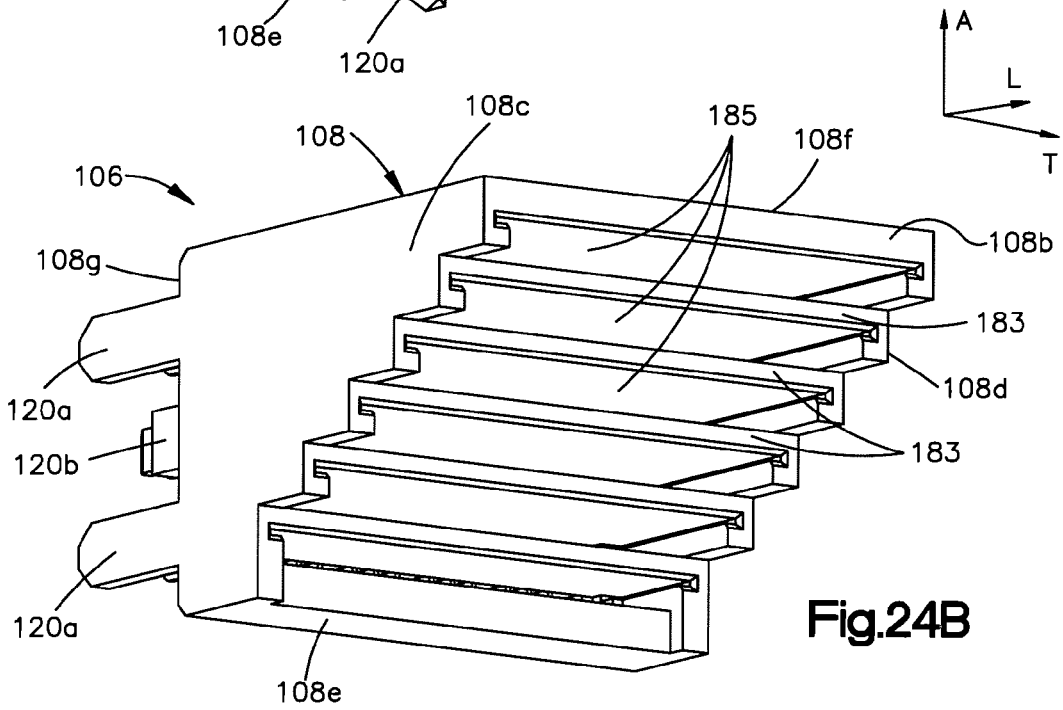
FIG. 24B is a rear perspective view of the connector housing of the first electrical connector illustrated in FIG. 20.

The leadframe assemblies 130 are spaced from each other along the lateral direction A at the mating interface 102, and along the longitudinal direction L at the mounting interface 104. The mating ends 156 of the signal contacts 152 and the ground mating ends 172 of each leadframe assembly 130 are spaced apart along the linear array 151, or the transverse direction T, and the mounting ends 158 of the signal contacts 152 and the ground mounting ends 174 of each leadframe assembly 130 are also spaced apart along the same transverse direction T. One of a pair of adjacent ones of the leadframe assemblies 130 can be nested within the other of the pair of adjacent ones of the leadframe assemblies 130, such that the electrical contacts 150 of the other of the pair of adjacent ones of the leadframe assemblies 130 are disposed outward, for instance along the longitudinal direction L and the lateral direction A, with respect to the electrical contacts 150 of the one of the pair of adjacent ones of the leadframe assemblies 130. As illustrated in FIG. 23B, the leadframe assemblies 130 can further include contact support projections 177 that extend out from the leadframe housing 132 and abut at least one or more up to all of the mounting ends of the respective electrical contacts 150. For instance, the projections can abut the mounting ends 158 of the electrical signal contacts 152.

Referring now to FIGS. 24A-25B, the connector housing 106 can be made from any suitable dielectric material, and can include a plurality of divider walls 183 that are spaced from each other along the lateral direction A, and can be substantially planar along the longitudinal direction L and transverse direction T. The connector housing 106 defines complementary pockets 185 disposed between adjacent ones of the divider walls 183. Each of the pockets 185 can be sized to receive at least a portion of respective ones of the leadframe assemblies 130 along the longitudinal direction L, such that the mating ends 156 of the signal contacts 152 and the ground mating ends 172 extend forward from the respective pocket 185. In particular, the leadframe assemblies 130, including the ground plate 168 and the leadframe housing 132, can be bent so as to define a mating portion 186*a*, a mounting portion 186*b*, and a ninety degree bent region 186*c* that separates the mating portion 186*a* from the mounting portion 186*b*, such that the mating and mounting portions 186*a* and 186*b* are oriented substantially perpendicular with respect to each other. The bent region 186*c* can be bent about an axis that is substantially parallel to the linear array 151.

The mating portion 186*a* of respective ones of the leadframe assemblies 130 can define a length along the longitudinal direction L between the bent region 186*c* and the mating ends of the electrical contacts 150. The length of the respective ones of the leadframe assemblies 130 can increases as the position of the mating and mounting portions of each leadframe assembly 130 are further spaced from the mating interface 102 and mounting interface 104, respectively, with respect to the other ones of the leadframe assemblies 130. Furthermore, the mounting portions 186*b* of respective ones of the leadframe assemblies 130 can define a length along the lateral direction A between the bent region 186*c* and the mounting ends of the electrical contacts 150. The length of the respective ones of the leadframe assemblies 130 can increase as the position of the mating and mounting portions of each leadframe assembly 130 are further spaced from the mating interface 102 and mounting interface 104. It should thus further be appreciated that the bent regions 186*c* of the leadframe assemblies 130 are increasingly spaced from both the mating interface 102 and the mounting interface 104 as the leadframe assemblies 130 are further spaced from the mating interface 102 and the mounting interface 104, respectively.

Figure 25:
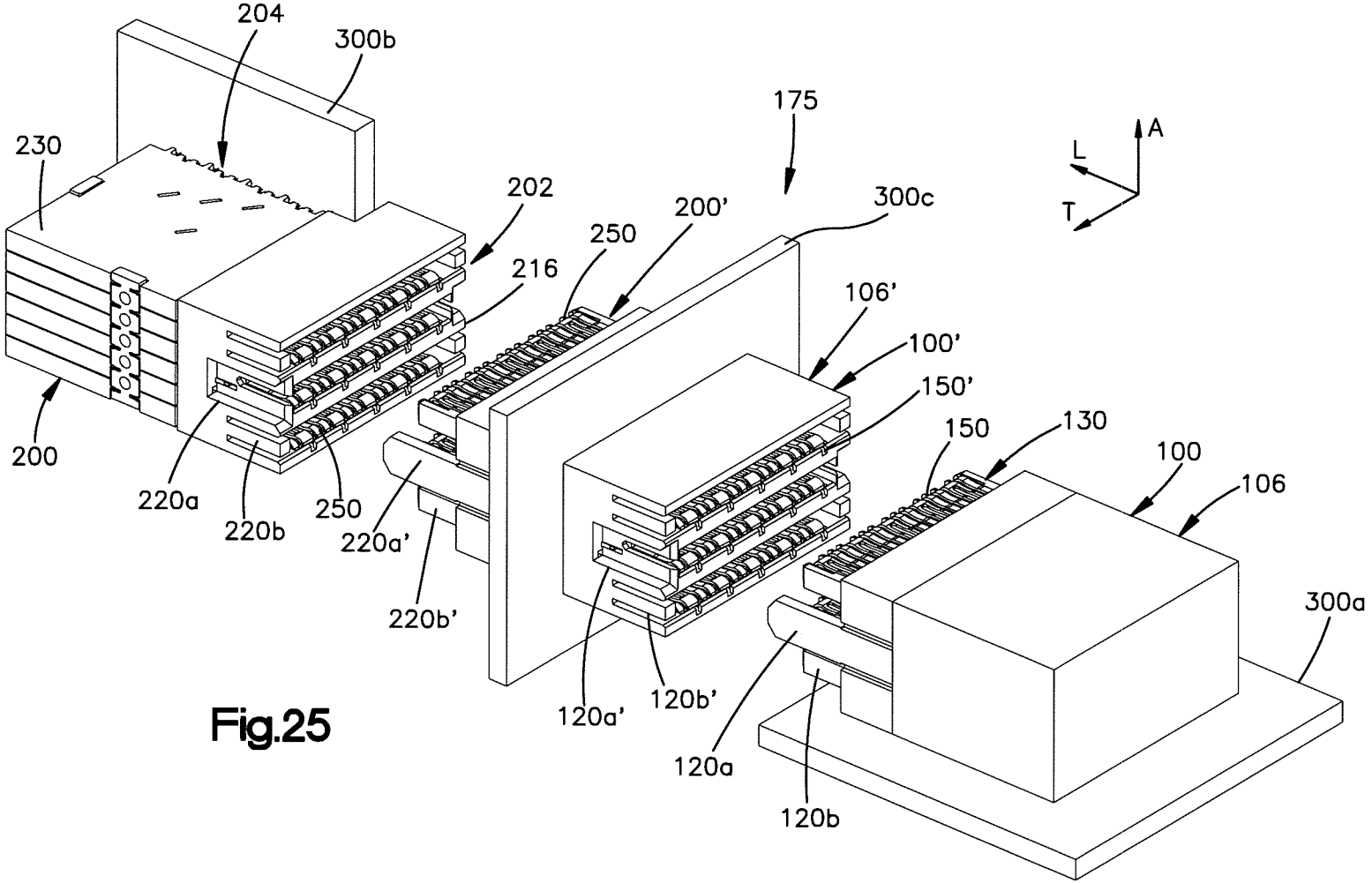
FIG. 25 is a perspective view of the orthogonal electrical connector assembly illustrated in FIG. 20, but further including a midplane, and a pair of electrical connectors configured to be mounted through the midplane and mated with the first and second electrical connectors, respectively.
Figure 26A:
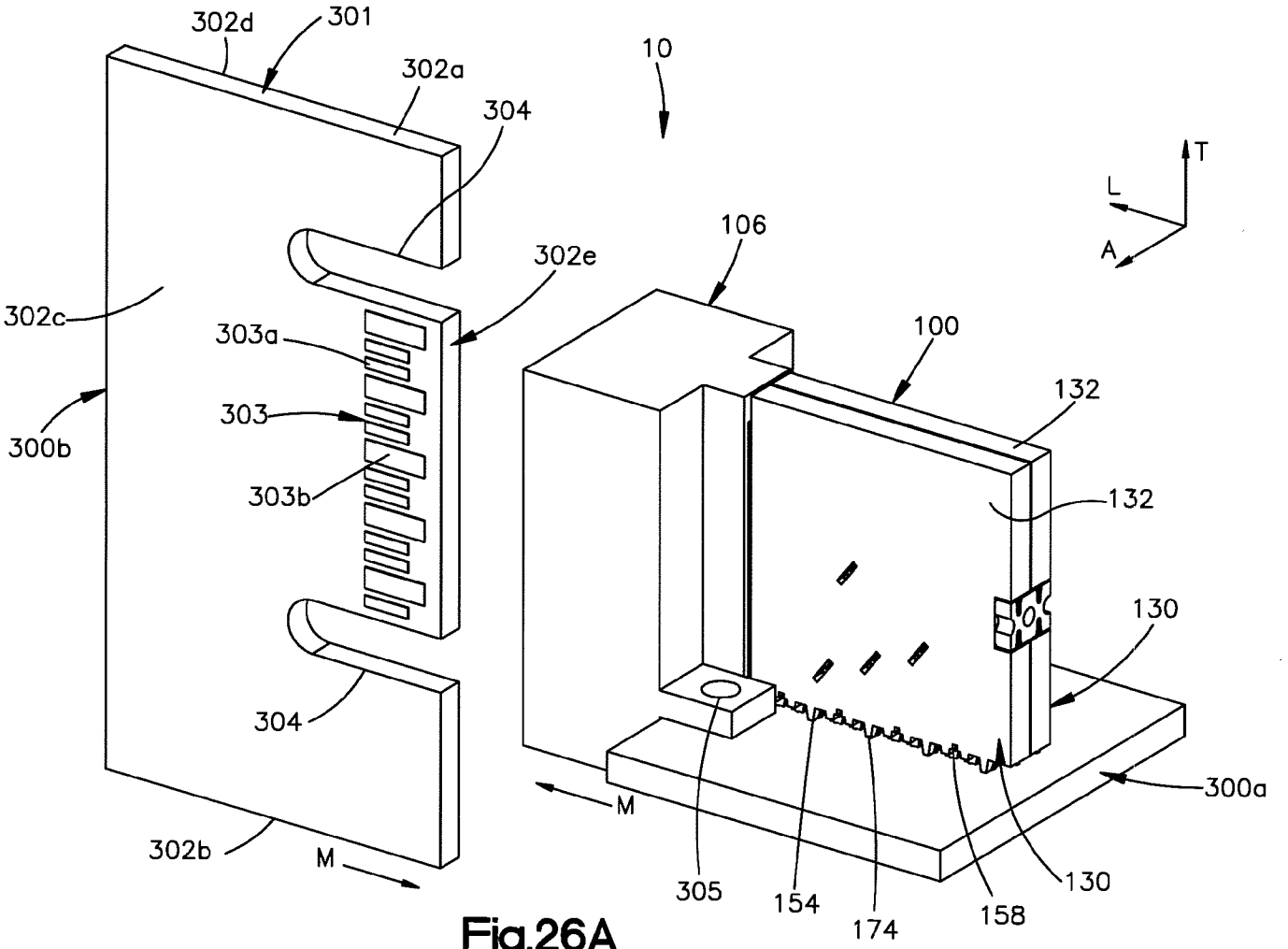
FIG. 26A is an exploded perspective view of an orthogonal electrical connector assembly constructed in accordance with an alternative embodiment, including a first substrate, an electrical connector, and a second substrate.
Figure 26B:
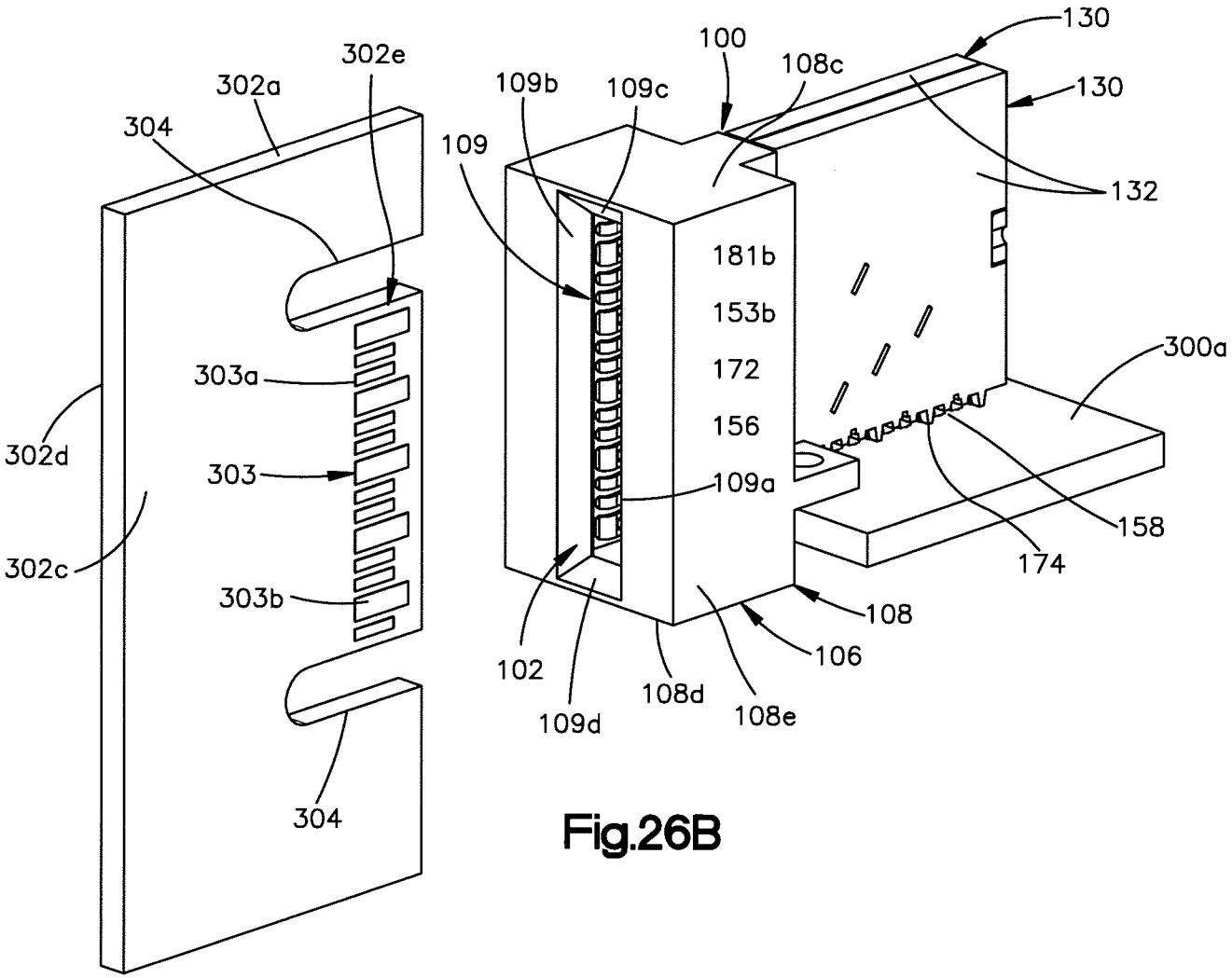
FIG. 26B is another exploded perspective view of the orthogonal electrical connector assembly illustrated in FIG. 26A.
Figure 26C:
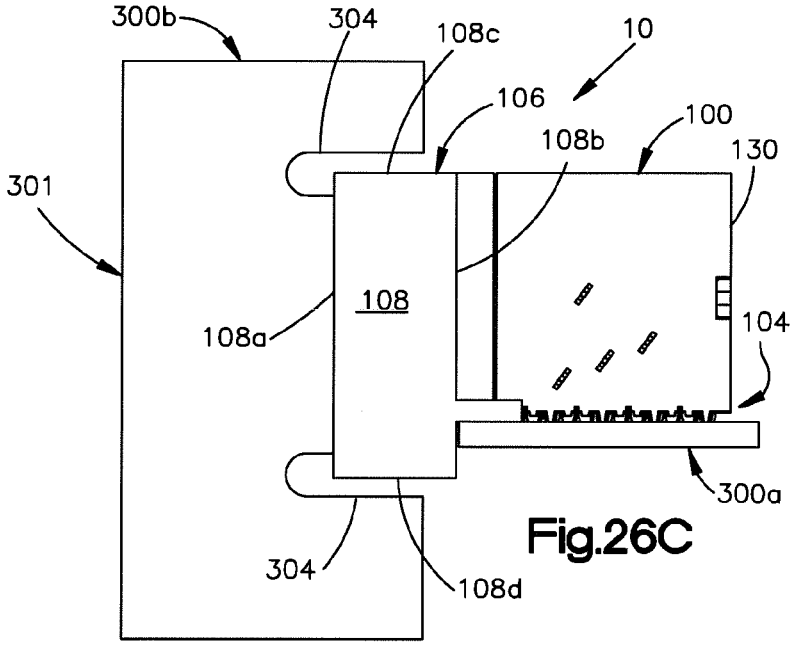
FIG. 26C is a side elevation view of the orthogonal electrical connector assembly illustrated in FIG. 26A, showing the electrical connector mounted to the first substrate and mated with the second substrate.
Figure 26D:
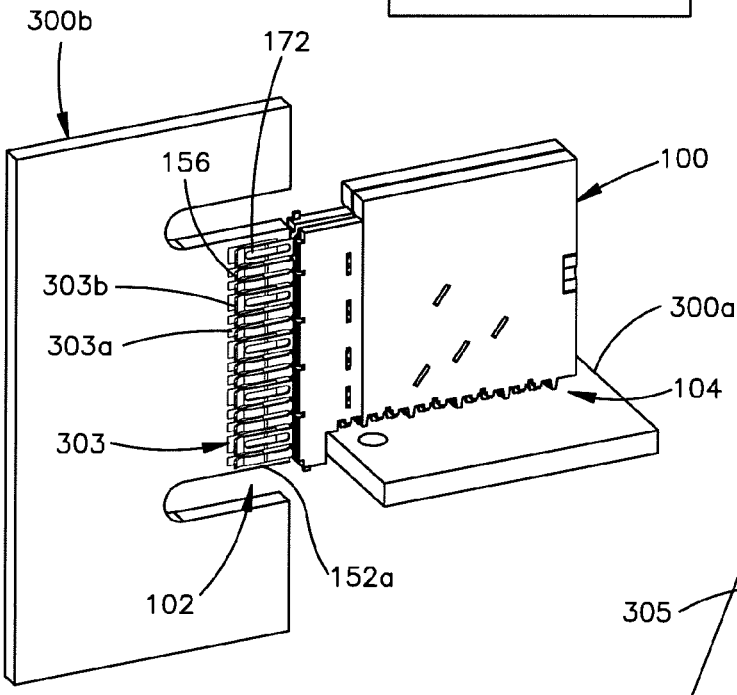
FIG. 26D is a perspective view of the orthogonal electrical connector assembly illustrated in FIG. 26A, showing the electrical connector mounted to the first substrate and mated with the second substrate, with a portion of the connector housing of the electrical connector shown removed.
Figure 26E:
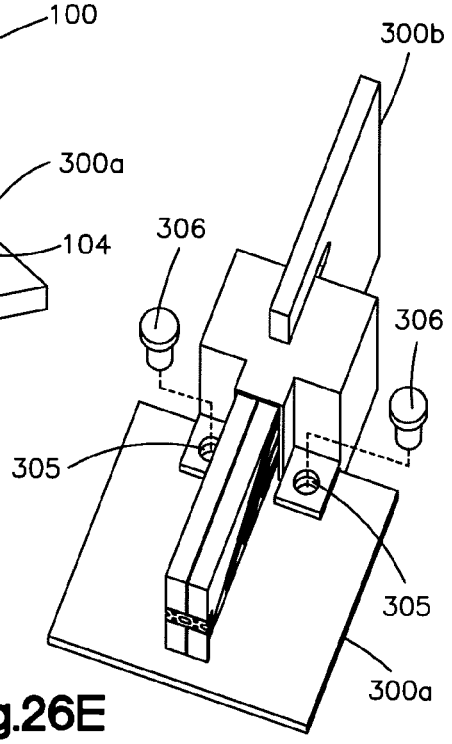
FIG. 26E is a perspective view of the orthogonal electrical connector assembly similar to the orthogonal electrical connector assembly illustrated in FIG. 26A, shown constructed in accordance with an alternative embodiment.

Referring now to FIG. 25, as described above, the first and second electrical connectors 100 and 200 can be mated directly to each other, for instance at the respective mating interfaces 102 and 202. Accordingly, the electrical contacts 150 and 250 can physically and electrically connect to each other at their respective mating ends. Alternatively, the electrical connector assembly 10 can include a midplane assembly 175 that includes a third substrate 300*c*, which can be a printed circuit board, that can be configured as a midplane, and first and second midplane electrical connectors 100' and 200', which can be vertical electrical connectors, configured to be mounted to the third substrate 300*c* so as to be placed in electrical communication with each other through the midplane. The first midplane electrical connector 100' is configured to mate with the first electrical connector 100, and the second electrical connector 200' is configured to mate with the second electrical connector 200 so as to place the first and second electrical connectors 100 and 200 in electrical communication with each other through the midplane. The first and second midplane electrical connectors 100' and 200' can be constructed in accordance with any embodiment described herein with respect to first and second electrical connectors 100 and 200, unless otherwise indicated. The mounting ends of the electrical contacts 150' and 250' of the first and second midplane electrical connectors 100' and 200' extend into opposite ends of common vias that extend through the midplane so as to electrically connect the first and second midplane electrical connectors 100' and 200' to each other through the midplane. The midplane electrical connectors 100' and 200' can include respective complementary gross alignment assemblies 120*a* and 200*a*, respectively, and respective complementary fine alignment assemblies 120*b* and 200*b*, respectively, so as to align the electrical connectors for mating in the manner described above. It should be appreciated that the mating ends of the electrical contacts 150' and 250' of the midplane connectors 100' and 200' can be configured as receptacle mating ends of the type described above. Similarly, the mating ends of the electrical contacts 150' and 250' of the midplane connectors 100' and 200' can be configured as receptacle mating ends of the type described above so as to mate with the mating ends of the electrical contacts 150' and 250' when the first and second electrical connectors 100 and 200 are mated with the first and second midplane connectors 100' and 200', respectively.

While the electrical connector assembly 10 can be configured as an orthogonal connector assembly in accordance with one embodiment, as described above with respect to FIGS. 20A-25, it is envisioned that either or both of the first and second electrical connectors 100 and 200, respectively, can be configured as an orthogonal connector that is configured to mate with the other of the first and second electrical connectors so as to place the orthogonal first and second substrates 300*a* and 300*b* in electrical communication with each other. However, as illustrated in FIGS. 26A-E, it is further recognized that either or both of the first and second electrical connectors 100 and 200 can be configured as orthogonal connectors that are referred to as direct-mate orthogonal connectors. The direct-mate orthogonal connectors can be configured to be mounted to the respective first or second substrates 300*a-b*, and configured to directly mate to the other of the first or second substrates 300*a-b*.

For instance, the first electrical connector 100 is illustrated as a right-angle electrical connector of the type described above, for instance of the type described above with respect to FIG. 2A. The connector housing 106 can support at least one pair of first and second leadframe assemblies 130 that are spaced apart from each other along the lateral direction A. Each of the leadframe assemblies 130 can be constructed as described above, and in particular can include a leadframe housing 132, and electrical contacts 150, including electrical signal contacts 152 that define respective mating ends 156 and mounting ends 158, and ground mating ends 172 and ground mounting ends 174, supported by the leadframe housing 132 as described above. The mounting ends 158 and ground mounting ends 174 of each leadframe assembly can be spaced from each other along the longitudinal direction L. The first electrical connector 100 is configured to be mounted to the first substrate 300*a* at the mounting interface 104 as described herein, such that the mounting ends 158 and the ground mounting ends 174 are placed in electrical communication with the first substrate 300*a*. The connector housing 106 can include at least one or more apertures 305 that extend through the housing body 108 that are configured to receive respective fasteners 306, such as screws, that can be further driven into the first substrate body 300*a* so as to secure the first electrical connector 100 to the first substrate 300*a*.

The mating ends 156 and the ground mating ends 172 of each leadframe assembly 130 can be spaced from each other along respective linear arrays 151 that can be oriented along the transverse direction T. For instance, as described above, the electrical signal contacts 152 can define concave inner surfaces 153*a*, which can be defined at one of the broadsides, and convex surfaces 153*b*, which can be defined at the other of the broadsides. The concave and convex surfaces 153*a-b*, respectively, can be defined at the mating ends 156. Similarly, the ground mating ends 172 can define concave surfaces 181*a*, which can be defined at one of the broadsides, and convex surfaces 181*b*, which can be defined at the other of the broadsides. The connector housing 106 can define a receptacle 109 that extends into the front end 108*a* of the housing body 108.

The receptacle 109 can be defined along the lateral direction A by respective inner lateral surfaces 109*a* and 109*b* of the housing body 108 that are spaced from each other along the lateral direction A. The inner lateral surfaces 109*a* and 109*b* can define a first pair of surfaces spaced apart from each other along the lateral direction A. The inner lateral surfaces 109*a* and 109*b* can be defined by the first and second side walls 108*e* and 108*f*, respectively, as illustrated, or can be defined by other walls that are spaced from the first and second side walls 108*e* and 108*f*. The receptacle 109 can be defined along the transverse direction T by respective inner transverse surfaces 109*c* and 109*d* of the housing body 108 that are spaced from each other along the transverse direction T. The inner transverse surfaces 109*c* and 109*d* can define a second pair of surfaces spaced apart from each other along the transverse direction T. The inner transverse surfaces 109*c* and 109*d* can be defined by respective first and second walls, such as the top and bottom walls 108*c* and 108*d*, respectively, as illustrated, or can be defined by other walls that are spaced from the top and bottom walls 108*c* and 108*d*. One or both of the inner lateral surfaces 109*a-b* can be chamfered away from the other of the inner lateral surfaces 109*a-b* as they extend forward along the mating direction M. Similarly, one or both of the inner transverse surfaces 109*c-d* can be chamfered away from the other of the inner transverse surfaces 109*c-d* as they extend forward along the mating direction M.

The receptacle 109 can be aligned with the gap 163 defined along the lateral direction A between the leadframe assemblies 130 of the pair of leadframe assemblies 130, and thus between the first and second linear arrays 151 defined by the leadframe assemblies 130. The gap 163 can be at least partially defined by the mating ends 156 and the ground mating ends 172, and in particular by the convex surfaces 153*b* and 181*b* of the mating ends 156 and the ground mating ends 172, respectively. The receptacles 109 can extend along the transverse direction T between the opposed inner transverse surfaces 109*c* and 109*d* of the housing body 108.

The second substrate 300*b* can include a substrate body 301 that defines a pair of opposed sides 302*a* and 302*b*, and opposed first and second contact surfaces 302*c* and 302*d*, respectively, that extend between the opposed sides 302*a* and 302*b*. The substrate body 301 is configured to be inserted into the receptacle 309 when the 1) the opposed sides 302*a* and 302*b* are spaced from each other along the transverse direction T, and 2) the opposed surfaces 302*c* and 302*d* are each oriented along respective plane defined by the transverse direction T and the longitudinal direction L, such that the contact surfaces 302*c* and 302*d* are spaced from each other along the lateral direction A. The substrate body 301 further defines a leading end 302*e*, which can be defined by an edge of the substrate body 301 that is connected between the contact surfaces 302*c* and 302*d*. At least a portion of the leading end 302*e* is configured to be inserted into the receptacle 109 so as to mate the first electrical connector 100 with the second substrate 300*b*. The second substrate body 300*b* can further define a plurality of electrical contact pads 303 that are carried by the substrate body 301, for instance that are carried by at least one or both of the opposed contact surfaces 302*c* and 302*d* at the leading end 302*e*. The electrical contact pads 303 can include signal contact pads 303*a* and ground contact pads 303*b*. The contact pads 303 are in electrical communication with electrical traces of the second substrate 300*b*.

When at least a portion of the leading end 302*e* is inserted into the receptacle 109 along the mating direction M, the signal contact pads 303*a* carried by the first surface 302*c* are placed in contact, and thus in electrical communication, with the mating ends 156 of the signal contacts 152, for instance at the concave surfaces 153*b*, of the first leadframe assembly 130. Furthermore, the signal contact pads 303*a* carried by the second surface 302*d* are placed in contact, and thus in electrical communication, with the mating ends 156 of the signal contacts 152, for instance at the concave surfaces 153*b*, of the second leadframe assembly 130. Similarly, when the at least a portion of the leading end 302*e* is inserted into the receptacle 109 along the mating direction M, the ground contact pads 303*b* carried by the first surface 302*c* are placed in contact, and thus in electrical communication, with the ground mating ends 172, for instance at the concave surfaces 181*b*, of the first leadframe assembly 130. Furthermore, the ground contact pads 303*b* carried by the second surface 302*d* are placed in contact, and thus in electrical communication, with the ground mating ends 172, for instance at the concave surfaces 181*b*, of the second leadframe assembly 130. Thus, the contact pads 303 can be placed in contact, and thus electrical communication with, respective ones of the mating ends of the electrical contacts 150 of at least one leadframe assembly, such as each of the first and second leadframe assemblies 130, so as to place the first substrate 300*a* in electrical communication with the second substrate 300*b*. The ground contact pads 303*b* can be longer than the signal contact pads 303*a*, and thus configured to mate with the ground mating ends 172 before the signal contact pads 303*a* mate with the mating ends 156.

The second substrate 300*b* can include at least one slot such as a pair of slots 304 that extend into the leading end 302*e* along the longitudinal direction L, from the first contact surface 302*c* to the second contact surface 302*d* along the lateral direction A. The slots 304 can be positioned such that the contact pads are disposed between the slots 304. The slots 304 can define a thickness along the transverse direction T that is at least equal to the thickness of the first and second walls that define the inner transverse surfaces 109*c* and 109*d*, for instance the top and bottom walls 108*c* and 108*d*. Accordingly, the top and bottom walls 108*c* and 108*d* are sized to be received in the slots 304 as the second substrate 300*b* is inserted into the receptacle 109. Thus, the slots 304 and the top and bottom walls 108*c* and 108*d* can be configured as respective alignment members of the second substrate 300*b* and the first electrical connector 100, respectively, that are configured to align the contact pads 303 with the mating ends of the electrical contacts 150 before the contact pads 303 are inserted into the gap 163.

Referring now to FIGS. 27-30 an electrical connector assembly 20 can include the first electrical connector 100, and a second electrical connector 400 that can be a cable connector configured to be mated with the first electrical connector 100 and mounted to a plurality of cables 500. The first and second electrical connectors 100 and 400 can be mated so as to place the first electrical connector 100 in electrical communication with the second electrical connector 400. It should be appreciated that any one or more up to all of the first and second electrical connectors 100 and 200 described herein can be configured as a cable connector as desired. In accordance with the illustrated embodiment, the first electrical connector 100 can be configured to be mounted to the first substrate 300*a* so as to be placed in electrical communication with the first substrate 300*a* in the manner described above. The second electrical connector 400 can be configured to be mounted to the plurality of cables 500 so as to be placed in electrical communication with the plurality of cables 500, thereby defining a cable assembly including the second electrical connector 400 mounted to the plurality of cables 500.

The first and second electrical connectors 100 and 400 can be mated to one another so as to place the first substrate 300*a* in electrical communication with the plurality of cables 500 via the first and second electrical connectors 100 and 400. In accordance with the illustrated embodiment, the first electrical connector 100 is constructed as a vertical electrical connector and the second electrical connector 400 can be constructed as a vertical electrical connector that defines a mating interface 402 and a mounting interface 404 that is oriented substantially parallel to the mating interface 402. It should be appreciated, of course, that either or both of the first and second electrical connectors 100 and 400 can be configured as a right-angle connector whereby the mating interface is oriented substantially perpendicular with respect to the mounting interface.

The second electrical connector 400 can include a dielectric, or electrically insulative connector housing 406 and a plurality of electrical contacts 450 that are supported by the connector housing 406. The plurality of electrical contacts 450 can include respective pluralities of signal contacts 452 and ground contacts 454. As will be described in more detail below, the second electrical connector 400 can include a plurality of leadframe assemblies 430 that are supported by the connector housing 406. Each leadframe assembly 430 can include a dielectric, or electrically insulative, leadframe housing 432, a plurality of electrical contacts 450 that are supported by the leadframe housing 432, and a compression shield 490.

In accordance with the illustrated embodiment, each leadframe assembly 430 includes a plurality of signal contacts 452 that are supported by the leadframe housing 432 and a ground contact 454 configured as an electrically conductive ground plate 468. The signal contacts 452 can be overmolded by the dielectric leadframe housing 432 such that the leadframe assemblies 430 are configured as insert molded leadframe assemblies (IMLAs), or can be stitched into or otherwise supported by the leadframe housing 432. The ground plate 468 can be attached to the dielectric housing 432. The first and second electrical connectors 100 and 400 can be configured to mate with and unmate from each other the mating direction M. The signal contacts 452, including the mating ends 456 and the mounting ends 458, of each leadframe assembly 430 are spaced from each other along the column direction. The leadframe assemblies 430 can be spaced along the lateral direction A in the connector housing 406.

The leadframe housing 432 includes a housing body 434 that defines a front wall 436 that defines extends along the lateral direction A and defines opposed first and second end 436*a* and 436*b* that are spaced apart from each other along the lateral direction A. The front wall 436 can be configured to at least partially support the signal contacts 452. For example, in accordance with the illustrated embodiment, the signal contacts are supported by the front wall 436 such that the signal contacts 452 are disposed between the first and second ends 436*a* and 436*b*. The leadframe housing 432 can further define first and second attachment arm 438 and 440, respectively, that extend rearward from the front wall 436 along the longitudinal direction L. The first and second attachment arm 438 and 440 can operate as attachment locations for at least one or both of the ground plate 468 or the compression shield 490, as described in more detail below. The first attachment arm 438 can be disposed closer to the first end 436*a* of the front wall 436 than to the second end 436*b*, for example substantially at the first end 436*a*. Similarly, the second attachment arm 440 can be disposed closer to the second end 436*b* of the front wall 436 than to the first end 436*a*, for example substantially at the second end 436*b*.

Figure 30:
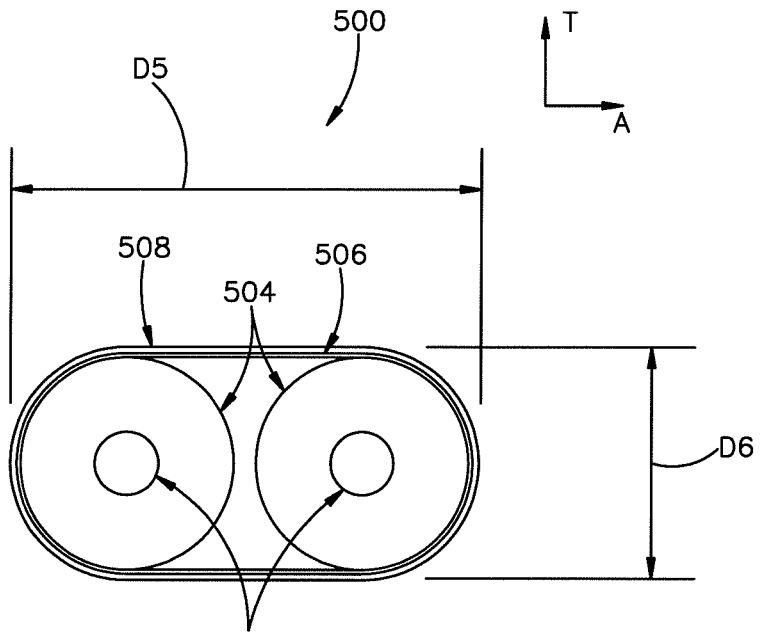
FIG. 30 is a section view of one of the cables of the second electrical connector illustrated in FIG. 27.
Figure 31A:
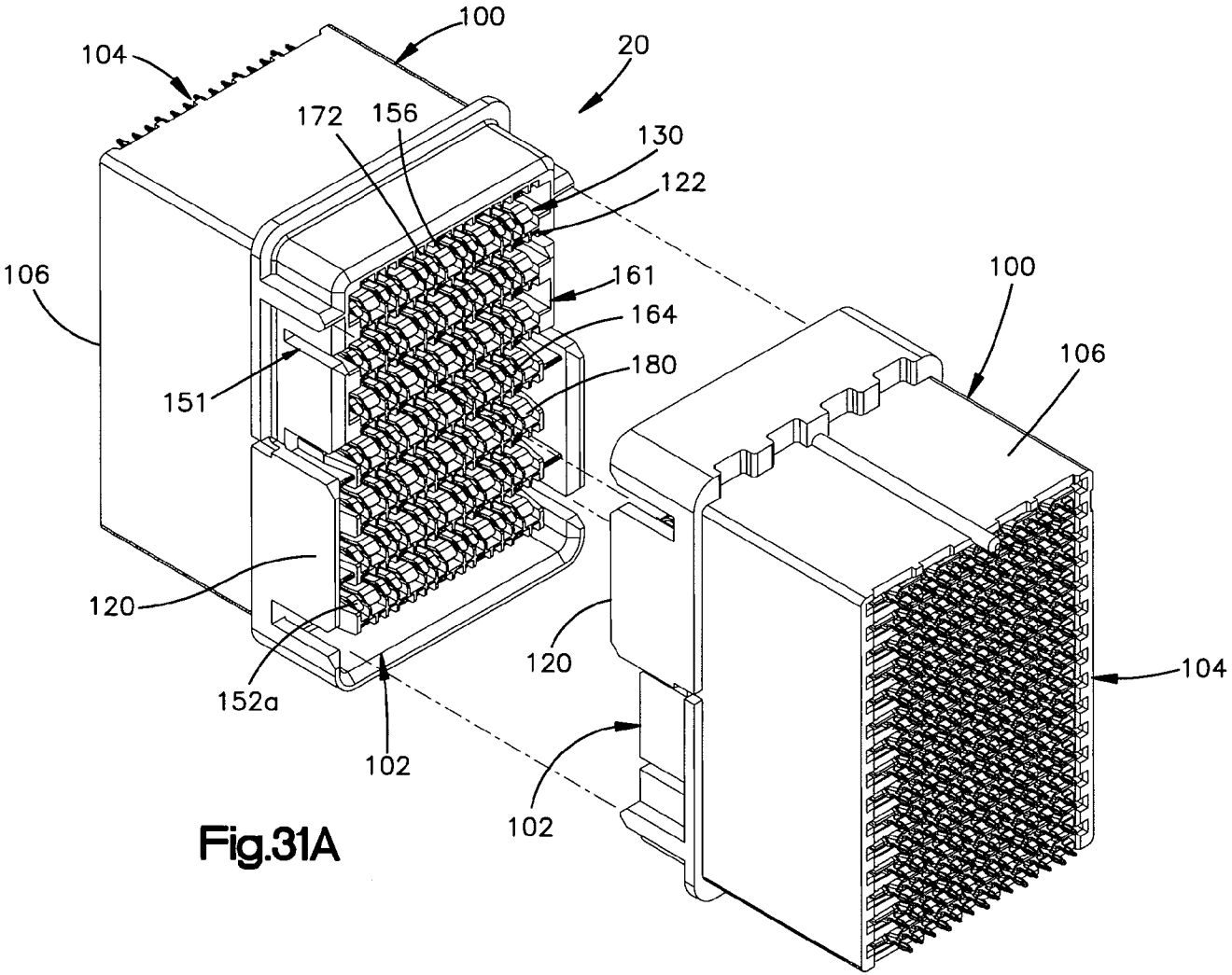
FIG. 31A is a perspective view of a mezzanine electrical connector assembly including first and second gender-neutral mezzanine connectors that are configured to mate with themselves, showing the mezzanine connectors aligned to be mated with each other.
Figure 31B:
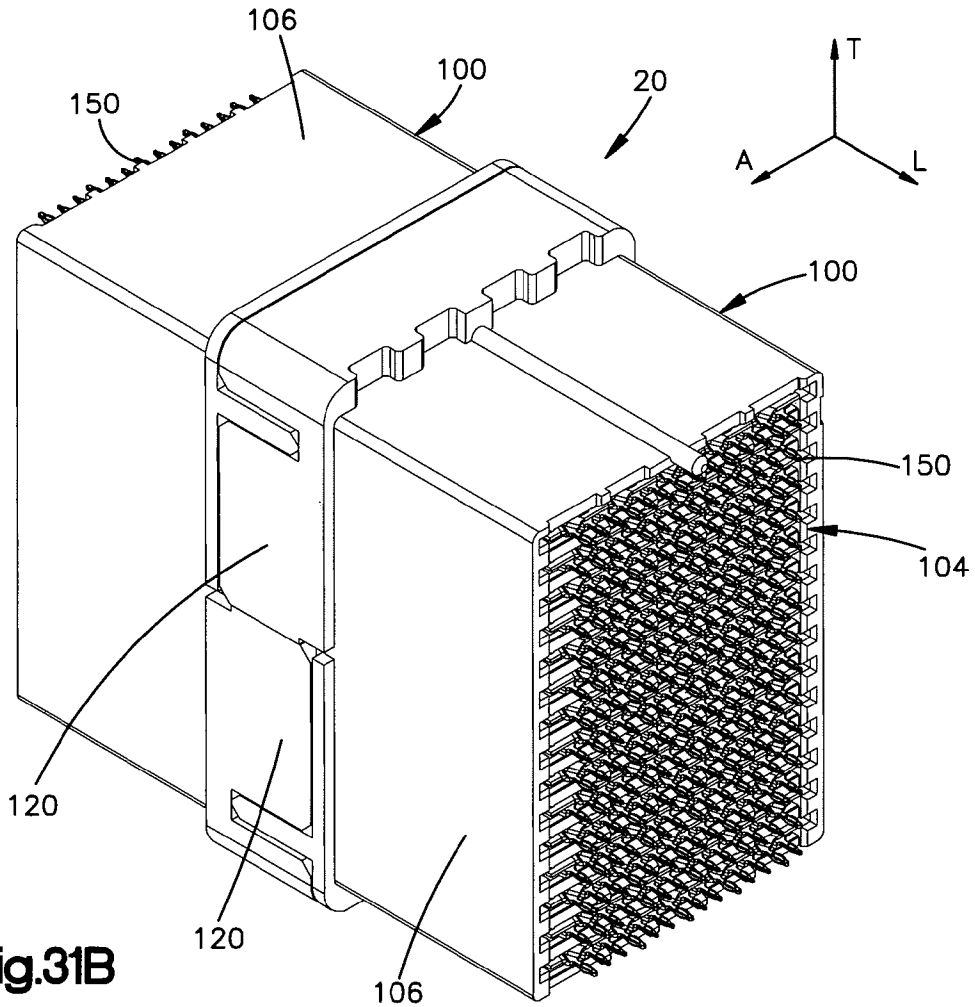
FIG. 31B is a perspective view of the mezzanine electrical connector assembly illustrated in FIG. 31A, showing the mezzanine connectors mated with each other.
Figure 31C:
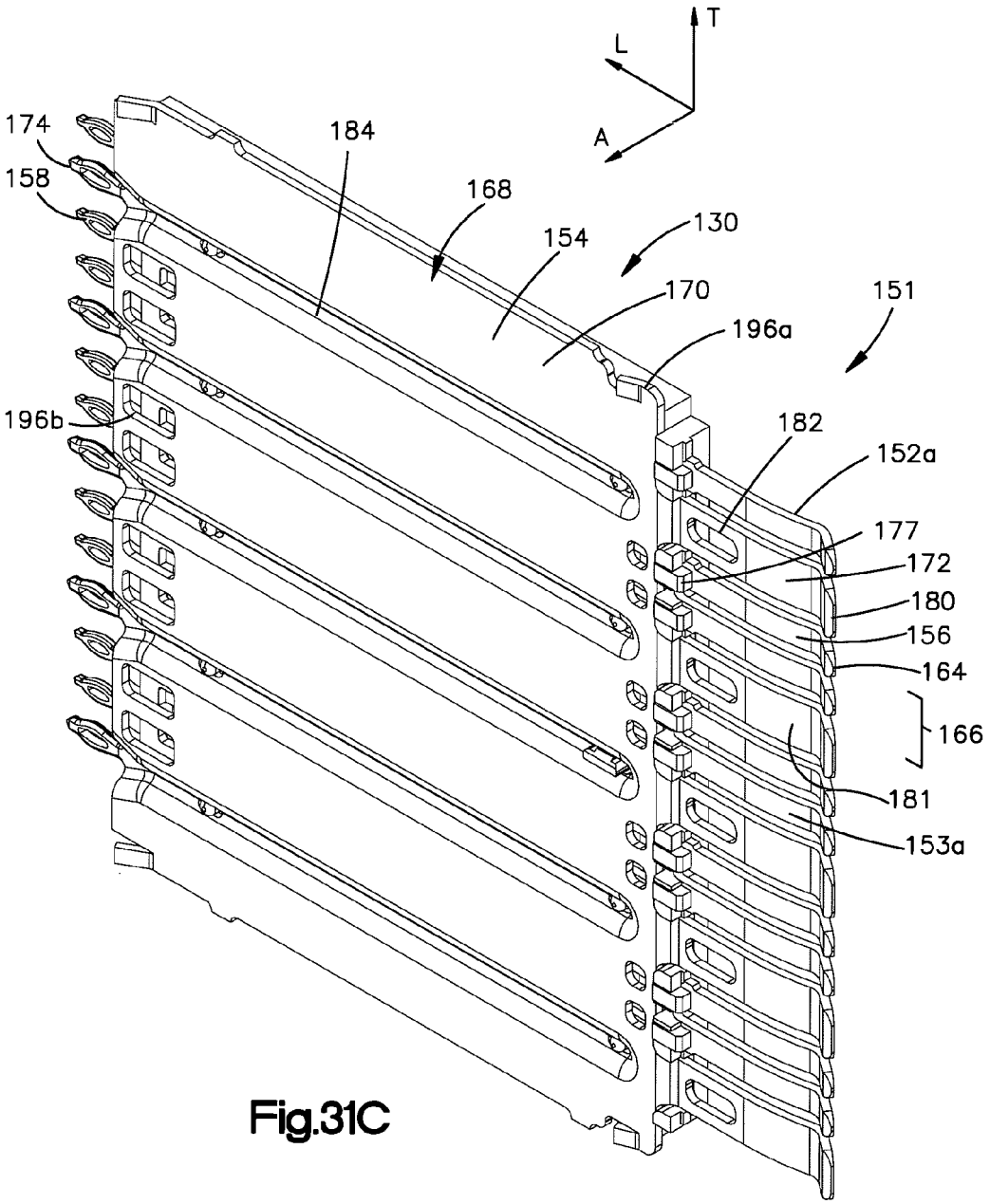
FIG. 31C is a perspective view of a leadframe assembly of one of the mezzanine connectors illustrated in FIG. 31A.
Figure 31D:
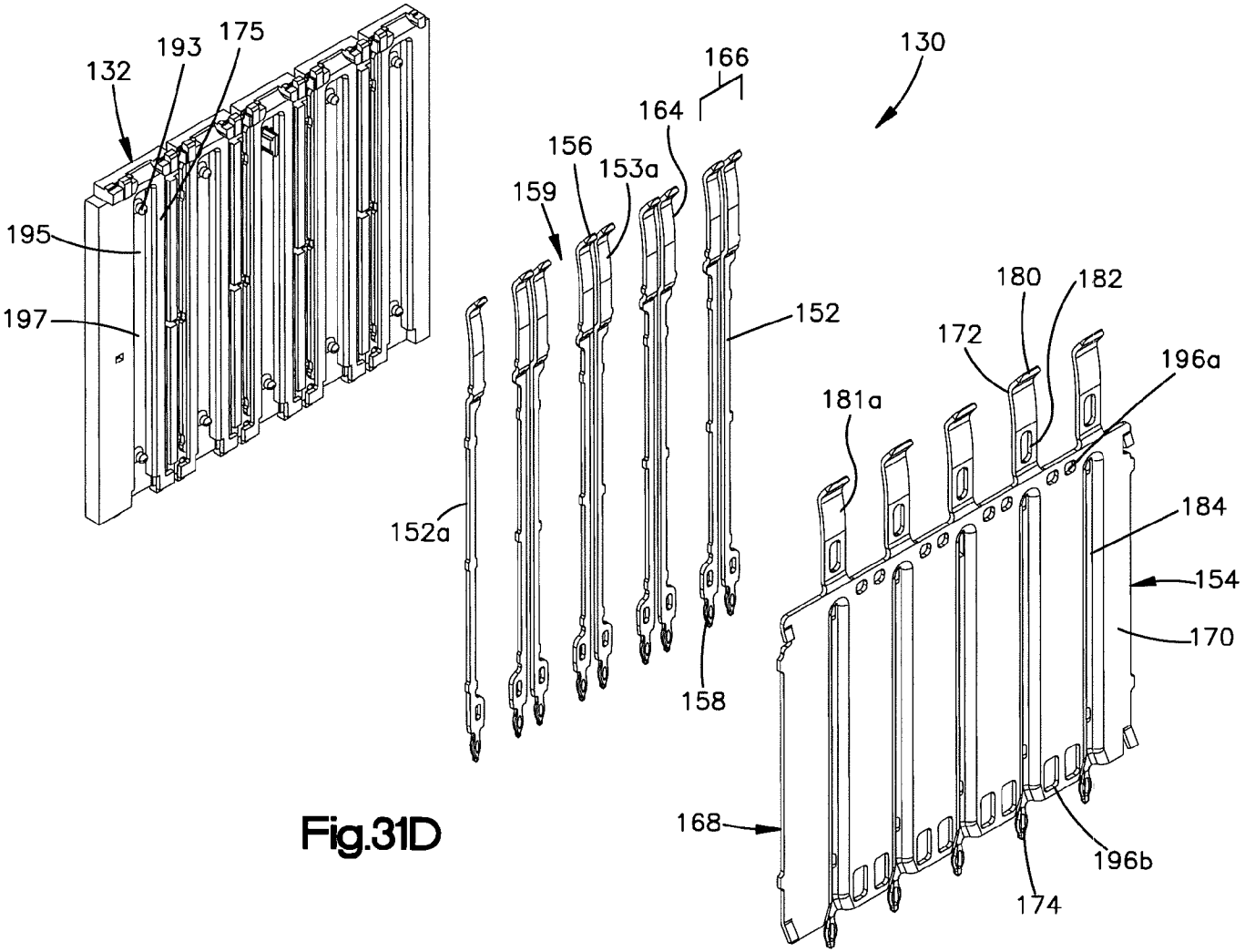
FIG. 31D is a perspective view of the leadframe assembly illustrated in FIG. 31C.

Referring now to FIG. 30, each of the plurality of cables 500 can each include at least one signal carrying conductor 502, such as a pair of signal carrying conductors 502, and an electrically insulative layer 504 that surrounds each of the pair of signal carrying conductors 502. The electrically insulative layers 504 of each cable can reduce the crosstalk imparted by one of the conductors 502 of the cable 500 to the other of the conductors 502 of the cable 500. Each of the cables 500 can further include an electrically conductive ground jacket 506 that surrounds both of the respective insulative layer 504 of the cable 500. The ground jacket 506 can be connected to a respective ground plane of a complementary electrical component to which the cable 500 is mounted. For example, in accordance with the illustrated embodiment, the ground jacket 506 of each of the plurality of cables 500 can be placed into contact with the ground plate 468. In accordance with certain embodiments, the ground jacket 506 can carry a drain wire. Each of the cables 500 can further include an outer layer 508 that is electrically insulative and surrounds the respective ground jacket 506. The outer layer 508 can reduce the crosstalk imparted by the respective cable 500 to another one of the plurality of cables 500. The insulative and outer layers 504 and 508 can be constructed of any suitable dielectric material, such as plastic. The conductors 502 can be constructed of any suitable electrically conductive material, such as copper. In accordance with the illustrated embodiment, each cable 500, and in particular the outer layer 508 of each cable 500, can define a first cross-sectional dimension D5 along the lateral direction A and a second cross-sectional dimension D6 along the transverse direction T.

Each of the plurality of cables 500 can have an end 512 that can be configured to be mounted or otherwise attached to the leadframe assembly 530 so as to place the cable 500 in electrical communication with the leadframe assembly 530. For example, the end 512 of each cable 500 can be configured such that respective portions of each of the signal carrying conductors 502 are exposed, the exposed portion of each signal carrying conductor 502 defining a respective signal conductor end 514 that can be electrically connected to the leadframe assembly 530. For example, respective portions of the insulative and outer layers 504 and 508 and the ground jacket 506 of each cable 500 can be removed from the respective signal carrying conductors 502 at the end 512 so as to expose the signal conductors ends 514. The respective portions of the insulative and outer layers 504 and 508 and the ground jacket 506 of each cable 500 can be removed such that each signal conductor end 514 extends outward from the insulative and outer layers 504 and 508 and the ground jacket 506 along the longitudinal direction L. Alternatively, the plurality of cables 500 can be manufactured such that the respective signal carrying conductors 502 extend longitudinally outward from the insulative and outer layers 504 and 508 and the ground jacket 506 at the end 512 of each cable 500, so as to expose the signal conductor ends 514. Additionally, a portion of the outer layer 508 rearward of the conductor end 516 of each cable 500 can be removed, thereby defining a respective exposed portion 507 of the ground jacket 506 of each cable 500. Alternatively, the plurality of cables 500 can be manufactured with at least a portion of the outer layer 508 removed so as to define the exposed portions 507 of the ground jackets 506.

Referring again to FIGS. 27-30, the signal contacts 452 define respective mating ends 456 that extend along the mating interface 402, and mounting ends 458 that extend along the mounting interface 404. The signal contacts 452 can be constructed as vertical contacts, whereby the mating ends 456 and the mounting ends 458 are oriented substantially parallel to each other. Each signal contact 452 can define a pair of opposed broadsides 460 and a pair of opposed edges 462 that extend between the opposed broadsides 460. The opposed edges 462 can be spaced apart the first distance D1. The mating end 456 of each signal contact 452 can be constructed as a receptacle mating end that defines a curved tip 464. The signal contacts 452 can be arranged in pairs 466, which can define edge-coupled differential signal pairs. Any suitable dielectric material, such as air or plastic, may be used to isolate the signal contacts 452 from one another. The mounting ends 458 can be provided as cable conductor mounting ends, each mounting end 458 configured to receive a signal conductor end 514 of a respective one of the plurality of cables 500. The first substrate 300*a* can be provided as a backplane electrical component, midplane electrical component, daughter card electrical component, or the like. In this regard, the electrical connector assembly 20 can be provided as a backplane electrical connector assembly.

Because the mating interface 402 is oriented substantially parallel to the mounting interface 404, the first electrical connector 400 can be referred to as a vertical connector, though it should be appreciated that the second electrical connector 400 can be constructed in accordance with any desired configuration so as to electrically connect a third complementary electrical component, such as a complementary electrical component electrically connected to opposed ends of the plurality of cables 500, to the first electrical connector 100, and thereby to a first complementary electrical component, such as the first substrate 300*a*. For instance, the second electrical connector 400 can be constructed as a vertical or mezzanine connector or a right-angle connector as desired.

The ground plate 468 includes a plate body 470 and a plurality of ground mating ends 472 that extend forward from the plate body 470 along the longitudinal direction L. The ground mating ends 472 are aligned along the transverse direction T. Each ground mating end 472 can define a pair of opposed broadsides 476 and a pair of opposed edges 478 that extend between the opposed broadsides 476. The opposed edges 478 can be spaced apart the second distance D2 along the transverse direction T. Each ground mating end 472 can be constructed as a receptacle ground mating end that defines a curved tip 480. At least one, such as each ground mating end 472 can define an aperture 482 that extends through the ground mating end 472 along the lateral direction A. The apertures 482 can be sized and shaped so as to control the amount of normal force exerted by the ground mating ends 472 on a complementary electrical contact of a complementary electrical connector, for instance the ground mating ends 172 of the first electrical connector 100. The apertures 482 of the illustrated embodiment are constructed as slots having rounded ends that are elongate in the longitudinal direction L. However it should be appreciated that the ground mating ends 472 can be alternatively constructed with any other suitable aperture geometry as desired.

The plate body 470 defines a first plate body surface that can define and inner surface 470*a* and an opposed second plate body surface that can define a second or outer surface 470*b* of the body of the ground plate 468. The outer surface 270*b* is spaced from the inner surface 470*a*, along the lateral direction A. The inner surface 470*a* faces the plurality of cables 500 when the ground plate 468 is attached to the leadframe housing 432. The ground plate 468 can further include opposed first and second side walls 467 and 469 that are spaced apart from each other along the transverse direction T such that the leadframe housing 432 can be received between the first and second side walls 467 and 469 in an interference fit, for example by pressing the leadframe housing 432 toward the ground plate 468 such that the leadframe housing 432 snaps into place between the first and second side walls 467 and 469. Each of the first and second side walls 467 and 469 can include a wing 471 that extends outwardly from the ground plate 468 along the transverse direction T, the wings 471 configured to be supported by the connector housing 406 when the leadframe assembly is inserted into the connector housing 406. The ground plate 468 can be formed from any suitable electrically conductive material, such as a metal.

Because the mating ends 456 of the signal contacts 452 and the ground mating ends 472 of the ground plate 468 are provided as receptacle mating ends and receptacle ground mating ends, respectively, the second electrical connector 400 can be referred to as a receptacle connector as illustrated. In accordance with the illustrated embodiment, each leadframe assembly 430 can include a ground plate 468 that defines five ground mating ends 472 and nine signal contacts 452. The nine signal contacts 452 can include four pairs 466 of signal contacts 452 configured as edge-coupled differential signal pairs, with the ninth signal contact 452 reserved. The ground mating ends 472 and the mating ends 456 of the signal contacts 452 of each leadframe assembly 430 can be arranged in a column that extends along the column direction. The differential signal pairs can be disposed between successive ground mating ends 472, and the ninth signal contact 452 can be disposed adjacent one of the ground mating ends 472 at the end of the column.

Each of the plurality of leadframe assemblies 430 can include a plurality of first leadframe assemblies 430 provided in accordance with a first configuration and a plurality of second leadframe assemblies 430 provided in accordance with a second configuration. In accordance with the first configuration, the ninth signal contact 452 of the first leadframe assembly 430 is disposed at an upper end of the column of electrical contacts 450. In accordance with the second configuration, the ninth signal contact 452 of the second leadframe assembly 430 is disposed at a lower end of the column of electrical contacts 450. It should be appreciated that the respective leadframe housings 432 of the first and second leadframe assemblies 430 can be constructed substantially similarly but with structural differences accounting for the respective configurations of electrical contacts 450 within the first and second leadframe assemblies 430 and for the configurations of the respective ground plates 468. It should further be appreciated the illustrated ground plate 468 is configured for use with the first leadframe assembly 430, and that the ground plate 468 configured for use with the second leadframe assembly 430 may define the ground mating ends 472 at locations along the plate body 470 that are different from those of the ground plate 468 configured for use with the first leadframe assembly 430.

The compression shield 490 can be configured to be attached to the leadframe housing 432 so as to compress exposed portions of the ground jackets 506 of the cables 500 into contact with the ground plate 468. The compression shield 490 can further be configured to isolate each cable 500 from each other cable 500 of the plurality of cables 500. The compression shield 490 can include a shield body 492 that defines an outer end 492*a* and an inner end 492*b* that is spaced from the outer end 492*a* along the transverse direction T, and opposed first and second sides 492*c* and 492*d* that are spaced apart from each other along the transverse direction T. The compression shield 490 is configured to be attached to the leadframe housing 432 such that the inner end 492*b* is spaced closer to the ground plate 468 than the outer end 492*a*. The inner end 492*b* of the shield body 492 can face the ground plate 468 when the compression shield 490 is attached to the leadframe housing 432. In accordance with the illustrated embodiment, the inner end 492*b* of at least a portion of the shield body 492 can abut the ground plate 468 when the compression shield 490 is attached to the leadframe housing 432.

The shield body 492 of each compression shield 490 can define a plurality of substantially "U" shaped canopies 494 that are spaced apart from each other along the transverse direction T. Each canopy 494 is configured to receive and isolate an end 512 of a respective one of the cables 500 from the respective ends 512 of other ones of the plurality of cables 500 that are disposed in respective adjacent ones of the cavities 504, for instance to reduce electrical cross talk between the cables 500 when the cables 500 carry data signals. In accordance with the illustrated embodiment, each canopy 494 includes a top wall 497 that is spaced from the inner end 492*b* along the lateral direction A, and opposed first and second side walls 493 and 495 that are spaced apart from each other along the transverse direction T. The compression shield 490 can include attachment members 498 that are configured to be attached to the first and second attachment arm 438 and 440 of the leadframe housing 432. The attachment members 498 can be disposed at the first and second sides 492*c* and 492*d* of the shield body 492. The attachment members 498 can be shaped the same or differently.

The top wall 497 can define an inner surface 497*a* that faces the inner end 492*b* of the shield body 492. The inner surface 497*a* can be spaced from the inner end 492*b* a distance D7 along the lateral direction A that is less than the second cross-sectional dimension D6 of each of the plurality of cables 500. The first and second side walls 493 and 495 can be spaced apart from each other a distance D8 along the transverse direction T that is greater than the cross-sectional dimension D5 of each of the plurality of cables 500, such that each of the canopies 494 is configured to receive at least one of the plurality of cables 500. The distance D8 can be less than the combined cross-sectional dimension of a pair of adjacent ones of the plurality of cables 500, such that each of the canopies 494 receives only a single cable 500 when the compression shield 490 is attached to the leadframe housing 432. It should be appreciated that the illustrated compression shield 490 is configured for use with the first leadframe assembly 430, and that the compression shield 490 configured for use with the second leadframe assembly 430 may define the canopies 494 at locations along the shield body 492 that are different from those of the compression shield 490 configured for use with the first leadframe assembly 430 as described herein, and that the attachment members 498 of the compression shields 490 for use with the first and second leadframe assemblies 430 as described herein can be configured in accordance with any alternative embodiment as desired.

In accordance with a preferred method of assembling the leadframe assembly 430, the leadframe housing 432, including the signal contacts 452, can be attached to the ground plate 468 as described above. The plurality of cables 500 can then be prepared, for example by removing portions of one or both of the insulative and outer layers 506 or 508 to define the conductor ends 514 and the exposed portions 507 of the ground jackets 506. The conductor ends 514 can be configured to be disposed onto respective ones of the mounting ends 458 of the signal contacts 452. The exposed portion 507 of the ground jacket 506 of each cable 500 can be configured to overlap with the inner surface 470*a* of the plate body 470, and can abut the inner surface 470*a* of the plate body 470 when the conductor end 514 of each cable 500 is attached to a corresponding one of the mounting ends 458 of the signal contacts 452.

The conductor ends 514 of each of the plurality of cables 500 can then be attached to respective ones of the mounting ends 458 of the signal contacts 452. For example, the conductor ends 514 of each of the plurality of cables 500 can be soldered, or otherwise attached to respective ones of the mounting ends 458 of the signal contacts 452. The compression shield 490 can then be attached to leadframe assembly 430. Prior to attaching the compression shield 490 to the leadframe assembly 430, the cross-sectional dimension D6 defined by each of the plurality of cables 500 is less than the distance D7, such that the compression shield 490 operates to compress at least the ends 512 of the plurality of cables 500 as the compression shield 490 is attached to the leadframe assembly 430.

As the compression shield 490 is attached to the leadframe housing 432, the inner surface 497*a* of the top wall 497 comes into contact with cables 500, thereby compressing the cables such that the exposed portions 507 of the ground jackets 506 of each of the cables 500 are compressed against the inner surface 470*a* of the plate body 470, until the cross-sectional dimension D6 defined by each of the plurality of cables 500 is substantially equal to the distance D7. The compression shield 490 can thus be configured to bias at least a portion of each of the plurality of cables 500, for instance the exposed portions 507 of the ground jackets 506, against respective portions of the ground plate 468, such that the exposed portions 507 of the ground jackets 506 are placed into electrical communication with the ground plate 468. It should be appreciated that the compression shield 490 can be constructed of any suitable material as desired. For instance, the compression shield 490 can be made from a conductive material such as a metal or a conductive plastic, or any suitable lossy material as desired, such as a conductive lossy material. It should be appreciated the second electrical connector 400 is not limited to the illustrated leadframe assembly 430. For example, the electrical connector 400 can be alternatively constructed using any other suitable leadframe assembly, for instance one or more leadframe assemblies constructed as desired.

Figure 27:
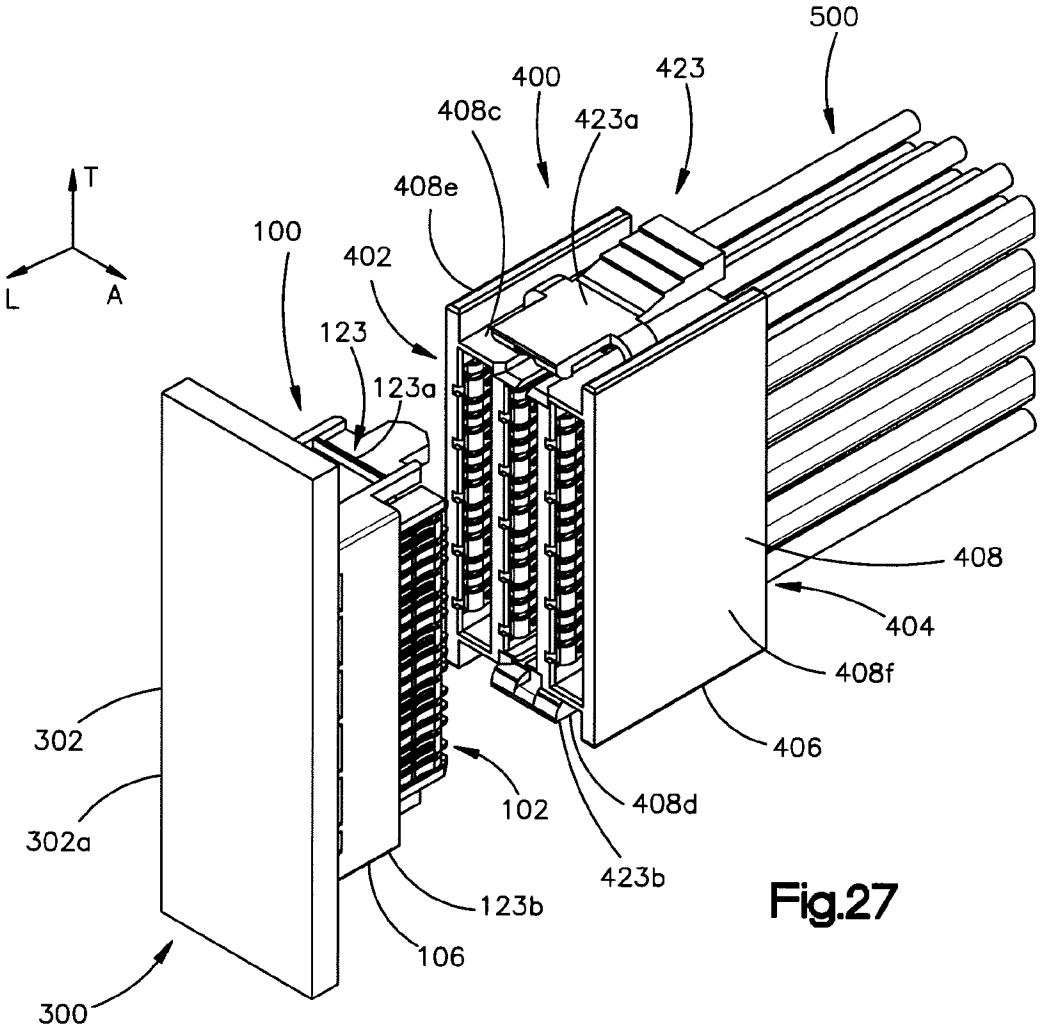
FIG. 27 is a perspective view of an electrical cable connector assembly constructed in accordance with one embodiment, including a first electrical connector and a second electrical connector configured to be mated to each other.
Figure 28:
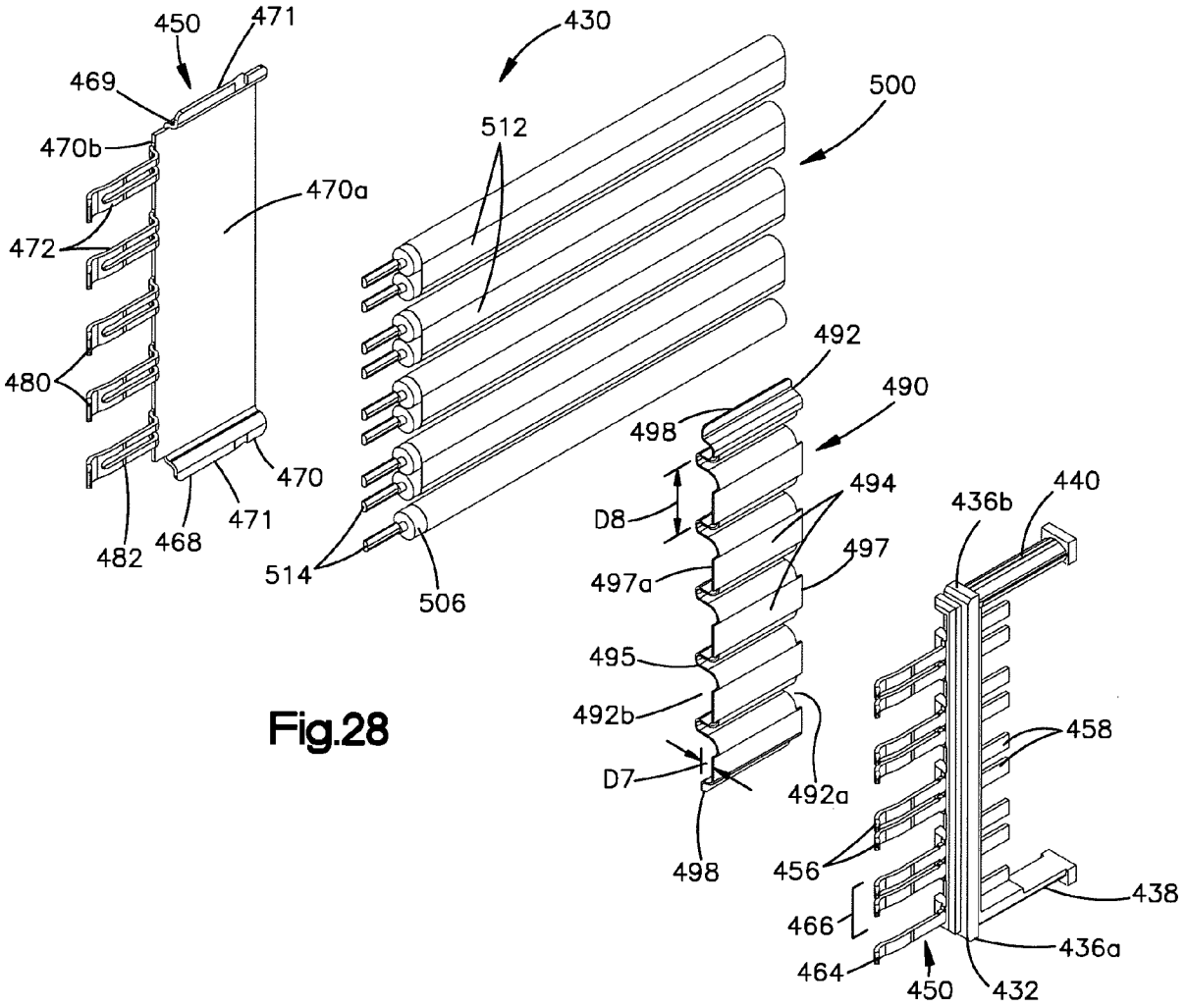
FIG. 28 is a perspective exploded view of a leadframe assembly of the second electrical cable connector assembly illustrated in FIG. 27.
Figure 29:
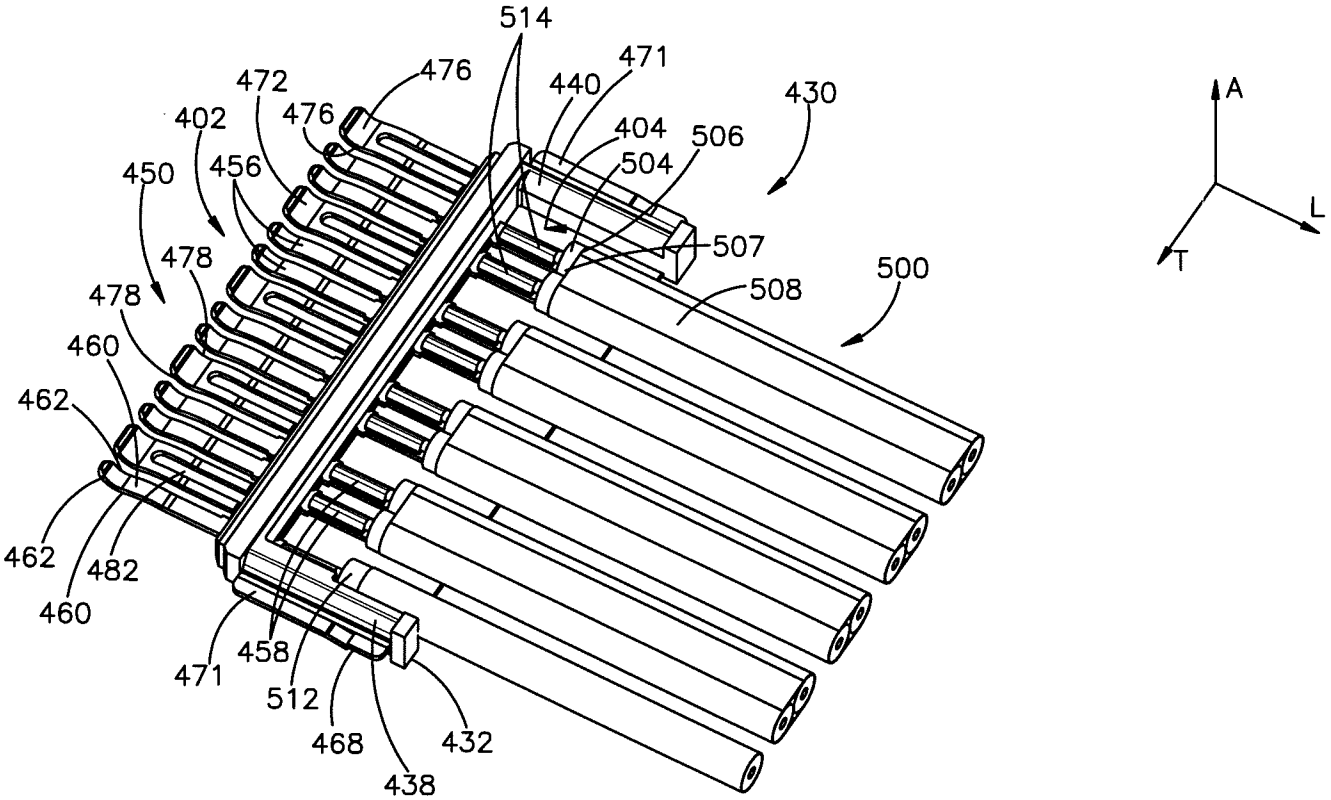
FIG. 29 is a perspective view of the leadframe assembly illustrated in FIG. 28, shown in a partially assembled configuration.

Referring now to FIG. 27, the connector housing 406 can be constructed substantially similarly to the connector housings 206, with the exception of certain elements of the connector housing 406 that are differently constructed, as described in more detail below. Accordingly, in the interest of clarity, elements of the connector housing 406 that are substantially similar to corresponding elements of the connector housing 206 are labeled with reference numbers that are incremented by 200. For example, the connector housing 406 is constructed as a vertical connector housing rather than a right-angle connector housing. Furthermore, the connector housing 406 does not include the flexible arms 231 of the connector housing 206.

The second electrical connector 400 can include a plurality of leadframe assemblies 430 that are disposed into the void of the connector housing 406 and are spaced apart from each other along the lateral direction A. Each leadframe assembly 430 can define a respective column of electrical contacts 450 in the electrical connector 400. In accordance with the illustrated embodiment, the connector housing 406 supports six leadframe assemblies 430. The six leadframe assemblies 430 can include alternating first and second leadframe assemblies 430 disposed from left to right in the connector housing 406. The tips 464 of the mating ends 456 of the signal contacts 452 and the tips 480 of the ground mating ends 472 of the ground plate 468 of the first leadframe assembly can be arranged in accordance with a first orientation wherein the tips 464 and 480 are curved toward the first side wall 408*e* of the housing body 408. The tips 464 of the mating ends 456 of the signal contacts 452 and the tips 480 of the ground mating ends 472 of the ground plate 468 of the second leadframe assembly can be arranged in accordance with a second orientation wherein the tips 464 and 480 are curved toward the second side wall 408*f* of the housing body 408. The second electrical connector 400 can be constructed with alternating first and second leadframe assemblies 430 disposed in the connector housing 406 from left to right between the first side wall 408*e* and the second side wall 408*f*.

The first and second connector housings 106 and 406 can further define complementary retention members that are configured to retain the first and second electrical connectors 100 and 400 in a mated position with respect to each other. For example, in accordance with the illustrated embodiment, the connector housing 106 further defines at least one latch receiving member 123, such as first and second latch receiving members 123*a* and 123*b* that extend into the first and second alignment beams 122*a* and 122*b*, respectively, along the transverse direction T. The connector housing 406 further includes at least one latch member 423, such as first and second latch members 423*a* and 423*b*. The first latch member 423*a* is disposed on the top wall 408*c* of the housing body 408, and is configured to releasably engage with the first latch receiving member 123*a*. The second latch member 423*b* is similarly constructed to the first latch member 423*a*, is disposed on the bottom wall 408*d* of the housing body 408, and is configured to releasably engage with the second latch receiving member 123*b*.

The housing body 408 can further be configured to protect the first and second latch members 423*a* and 423*b*. For example, in accordance with the illustrated embodiment, the first and second side walls 408*e* and 408*f* are extended above the top wall 408*c* along the transverse direction T, and are extended below the bottom wall 408*d* along the transverse direction T. It should be appreciated that the first and second connector housings 106 and 406 are not limited to the illustrated retention members, and that one or both of the first and second connector housings 106 and 406 can be alternatively constructed with any other suitable retention members as desired. It should further be appreciated that the second connector housing 206 can be alternatively constructed in accordance with the illustrated retention members or with any other suitable retention members as desired.

Moreover, it should be appreciated that the second electrical connector 400 can be alternatively constructed to mate with a right-angle receptacle electrical connector, such as the second electrical connector 200. For instance, the connector housing 406 can be alternatively constructed with first and second alignment beams constructed substantially similarly to the first and second alignment beams 122*a* and 122*b* of the first electrical connector 100. Alternatively, the connector housing 106 of the first electrical connector 100 can be alternatively constructed to receive the leadframe assemblies 430 of the second electrical connector 400.

Referring now to FIGS. 31A-31D an electrical connector assembly 20 can be configured as a mezzanine connector assembly including first and second electrical connectors 100 and 200 that are both mezzanine connectors having electrical contacts 150 and 250 that include a plurality of electrical signal contacts 152 and a plurality of ground contacts 154 of the type described herein. In particular, each of the mating ends 156 of the signal contacts and the ground mating ends 172 are configured to mate with complementary electrical contacts that are their mirror images of themselves. The mating ends 156 and the ground mating ends 172 can be oriented substantially parallel to each other, and the mounting ends 158 and the ground mounting ends 174 can be oriented substantially parallel to each other. Each of the electrical connectors 100 can include first and second leadframe assemblies 130*a* and 130*b* supported by the respective connector housings 106 as described above. Further, each connector housing 106 can define a one or more such as a plurality of alignment members 120 that can include beams and recesses each configured to receive each other. The alignment members 120 can be constructed such that the connector housings 106 are hermaphroditic, that is they mate with housings that define mirror images of themselves. Because the electrical connectors 100 are configured to interchangeably with each other, the electrical connector assembly 20 can be referred to as a hermaphroditic connector assembly, and the electrical connectors 100 can be referred to as hermaphroditic electrical connectors. For instance, the mating ends of the electrical contacts 150 are configured to mate with mating ends that define mirror images of themselves, the electrical contacts 150 define their mirror images when the electrical connector 100 is inverted, and the linear arrays 151 are symmetrical to each other when the electrical connectors 100 are inverted, the mezzanine connectors 100 can be referred to as hermaphroditic connectors. The hermaphroditic connectors, such as the first electrical connectors 100, can be constructed in accordance with any embodiment described herein, unless otherwise indicated. When the first and second electrical connectors 100 are mated, they can define any stack height as desired, measured from the mounting interface 104 of the first electrical connector 100 to the mounting interface 104 of the second electrical connector, or from the first substrate 300*a* to which the first electrical connector 100 is mounted to the second substrate 300*b* to which the second electrical connector 200 is mounted (see, e.g., FIG. 1). The stack height can, for instance be within a range having a lower end of approximately 10 mm and approximately 50 mm.

Figure 32A:
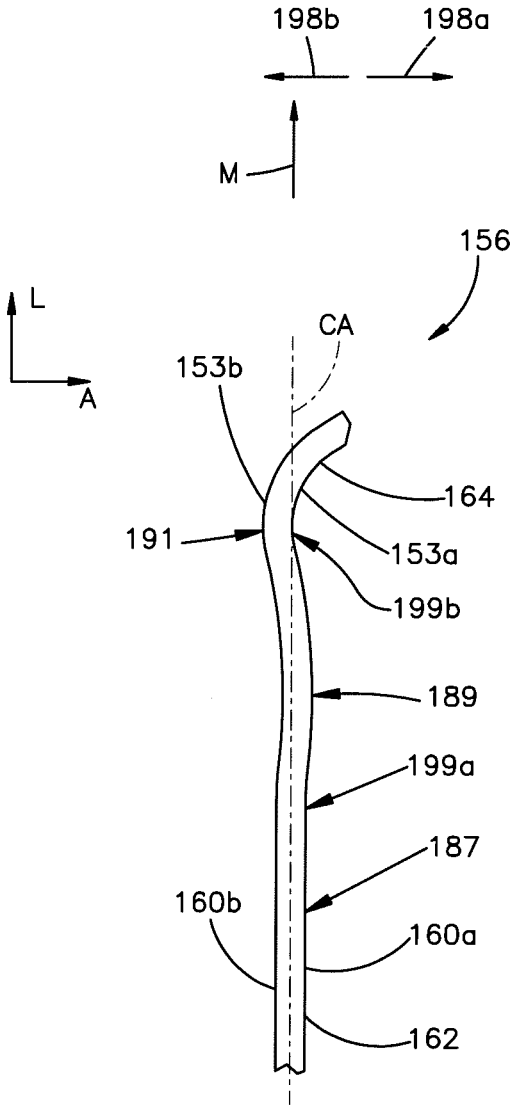
FIG. 32A is a side elevation view showing a geometry of a receptacle mating end of a respective one of the signal contacts of the first electrical connectors of any embodiment described herein.
Figure 32F:
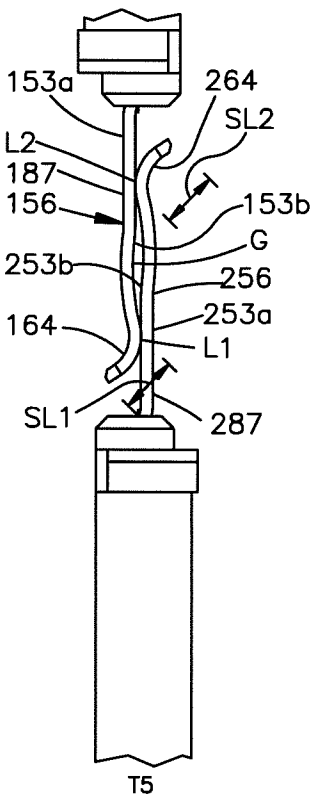
FIG. 32F is a side elevation view showing the receptacle mating ends illustrated in FIG. 32E shown in a fully mated configuration.
Figure 32E:
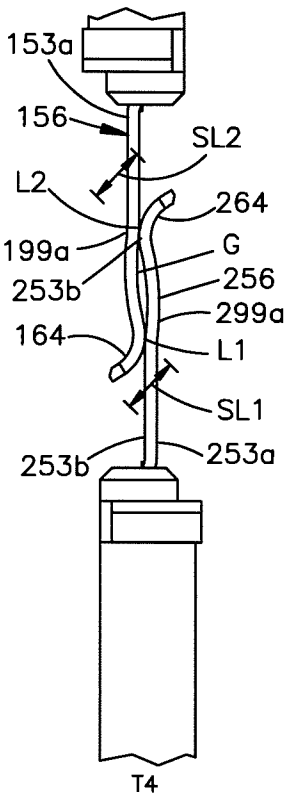
FIG. 32E is a side elevation view showing the receptacle mating ends illustrated in FIG. 32D shown in a third partially mated configuration more fully mated than the second partially mated configuration.
Figure 32D:
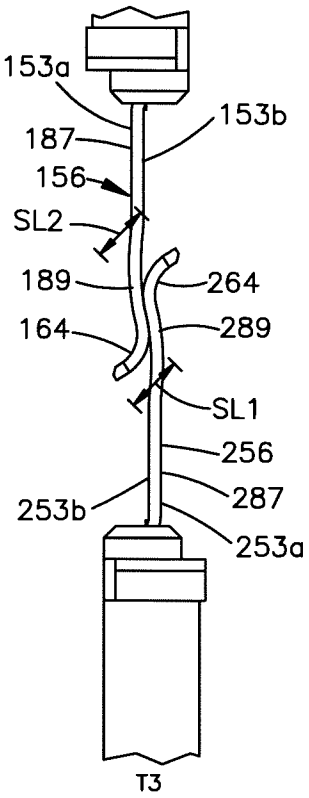
FIG. 32D is a side elevation view showing the receptacle mating ends illustrated in FIG. 32C shown in a second partially mated configuration more fully mated than the first partially mated configuration.
Figure 32C:
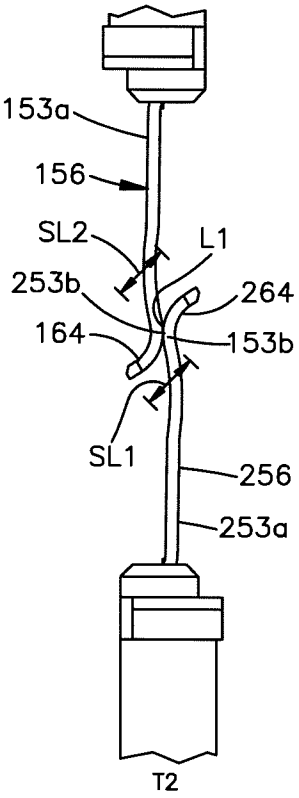
FIG. 32C is a side elevation view showing the receptacle mating ends illustrated in FIG. 32B shown in a first partially mated configuration.

Referring now to FIG. 32A, the receptacle mating end 156 of a respective one of the plurality of signal contacts 152, representative of the mating ends 156 of a plurality up to all of the signal contacts 152, can define receptacles as described herein. The signal contacts 152, and thus the mating ends 164, define first and second opposed surfaces such as broadsides 160*a* and 160*b*, and opposed edges 162 that are connected between each of the opposed broadsides 160*a-b*. The inner surface 153*a* can be defined by the first broadside 160*a* and the outer surface 153*b* can be defined by the second broadside. Thus the mating end 156*a* can define an inner direction 198*a* from the outer surface 153*b* toward the inner surface 153*a*, for instance along the lateral direction A, and an outer direction 198*b* opposite the inner direction 198*a*, and thus from the inner surface 153*b* toward the outer surface 153*a*, for instance along the lateral direction A. In accordance with the illustrated embodiment, the mating end 156 includes at least a first section which can define a stem 187 that extends substantially straight along a central contact axis CA that can oriented substantially along the longitudinal direction L.

The mating end 156 can define a pair of sections, such as a second section 189 and a third section 191 can combine to define a profile that is substantially "S" shaped. The second section 189 can extend longitudinally forward from the first section 191, which can be defined as a direction from the respective mounting end toward the mating end 156, for instance along the mating direction M. The third section 191 can extend longitudinally forward from the second section 189. The third section 191 can thus define an outer portion along the longitudinal direction L, and the second section 18 can define an inner portion that is inwardly spaced from the outer portion along the longitudinal direction L, the outer portion defining a curvature that is greater than the inner portion. Further, the curvature of the outer portion can be opposite the curvature of the inner portion with respect to the central contact axis CA.

The mating end 156 define a first interface 199*a* between the first section 187 and the second section 189, and a second interface 199*b* between the second section 189 and the third section 191. At the first section 187, the first and second broadsides 160*a-b* can be substantially co-planar in respective planes that are substantially parallel to the central contact axis CA and defined by the longitudinal direction L and the transverse direction T. For instance, at the first interface 199*a*, the mating end 156 can bend, for instance curve, away from the contact axis CA along a first direction, such as the inner direction 198*a* as the mating end 156 extends forward along the longitudinal direction, which can be defined as a direction from the respective mounting end toward the mating end 156, for instance along the mating direction M. Thus, the inner surface 153*a* can be concave at the first interface 199*a*, and the outer surface 153*b* can be convex at the first interface 199*a*.

At the second section 189, the mating end 156 can bend, for instance curve, along the outer direction as it extends forward along the longitudinal direction L. Thus, the outer surface 153*b* can be concave and the inner surface 153*a* can be convex at the second section 189. The mating end 156 can extend to the second interface 199*b*, which defines a transition from the second section 189 to the third section 191 which can bend, for instance curve, along the inner direction 198*a* as it extends forward along the longitudinal direction. Thus, the inner surface 153*a* can be concave at the third section 191, and the outer surface 153*b* can be convex at the third section 191. The third section 191 can define the tip 164 as described above. The curvature of the inner surface 153*a* at the third section can be greater than the curvature of the outer surface 153*b* at the second section. Similarly, the curvature of the outer surface 153*b* at the third section 191 can be greater than the curvature of the inner surface 153*a* at the second section 189.

It should be appreciated that the ground mating ends 172, the ground mating ends 272, the ground mating ends 472, and any suitable alternatively configured ground mating ends can constructed as described herein with respect to the mating ends 156 of the signal contacts 152. Thus, the ground mating ends 172, the ground mating ends 272, the ground mating ends 472, and any suitable alternatively configured ground mating ends can define the first, second, and third sections 187, 189, and 191, and interfaces 199*a* and 199*b* as described herein with respect to the signal contacts 152. Further, the mating ends 256, the mating ends 456, and any suitable alternatively configured mating ends of signal contacts can be constructed as described herein with respect to the mating ends 156 of the signal contacts 152. Thus, the mating ends 256, the mating ends 456, and any suitable alternatively configured mating ends of signal contacts can define the first, second, and third sections 187, 189, and 191, and interfaces 199*a* and 199*b* as described herein with respect to the signal contacts 152. For instance, FIGS. 32B-32F illustrate a mating end 256 constructed as described herein with respect to the mating end 156, but with reference numerals incremented by 100 for the purposes of clarity.

Figure 32B:
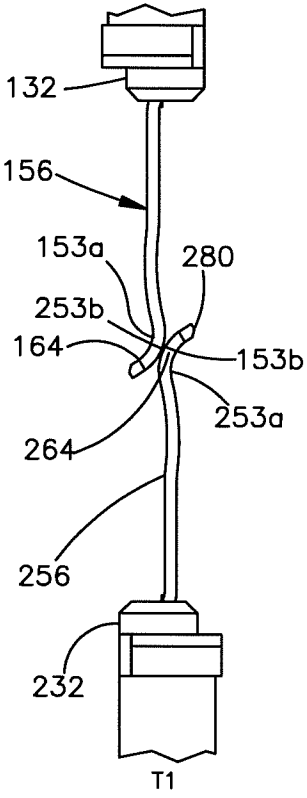
FIG. 32B is a side elevation view showing the receptacle mating end illustrated in FIG. 32A aligned to be mated to a complementary receptacle mating end of a respective one of the signal contacts of the second electrical connectors of any embodiment described herein.

Referring now to FIG. 32B, mating between the mating ends 156 of the first electrical connector 100 and the mating ends 256 of the second electrical connector along the mating direction M is illustrated, for instance after the first and second electrical connectors have completed the second stage of fine alignment as described above. The mating ends 156 and 256 are illustrated over a series of sequential units of time starting at a first time T1, whereby the mating ends 156 and 256 are in an unmated position and ending at a fifth time T5 with the mating ends 156 and 256 in a substantially fully mated position relative to each other, and times T2 through T4, illustrating sequential times between T1 and T5 as the mating ends 156 and 256 are mated along the respective mating directions.

At the first time T1, the convex outer surface 153*b* at the tip 164 is aligned with the outer surface 181*b* at the tip 180. At a second time T2 after the first time T1, the tip 164 of the mating end 156 and the tip 264 of the mating end 256 make initial contact with each other at a contact location L1, for instance at the respective outer surfaces 153*b* and 253*b*, respectively. The mating ends 156 and mating end 256 exert normal forces against each other that are directed substantially normal to the mating direction, and thus can be directed substantially along the lateral direction A. Further, the mating ends 156 and 256 move along each other between times T1 and T2 in response to a mating force that is applied to the electrical connectors 100 and 200 along the mating directions. The mating end 156 defines a first stub length SL1, and the mating end 256 define s a second stub length SL2 as described in more detail below. It should be appreciated that the first stub length SL1 is substantially equal to the second stub length SL2.

Figure 33A:
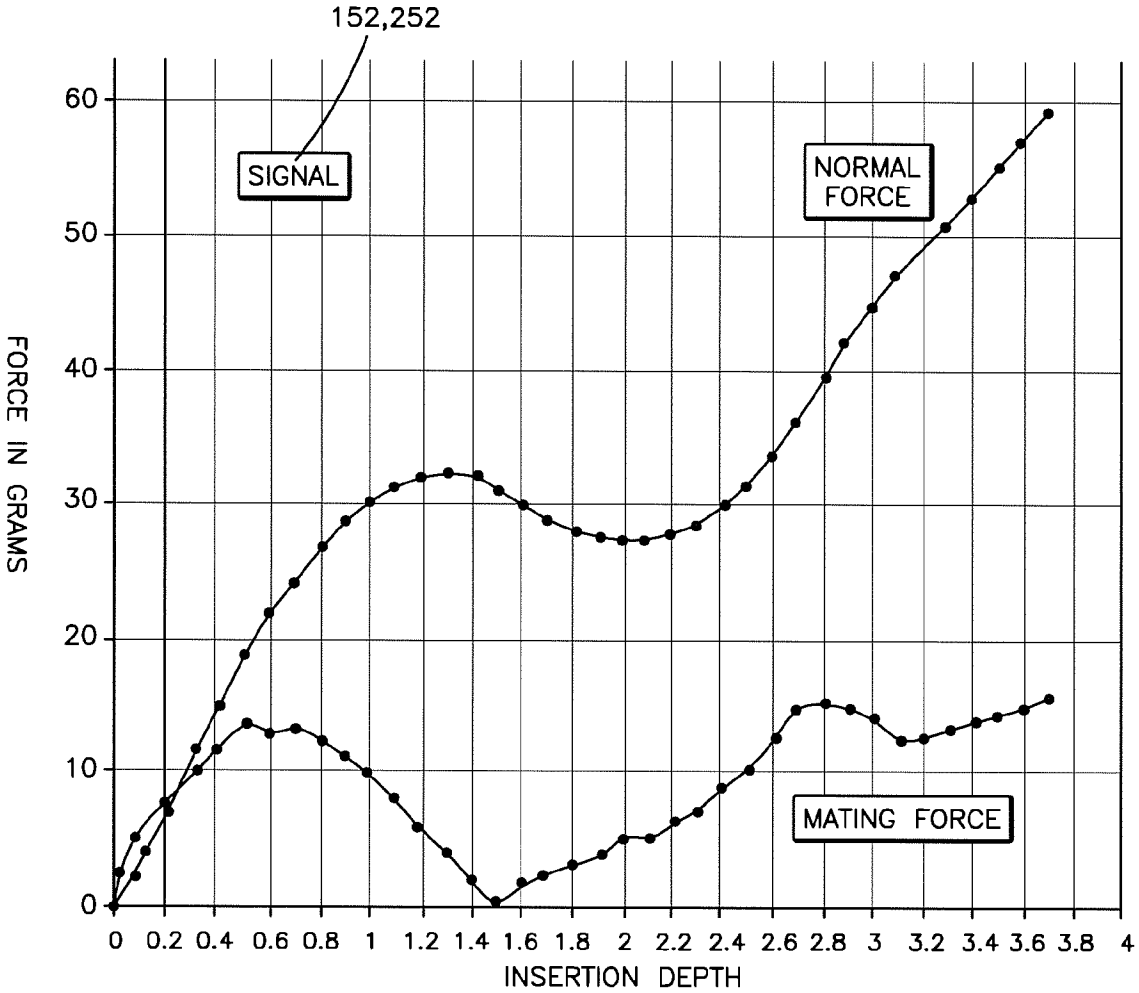
FIG. 33A is a first graph illustrating normal forces against insertion depths of the signal contacts of the electrical connectors constructed as described herein.
Figure 33B:
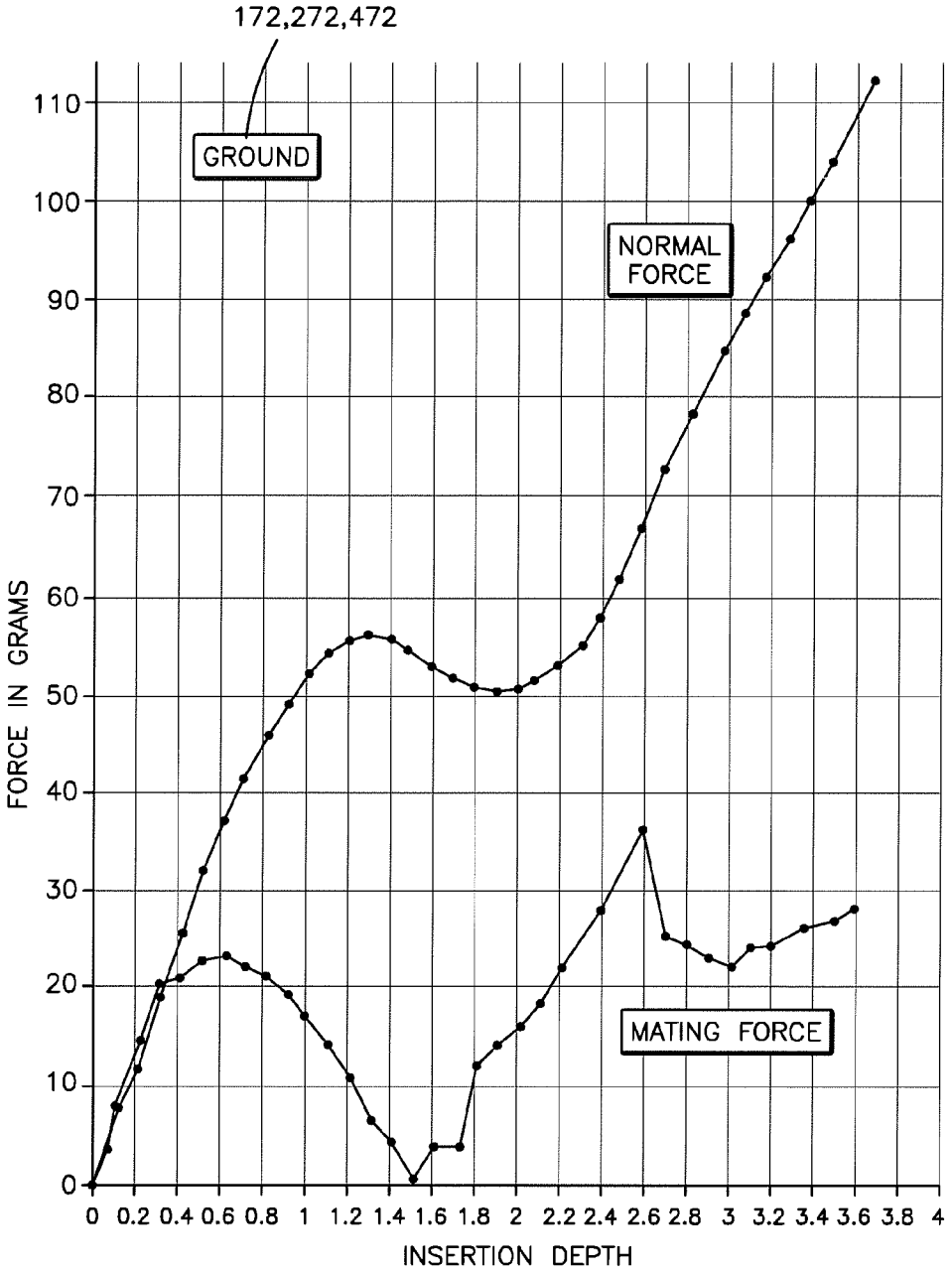
FIG. 33B is a second graph illustrating normal forces against insertion depths of the ground mating ends of the electrical connectors constructed as described herein.

At a third time T3 after the second time T2, as the mating ends 156 and 256 continue to move along their respective mating directions M, the outer surfaces 153*b* and 253*b* at the tips 164 and 264, respectively, slide past each other and abut each other at the respective second sections 189 and 289, where the outer surfaces 153*b* and 253*b* are concave. Between times T2 and time T3 the mating force diminish and approach zero. When the first and second electrical connectors 100 and 200 are mated to one another, engagement between the receptacle mating ends 156 of the first plurality of signal contacts 150 and the receptacle mating ends 256 of the second plurality of signal contacts 250 produces a non-zero mating force when the first and second connector housings 106 and 206 are spaced apart a first distance along the lateral direction A, for example at time T2, and that engagement between the receptacle mating ends 156 of the first plurality of signal contacts 150 and the receptacle mating ends 256 of the second plurality of signal contacts 250 produces a mating force of substantially zero (see FIGS. 33A-33B) when the first and second connector housings 106 and 206 are spaced apart a second distance that is shorter than the first distance.

Between the third time T3 and a fourth time T4, after the third time T3, the outer surface 253*b* of the tip 264 rides along the outer surface 153*b* toward the interface 199*a* between the second section 189 and the first section 187. Similarly, the outer surface 153*b* of the tip 164 rides along the outer surface 253*b* toward the interface 299*a* between the second portion 289 and the first portion 287. At the fourth time T4, the first and second mating ends 164 and 264 define first and second contact locations L1 and L2. At the first contact location L1, the outer surface 153*b* at the tip 164 contacts the outer surface 253*b* at the interface 299*a*. At the second contact location L2, the outer surface 253*b* at the tip 264 contacts the outer surface 153*b* at the interface 199*a*. The mating forces increase between time T3 and time T4.

It should be appreciated that each receptacle mating end 172 and 156, and 272 and 256, is elongate along a respective central axis, and each receptacle mating end defines two contact locations L1 and L2 configured to mate with a mating end that is mirror image of itself. For instance, the contact locations L1 and L2 can be the innermost locations of the mating ends 156 and 172, that is the locations that are spaced closest to the divider wall described above. The second contact location L2 can be spaced from the respective tip a first distance, and the first contact location L1 can be spaced from the respective tip a second distance that is less than the first distance. For instance, the first contact location L1 can be defined by the tip. Thus, the first contact location L1 can be referred to as a distal contact location, and the second contact location L2 can be referred to as a proximal contact location. The proximal contact location L2 is spaced from the respective leadframe housing a first distance, and the distal contact location L1 is spaced from the respective leadframe housing a second distance that is greater than the first distance. Each receptacle mating end defines a stub length measured from one of the contact locations, such as the distal-most contact location, to a terminating edge of the tip. Thus, the mating ends 172 and 156 define a first stub length SL1, and the mating ends 272 and 256 each define a second stub length SL2. The stub lengths SL1 and SL2 can be in a range having a lower end of approximately 1.0 mm and an upper end of approximately 3.0 mm. For instance, the stub lengths SL1 and SL2 can be approximately 1.0 mm.

Furthermore, each of the mating ends at the first contact location L1 is configured to ride along the complementary mating end to which it is mated a distance known as a wipe distance, which can be defined as a linear distance along which the first contact location L1 abuts and rides along the mating end of the complementary mating end until the first contact location L1 each of the first and second complementary mating ends is seated the second contact location L2 of the other of the first and second complementary mating ends. The ground mating ends and the mating ends of the signal contacts of each of the first and second electrical connectors 100 and 200 can define a wipe distance in a range having a lower end of approximately 1.0 mm, such as approximately 2.0 mm, and an upper end of approximately 5.0 mm, for instance approximately 4.0 mm, for approximately instance 3.0 mm. In accordance with one embodiment, the wipe distance is approximately 2.0 mm.

At the fourth time T4, the signal contacts 152 and 252 define a gap G between the mating end 156 and the mating end 256 between the first and second contact locations L1 and L2. The gap G can have a width along the lateral direction A between the respective outer surfaces 153*b* and 253*b* that is less than both the first stub length SL1 and the second stub length SL2. Because two locations of contact, specifically L1 and L2, are maintained by the mating end 156 and the mating end 256, the first and second stub lengths SL1 and SL2 remain constant. Accordingly, it should be appreciated that the first and second stub lengths SL1 and SL2 remain substantially equal to the values exhibited at time T3.

Figure 4A:
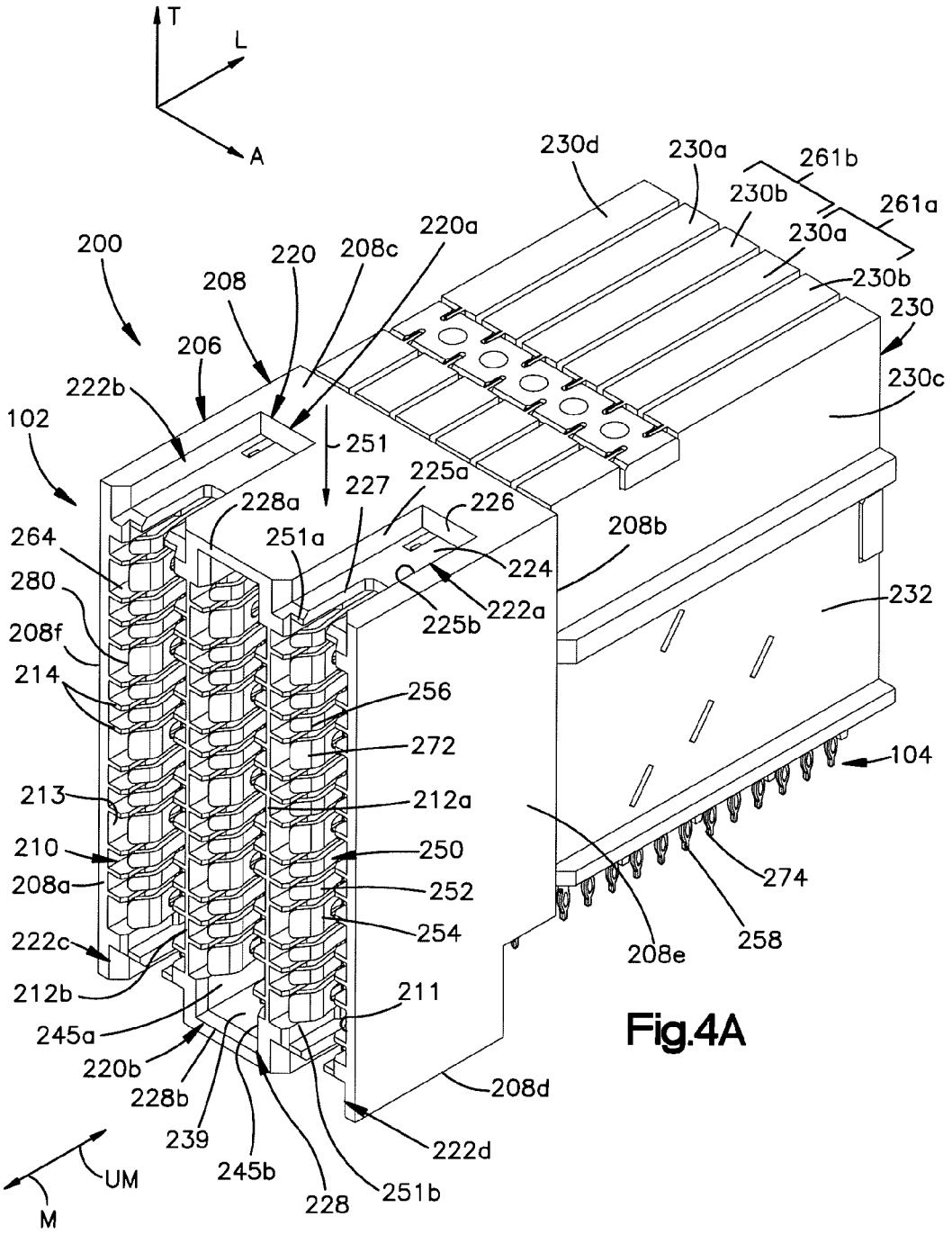
FIG. 4A is a perspective view of the second electrical connector illustrated in FIG. 1.
Figure 4B:
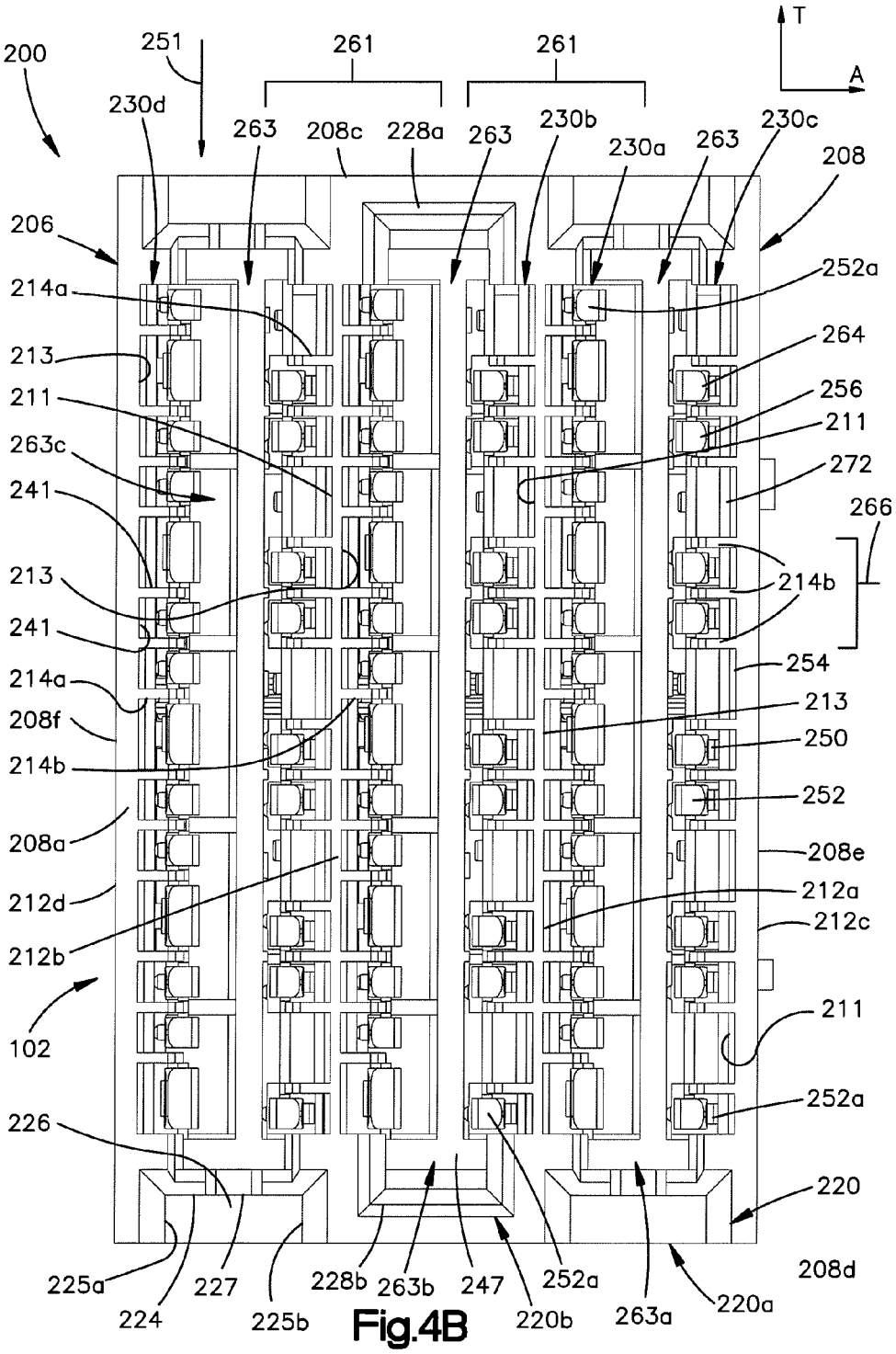
FIG. 4B is a front elevation view of the second electrical connector illustrated in FIG. 4A.

At the fifth time T5, after the fourth time T4, the first and second electrical connectors 100 and 200 are substantially fully mated relative to one another. In particular the outer surface 153*b* at the tip 164 contacts the outer surface 253*b* at the stem 287 so as to define the first contact location L1. Similarly, the outer surface 253*b* at the tip 264 contacts the outer surface 153*b* at the stem 187 so as to define the second contact location L1. The width along the lateral direction A of the gap G increases relative to the width of the gap G at time T4, but the width of the gap G remains narrower than both the first stub length SL1 and the second stub length SL2. Because the mating ends 156 and 256 contact each other at two contact locations, specifically contact locations L1 and L2, the first and second stub lengths SL1 and SL2 remain constant. Accordingly, it should be appreciated that the first and second stub lengths SL1 and SL2 remain substantially equal to the values exhibited at time T3. As described above, the normal forces that each of the mating ends 156 and 256 applies on the other of the mating ends 156 and 256 bias the respective mating ends 156 and 256 to move along the inner direction 198*a*, toward the respective bases 141 (FIGS. 2A-C) and 241 (FIGS. 4A-B).

Electrical simulation has demonstrated that the herein described embodiments of the first, second, and second electrical connectors 100, 200, and 400, respectively, can operate to transfer data, for example between the respective mating and mounting ends of each electrical contact, in the range between and including approximately eight gigabits per second (8 Gb/s) and approximately fifty gigabits per second (50 Gb/s) (including approximately twenty five gigabits per second (25 Gb/s), approximately thirty gigabits per second (30 Gb/s), and approximately forty gigabits per second (40 Gb/s)), such as at a minimum of approximately thirty gigabits per second (30 Gb/s), including any 0.25 gigabits per second (Gb/s) increments between approximately therebetween, with worst-case, multi-active crosstalk that does not exceed a range of about 0.1%-6%, including all sub ranges and all integers, for instance 1%-2%, 2%-3%, 3%-4%, 4%-5%, and 5%-6% including 1%, 2%, 3%, 4%, 5%, and 6% within acceptable crosstalk levels, such as below about six percent (6%), approximately. Furthermore, the herein described embodiments of the first, second, and second electrical connectors 100, 200, and 400, respectively can operate in the range between and including approximately 1 and 25 GHz, including any 0.25 GHz increments between 1 and 25 GHz, such as at approximately 15 GHz.

The electrical connectors as described herein can have edge-coupled differential signal pairs and can transfer data signals between the mating ends and the mounting ends of the electrical contacts 150 to at least approximately 28, 29, 30, 31, 32, 33, 34, 35, 36, 37, 38, 39 or 40 Gigabits per second (or any 0.1 Gigabits per second increment between) (at approximately 30 to 25 picosecond rise times) with asynchronous, multi-active, worst-case crosstalk on a victim pair of no more than six percent, while simultaneously maintaining differential impedance at plus or minus ten percent of a system impedance (typically 85 or 100 Ohms) and simultaneously keeping insertion loss within a range of at approximately zero to −1 dB through 20 GHz (simulated) through within a range of approximately 20 GHz zero to −2 dB through 30 GHz (simulated), and within a range of zero to −4 dB through 33 GHz, and within a range of approximately zero to −5 dB through 40 GHz. At a 10 Gbits/sec data transfer rate, simulation produces ICN (all NEXT) values that do not exceed 3.5 and ICN (all FEXT) values below 1.3. At a 20 Gbit/sec data transfer rate, simulation produces ICN (all NEXT) values below 5.0 and ICN (all FEXT) values below 2.5. At a 30 Gbit/sec data transfer rate, simulation produces ICN (all NEXT) values below 5.3 and ICN (all FEXT) below 4.1. At a 40 Gbit/sec data transfer rate, simulation produces ICN (all NEXT) values below 8.0 and ICN (all FEXT) below 6.1.

It should be appreciated that the first, second, and second electrical connectors 100, 200, and 400 are not limited to the number and configuration of leadframe assemblies 130, 230, and 430, respectively, and that the first, second, and second electrical connectors 100, 200, and 400 can be alternatively configured as desired. For example, in accordance with the embodiments described and illustrated herein, the electrical connectors are configured as six-column, four-pair electrical connectors. However the first, second, and second electrical connectors 100, 200, and 400 can be configured having two pairs, four pairs, six pairs, six columns, eight columns, ten columns, or the like in any combination as desired. Additionally, the connector housings 106, 206, and 406 can be constructed with or without one or both of alignment members or retention members.

It should be appreciated that the second connectors 200 and 400 can be constructed as described above with respect to the first electrical connector 100 in accordance with any of the embodiments described herein, unless otherwise indicated, and the first electrical connector 100 can be constructed as described above with respect to the second electrical connectors 200 and 400 in accordance with any of the embodiments described herein, unless otherwise indicated. For example, either or both of the first and second electrical connectors 100, 200, and 400 can be configured as a vertical connector, right angle connector, or orthogonal connector as desired. Alternatively or additionally, either or both of the first and second electrical connectors 100, and 200 and 400 can be configured as a cable connector. Further, the gross alignment members 220*a* and/or the fine alignment members 220*b* of the second electrical connectors 200 and 400 can be disposed on opposed sides of gaps 263 that separate adjacent leadframe assemblies 230, or on opposed sides of the leadframe assemblies 230 themselves, in the manner described above. Furthermore, the gross alignment members 120*a* and/or the fine alignment members 120*b* of the first electrical connector 100 can be disposed on opposed sides of gaps that separate adjacent leadframe assemblies 130, such as pairs 161, or on opposite sides of the leadframe assemblies 130 themselves, such as the pairs 161, along the transverse direction T. The fine alignment members 220*b* can thus be aligned with respective ones of the divider walls 212 that divide first and second leadframe assemblies 230*a-b* of a given one of the pairs 261, and disposed on opposed sides of the respective ones of the divider walls 212 along the transverse direction T.

The fine alignment members 120*b* of the first electrical connector 100 can be configured as alignment beams as described herein, alignment recesses as described herein, flexible arms as described herein, or any suitable alternative alignment structure as described herein. Similarly, the fine alignment members of the second electrical connector 200 and 400 can be configured as alignment beams as described herein, alignment recesses as described herein, flexible arms as described herein, or any alternative alignment structure as described herein.

Furthermore, it should be appreciated that the gross alignment members of the second electrical connectors 200 and 400 can be disposed on opposed sides of gaps that separate adjacent leadframe assemblies or pairs of leadframe assemblies, and aligned with the gaps along the transverse direction T, in the manner described above. Alternatively, the gross alignment members of the first electrical connector can be disposed on opposed sides of gaps that separate adjacent leadframe assemblies or pairs of leadframe assemblies, and aligned with the gaps along the longitudinal direction L, and the alignment receptacles of the second electrical connector can be aligned with respective ones of the divider walls that divide first and second leadframe assemblies of a given one of the pairs of leadframe assemblies, and disposed on opposed sides of the respective ones of the divider walls along the longitudinal direction L. The gross alignment members of the first electrical connector 100 can be configured as alignment beams as described herein, alignment recesses as described herein, flexible arms as described herein, or any suitable alternative alignment structure as described herein. Similarly, the gross alignment members of the second electrical connectors 200 and 400 can be configured as alignment beams as described herein, alignment recesses as described herein, flexible arms as described herein, or any alternative alignment structure as described herein.

Furthermore, one or more up to all pairs of the fine alignment members 120*b* of the first electrical connector 100 can define inner alignment members disposed between respective pairs of the gross alignment members 120*a*, which can define outer alignment members, along the lateral direction A. Alternatively or additionally, one or more up to all pairs of the gross alignment members 120*a* of the first electrical connector 100 can define inner alignment members disposed between respective pairs of the fine alignment members 120*b*, which can define outer alignment members, along the lateral direction A. It should be appreciated that at least one of the pairs of gross alignment members 120*a* can be disposed adjacent at least one of the pairs of fine alignment members 120*b*. Alternatively still, the first electrical connector 100 can include one pair of gross alignment members 120*a* and one pair of fine alignment members 120*b* disposed adjacent the one pair of gross alignment members 120*a* along the lateral direction A. Thus, it can be said that the first electrical connector 100 can include at least one pair of gross alignment members 120*a* and at least one pair of fine alignment members 120*b* disposed adjacent the pair of gross alignment members 120*a*. Further still, the first electrical connector 100 can be constructed with only one set of alignment members 120, or devoid of alignment members altogether.

Similarly, one or more up to all pairs of the fine alignment members 220*b* of the second electrical connectors 200 and 400 can define inner alignment members disposed between respective pairs of the gross alignment members, which can define outer alignment members, along the lateral direction A. Alternatively or additionally, one or more up to all pairs of the gross alignment members of the second electrical connectors 200 and 400 can define inner alignment members disposed between respective pairs of the fine alignment members, which can define outer alignment members, along the lateral direction A. It should be appreciated that at least one of the pairs of gross alignment members of the second electrical connector 200 and 400 can be disposed adjacent at least one of the pairs of fine alignment members. Alternatively still, the second electrical connector 200 and 400 can include one pair of gross alignment members and one pair of fine alignment members disposed adjacent the one pair of gross alignment members along the lateral direction A. Thus, it can be said that the second electrical connector 200 and 400 can include at least one pair of gross alignment members and at least one pair of fine alignment members disposed adjacent the pair of gross alignment members. Further still, the second electrical connector 200 and 400 can be constructed with only one set of alignment members, or devoid of alignment members altogether.

Additionally, while the first electrical connector 100 can define an abutment surface between the rear end of the connector housing and the front end of the connector housing, the second electrical connector can alternatively or additionally include an abutment surface between the respective rear end of the connector housing and the front end of the connector housing. Alternatively, the front end of the connector housing of the first electrical connector can define an abutment surface. Furthermore, either or both of the first and second electrical connectors can include respective cover walls 116 and 216, or can be devoid of the first and second cover walls 116 and 216, respectively. Furthermore, either or both of the first and second electrical connectors can include respective contact projections, or can be devoid of the contact projections. Further still, either or both of the first and second electrical connectors can include the leadframe apertures, or can be devoid of the leadframe apertures. Further still, the mounting ends of the electrical contacts of either or both of the first and second electrical connectors can define the leads as described with respect to 271. Further still, the mating ends of the electrical contacts of either or both of the first and second electrical connectors can be substantially "S-shaped" as described with respect to FIGS. 32A-32F.

A method can be provided for controlling insertion loss in an electrical connector. The method can include the step of accessing a plurality of signal contacts each defining a mounting end and a receptacle mating end, each receptacle mating end defining a tip that defines a concave surface and a convex surface opposite the concave surface. The method can further include the step of positioning the signal contacts in an electrically insulative connector housing, such that the signal contacts are arranged in at least first and second immediately adjacent linear arrays, and the concave surfaces of the signal contacts of the first linear array face the concave surfaces of the signal contacts of the second linear array. The method can further include the step of defining differential signal pairs along each of the first and second linear arrays. The method can further include the step of mating each of the mating ends with a complementary mating end that is a mirror image of itself at first and second contact locations. Each receptacle mating end is elongate along a central axis and defines a stub length measured from the first contact location to a terminating edge of the tip along the central axis, and the stub length is in a range having a lower end of approximately 1.0 mm and an upper end of approximately 3.0 mm.

The method can further include the step of abutting and riding one of the contact locations along the complementary mating end a wipe distance until the first contact locations of each of the receptacle mating end and the complementary mating end abuts the second contact location of the other of the receptacle mating end and the complementary mating end, and the wipe distance is in a range having a lower end of approximately 2.0 mm and an upper end of approximately 5.0 mm. The method can further include the step of positioning each of the first and second linear arrays adjacent opposed first and second surfaces of a divider wall, such that the concave surfaces of the signal contacts of the first linear array face the first surface of the divider wall, and the concave surfaces of the signal contacts of the second linear array face the second surface of the divider wall that is opposite the first surface. The method can further include the step of covering at least a portion of the tips of the first and second linear arrays along the first direction with a cover wall. The method can further include the step of defining a pocket that receives a select one of the signal contacts of one of the differential signal pairs, the pocket being defined by a pair of ribs that extend out from the divider wall. The method can further include the step of orienting the signal contacts such that its edges face the ribs.

The method can further include the step of defining a single electrical widow contact at a first end of the first linear array, and defining a single widow contact disposed at a second end of the second linear array, the second end opposite the first end, and each of the widow contacts having a respective mating end and a respective mounting end. The method can further include the step of disposing a respective ground mating end disposed between the mating ends of each of the widow contacts and a differential signal pair of the respective first and second linear arrays, such that the single widow contacts are not disposed adjacent any other electrical contacts along the respective linear array, except for the respective ground mating end. The method can further include the step of disposing a ground mating end disposed between first and second differential signal pairs along at least one of the linear arrays, wherein an aperture extends through the ground mating end along the second direction.

The method can further include the step of fabricating a leadframe assembly that includes an electrically insulative leadframe housing, supporting the signal contacts of the first linear array by the leadframe housing, attaching a ground plate to the leadframe housing, wherein the ground plate includes a ground plate body and a plurality of ribs that are carried by the ground plate body, each of the ribs extending to a location between adjacent differential signal pairs of the first linear array, and each of the ribs aligned with respective ground mating ends and ground mounting ends. The mounting ends can define leads having a stem that extends out from the leadframe housing to a distal end, and a hook that extends from the distal end of the stem along a direction that is angularly offset from both the stem and a third direction that is perpendicular to the first and second directions. The method can further include the step of contacting the signal contacts with a projection that extends beyond channels in the leadframe housing in which the signal contacts of the first linear array reside, so as to resist flexing of the signal contacts as they mate with complementary signal contacts. The leadframe assembly can further define leadframe apertures that extend through the leadframe housing at locations aligned with respective ones of the ribs, wherein the leadframe apertures define a length between the ground mating ends and the ground mounting ends that are aligned with the one of the ribs, and the length is at least half a length of the one of the ribs between the aligned ground mating end and the ground mounting end. The method can further include the step of embossing the ribs into the ground plate body.

The method can further include the step of mounting the mounting ends to a first substrate oriented along a first plane defined by the first and second direction and the second direction, inserting a leading end of a second substrate in a gap at the mating ends defined between the first linear array and the second linear array while the second substrate is oriented along a second plane that is defined by the first direction and a third direction that is perpendicular to both the first direction and the second direction. The method can further include the step of disposing the ground mating ends are disposed between respective ones of the differential signal pairs, such that the ground mating ends define a distance along the respective linear array from edge to edge that is greater than a distance defined by each of the mating ends of the signal contacts along the respective linear array from edge to edge. The method can further include the step of oriented substantially the mating ends perpendicular with respect to the mounting ends, and recessing the tip in the connector housing. The method can further include the step of flanking the mating ends of each differential signal pair along each of the first and second linear arrays with a respective immediately adjacent ground mating end on opposite sides of the differential signal pair along the linear array. The method can further include the step of transferring data signals along the differential signal pairs at data transfer rates up to 40 Gigabits per second with asynchronous, multi-active, worst-case crosstalk on a victim pair of no more than six percent, while simultaneously maintaining insertion loss within a range of at approximately zero to −2 dB through 30 GHz.

A method can also be provided for selling electrical connectors. The method may comprise the step of advertising to a third party, offering for sale to a third party, or selling to a third party, by audible words or a visual depiction fixed in a tangible medium of expression, the commercial availability of a first electrical connector constructed in accordance with any embodiment herein, including a first electrical connector having differential signal pairs positioned edge-to-edge, a receptacle-type mating interface, and a data transfer rate that includes 40 Gbits/sec. Another step may include advertising to a third party, by audible words or a visual depiction fixed in a tangible medium of expression, the commercial availability of a second electrical connector constructed in accordance with any embodiment herein, having differential signal pairs positioned edge-to-edge, a receptacle-type mating interface, and a data transfer rate that includes 40 Gbits/sec, wherein the first electrical connector and the second electrical connector mate to one another.

The foregoing description is provided for the purpose of explanation and is not to be construed as limiting the electrical connector. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the electrical connector is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the electrical connector as described herein, and changes may be made without departing from the spirit and scope of the electrical connector, for instance as set forth by the appended claims.

What is claimed:

1. An electrical connector configured to be mated to a complementary electrical connector along a first direction, the electrical connector comprising:

an electrically insulative connector housing including a divider wall and a plurality of ribs that project out from the divider wall, such that adjacent ones of the ribs define a plurality of pockets;

a plurality of signal contacts supported by the connector housing, each of the plurality of signal contacts defining a mounting end and a receptacle mating end, each receptacle mating end defining a tip that defines a concave surface and a convex surface opposite the concave surface; and a plurality of ground contacts including a plurality of ground mounting ends and a plurality of ground mating ends;

wherein 1) the signal contacts are arranged in at least first and second linear arrays, the second linear array disposed immediately adjacent the first linear array along a second direction that is perpendicular to the first direction, such that the concave surfaces of the signal contacts of the first linear array face the concave surfaces of the signal contacts of the second linear array, 2) immediately adjacent signal contacts along each of the linear arrays defines respective differential signal pairs of adjacent ones of the signal contacts, the signal contacts of each of the differential signal pairs having respective receptacle mating ends, and each linear array includes one of the ground mating ends disposed between immediately adjacent ones of the respective differential signal pairs, 3) the ground mating ends are taller than each of the respective receptacle mating ends of the respective differential signal pairs along a third direction that is perpendicular to each of the first and second directions, 4) each of the pockets is sized to receive only a single one of a group that includes the receptacle mating ends and the ground mating ends, and 5) ones of the ground mating ends of the first linear array are offset along the third direction with respect to all of the ground mating ends of the second linear array.

2. The electrical connector as recited in claim 1, wherein each receptacle mating end defines first and second contact locations and is configured to mate with a complementary mating end that is a mirror image of each receptacle mating end at the two contact locations.

3. The electrical connector as recited in claim 2, wherein each receptacle mating end is elongate along a central axis and defines a stub length measured from the first contact location to a terminating edge of the tip along the central axis, and the stub length is in a range having a lower end of approximately 1 mm and an upper end of approximately 3 mm.

4. The electrical connector as recited in claim 3, wherein the stub length is approximately 1 mm.

5. The electrical connector as recited in claim 3, wherein each of the first contact locations abuts and rides along the complementary mating end a wipe distance until the first contact locations of each of the receptacle mating end and the complementary mating end abuts the second contact location of the other of the receptacle mating end and the complementary mating end, and the wipe distance is in a range having a lower end of approximately 2 mm and an upper end of approximately 5 mm.

6. The electrical connector as recited in claim 1, wherein the concave surfaces of the signal contacts of the first linear array face a first surface of the divider wall, and the concave surfaces of the signal contacts of the second linear array face a second surface of the divider wall that is opposite the first surface along the second direction.

7. The electrical connector as recited in claim 6, wherein the connector housing further defines at least one cover wall that extends from the divider wall along the second direction so as to overlap at least a portion of the tips of the first and second linear arrays along the first direction.

8. The electrical connector as recited in claim 1, wherein each of the signal contacts and the ground mating ends defines respective opposed broadsides and opposed edges connected between the broadsides, and each of the signal contacts and the ground mating ends is oriented such that the respective edges of the ground mating ends and the signal contacts face respective ones of the adjacent ribs that define the respective pocket.

9. The electrical connector as recited in claim 8, wherein the receptacle mating ends and the ground mating ends each extend continuously from one of the respective edges to the other of the respective edges along each of the respective broadsides.

10. The electrical connector as recited in claim 1, wherein the first linear array defines a single electrical widow contact disposed at a first end of the linear array, and the second linear array defines a single widow contact disposed at a second end of the second linear array, the second end opposite the first end, and each of the widow contacts having a respective mating end and a respective mounting end.

11. The electrical connector as recited in claim 10, wherein the ground mating ends includes a ground mating end disposed between the mating ends of each of the widow contacts and one of the differential signal pairs of the respective first and second linear arrays.

12. The electrical connector as recited in claim 11, wherein the single widow contacts are not disposed adjacent any other electrical contacts along the respective linear array, except for the respective ground mating end.

13. The electrical connector as recited in claim 10, wherein the ground mating ends include a ground mating end disposed between first and second ones of the differential signal pairs along at least one of the linear arrays, and an aperture extends through the ground mating end along the second direction.

14. The electrical connector as recited in claim 1, wherein each of the plurality of ground contacts comprises an electrically conductive ground plate, and the electrical connector further comprises a leadframe assembly that includes an electrically insulative leadframe housing, the signal contacts of the first linear array supported by the leadframe housing, and one of the ground plates attached to the leadframe housing, wherein each of the ground plates includes a ground plate body and a plurality of ribs that are carried by the ground plate body, each of the ribs extending to a location between and inline with adjacent differential signal pairs of the first linear array, and each of the ribs aligned with respective ground mating ends and ground mounting ends.

15. The electrical connector as recited in claim 14, wherein a plurality of the mounting ends of the signal contacts and the ground mounting ends define leads having a stem that extends out from the leadframe housing to a distal end, and a hook that extends from the distal end of the stem along a direction that is angularly offset from both the stem and a third direction that is perpendicular to the first and second directions.

16. The electrical connector as recited in claim 14, wherein the signal contacts of the first linear array reside in channels that extend through the leadframe housing, and the leadframe housing defines a plurality of projections that extend beyond the channels and contact the signal contacts so as to resist flexing of the signal contacts as they mate with complementary signal contacts.

17. The electrical connector as recited in claim 14, wherein the leadframe assembly defines leadframe apertures that extend through the leadframe housing at locations aligned with respective ones of the ribs, wherein the leadframe apertures define a length between the ground mating ends and the ground mounting ends that are aligned with the one of the ribs, and the length is at least half a length of the one of the ribs between the aligned ground mating end and the ground mounting end.

18. The electrical connector as recited in claim 14, wherein the ribs are embossed into the ground plate body.

19. The electrical connector as recited in claim 1, wherein the mounting ends are configured to be mounted to a first substrate oriented along a first plane defined by the first and second directions, and the mating ends define a gap between the first linear array and the second linear array, the gap sized to receive a leading end of a second substrate oriented along a second plane that is defined by the first direction and third direction.

20. The electrical connector as recited in claim 1, wherein the ground mating ends of each of the linear arrays are disposed between adjacent ones of the mating ends of the respective differential signal pairs at a mating interface, and the ground mating ends of each of the linear arrays is between adjacent ones of the mounting ends of the respective differential signal pairs at a mounting interface, and the electrical connector defines a constant contact pitch at the mounting interface and a variable contact pitch at the mating interface.

21. The electrical connector as recited in claim 1, wherein the mating ends are oriented substantially perpendicular with respect to the mounting ends.

22. The electrical connector as recited in claim 21, wherein the tip is recessed in the connector housing in a direction opposite the first direction.

23. The electrical connector as recited in claim 1, wherein the mating ends of each differential signal pair along each of the first and second linear arrays are flanked by a respective immediately adjacent ground mating end on opposite sides of the differential signal pair along the linear array.

24. The electrical connector as recited in claim 1, wherein the differential signal pairs are configured to transfer data signals up to 40 Gigabits per second with asynchronous, multi-active, worst-case crosstalk on a victim pair of no more than six percent, while simultaneously maintaining insertion loss within a range of at approximately zero to −2 dB through 30 GHz.

25. The electrical connector as recited in claim 24, wherein the plurality of ground contacts comprises a respective plurality of electrically conductive ground plates each including a ground plate body, respective ones of the plurality of ground mounting ends that extend from the ground plate body, and respective ones of the plurality of ground mating ends that extend from the ground plate body.

26. The electrical connector as recited in claim 25, wherein each of the ground plates includes a plurality of embossments that are carried by the ground plate body and project out from the ground plate body along the second direction.

27. The electrical connector as recited in claim 1, wherein the plurality of ground contacts comprises individual discrete ground contacts, each including a respective one of the ground mating ends and a respective one of the ground mounting ends.

28. The electrical connector as recited in claim 27, wherein each of the linear arrays includes a plurality of the individual discrete ground contacts.

29. The electrical connector as recited in claim 1, wherein the plurality of ground contacts comprises a respective plurality of electrically conductive ground plates each including a ground plate body, respective ones of the plurality of ground mounting ends that extend from the ground plate body, and respective ones of the plurality of ground mating ends that extend from the ground plate body.

30. The electrical connector as recited in claim 29, wherein a first one of the ground plates is disposed adjacent the signal contacts of the first linear array, and a second one of the ground plates is disposed adjacent the signal contacts of the second linear array.

31. The electrical connector as recited in claim 30, wherein the ground mating ends of the first one of the ground plates are inline with the receptacle mating ends of the first linear array along the third direction, and the ground mating ends of the second one of the ground plates are inline with the receptacle mating ends of the second linear array along the third direction.

32. The electrical connector as recited in claim 31, wherein the ground mounting ends of the first one of the ground plates are inline with the mounting ends of the signal contacts of the first linear array along the first direction, and the ground mounting ends of the second one of the ground plates are inline with the mounting ends of the signal contacts of the second linear array along the first direction.

33. The electrical connector as recited in claim 30, wherein the first one of the ground plates includes a plurality of embossments that are carried by the ground plate body, each of the embossments extending to a location between adjacent differential signal pairs of the first linear array.

34. The electrical connector as recited in claim 30, wherein the ground mating ends are oriented substantially perpendicular with respect to the ground mounting ends, and the receptacle mating ends are oriented substantially perpendicular with respect to the mounting ends of the signal contacts.

35. The electrical connector as recited in claim 34, wherein the differential signal pairs are configured to transfer differential signals between their mating and mounting ends at data transfer rates of 25 Gigabits/sec while producing produce no more than six percent worst-case, multi-active cross talk on a victim differential signal pair.

36. The electrical connector as recited in claim 29, further comprising a plurality of leadframe assemblies that each includes an electrically insulative leadframe housing, ones of the plurality of signal contacts, and one of the ground plates attached to the leadframe housing, wherein the leadframe housing is configured to be supported by the connector housing.

37. The electrical connector as recited in claim 1, wherein some of the ribs that project from the divider wall to define pockets that receive the receptacle mating ends and the ground mating ends of the first linear array are offset along the third direction with respect to all of the ribs that project from the divider wall to define pockets that receive the receptacle mating ends and the ground mating ends of the second linear array.

38. The electrical connector as recited in claim 1, wherein adjacent ones of the ribs that project from the divider wall to define pockets that receive the ground mating ends are spaced a apart from each other a greater distance along the third direction than adjacent ones of the ribs that project from the divider wall to define pockets that receive the receptacle mating ends.

39. An electrical connector configured to be mated to a complementary electrical connector along a first direction, the electrical connector comprising:

an electrically insulative connector housing; and first and second leadframe assemblies each including a leadframe housing, a plurality of signal contacts supported by the leadframe housing so as to define a plurality of mating ends along a mating interface, and an electrically conductive ground plate attached to the leadframe housing, the ground plate defining a plurality of ground mounting ends extending out from the connector housing substantially along a longitudinal direction, respective ones of the ground mating ends disposed between and aligned with the mating ends of the signal contacts along a transverse direction that is substantially perpendicular to the longitudinal direction, wherein 1) the first leadframe assembly defines a first linear array of mating ends, and the second leadframe assembly defines a second linear array of mating ends, 2) the first leadframe assembly defines a single electrical widow contact disposed at a first end of the first linear array, 3) the second leadframe assembly defines a single widow contact disposed at a second end of the second linear array, the second end opposite the first end, and 4) each of the single widow contacts is not disposed adjacent any other electrical contacts, except a single ground mating end along the respective first and second linear arrays.

40. The electrical connector as recited in claim 39, wherein the ground mating ends define a distance along the transverse direction from edge to edge that is greater than a distance defined by each of the mating ends of the signal contacts along the transverse direction from edge to edge.

41. The electrical connector as recited in claim 39, wherein the mating ends of the electrical signal contacts and the ground mating ends are recessed in the connector housing in a second direction opposite the first direction.

42. The electrical connector as recited in claim 39, wherein the housing further comprises at least one divider wall disposed between the first and second leadframe assemblies, such that concave surfaces of the ground mating ends and the mating ends of the electrical signal contacts of the first leadframe assembly face a first surface of the divider wall, and concave surfaces of the ground mating ends and the mating ends of the electrical signal contacts of the second leadframe assembly face a second surface of the divider wall that is opposite the first surface.

43. The electrical connector as recited in claim 42, further comprising a plurality of ribs that project out from the divider wall, such that the divider wall and adjacent ones of the ribs define respective pockets that each receives only a single one of a group that includes the ground mating ends and the mating ends of the electrical signal contacts, wherein the ground mating ends are taller than the signal mating ends along the transverse direction.

44. The electrical connector as recited in claim 39, wherein the ground plate defines an enclosed aperture that extends through each of the ground mating ends along the lateral direction.

45. The electrical connector as recited in claim 39, wherein immediately adjacent signal contacts of each of the first and second leadframe assemblies define differential signal pairs, and the ground plate of each leadframe assembly includes a ground plate body and a plurality of ribs that project out from the ground plate body to a location between and aligned with immediately adjacent differential signal pairs of the respective leadframe assembly.

46. The electrical connector as recited in claim 45, wherein the ribs are embossed into the ground plate body, each of the ribs aligned with respective ones of ground mating ends and ground mounting ends.

47. The electrical connector as recited in claim 46, wherein the leadframe assembly defines leadframe apertures that extend through the leadframe housing at locations aligned with respective ones of the ribs, wherein the leadframe apertures define a length between the ground mating ends and the ground mounting ends that are aligned with the one of the ribs, and the length is at least half a length of the one of the ribs between the aligned ground mating end and the ground mounting end.

48. An electrical connector configured to be mated to a complementary electrical connector along a first direction, the right-angle electrical connector comprising:

an electrically insulative connector housing;

a plurality of signal contacts, each of the plurality of signal contacts defining a mounting end and a mating end, immediately adjacent signal contacts defining respective differential pairs; and a plurality of ground mating ends aligned with the signal contacts along first and second adjacent linear arrays, such that each differential signal pair along the first linear array is flanked by a respective immediately adjacent one of the ground mating ends on opposite sides of the differential signal pair along the first linear array, and each differential signal pair along the second linear array is flanked by a respective immediately adjacent one of the ground mating ends on opposite sides of the differential signal pair along the second linear array, wherein the first linear array defines a single electrical widow contact disposed at a first end of the first linear array, and the second linear array defines a single widow contact disposed at a second end of the second linear array, the second end opposite the first end, and each of the widow contacts are single-ended signal contacts having a respective mating end aligned with the ground mating ends of the respective linear array, and a respective mounting end aligned with the ground mounting ends of the respective linear array.

49. The electrical connector as recited in claim 48, wherein the single widow contacts are not disposed adjacent any other electrical contacts along the respective linear array, except for one of the ground mating ends and aligned mounting end.

50. The electrical connector as recited in claim 48, wherein mating ends of the signal contacts and the ground mating ends each define receptacle mating ends having a concave surface and a convex surface opposite the concave surface, and each of the receptacle mating ends are configured to mate with complementary receptacle mating ends of a second electrical connector.

51. The electrical connector as recited in claim 50, further comprising first and second electrically conductive ground plates that each includes a ground plate body, respective ones of the plurality of ground mounting ends that extend from the ground plate body, respective ones of the plurality of ground mating ends that extend from the ground plate body, and a respective plurality of ribs that project from the ground plate body.

52. The electrical connector as recited in claim 51, wherein the ground plate body of the first electrically conductive ground plate is disposed adjacent and spaced from the signal contacts of the first linear array, the ribs of the first electrically conductive ground plate extend between and aligned with adjacent differential signal pairs of the first linear array, the ground plate body of the second electrically conductive ground plate is disposed adjacent and spaced from the signal contacts of the second linear array, and the ribs of the second electrically conductive ground plate extend between and aligned with adjacent differential signal pairs of the second linear array.

53. The electrical connector as recited in claim 52, wherein the differential signal pairs are configured to transfer differential signals between their mating and mounting ends at data transfer rates of 30 Gigabits/sec while producing produce no more than six percent worst-case, multi-active cross talk on a victim differential signal pair.

54. An electrical connector assembly comprising:

a first electrical connector configured to be mounted to a first electrical component, the first electrical connector including:

a first plurality of signal contacts, each of the first plurality of signal contacts defining a mounting end and a receptacle mating end, each receptacle mating end defining a tip that defines a first concave surface and a second convex surface opposite the first concave surface, an electrically insulative first connector housing supporting the first plurality of signal contacts, such that the first connector housing extends forward from the tips, the first connector housing defining at least one gross alignment member and at least one fine alignment member;

wherein the first plurality of signal contacts is arranged in at least first and second linear arrays of signal contacts, such that the first concave surfaces of the signal contacts of the first linear array faces a direction opposite a direction that the first concave surfaces of the signal contacts of the second linear array face; and a second electrical connector configured to mate with the first electrical connector and further configured to be mounted to a second electrical component, the second electrical connector including:

a second plurality of signal contacts, each of the second plurality of signal contacts defining a mounting end and a receptacle mating end, each receptacle mating end defining a tip that defines a first concave surface and a second convex surface opposite the first concave surface, an electrically insulative second connector housing supporting the second plurality of signal contacts, such that the first connector housing extends forward from the tips, the second connector housing defining at least one gross alignment member and at least one fine alignment member;

wherein the second plurality of signal contacts is arranged in at least first and second linear arrays of signal contacts, such that the first concave surfaces of the signal contacts of the first linear array of the second plurality of signal contacts faces the first concave surfaces of the signal contacts of the second linear array of the second plurality of signal contacts, wherein the gross alignment members of the first and second connector housings are configured to engage each other to place the signal contacts of the first electrical connector in a first stage of alignment with the signal contacts of the second electrical, and the fine alignment members of the first and second connector housings are configured to engage each only other after the gross alignment members have engaged each other to place the signal contacts of the first electrical connector in a second stage of alignment with the signal contacts of the second electrical, the second stage of alignment more precise than the first stage of alignment.

55. The electrical connector assembly of claim 54, wherein the gross alignment members of the first electrical connector comprise beams, and the gross alignment members of the second electrical connector comprises recesses configured to receive the beams so as to engage the gross alignment members of the first electrical connector with the gross alignment members of the second electrical connector.

56. The electrical connector assembly of claim 55, wherein the fine alignment members of the first electrical connector comprise beams, and the fine alignment members of the second electrical connector comprises recesses configured to receive the beams so as to engage the fine alignment members of the first electrical connector with the fine alignment members of the second electrical connector.

57. The electrical connector assembly of claim 55, wherein the fine alignment members of the first electrical connector comprise fine alignment beams, and the second fine alignment members of the second electrical connector comprise arms that are flexible along a third direction that is perpendicular to both the first and the second directions, wherein the arms are configured to ride along the fine alignment beams so as to engage the fine alignment members of the first electrical connector with the fine alignment members of the second electrical connector.

* * * * *

UNITED STATES PATENT AND TRADEMARK OFFICE

CERTIFICATE OF CORRECTION

PATENT NO. : 9,257,778 B2
APPLICATION NO. : 13/836610
DATED : February 9, 2016
INVENTOR(S) : Buck et al.

It is certified that error appears in the above-identified patent and that said Letters Patent is hereby corrected as shown below:

In the Claims

COL. 93 (Claim 38), line 4, delete the first occurrence of the word "a" (occurring before the word "apart").

Signed and Sealed this
Third Day of May, 2016

Michelle K. Lee

Michelle K. Lee
*Director of the United States Patent and Trademark Office*